US010925312B2

(12) United States Patent
Bavar et al.

(10) Patent No.: US 10,925,312 B2
(45) Date of Patent: Feb. 23, 2021

(54) SYSTEMS, METHODS, AND DEVICES FOR HEAT MANAGEMENT OF HEATING IMPLEMENTS FOR WATER PIPES

(71) Applicant: Kaloud, Inc., Los Angeles, CA (US)

(72) Inventors: Reza Bavar, Los Angeles, CA (US); Skyler Olsen, Denver, CO (US)

(73) Assignee: Kaloud, Inc., Los Angeles, CA (US)

( * ) Notice: Subject to any disclaimer, the term of this patent is extended or adjusted under 35 U.S.C. 154(b) by 8 days.

(21) Appl. No.: 16/289,029

(22) Filed: Feb. 28, 2019

(65) Prior Publication Data

US 2019/0261680 A1 Aug. 29, 2019

Related U.S. Application Data

(63) Continuation-in-part of application No. 15/974,286, filed on May 8, 2018, which is a continuation-in-part of application No. 15/476,296, filed on Mar. 31, 2017, now Pat. No. 10,092,034, which is a continuation of application No. 15/422,433, filed on Feb. 1, 2017, now Pat. No. 10,034,491.

(51) Int. Cl.

| | |
|---|---|
| ***A24F 1/30*** | (2006.01) |
| ***A24F 1/24*** | (2006.01) |
| ***A24F 47/00*** | (2020.01) |
| ***A24F 1/32*** | (2006.01) |

(52) U.S. Cl.

CPC ..... *A24F 1/30* (2013.01); *A24F 1/24* (2013.01); *A24F 1/32* (2013.01); *A24F 47/00* (2013.01)

(58) Field of Classification Search

None

See application file for complete search history.

(56) References Cited

U.S. PATENT DOCUMENTS

| | | | | |
|---|---|---|---|---|
| 4,036,240 | A * | 7/1977 | Murray, Jr. | A24F 1/30 131/173 |
| 4,638,815 | A * | 1/1987 | Yoshioka | A24F 1/30 131/173 |
| 2010/0101590 | A1 | 4/2010 | Pflaum | |
| 2010/0212679 | A1 | 8/2010 | Bishara | |
| 2013/0330680 | A1 | 12/2013 | Bavar | |
| 2016/0143352 | A1 | 5/2016 | Bavar | |
| 2017/0265520 | A1 | 9/2017 | Do | |

FOREIGN PATENT DOCUMENTS

RU 2017 108 910 A 9/2018

OTHER PUBLICATIONS

International Search Report and Written Opinion issued by the International Searching Authority for corresponding International Patent Application No. PCT/US2019/026050, dated Oct. 17, 2019.
International Search Report issue for corresponding International Patent Application No. PCT/US2017/016102 dated Aug. 3, 2017.
Non-Final Office Action issued for corresponding U.S. Appl. No. 15/974,286 electronically delivered on Oct. 29, 2018.

* cited by examiner

*Primary Examiner* — Michael H. Wilson
*Assistant Examiner* — Katherine A Will
(74) *Attorney, Agent, or Firm* — Myers Wolin, LLC

(57) ABSTRACT

Systems, methods, and devices for heat management of heating implements for a water pipe.

17 Claims, 184 Drawing Sheets

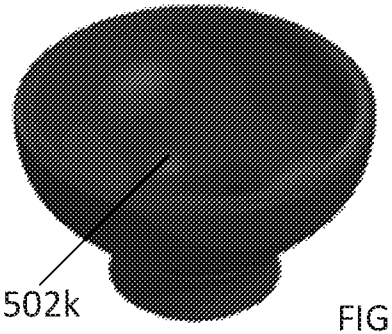
FIG. 18Q
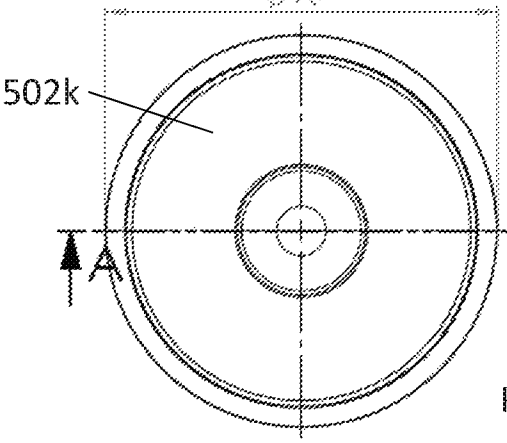
FIG. 18P
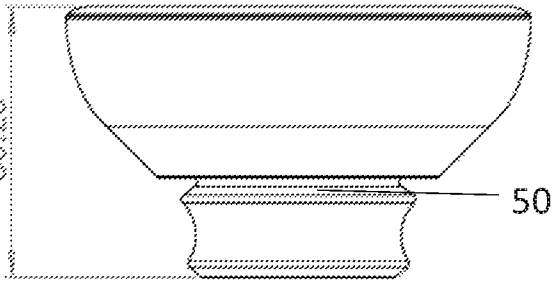
FIG. 18N
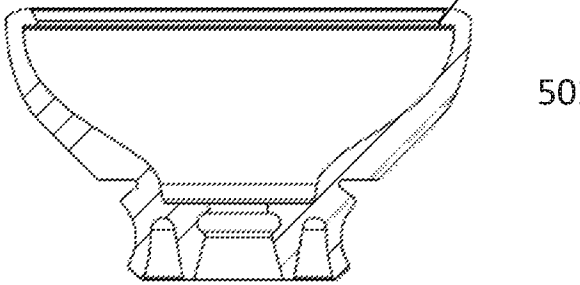
FIG. 18O SECTION A-A
SCALE 2 : 3

SECTION A-A
SCALE 1:1

SECTION A-A
SCALE 2:1

SECTION A-A

DETAIL B

SCALE 1 : 1

730k
733
732
90°
42
R7
4
731
734
DETAIL B
SCALE 2 : 3

730i
731
165

730j
731

732
SECTION A-A

SECTION A-A

SCALE 1 : 3

DETAIL B
SCALE 2 : 1

900f
906
912
914
902
916
910
918

900e
902

900c 906
910
908
902
Ø 273
900d 902
908
89

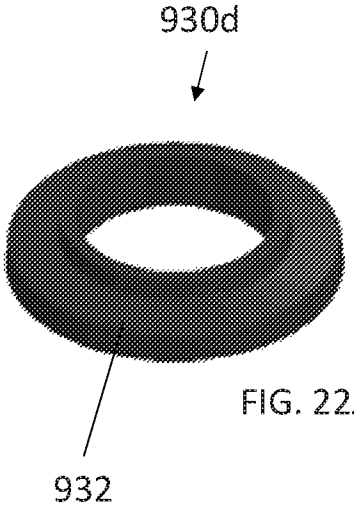
FIG. 22J
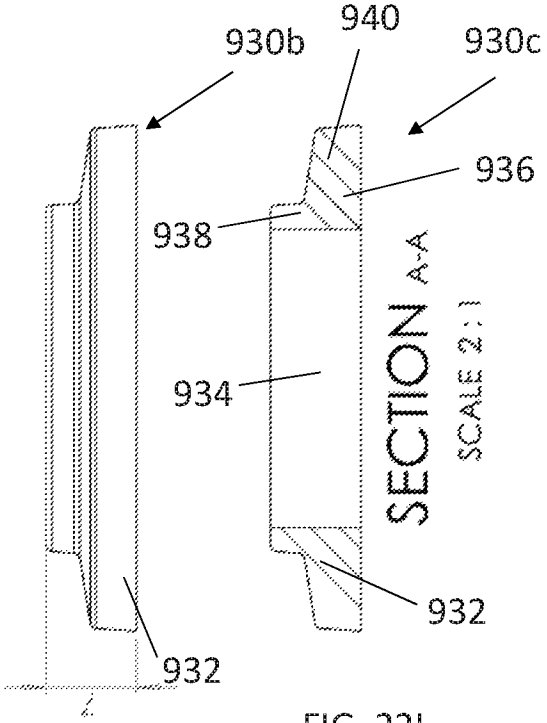
FIG. 22I
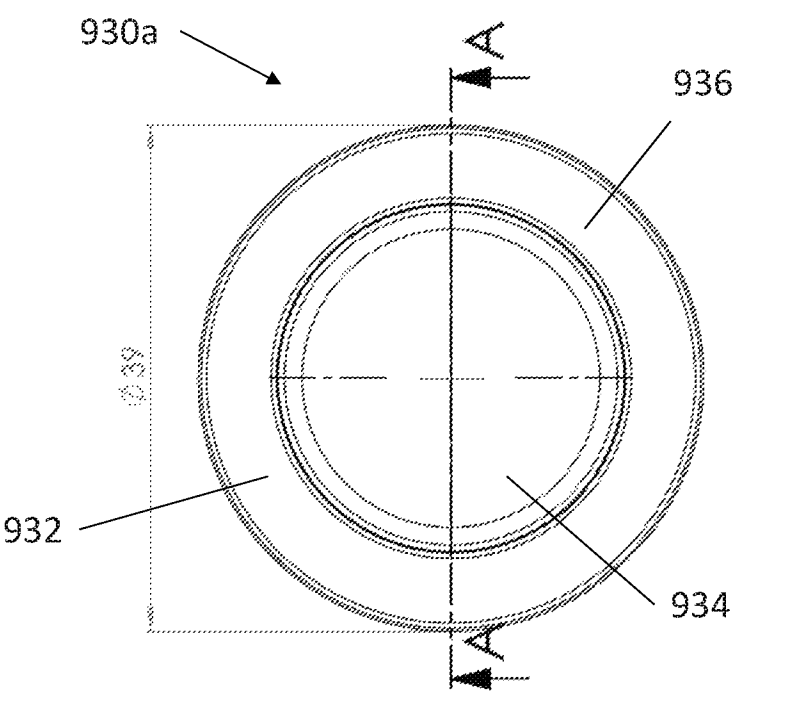
FIG. 22H
FIG. 22G 1000a
1000b
1000c
1000d
1002
1002
1002
1002

1000g
Ø42
Ø22
1010

1000h
3.18mm
(1/8 inch)
1010

1000i
1010

1100s
1140

1:1
1100q
[0.709]
Ø18
[0.565]
14.3
1140
1142

1100r
1140
[0.591 max.]
Ø15 max.
[0.083]
[0.079]
Ø2.1
2.0

1100p
[0.098]
R0.2
[0.087]
[0.079]
2.2
2.0
1140
1142

SECTION A-A

SCALE 1 : 1

SECTION A-A
SCALE 2 : 3

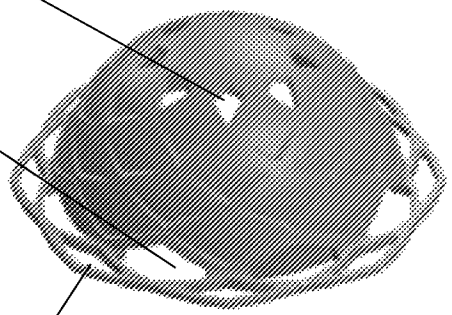
FIG. 28J
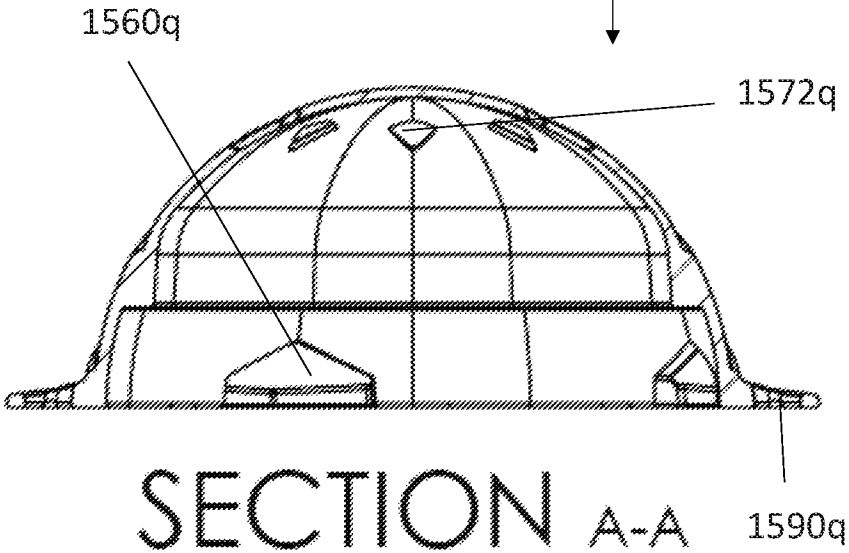
SECTION A-A
FIG. 29I SCALE 2 : 3

SECTION A-A

SCALE 2 : 3

DETAIL B
SCALE 2 : 1

1700g

1700h

SECTION A-A
SCALE 1 : 2

1700i 1708
1708
B

SECTION A-A
SCALE 1 : 2
10'6
1700o
1700p

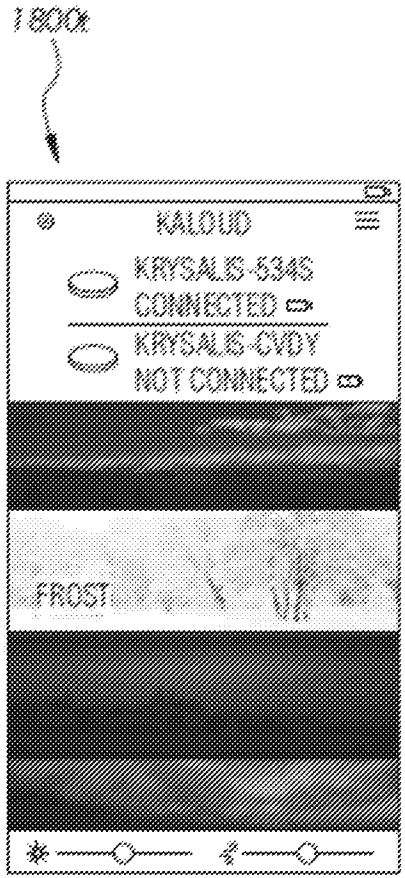
FIG. 32S
FIG. 32T
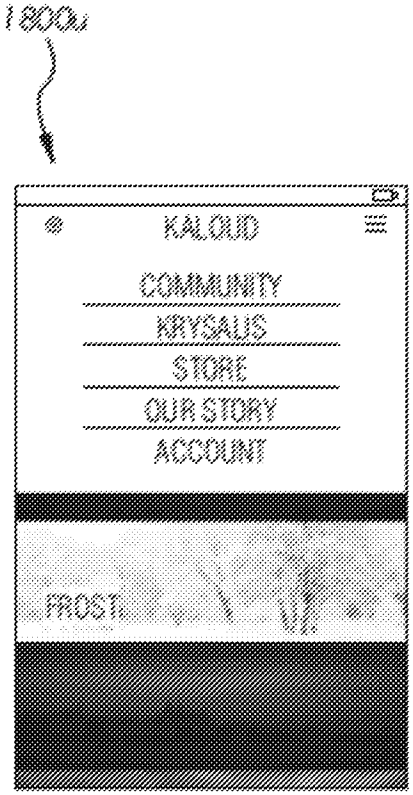
FIG. 32U

SECTION A-A

SCALE 3 : 4

6.1a 6.1a 6.1a 6.1a
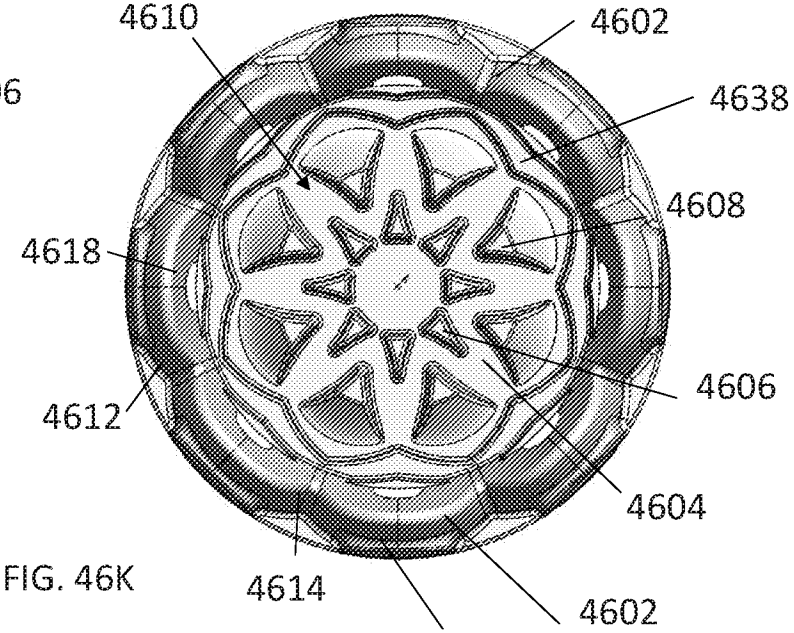
FIG. 46K
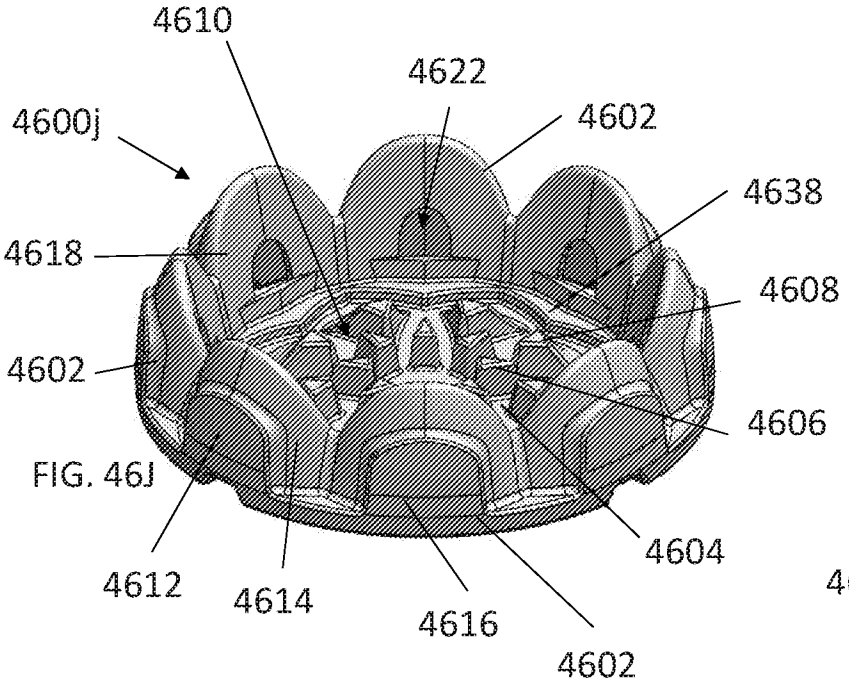
FIG. 46J
FIG. 46J 6.1c 6.1e 6.1g 6.1g 7.0p1

6.1b 6.1d 6.1d

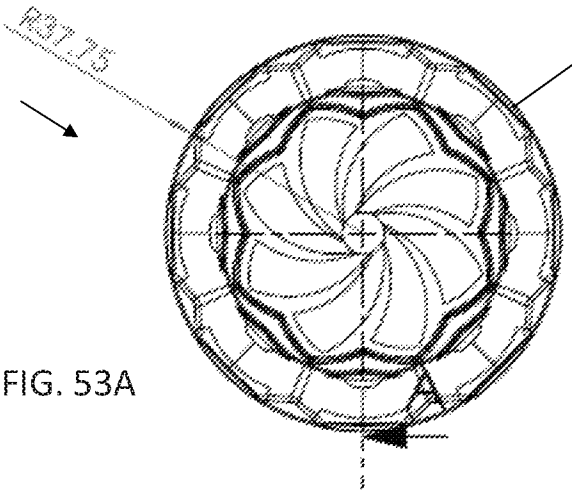
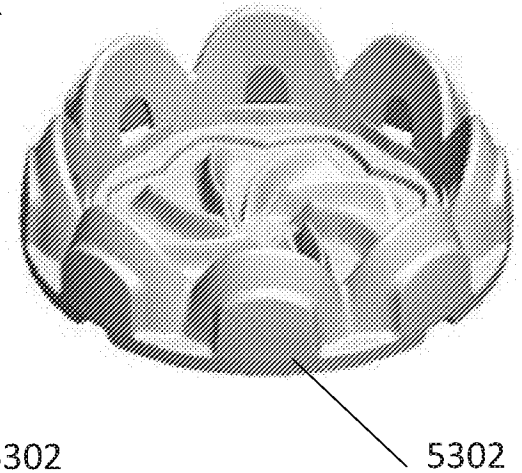
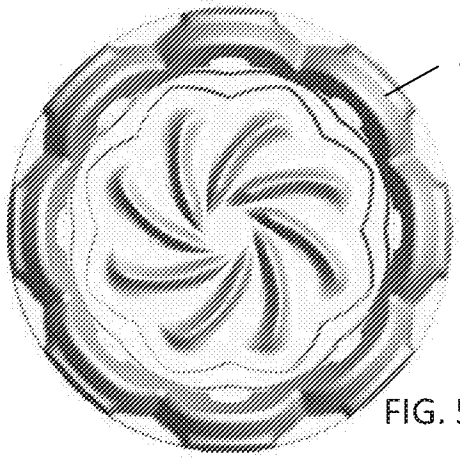
6.1f 6.1h

SYSTEMS, METHODS, AND DEVICES FOR HEAT MANAGEMENT OF HEATING IMPLEMENTS FOR WATER PIPES

CROSS-REFERENCE TO RELATED APPLICATIONS

This application claims priority to and is a continuation-in-part of U.S. patent application Ser. No. 15/974,286, filed May 8, 2018, which claims priority to and is a continuation-in-part of U.S. patent application Ser. No. 15/476,296, filed Mar. 31, 2017, which claims priority to and is a continuation of U.S. patent application Ser. No. 15/422,433, filed Feb. 1, 2017, each of which are hereby incorporated by reference in their entirety herein for all purposes.

This application is also related to U.S. Pat. No. 9,237,770; U.S. patent application Ser. No. 14/994,907; U.S. patent application Ser. No. 14/549,435; U.S. patent application Ser. No. 14/948,168; and U.S. patent application Ser. No. 14/948,186, each of which are hereby incorporated by reference in their entirety herein for all purposes.

BACKGROUND OF THE INVENTION

The subject matter described herein relates generally to a system, device, and method of preparing tobacco, or other organic material, for smoking using a water pipe. Existing and traditional water pipes generally include a plate for supporting charcoal, a head for containing tobacco, a body including an internal pipe, a base for containing water, and a hose. Typically, a user will first fill the base with water and then place the internal pipe into the water such that the body creates an airtight seal with the base. The head is then filled with tobacco, or other organic material, and placed over the internal pipe such that an airtight seal is created between the internal pipe and the head. Next the user places the plate over the head, places one or more lit charcoals on the plate and these charcoals serve to heat the tobacco, or other organic material, underneath the plate. The hose is typically attached to the body such that it has an airtight connection with air above the water in the base. The user can inhale through the hose, which draws smoke from the heated tobacco, or other organic material, in the head through the internal pipe, through the water contained in the base, through the hose and into the user's lungs.

U.S. Patent Publ. No. 2013/0330680 shows an example of a common water pipe and is incorporated by reference herein in its entirety.

While standard water pipes are known, the embodiments provided herein teach features and advantages heretofore untaught by the prior art, as will be clear to one of ordinary skill in the art.

SUMMARY OF THE INVENTION

Provided herein are embodiments of systems, devices and methods for preparing, storing, heating and smoking tobacco, or other organic material, through a water pipe. The water pipe is different in form and function from traditional water pipes and provides a new experience for users, unknown in the industry.

A hookah is a water pipe known for centuries that has maintained a single, basic form. Traditional hookah pipes commonly include single chamber for holding water or other liquid that resembles a vase, and a pipe, hose, and bowl for holding tobacco. When being used for smoking or storing in an upright orientation, traditional hookahs have a center of gravity that is often located some distance above the surface on which the hookah pipe is resting. This high center of gravity can be prone to tipping over, especially when multiple users are sharing a smoking experience, where they may be passing hoses between each other. In a departure from the traditional orientation, the water pipe device disclosed herein has a low center of gravity and is therefore much more stable and less prone to falling over. As such, the water pipe devices disclosed herein provide improved safety and cleanliness compared with traditional hookah pipes since there is a reduced likelihood that the water pipe will tip over, causing coals or other heating implements to burn property or individuals and there is a reduced likelihood that the liquid holding chamber will spill or break. Similar advantages are also disclosed with respect to new bowl mechanics that are disclosed herein, providing mechanisms for securely coupling tobacco, or other organic material, holding bowls to the new water pipe devices and thus improving safety and cleanliness over prior art hookah pipes.

Operation of a traditional hookah pipe includes heating tobacco, or other organic material, in a bowl, drawing smoke from the heated tobacco, or other organic material, through a pipe and into water in the liquid chamber and then into the user's lungs. This has traditionally offered a smoke, which can be cooler in temperature, smoother in experience, and cleaner than other smoking implements, such as cigarettes and cigars. The water pipes disclosed herein further improve on the traditional hookah pipe in that they can provide users a cooler temperature and smoother smoking experience than a traditional hookah pipe. Disclosed herein are water pipes that provide various mechanisms for achieving these improvements including an increased surface area for smoke to cool, improved, and as yet unknown, purge valves and other inventive advancements not heretofore known.

To elaborate, various new types of water pipes are disclosed herein. In particular, some of these water pipes include a bowl that is pushed into a neck or hole from one direction. Some of these water pipes utilize two-part downstem systems that separate to allow for upper and lower sections to create a seal over a hole in a glass dome from two directions. For these embodiments, once the seal is formed by screwing, or otherwise coupling the upper and lower sections to one another, there is a nipple at the top of the downstem to which a silicone bowl can be coupled. This allows for an airtight system, which is ideal for smoking and is an improvement on traditional hookah pipes that rely on a male or female bowl that connects with a stem and allow for smoke to travel from the bowl through the stem and into the base where water is held.

The devices and components described herein also promote improved social and personal smoking experiences by incorporating lighting, music, new smoking aesthetics, and improved storage abilities over traditional hookah pipes.

Other features and advantages of the present invention will become apparent from the following more detailed description, taken in conjunction with the accompanying drawings, which illustrate, by way of example, the principles of the present invention.

BRIEF DESCRIPTION OF THE SEVERAL VIEWS OF THE DRAWING(S)

Illustrated in the accompanying drawing(s) is at least one of the best mode embodiments of the present invention. In such drawing(s):

Figure 18A:
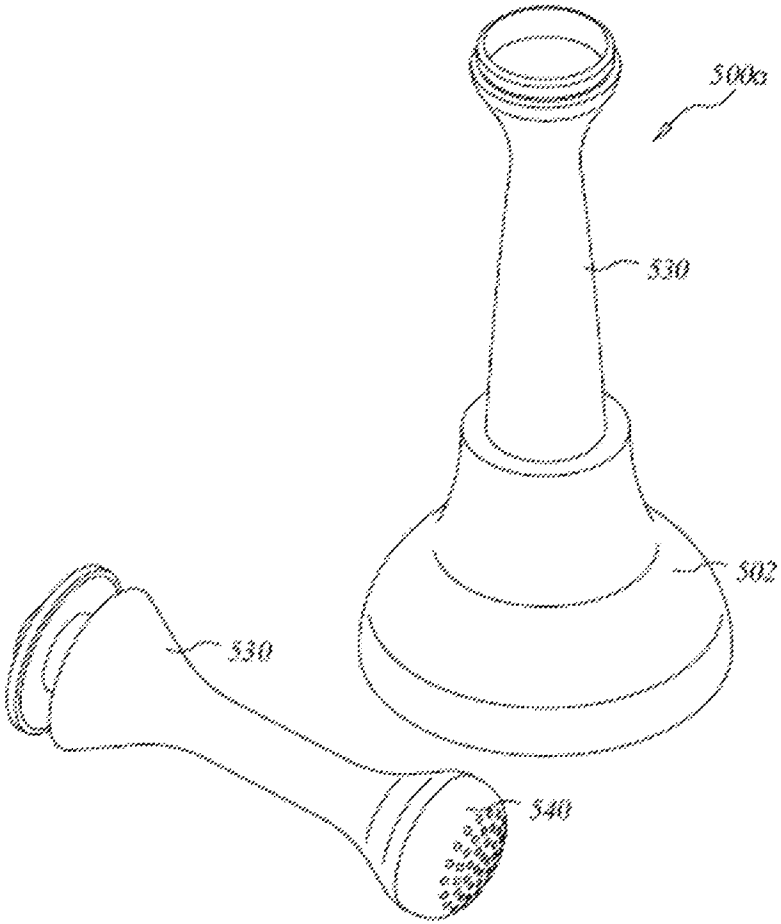
FIG. 18A shows an example embodiments of down stem assemblies attached to a silicone bowl as well as unattached.
Figure 18B:
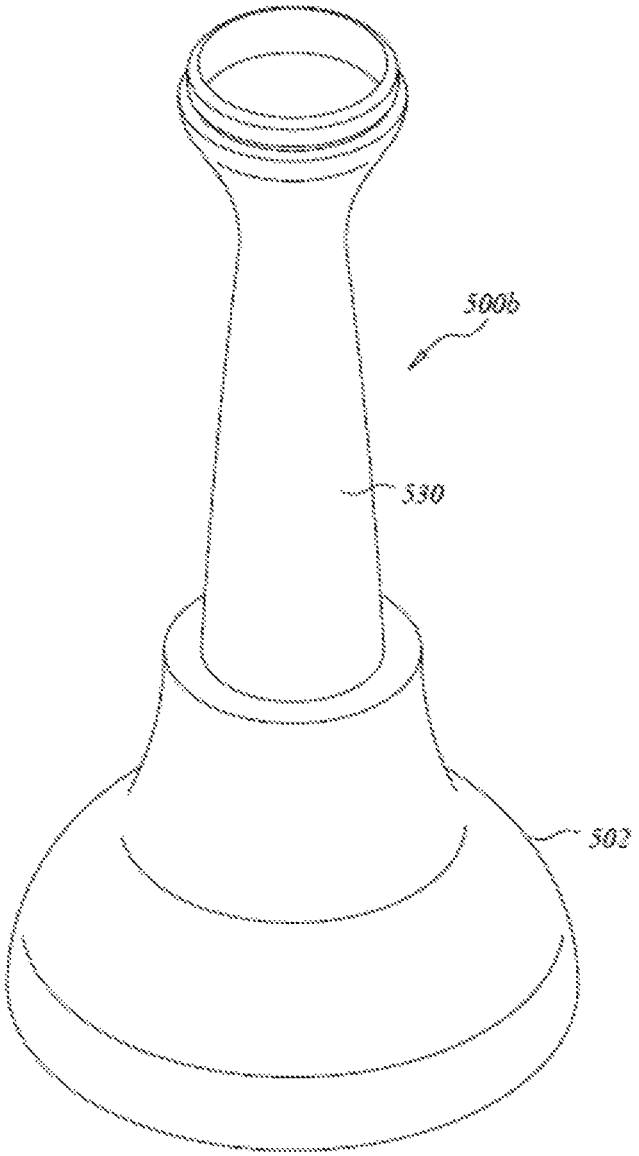
FIG. 18B shows an example embodiment of a down stem assembly attached to a silicone bowl.
Figure 18C:
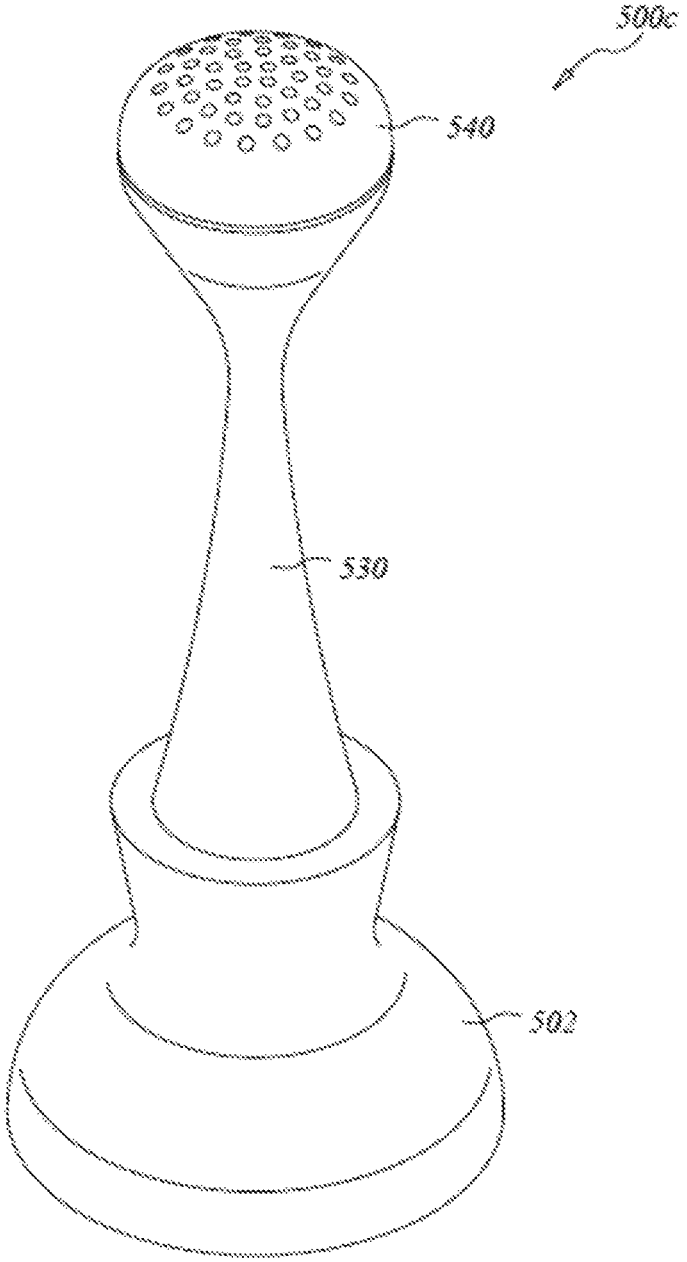
FIG. 18C shows an example embodiment of a down stem assembly coupled with a silicone bowl and a coupled silicone diffuser.
Figure 18D:
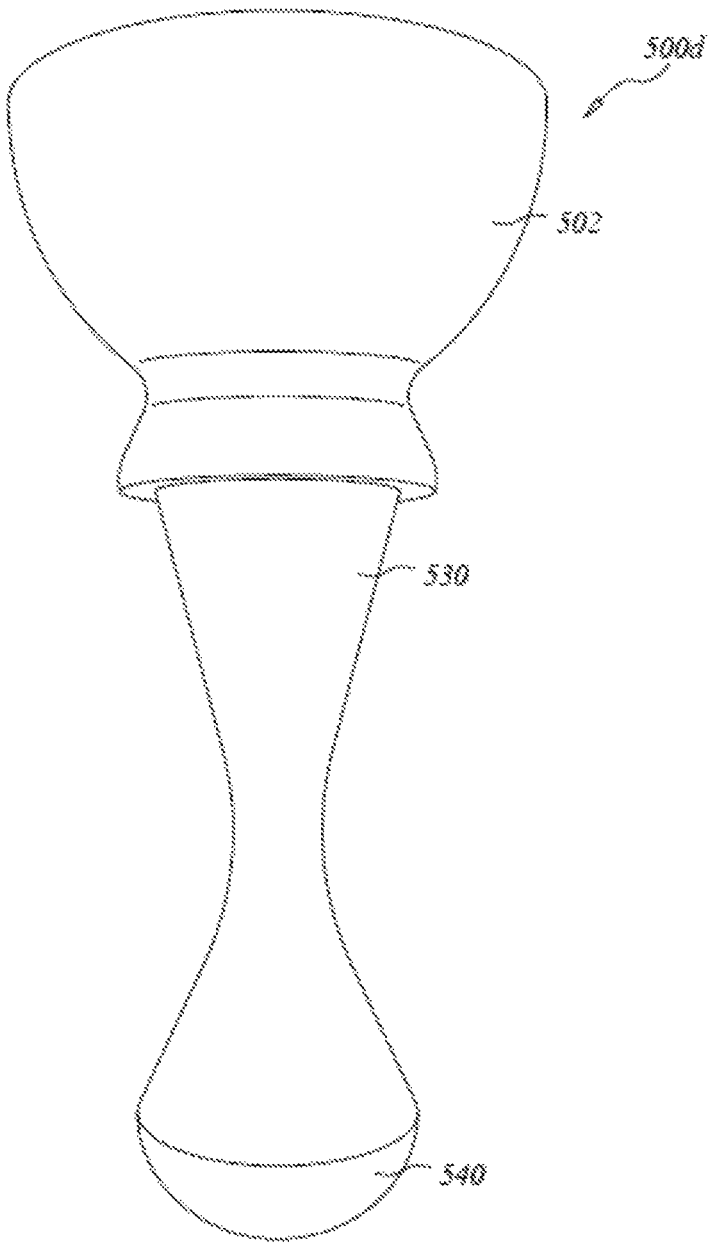
FIG. 18D shows an example embodiment of a down stem assembly coupled with a silicone bowl and a silicone diffuser.
Figure 18E:
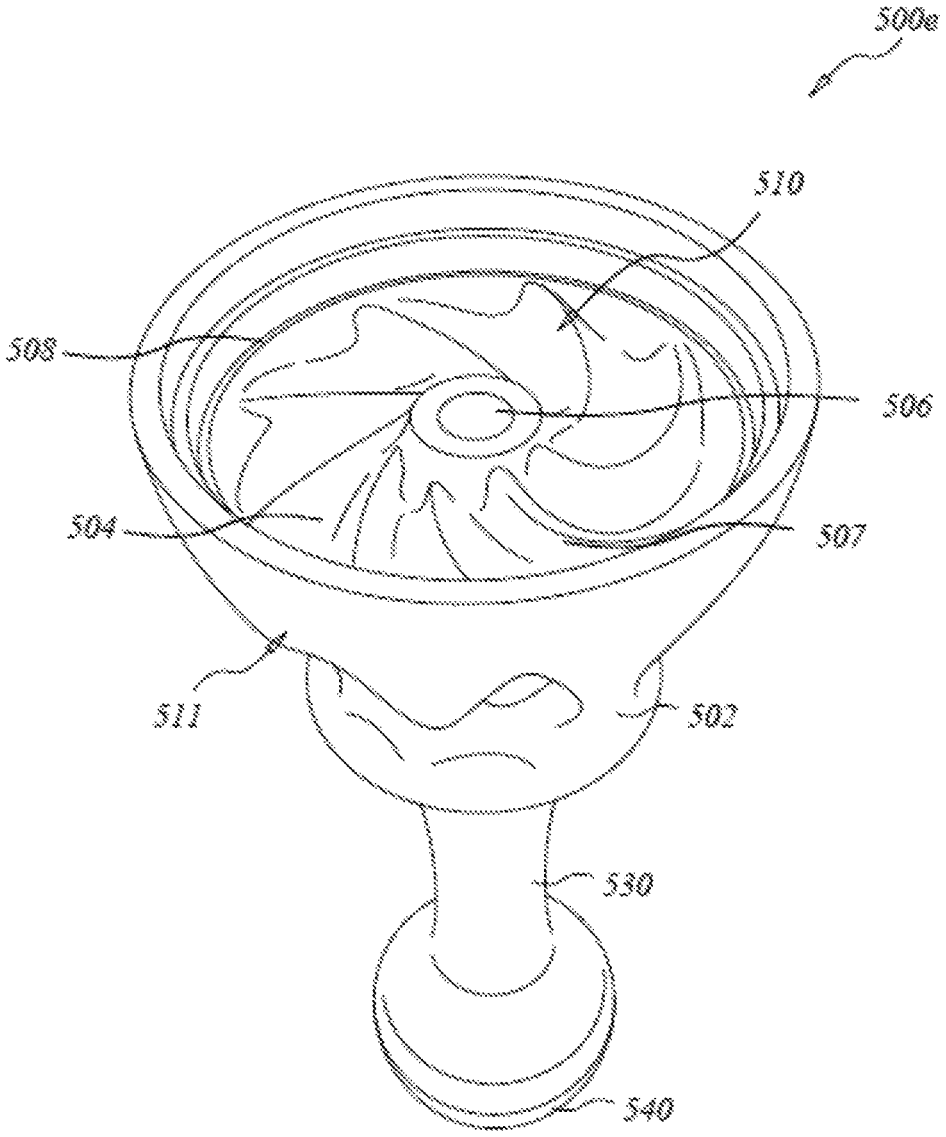
FIG. 18E shows an example embodiment of a down stem assembly attached to a silicone bowl.
Figure 18F:
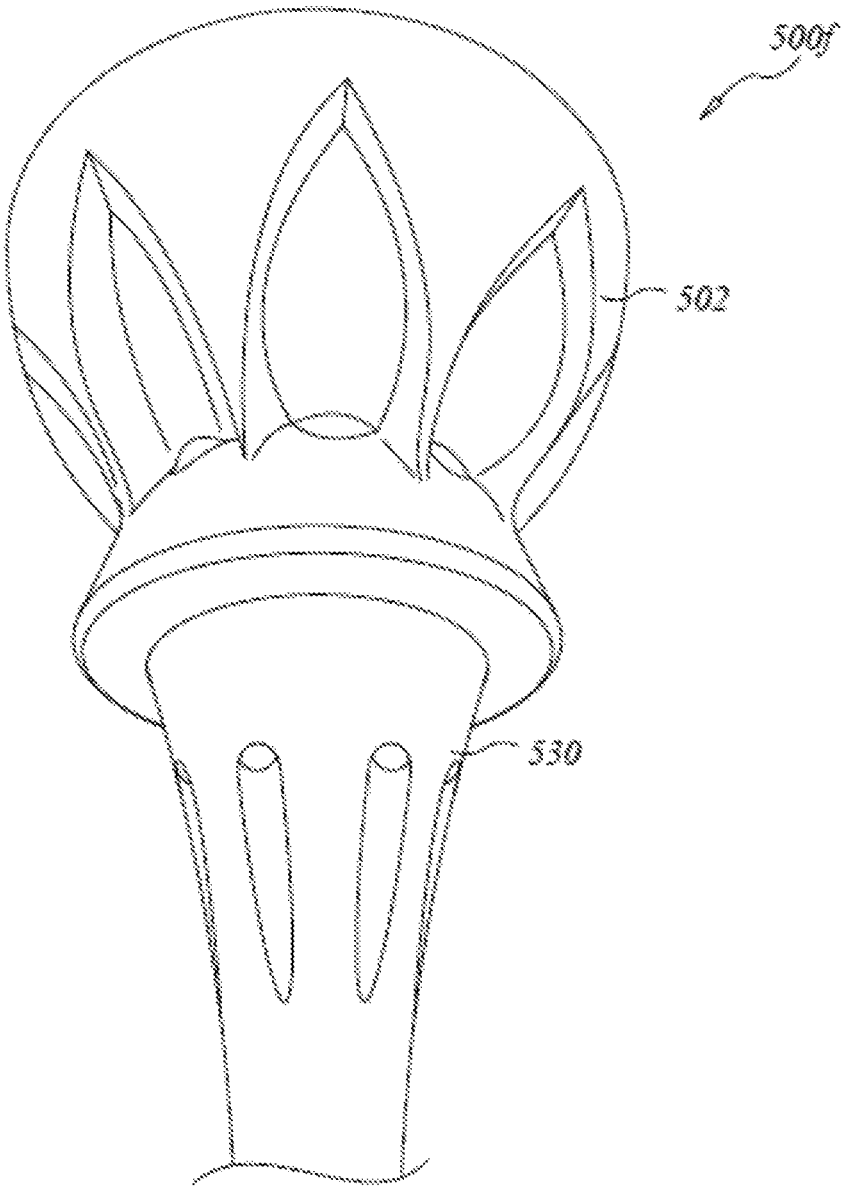
Figure 18G:
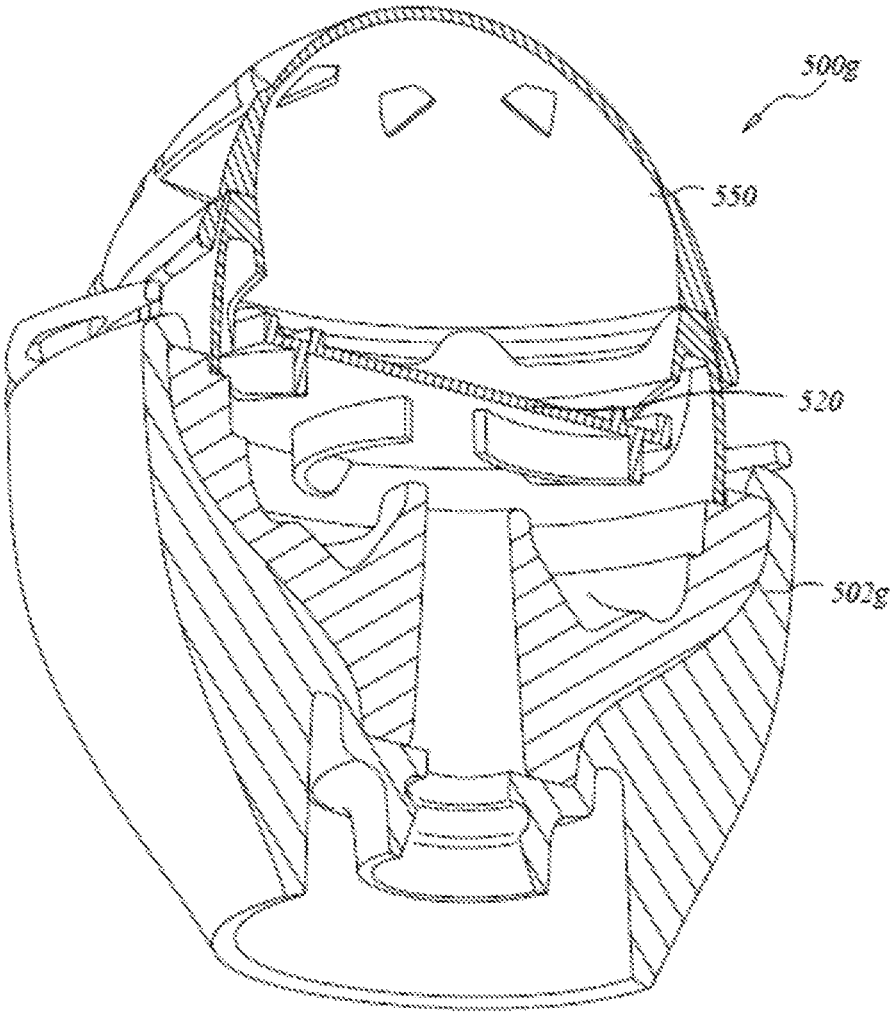
Figure 18H:
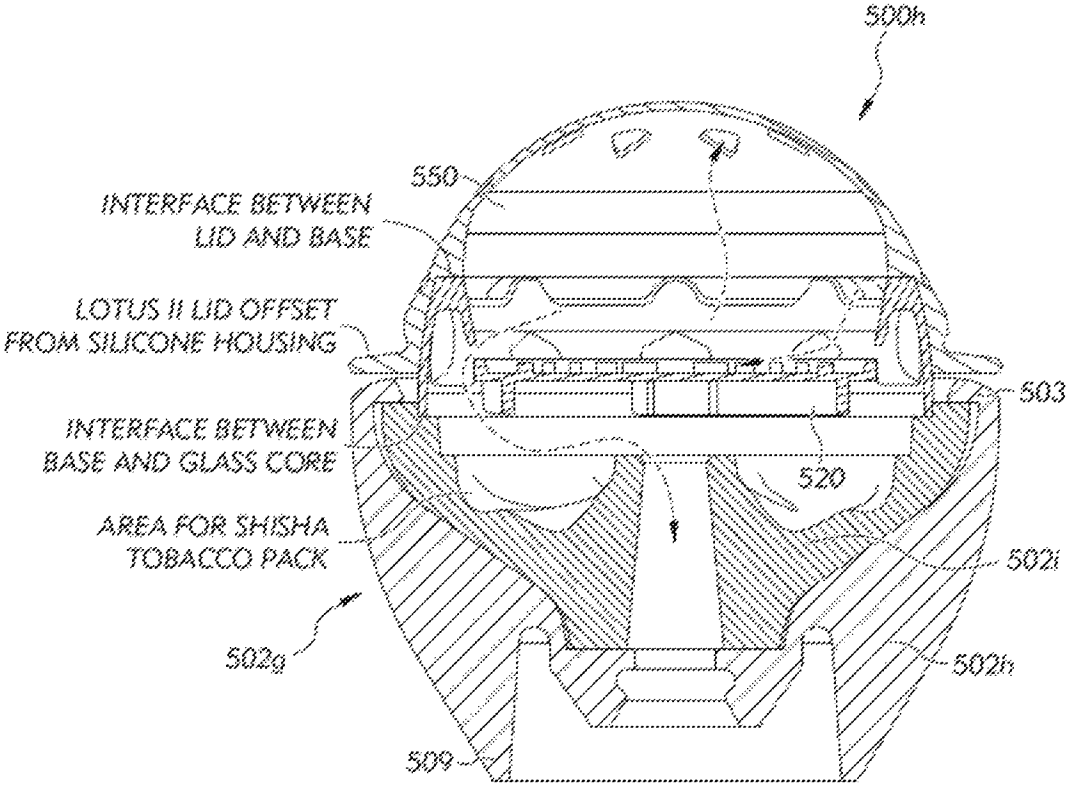

FIG. 18F shows an example embodiment of a down stem assembly attached to a silicone bowl and which has purge channels on a down stem FIG. 18G shows an example embodiment of a side cross-sectional view of a silicone housing, glass bowl, and a metal heat management device FIG. 18H shows an example embodiment of a side cross-sectional view of a silicone housing, glass bowl, and a metal heat management device with airflow.

Figure 18I:
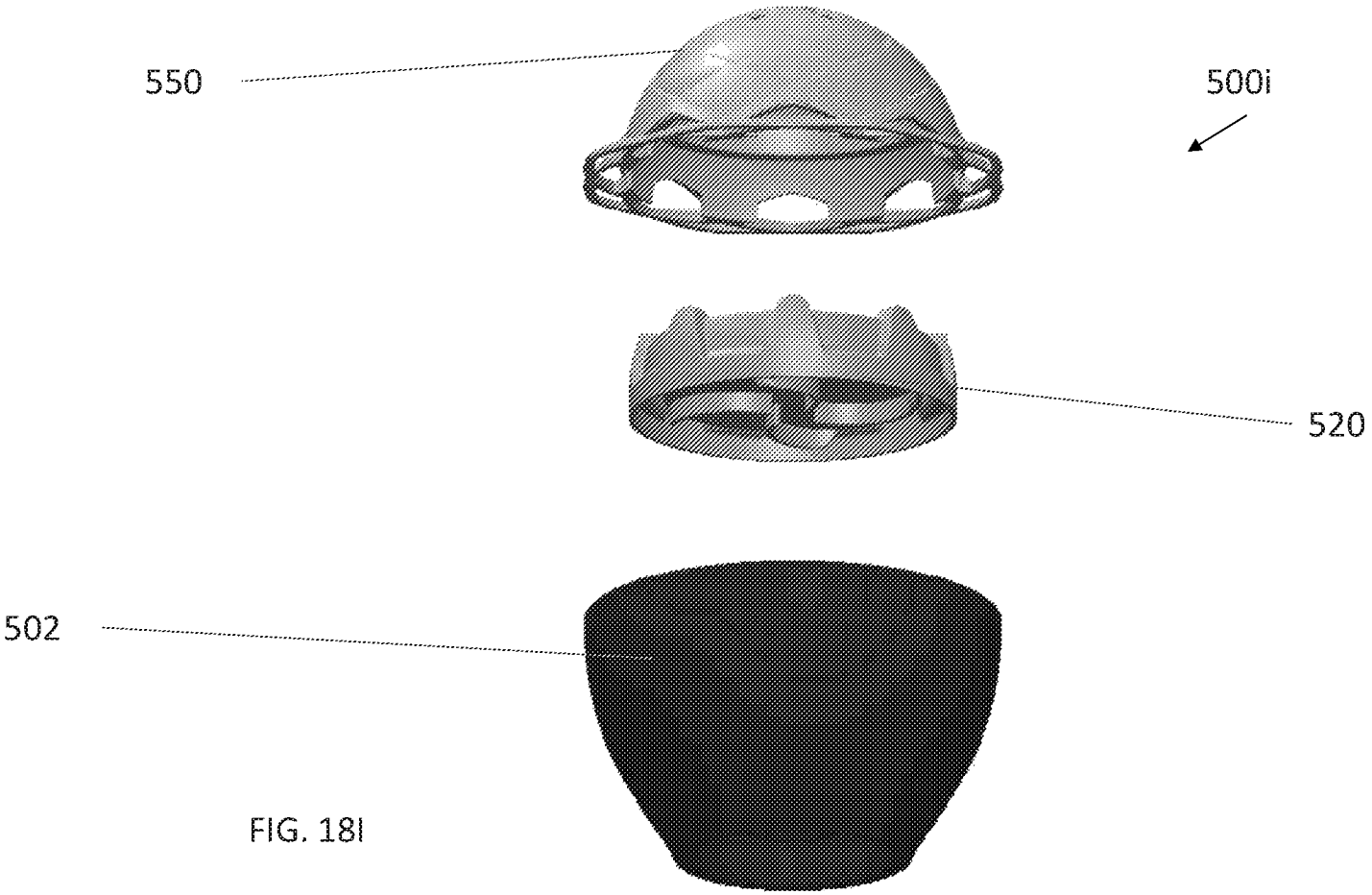
Figure 18L:
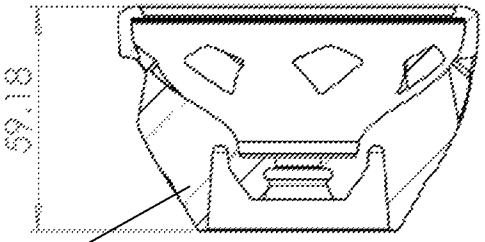
Figure 18M:
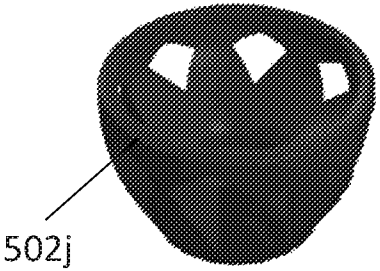
Figure 18J:
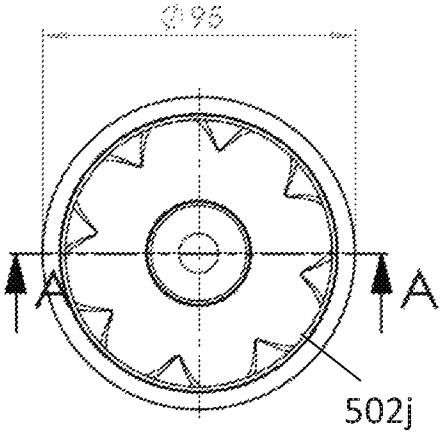
Figure 18K:
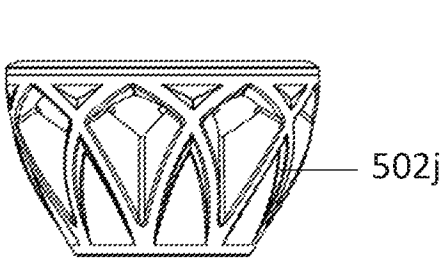
Figure 18U:
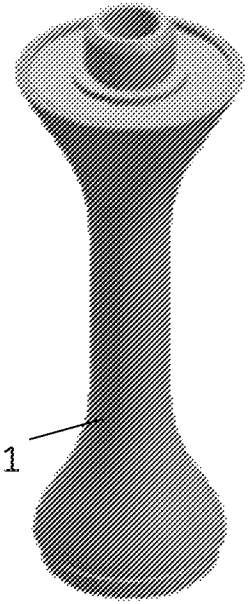
Figure 18T:
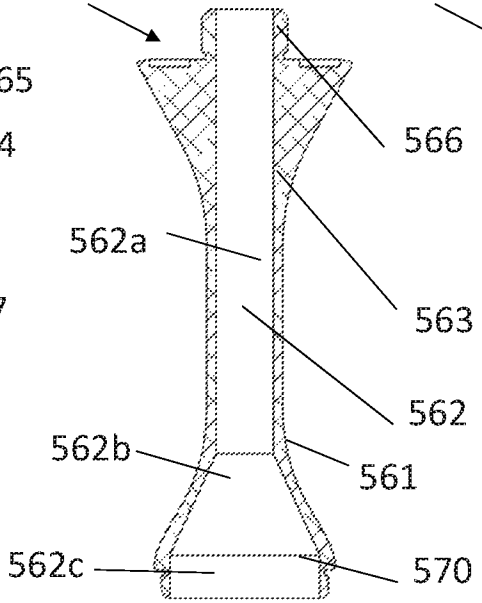
Figure 18S:
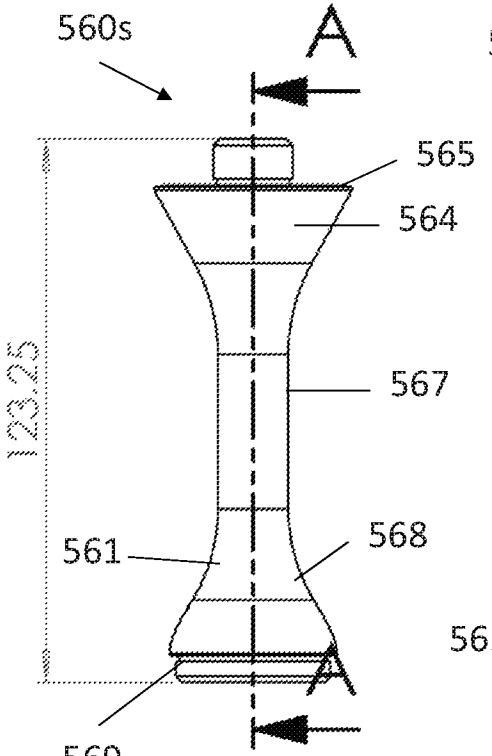
Figure 18R:
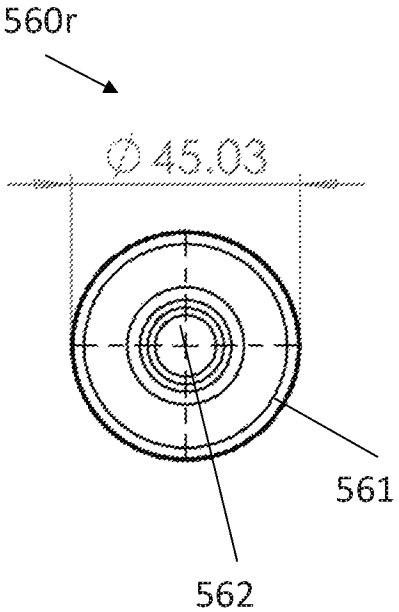

FIG. 18I shows an example embodiment of an exploded view of the silicone housing and a metal heat management device.

FIGS. 18J-18M show an example embodiment of a silicone bowl housing.

FIGS. 18N-18Q show an example embodiment of a silicone bowl housing.

FIGS. 18R-18U show an example embodiment of a down stem.

Figure 18V:
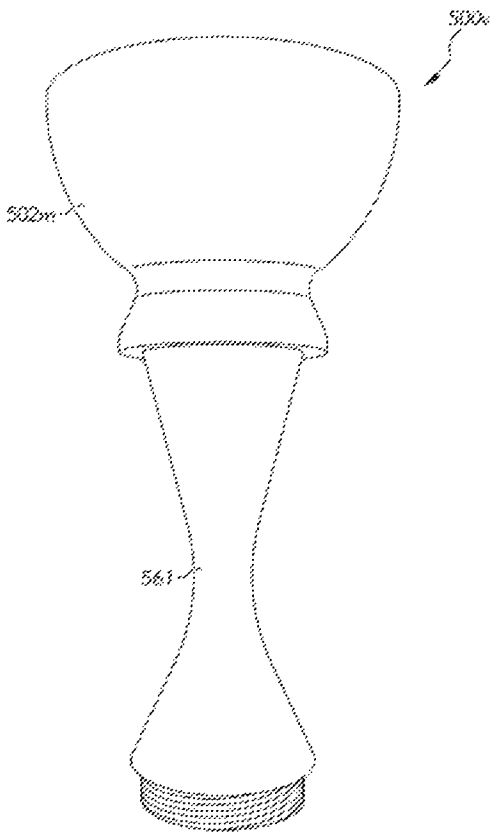
Figure 18X:
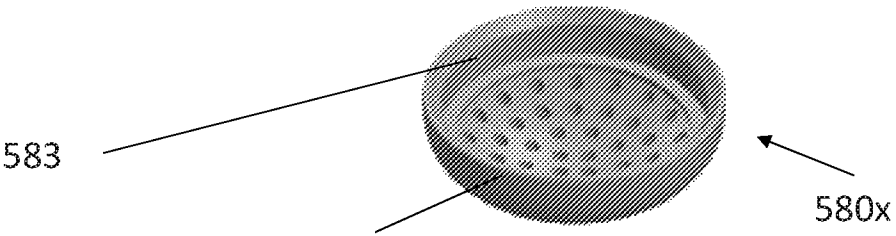
Figure 18Y:
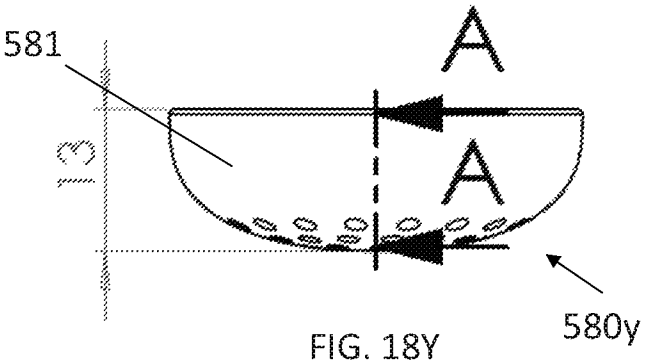
Figure 18W:
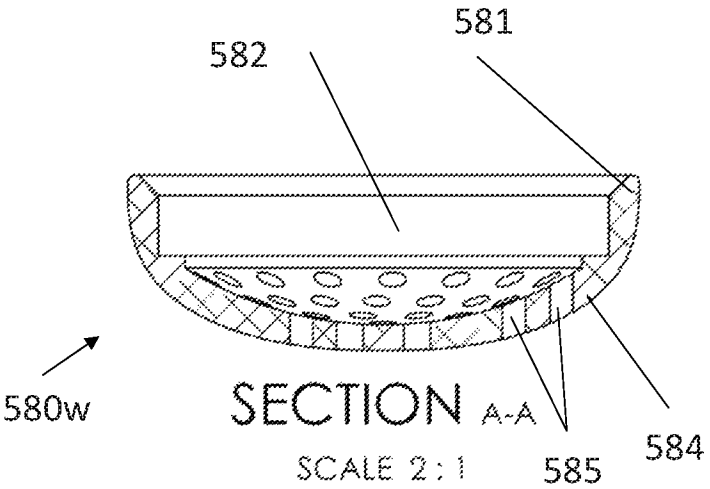
Figure 18A:
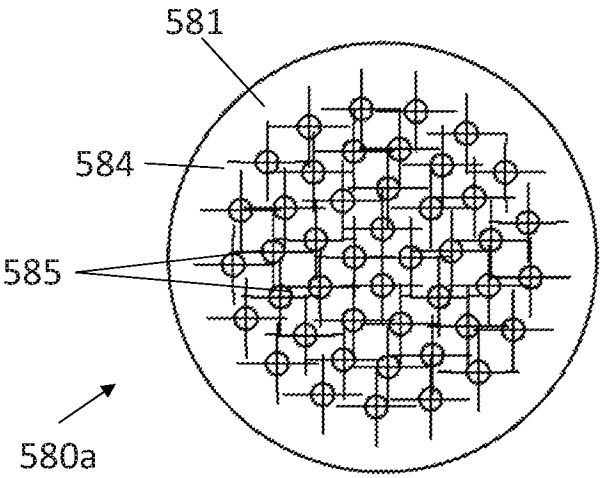

FIGS. 18W-18Y show an example embodiment of a diffuser.

Figure 18Z:
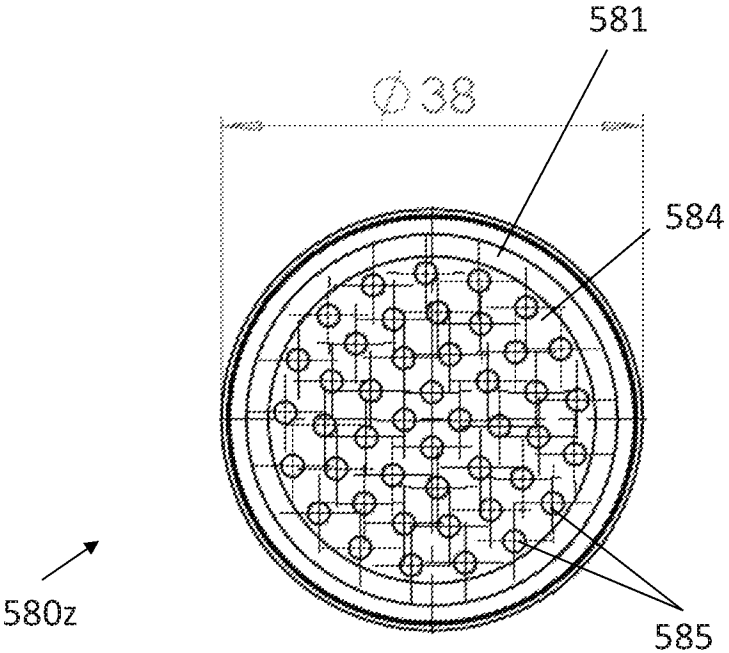

FIGS. 18Z, 18AA show an example embodiment of a diffuser from top and bottom views.

FIG. 18V shows an example embodiment of an assembled bowl with a down stem attached.

Figure 19A:
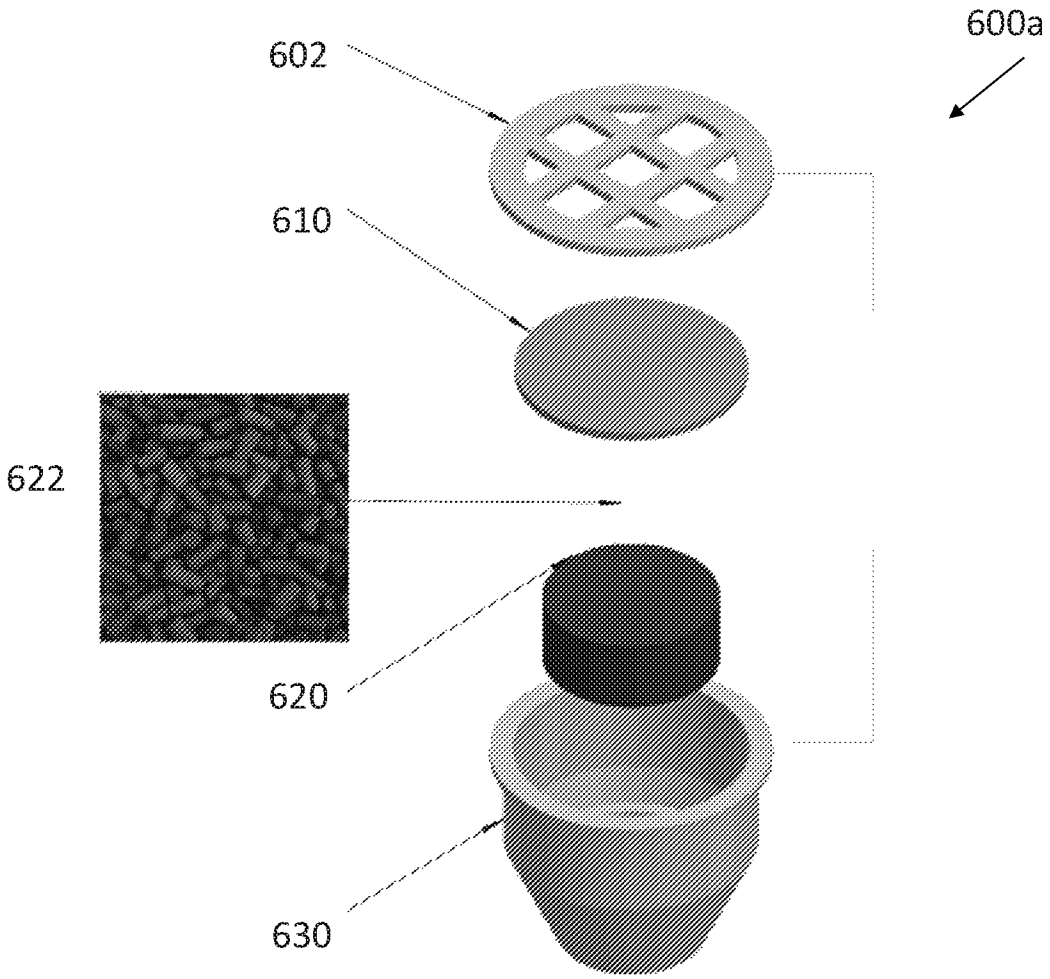

FIG. 19A shows an example embodiment of an exploded view of a carbon filter assembly exploded view.

Figure 19D:
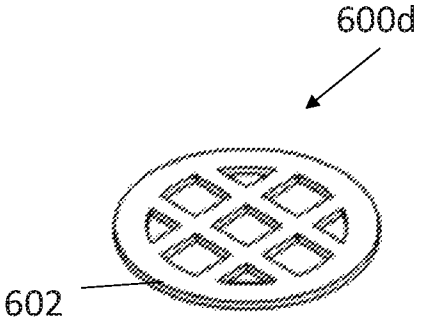
Figure 19B:
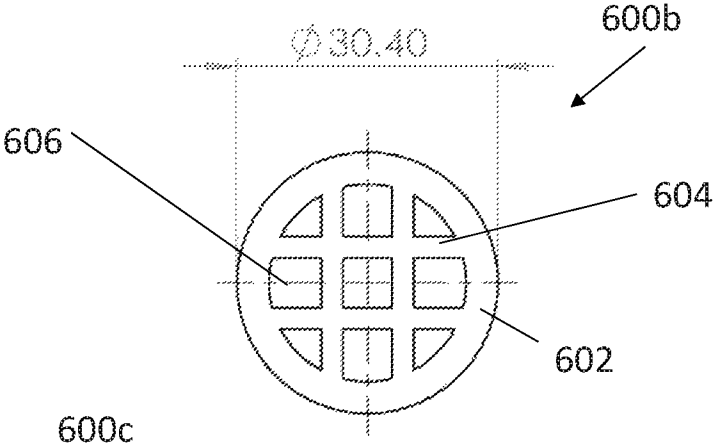
Figure 19C:
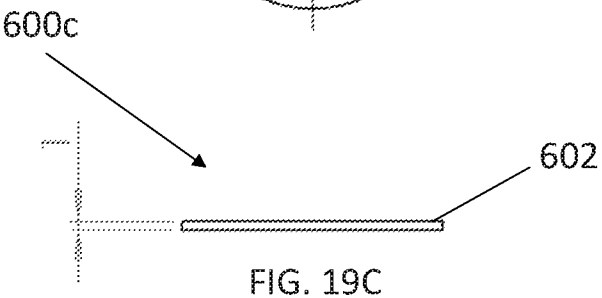
Figure 19G:
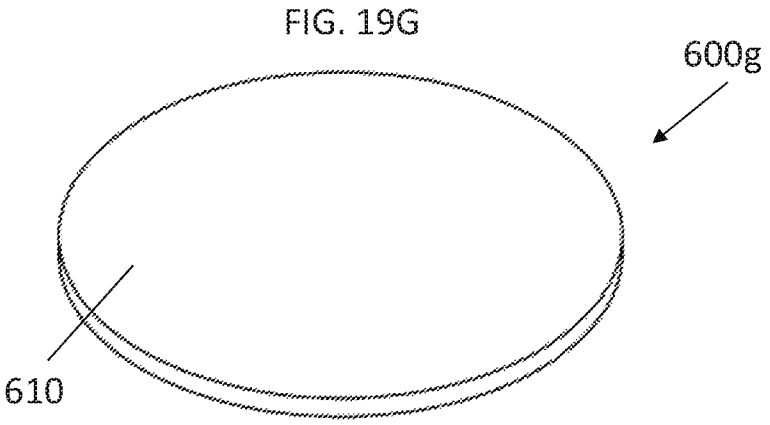
Figure 19H:
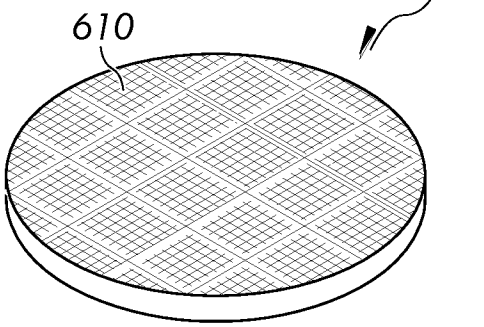
Figure 19E:
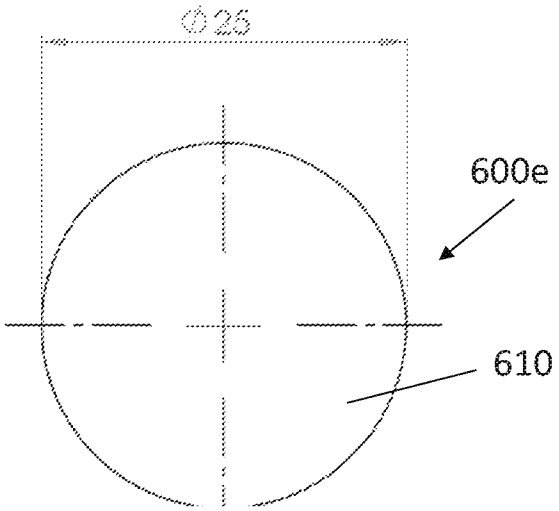
Figure 19F:
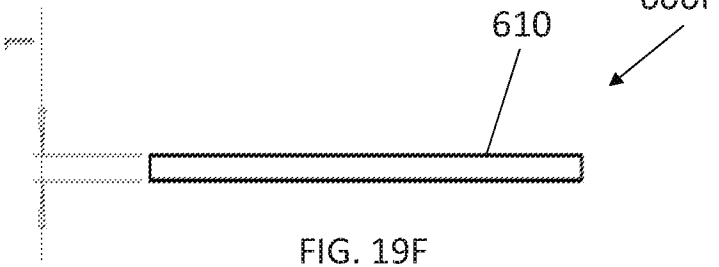

FIGS. 19B-D show an example embodiment the top of a carbon filter.

FIGS. 19E-19H show an example embodiment of a mesh for the carbon filter.

Figure 19J:
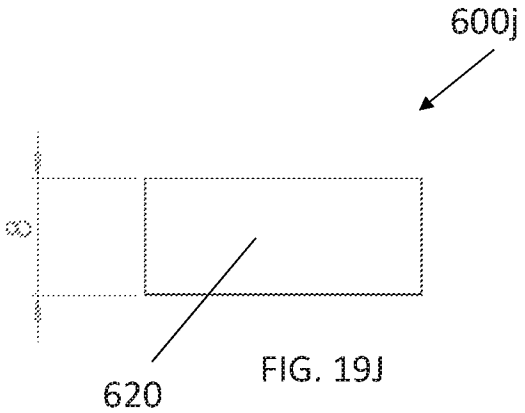
Figure 19I:
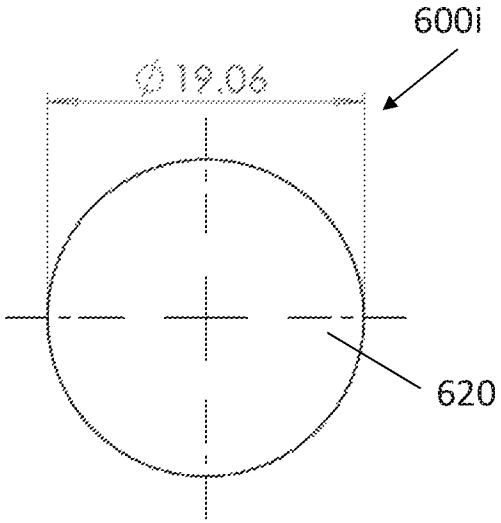
Figure 19O:
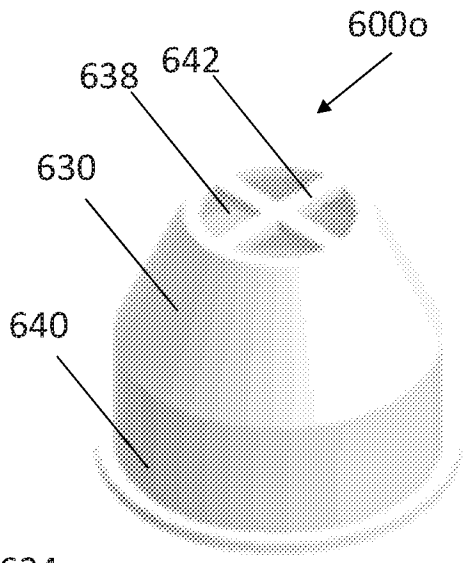
Figure 19L:
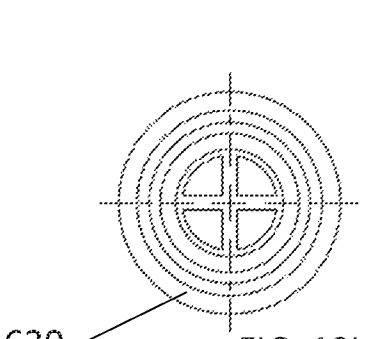

FIGS. 19I-19J show an example embodiment of a carbon sponge for the carbon filter.

Figure 19K:
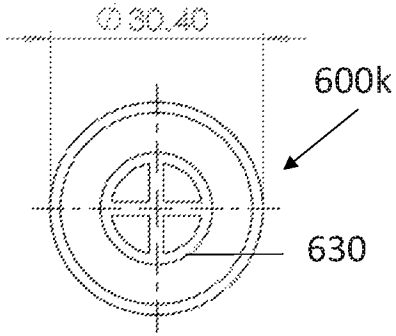
Figure 19N:
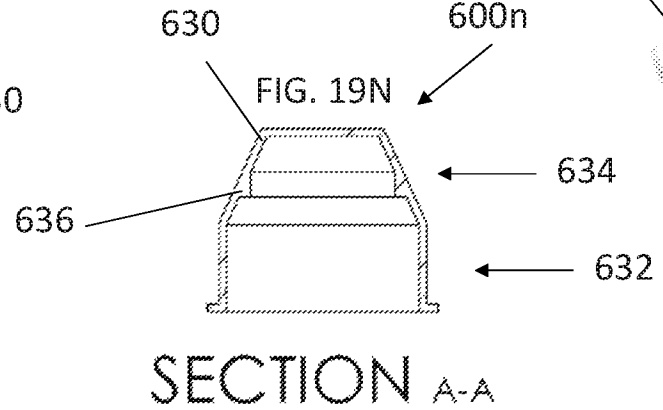
Figure 19M:
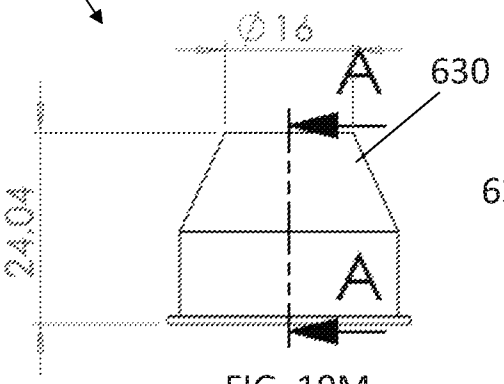

FIGS. 19K-190 show an example embodiment of a carbon filter body.

Figure 20B:
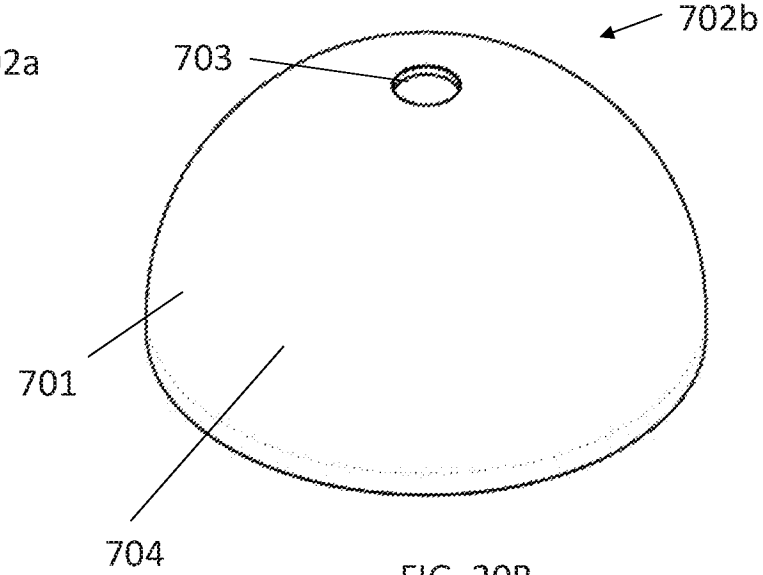
Figure 20A:
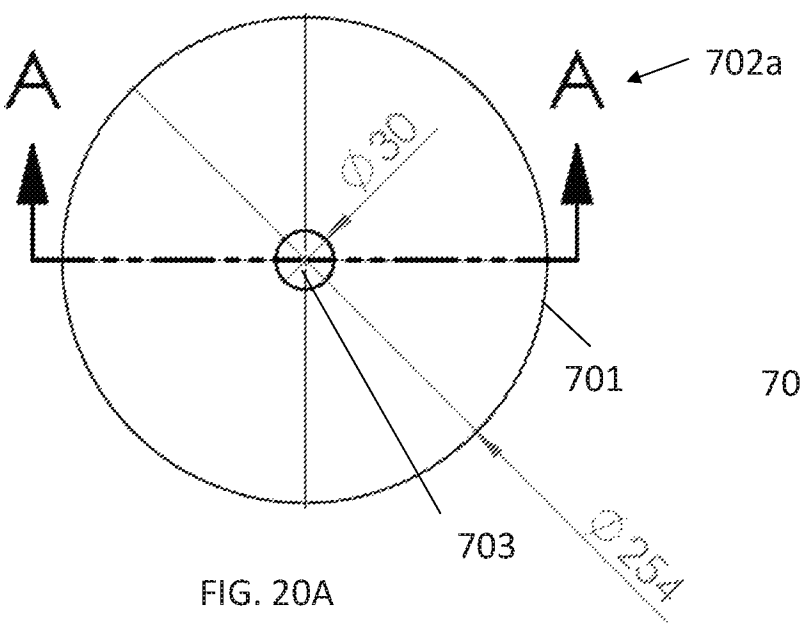

FIGS. 20A-20B show an example embodiment of an outer vessel top view diagram and isometric view diagram.

Figure 20C:
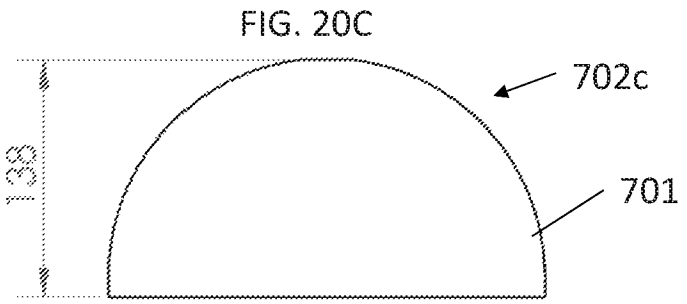
Figure 20D:
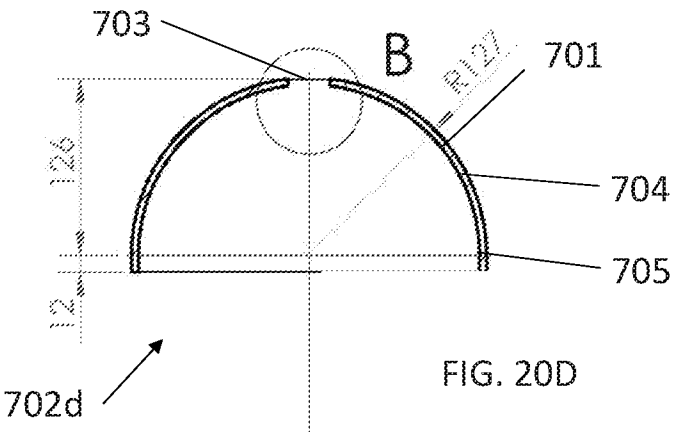
Figure 20E:
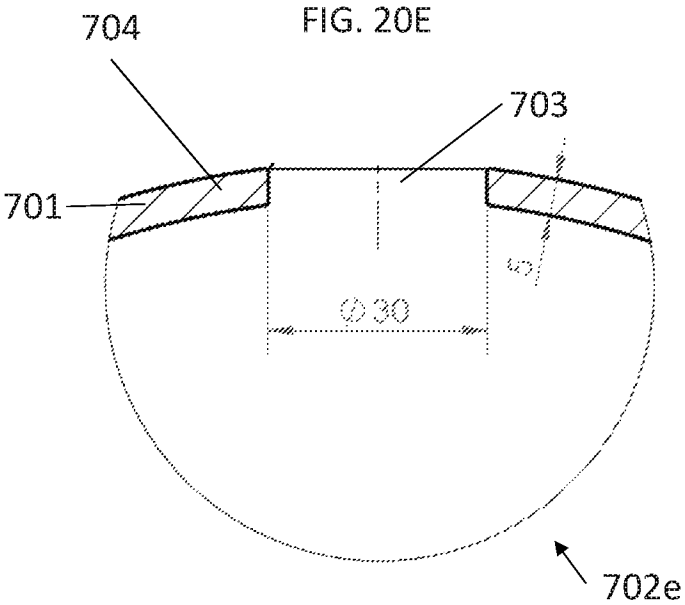

FIGS. 20C-20E show an example embodiment of an outer vessel side view diagram, side cross-sectional diagram and side cross-sectional detail diagram.

Figure 20F:
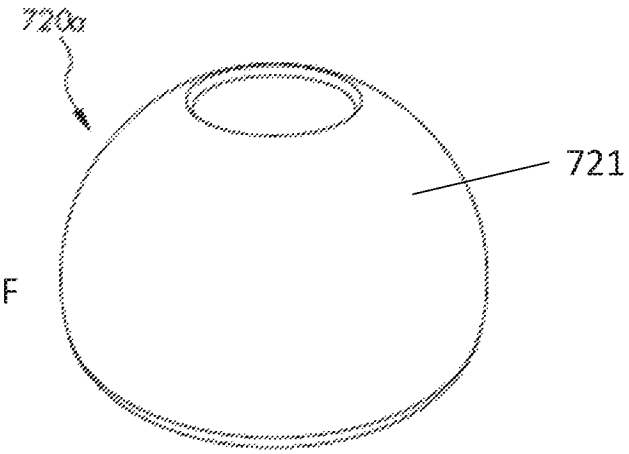
Figure 20G:
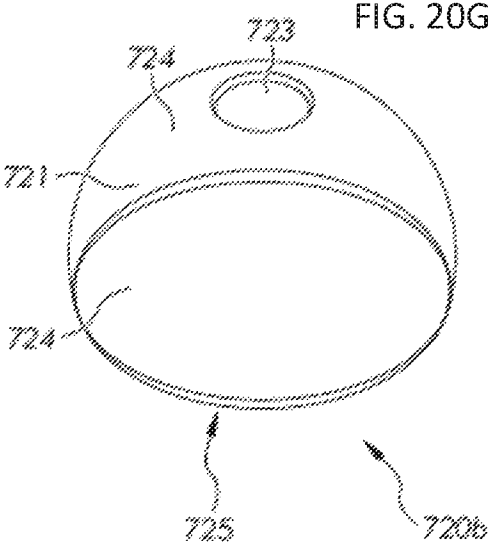
Figure 20H:
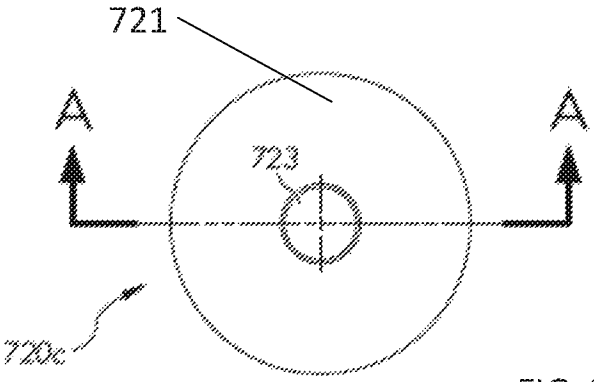

FIGS. 20F-20H show an example embodiment of an inner vessel an inner vessel picture, mockup and top view diagram.

Figures 7D, 20I, 20J, 20K:
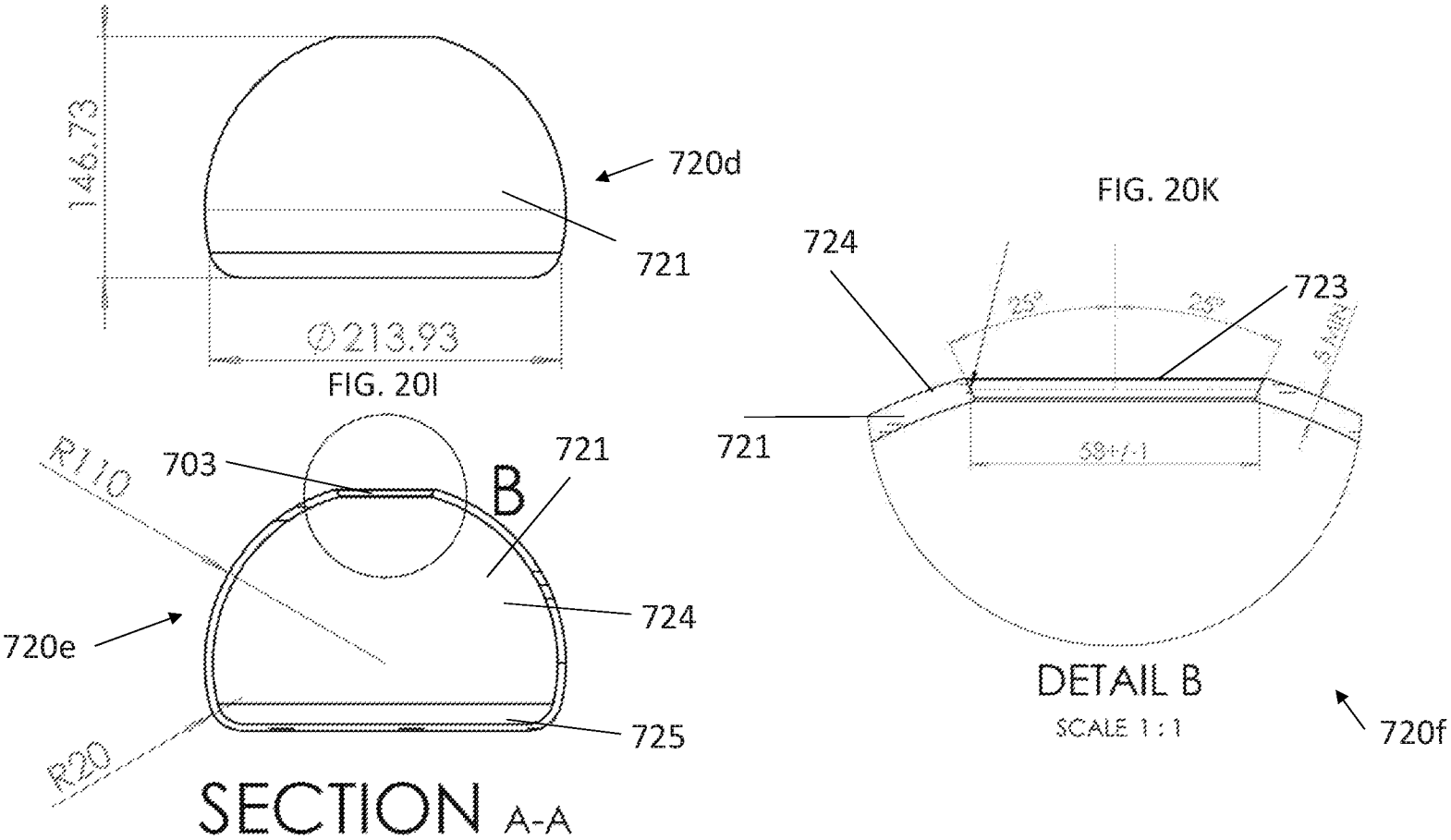

FIGS. 201-20K show an example embodiment of an inner vessel side view diagram, side cross-sectional diagram and side cross-sectional detail diagram.

Figure 20M:
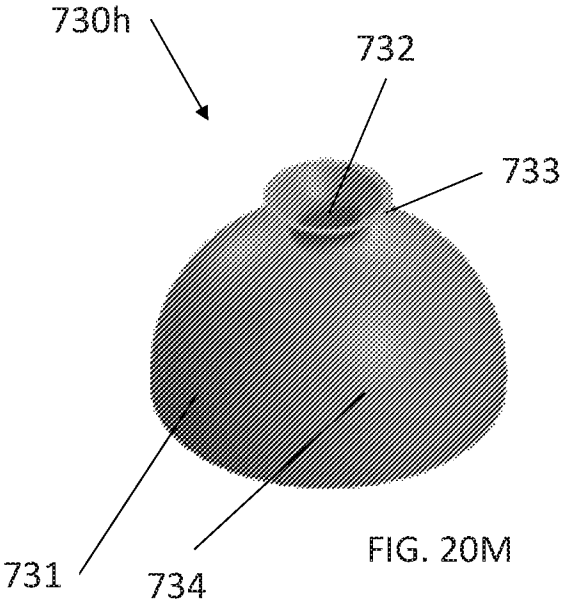
Figure 20L:
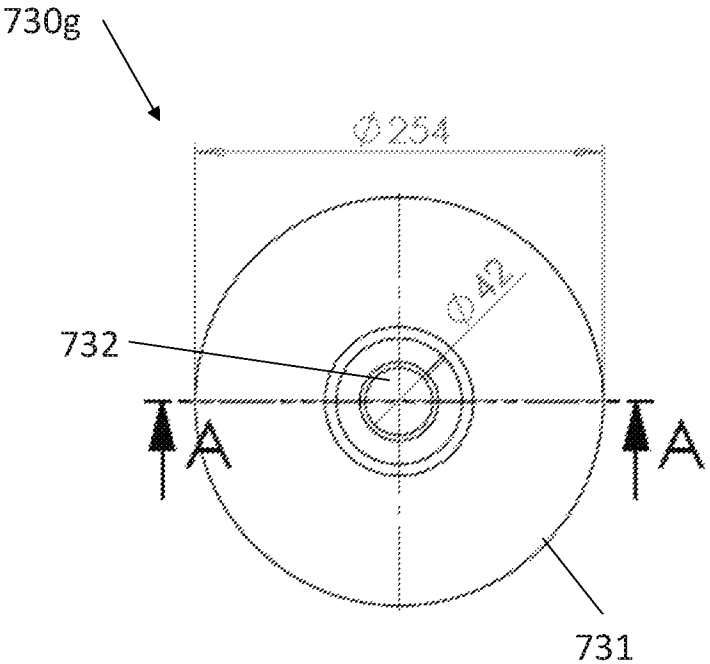

FIGS. 20L-20M show an example embodiment of an outer vessel top view diagram and isometric view diagram.

Figures 20N, 20O, 20P:
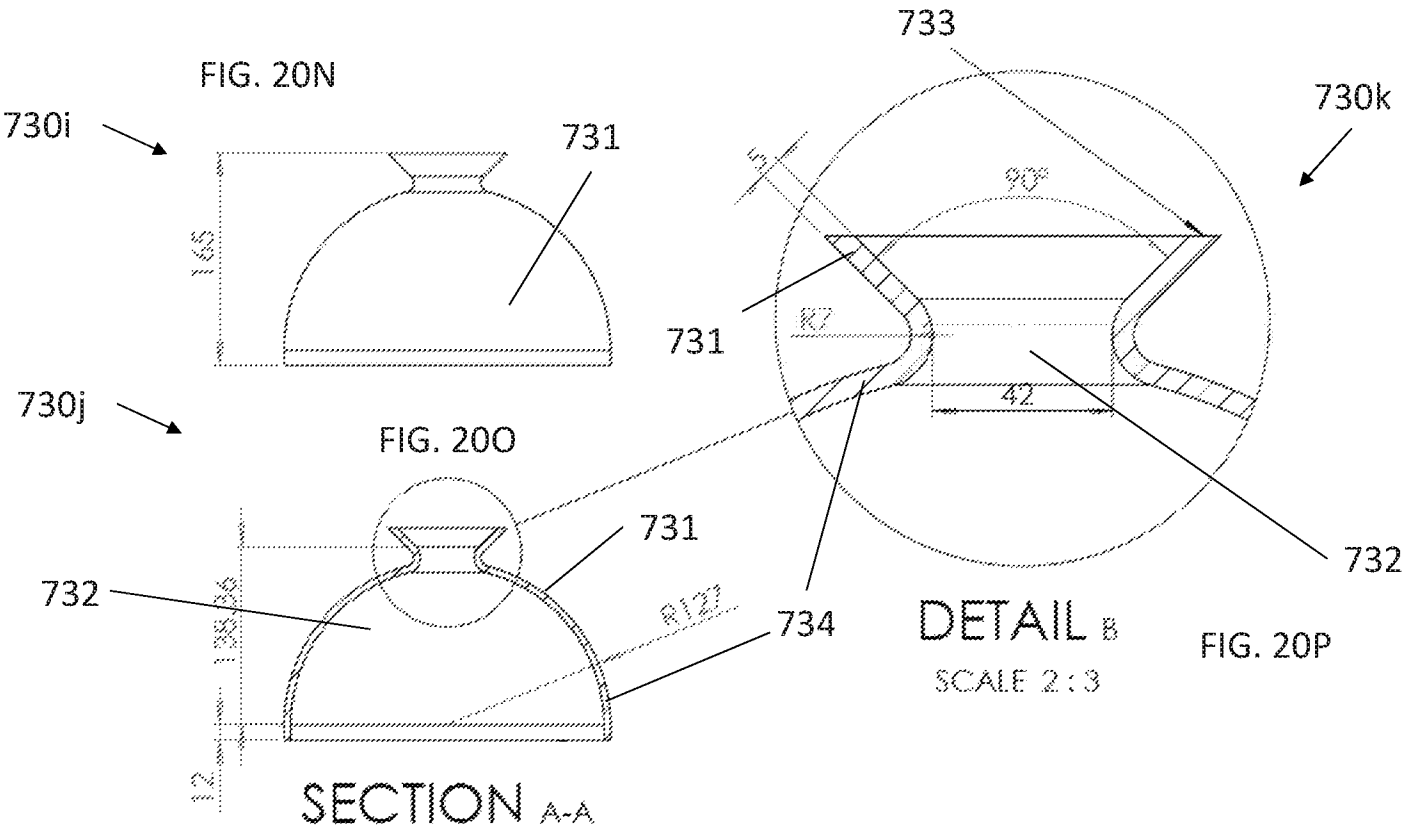

FIGS. 20N-20P show an example embodiment of an outer vessel side view diagram, side cross-sectional diagram and side cross-sectional detail diagram.

Figure 20Q:
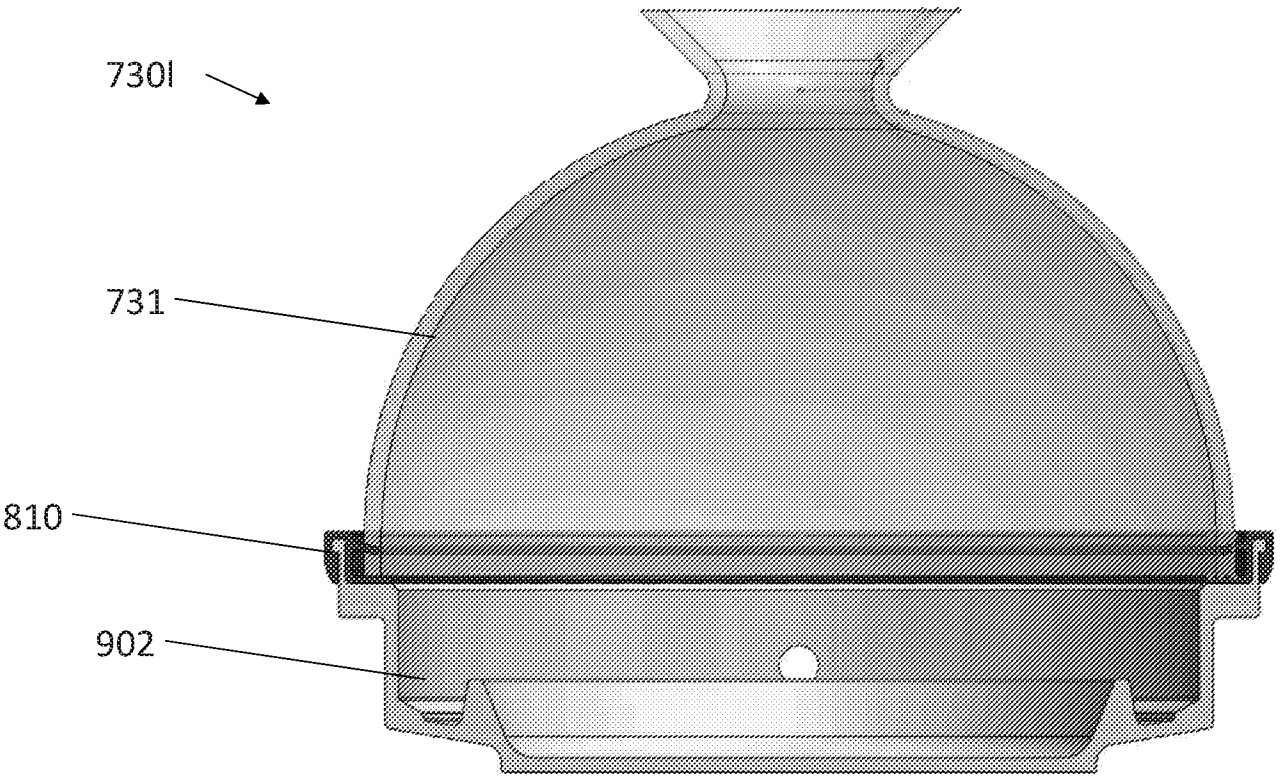

FIG. 20Q shows an example embodiment of an outer vessel side view diagram, side cross-sectional diagram and side cross-sectional detail diagram as it sits on a manifold.

Figure 20S:
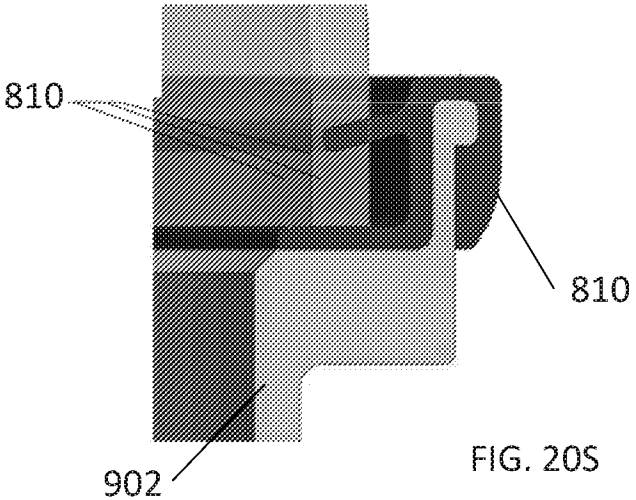
Figure 20R:
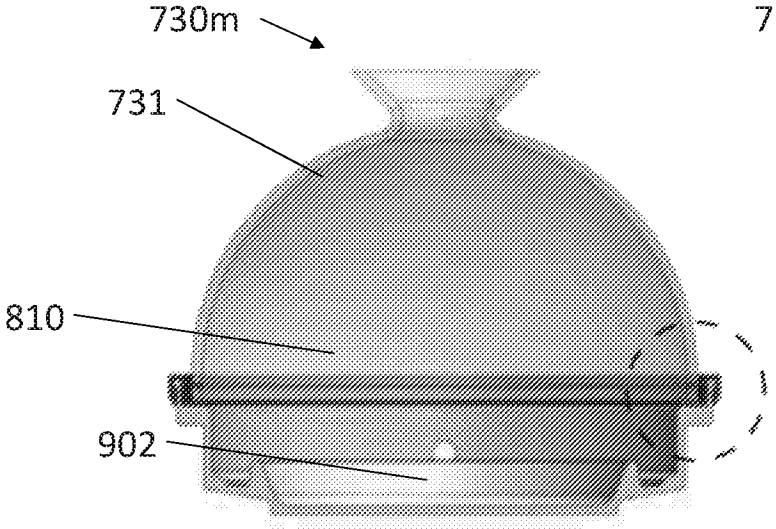

FIGS. 20R-20S show an example embodiment of an outer vessel side view diagram, side cross-sectional diagram and side cross-sectional detail diagram as it sits on a manifold with a close-up of a silicone seal and outer vessel interface.

Figure 20T:
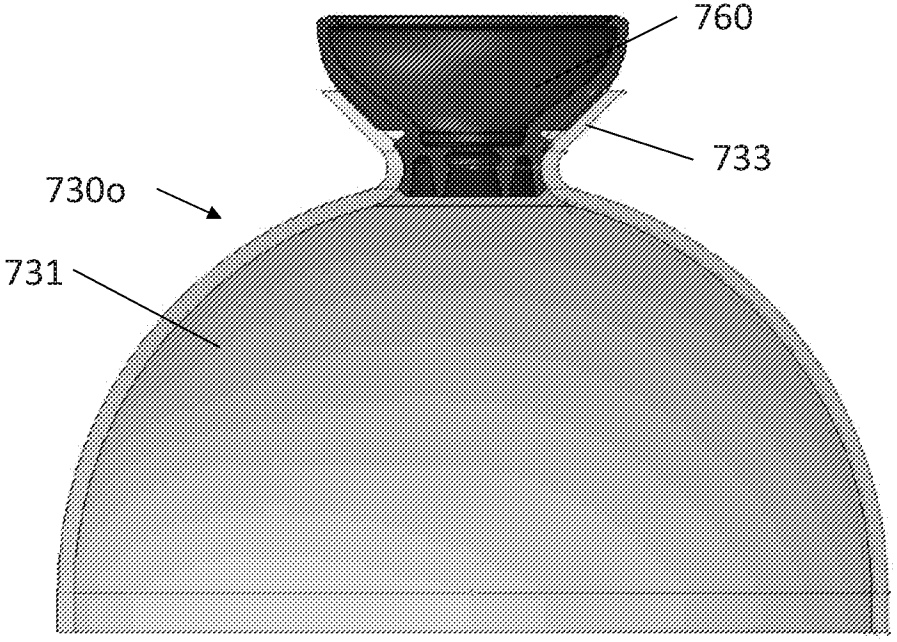

FIG. 20T shows an example embodiment of an outer vessel side view diagram, side cross-sectional diagram and side cross-sectional detail diagram with a silicone housing inserted in a top opening of the outer vessel.

Figure 20V:
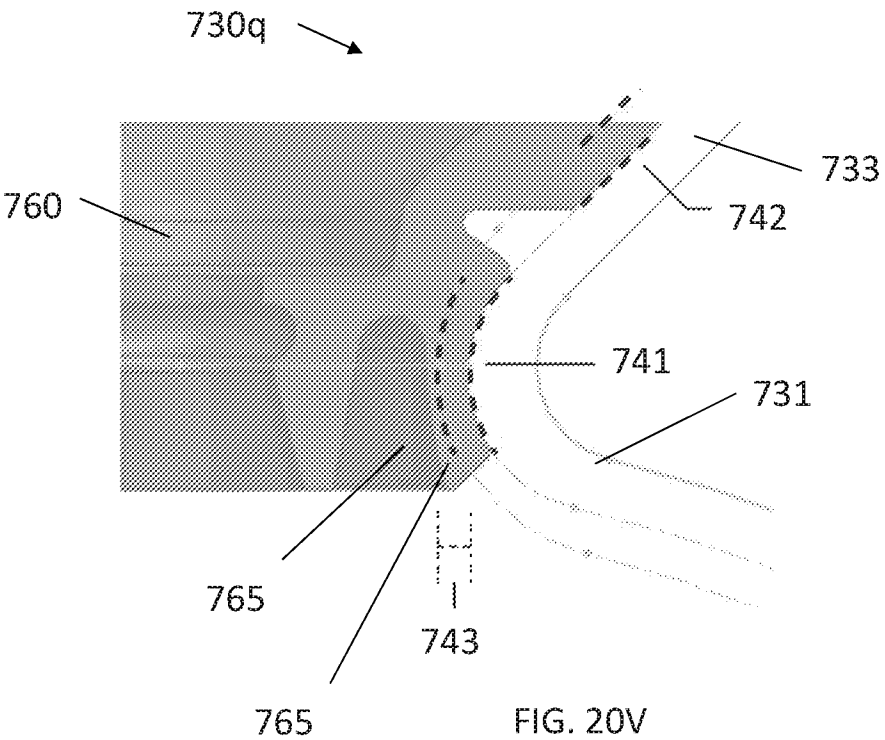
Figure 20U:
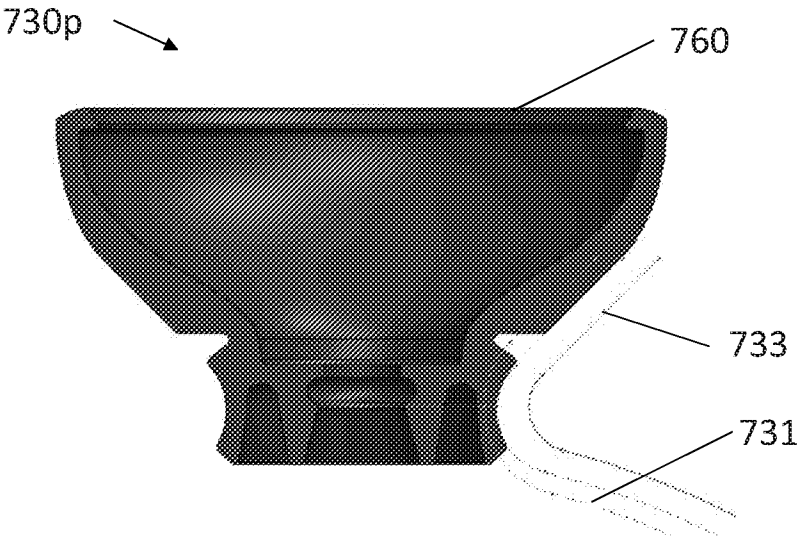

FIGS. 20U-20V show an example embodiment of a silicone housing side view diagram, side cross-sectional diagram and side cross-sectional detail diagram of a silicone and glass interface.

Figure 21A:
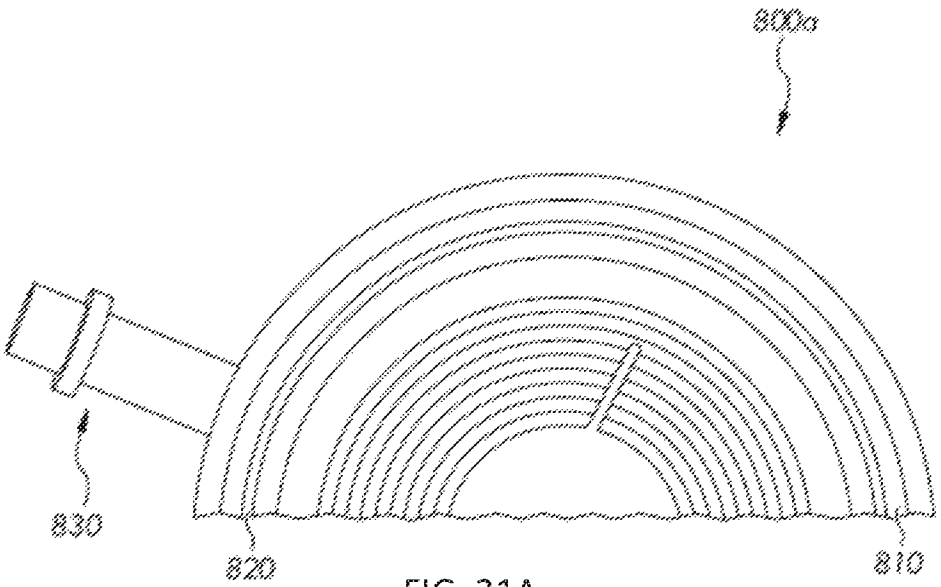
Figure 21C:
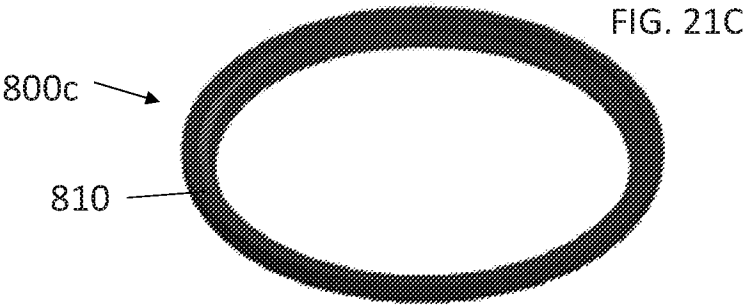
Figure 21D:
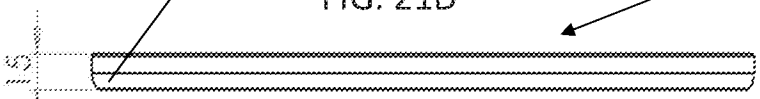
Figure 21E:
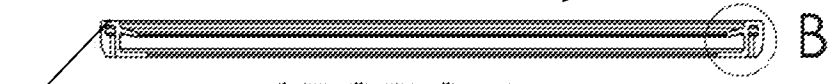
Figure 21B:
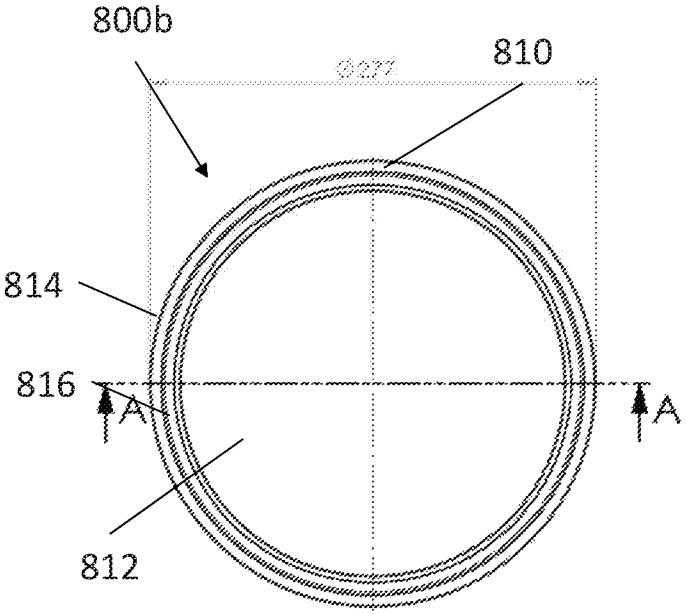

FIG. 21A shows an example image of a purge valve assembly coupled with a manifold, and manifold coupled with a main seal.

FIGS. 21B-21E show an example embodiment of a main seal top diagram, side diagram, side cross-sectional diagram and mockup.

Figure 21F:
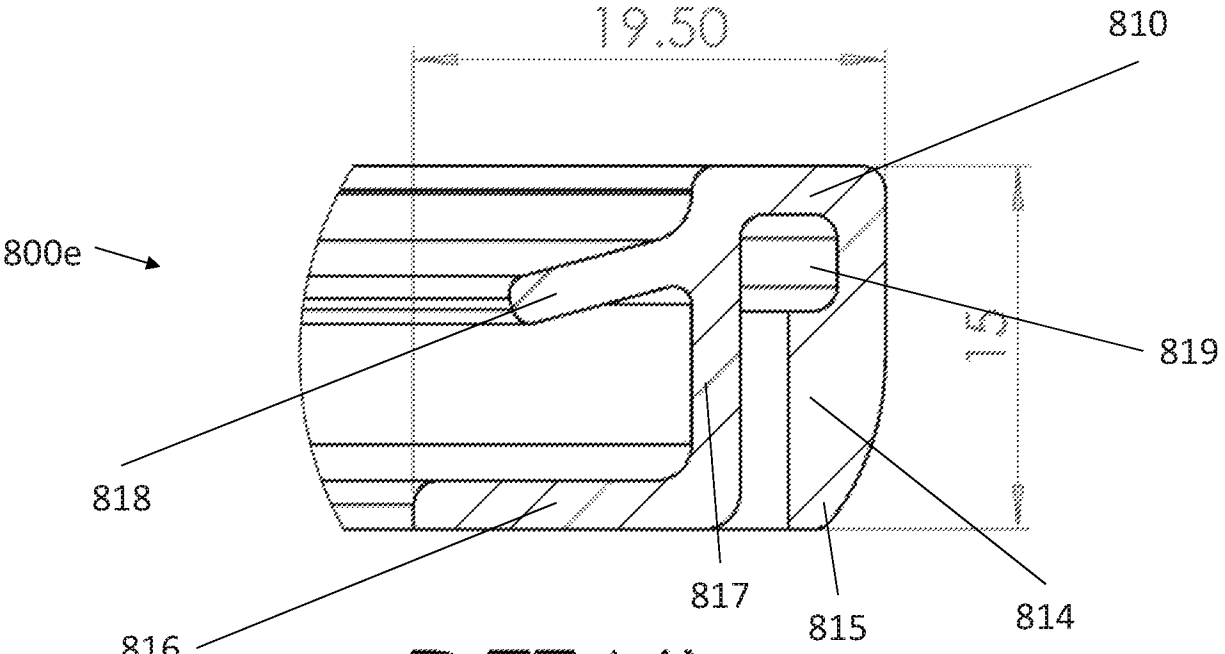

FIG. 21F shows an example embodiment of a main seal side cross-sectional detail diagram.

Figure 21H:
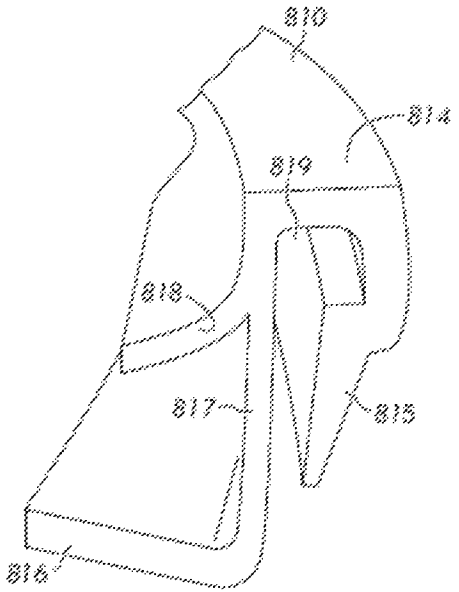
Figure 21G:
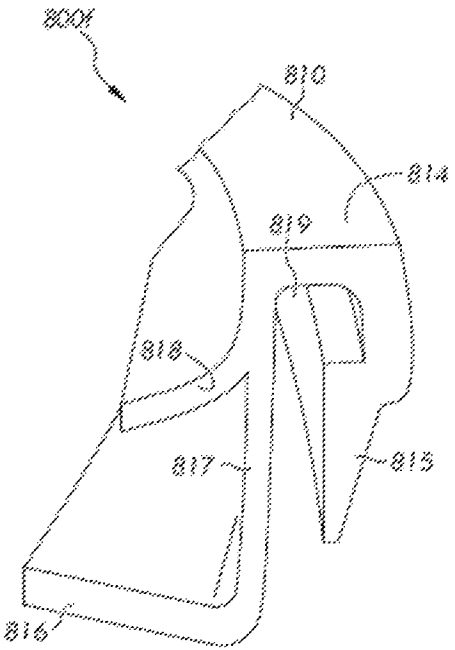

FIGS. 21G-21H show an example embodiment of two images of a main seal cross section.

Figure 22A:
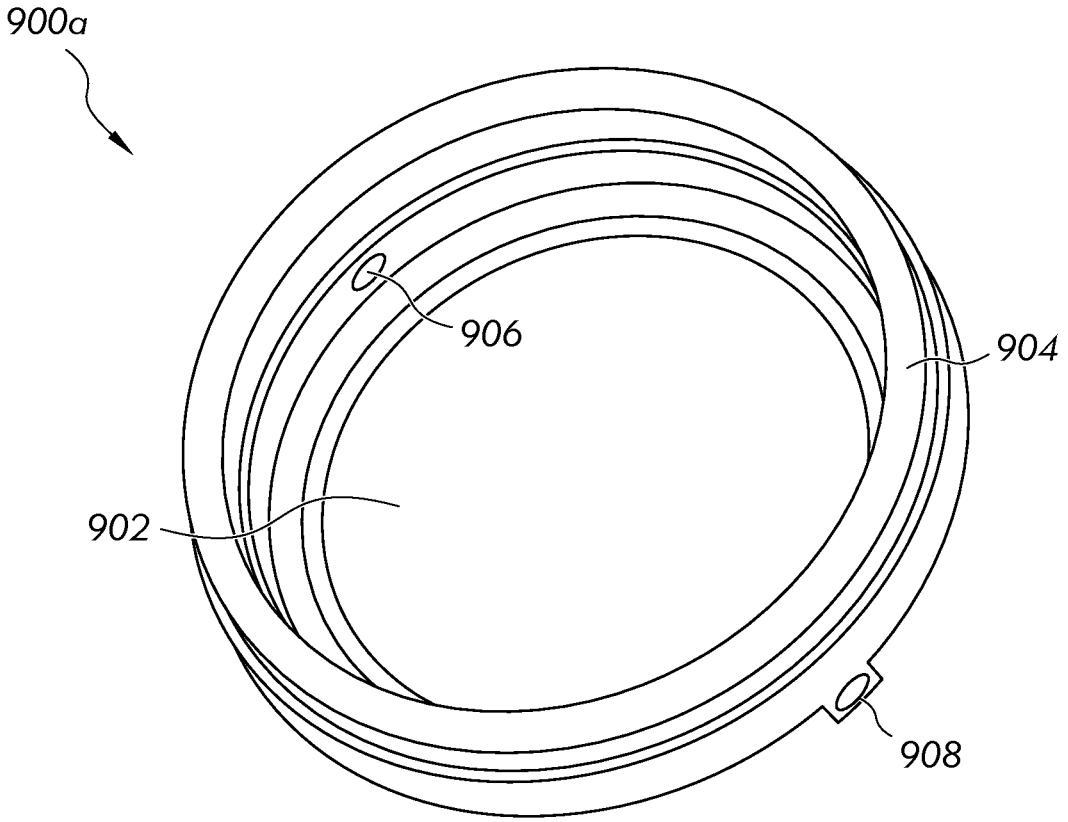

FIG. 22A shows an example embodiment image of a manifold from a top perspective view that is coupled with a main seal.

Figure 22B:
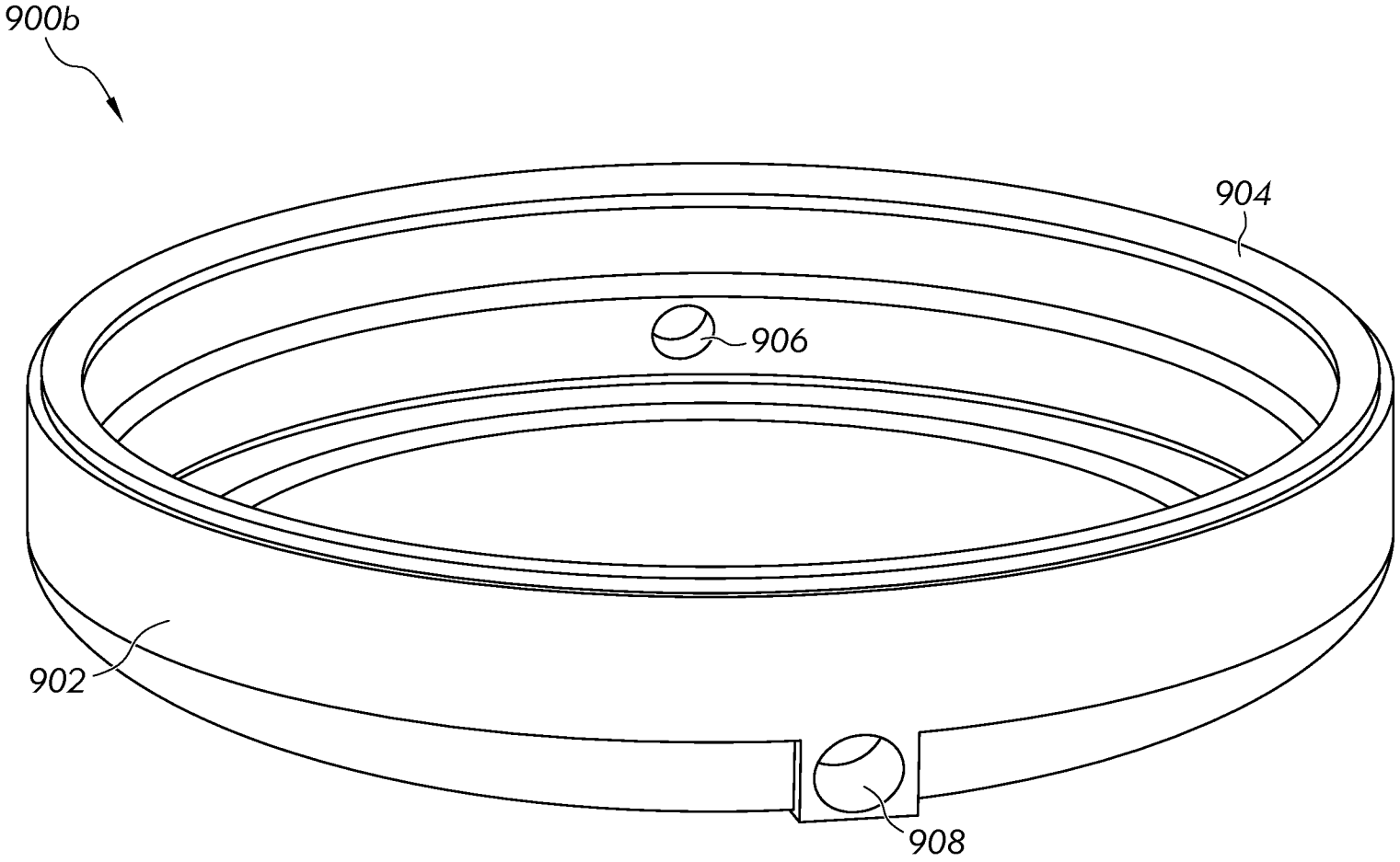
Figures 22C, 22D, 22E, 22F:
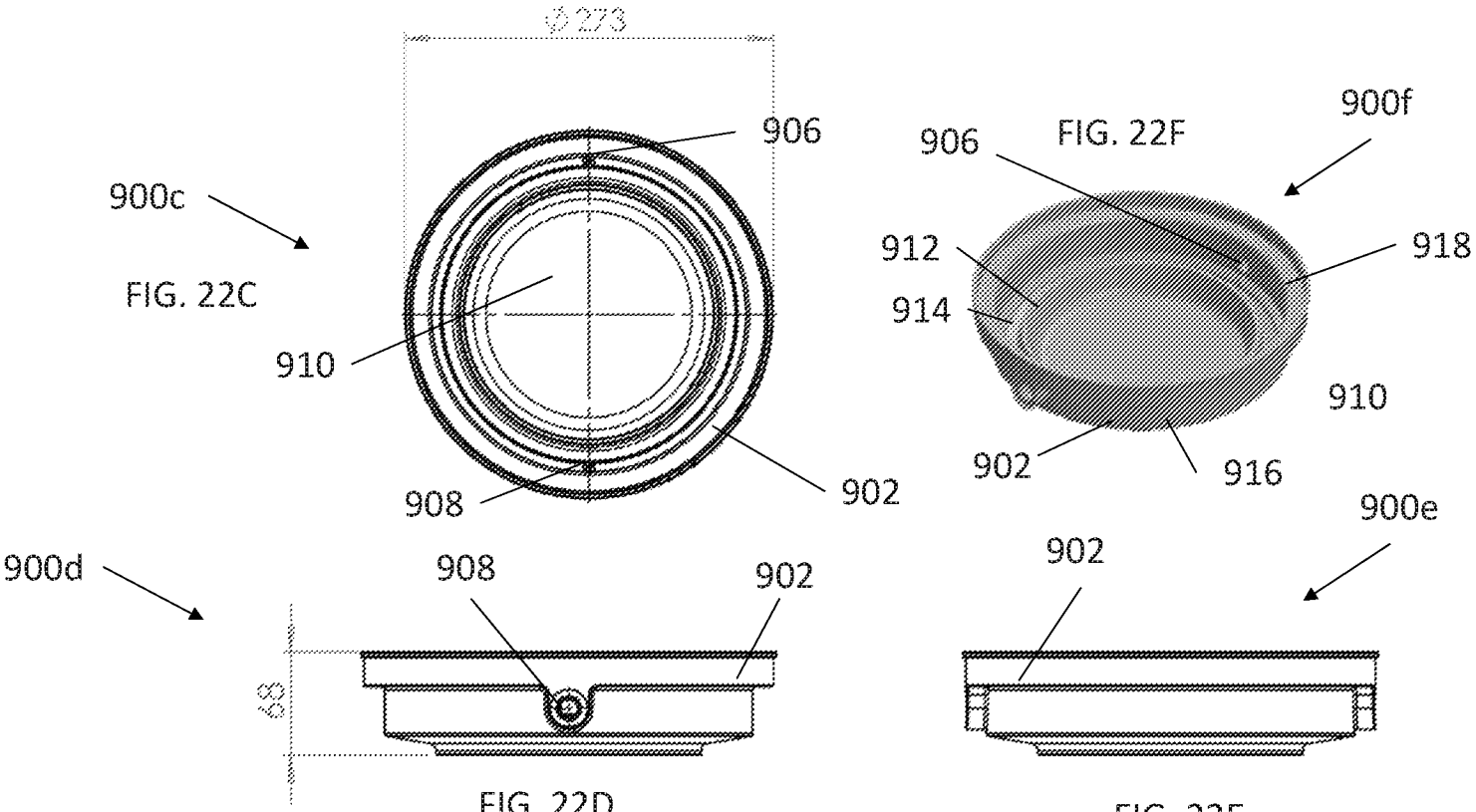

FIG. 22B shows an example embodiment image of a manifold from a side perspective view that is coupled with a main seal.

FIGS. 22C-22F show an example embodiment of a manifold top view diagram, side view diagram, side cross-sectional diagram and mockup.

FIGS. 22G-22J show an example embodiment of a bottom seal from a top view diagram, side view diagram, side cross-sectional diagram and mockup.

FIGS. 23A-23D show an example embodiment of a puck glass side diagram, bottom diagram and top diagram.

Figures 23A, 23B, 23C, 23D:
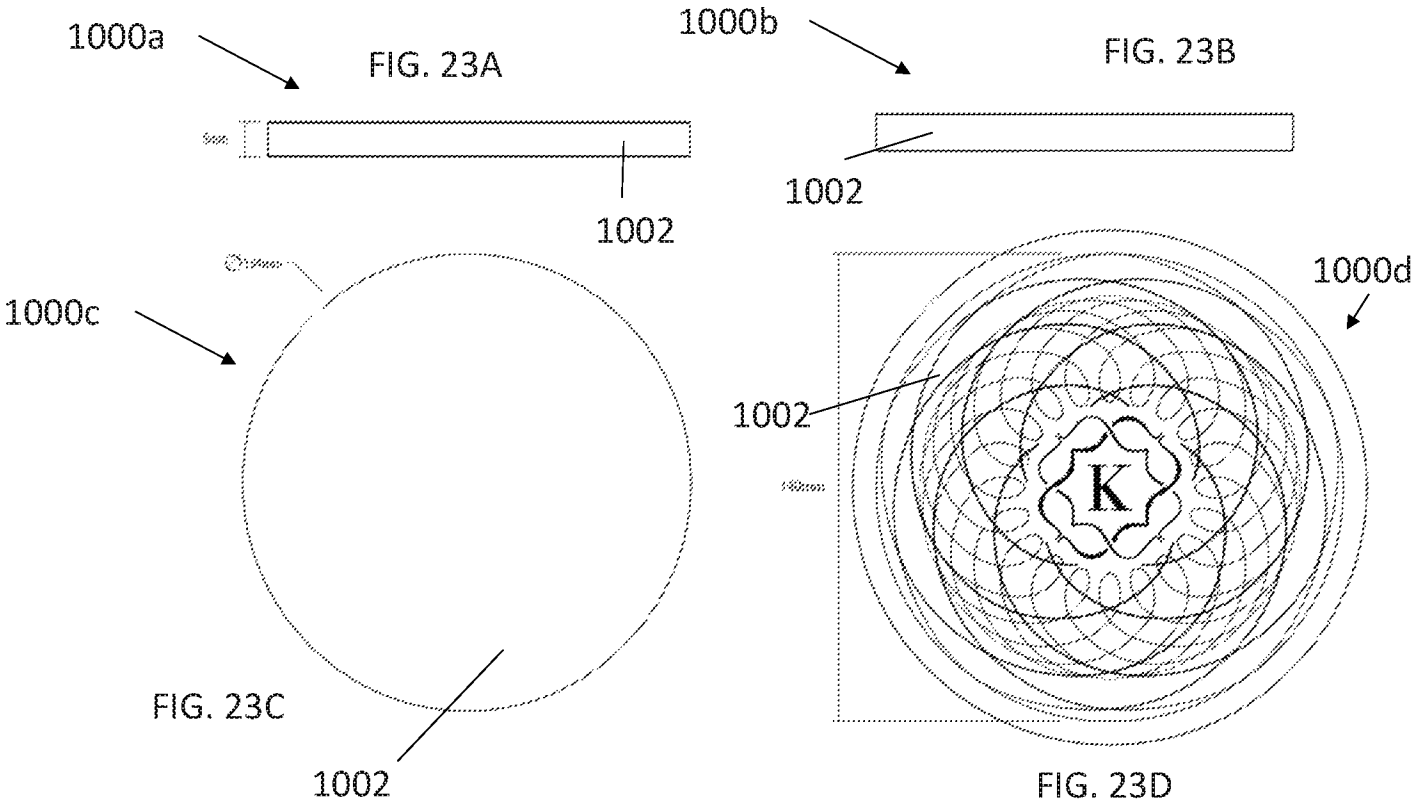
Figure 23F:
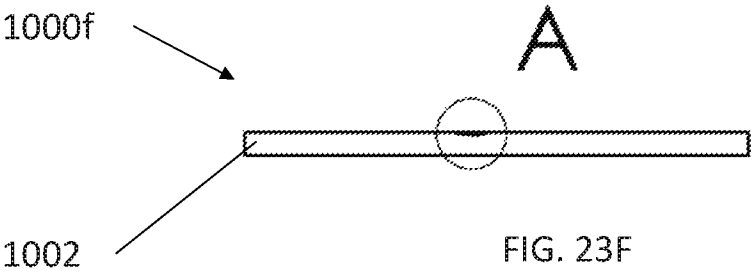
Figure 23E:
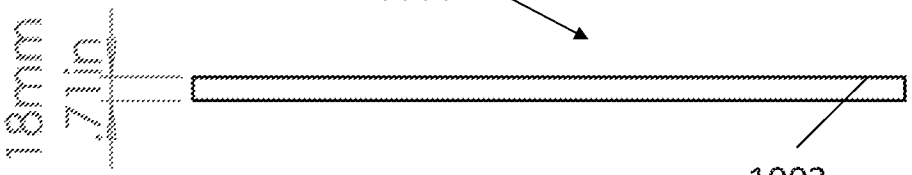

FIGS. 23E-23F show an example embodiment of puck glass side diagrams.

Figures 23G, 23H, 23I:
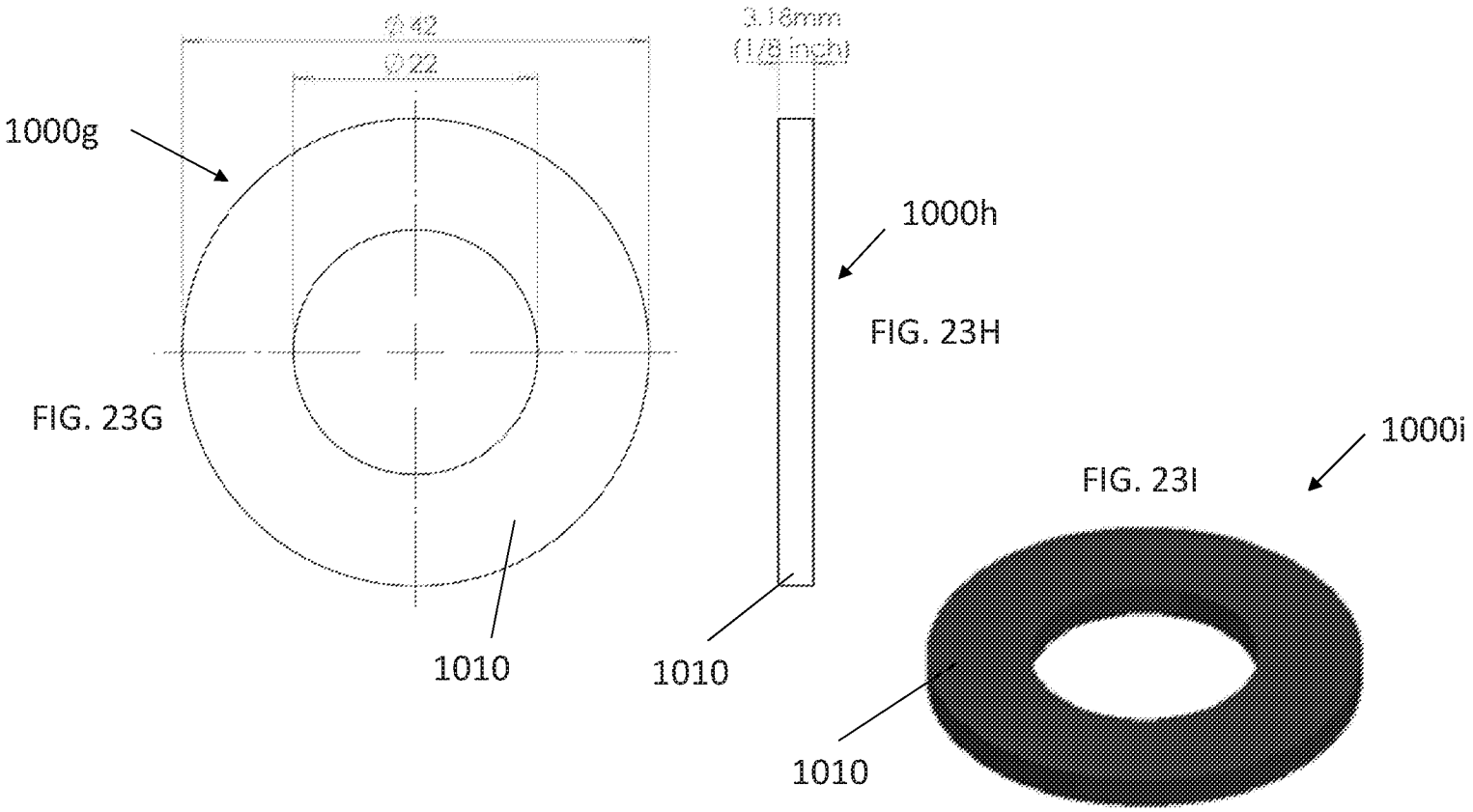

FIGS. 23G-23I show an example embodiment of a vessel gasket top view diagram, side view diagram and mockup.

Figure 23J:
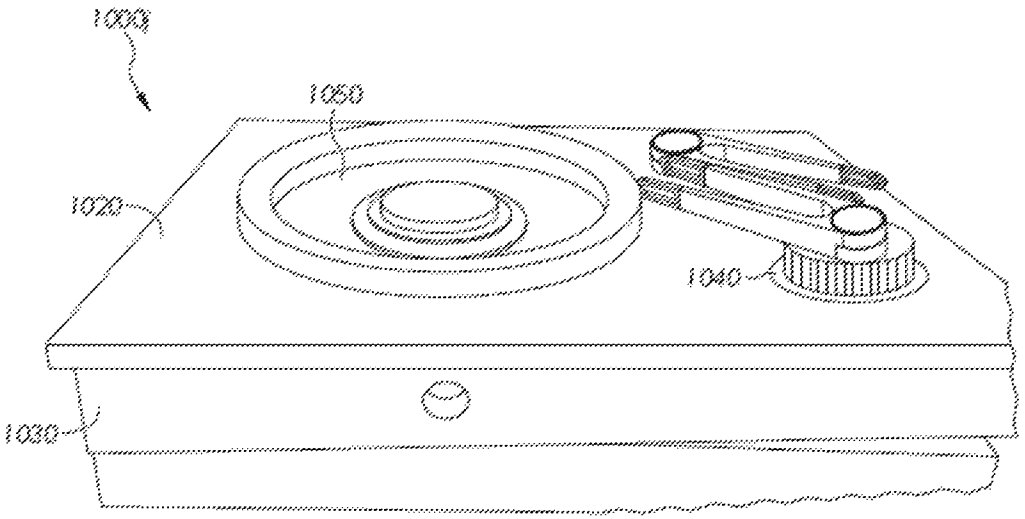
Figure 23N:
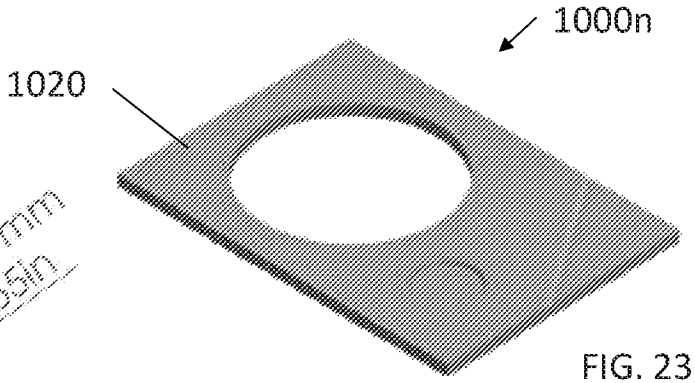
Figure 23L:
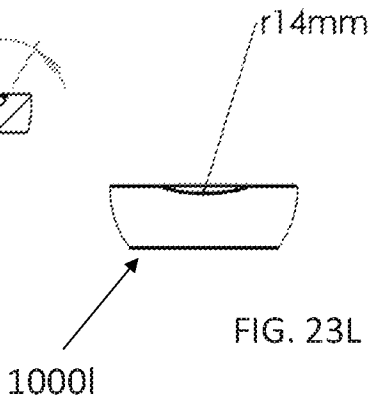
Figure 23M:
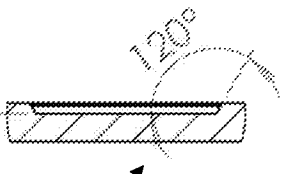
Figure 23K:
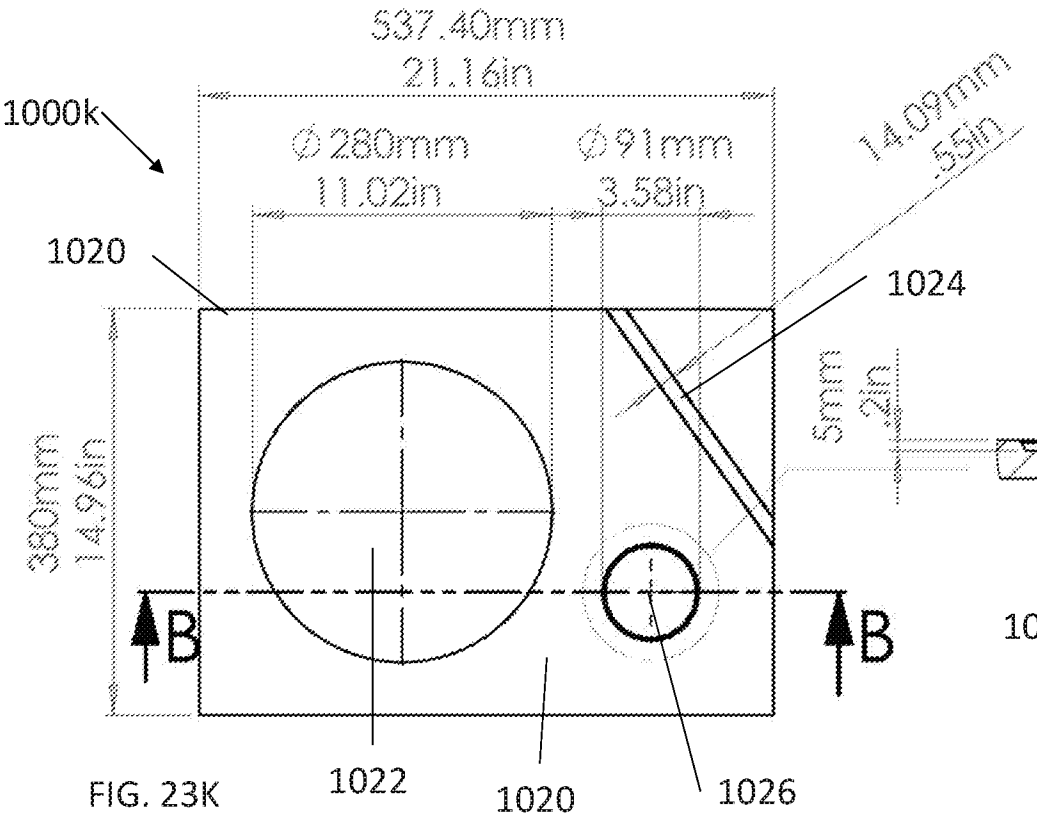

FIG. 23J shows an example embodiment of a cover image coupled with a base, ashtray and manifold.

FIGS. 23K-23N show an example embodiment of a cover top view diagram, cover channel side view diagram and cover channel side cross-sectional diagram.

FIGS. 24A-24D show an example embodiment of a purge nipple side view diagram, side cross-sectional diagram, end diagram and mockup.

Figures 24A, 24B, 24C, 24D:
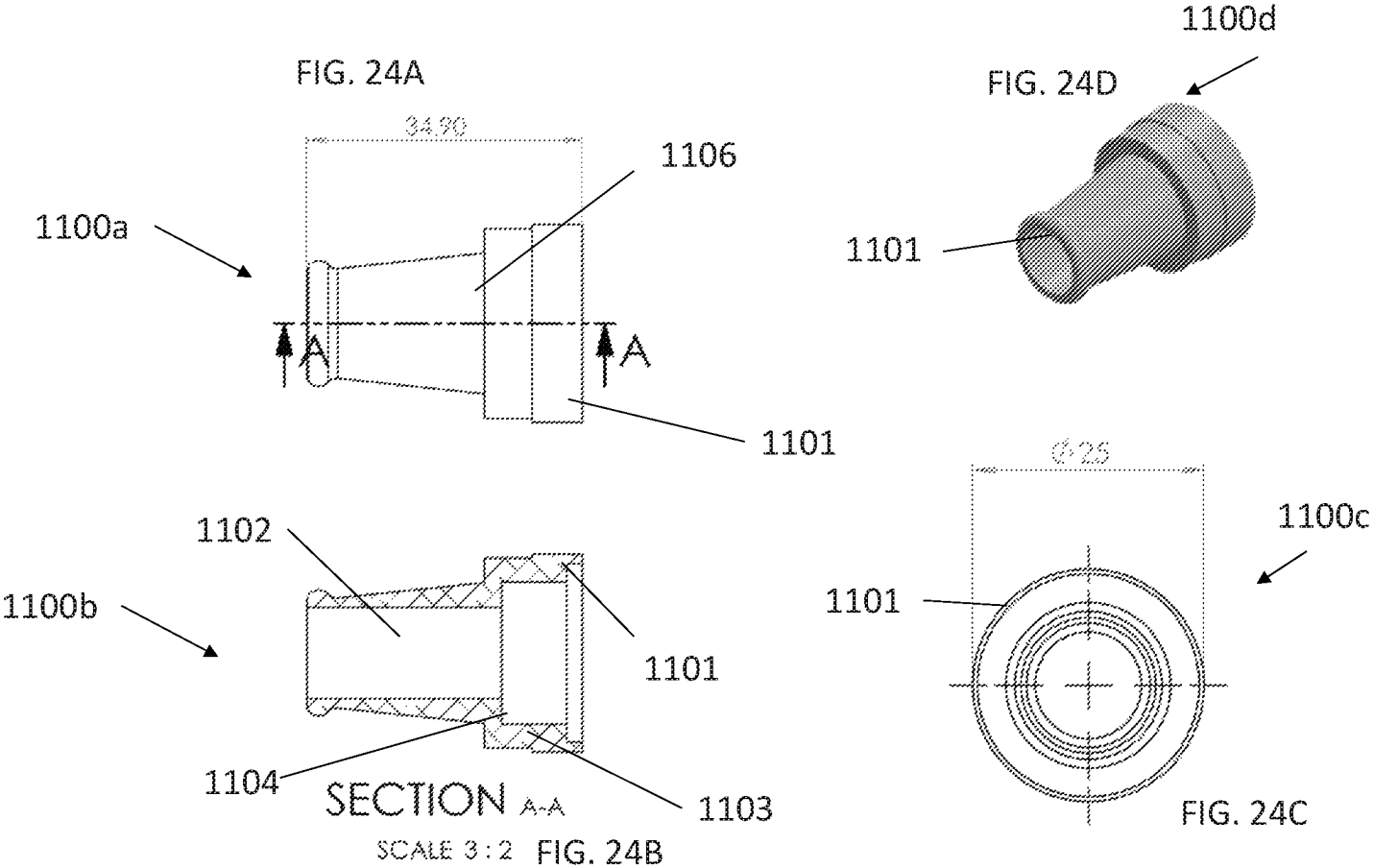
Figure 24G:
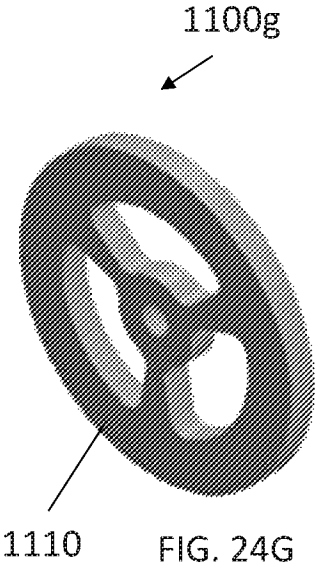
Figure 24F:
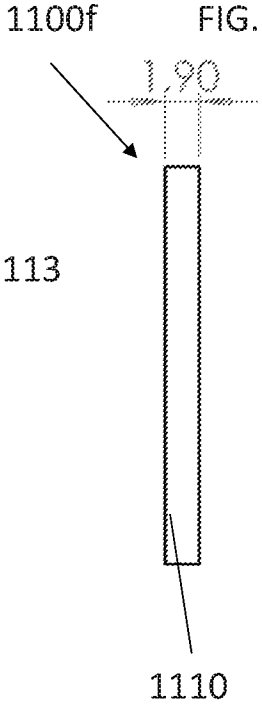
Figure 24E:
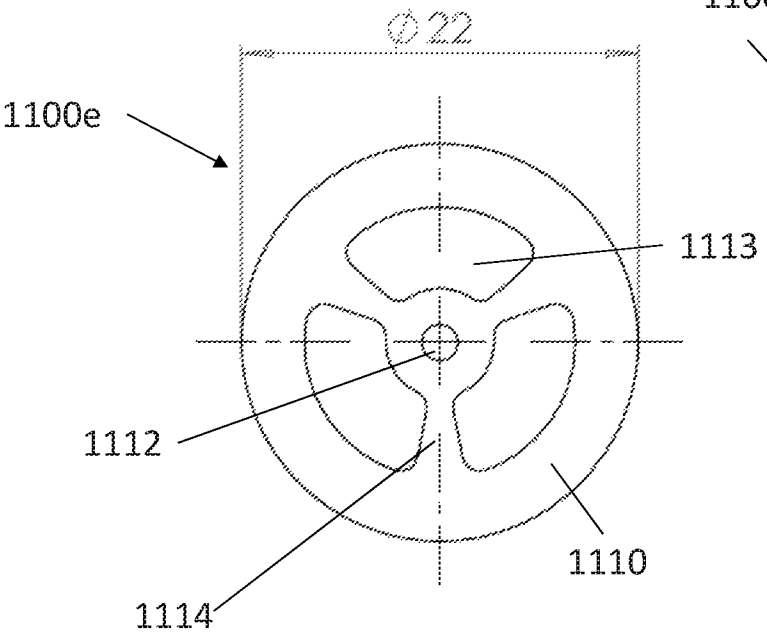
Figures 24H, 24I, 24J, 24K:
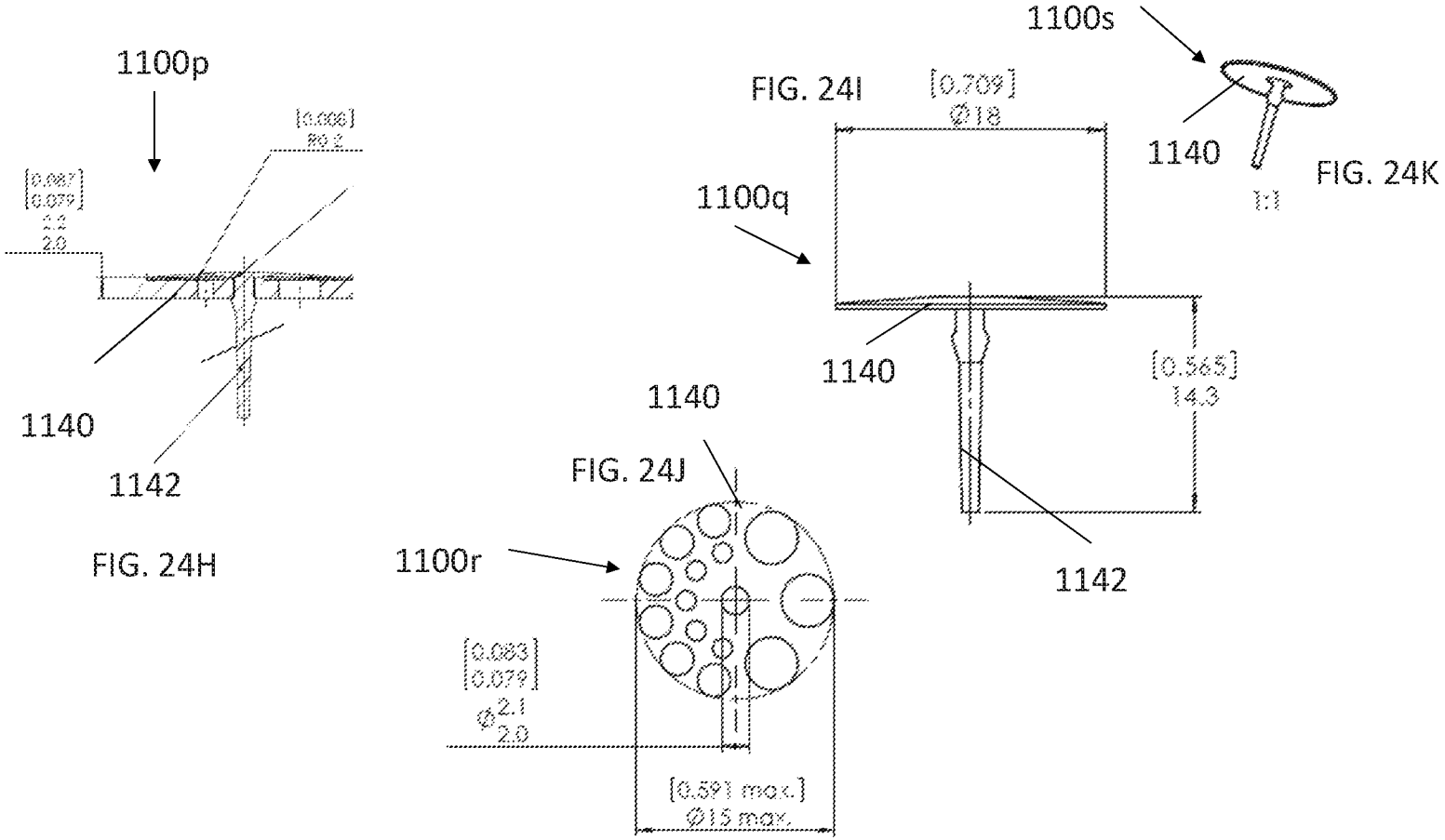

FIGS. 24E-24G show an example embodiment of a purge plate end view diagram, side diagram and mockup.

FIGS. 24H-24K show an example embodiment of an umbrella valve.

Figure 24N:
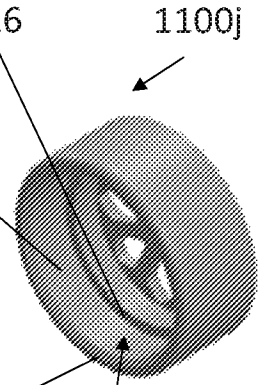
Figure 24M:
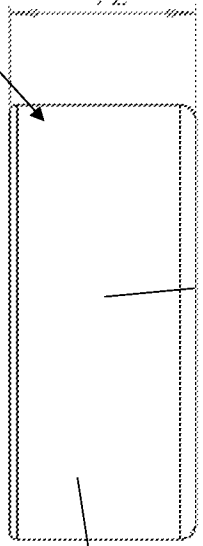
Figure 24L:
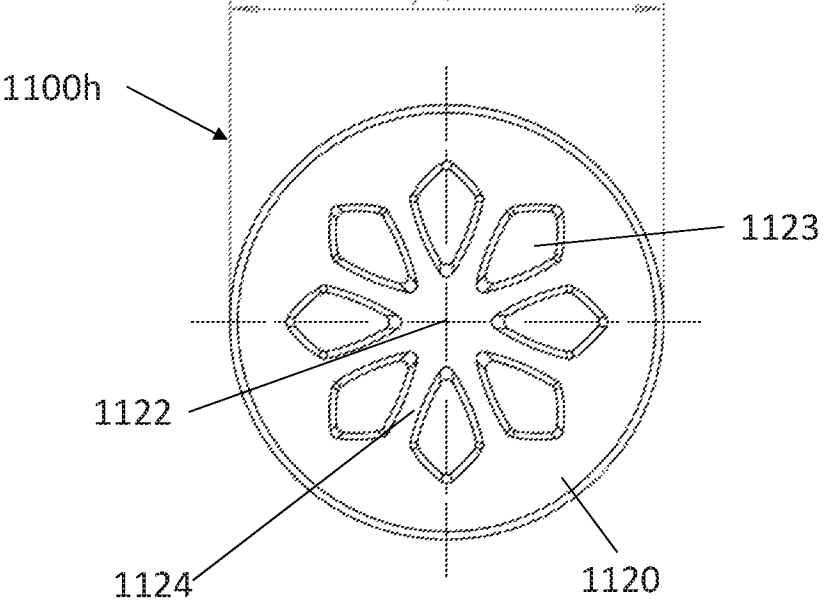
Figure 24Q:
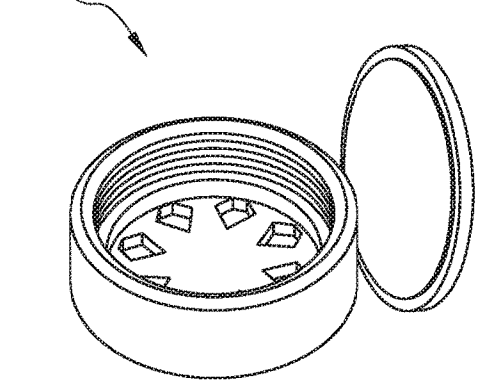

FIGS. 24L-24N show an example embodiment of a purge cap end view diagram, side view diagram and mockup.

Figure 24S:
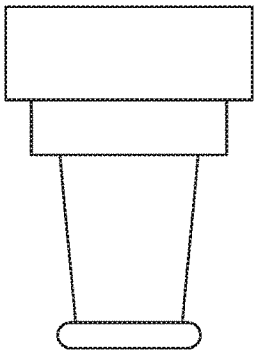
Figure 24P:
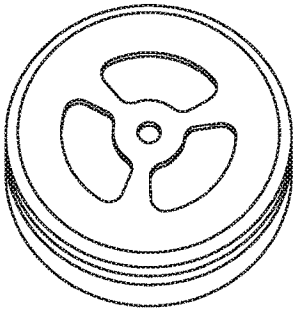
Figure 24R:
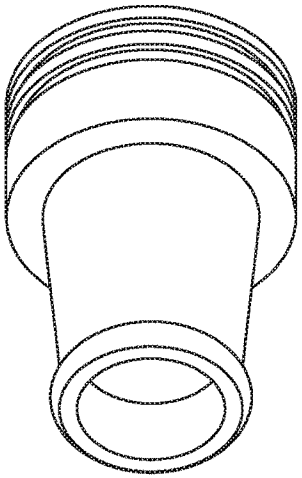
Figure 24O:
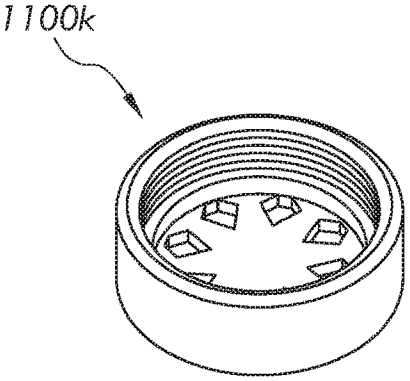

FIGS. 240-24S show an example embodiment of a fully assembled and disassembled purge valve assembly.

Figure 25A:
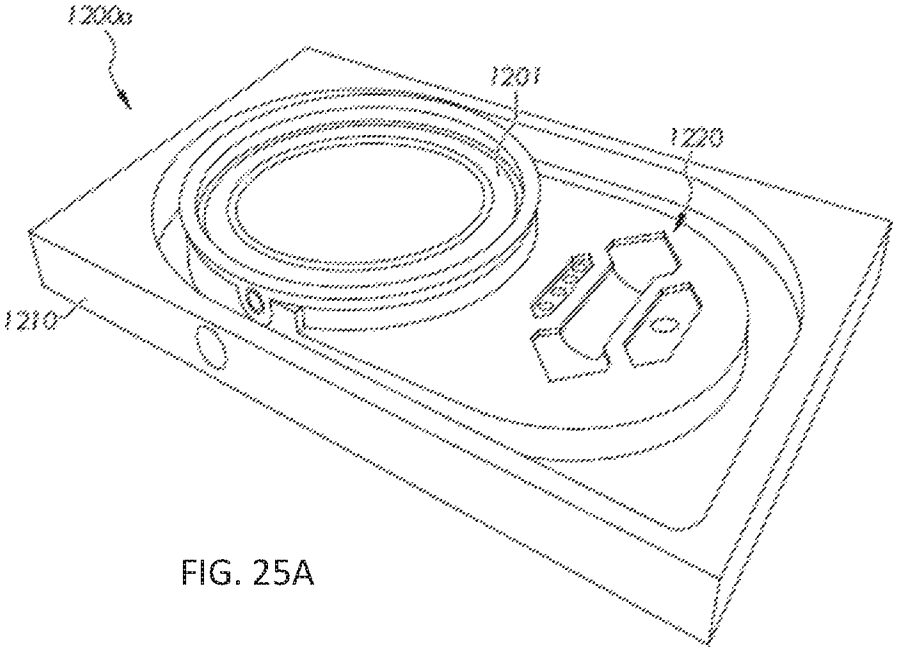

FIG. 25A shows an example embodiment of a tray coupled with a manifold in an image from a perspective view.

Figure 25D:
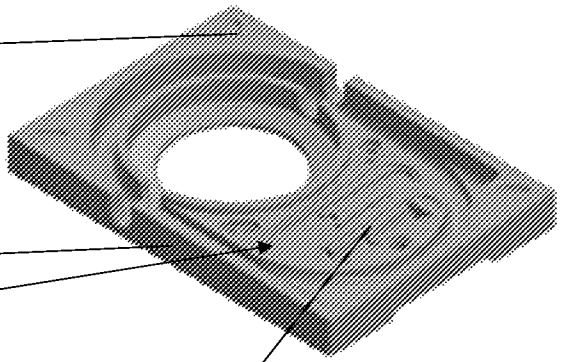
Figure 25C:
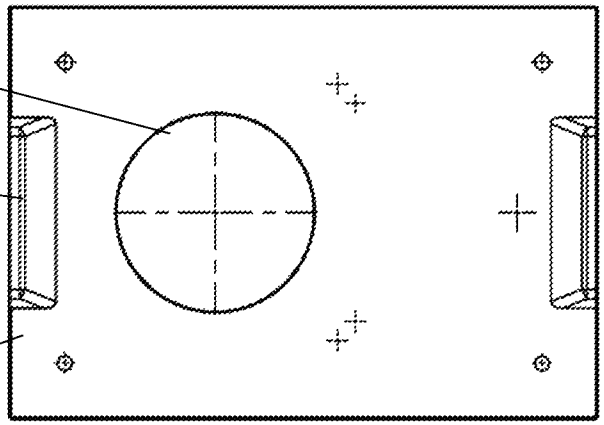
Figure 25B:
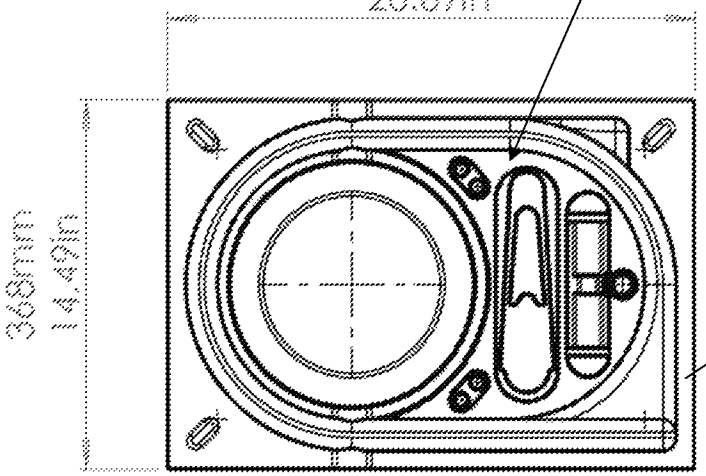

FIGS. 25B-25D show an example embodiment of a tray from a top view diagram, bottom view diagram and mockup.

Figure 25F:
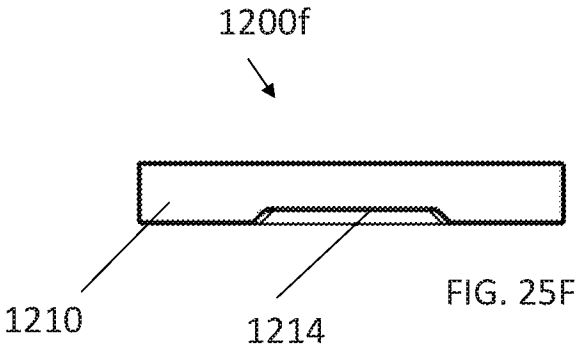
Figure 25E:
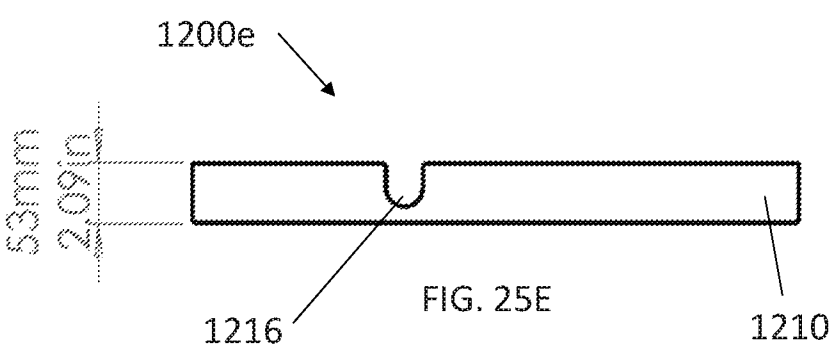
Figure 25J:
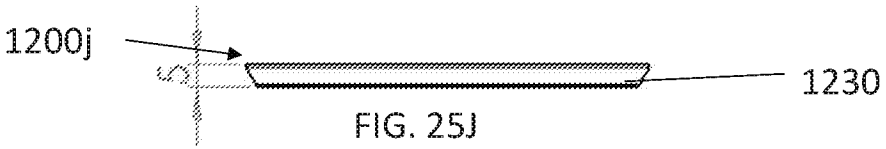
Figure 25K:
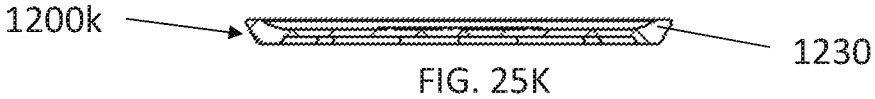
Figure 25H:
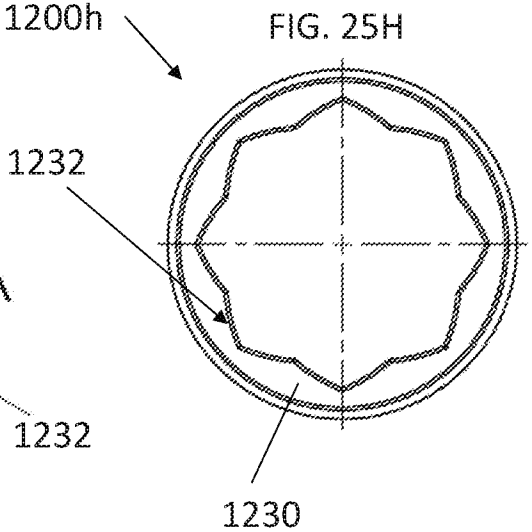
Figure 25G:
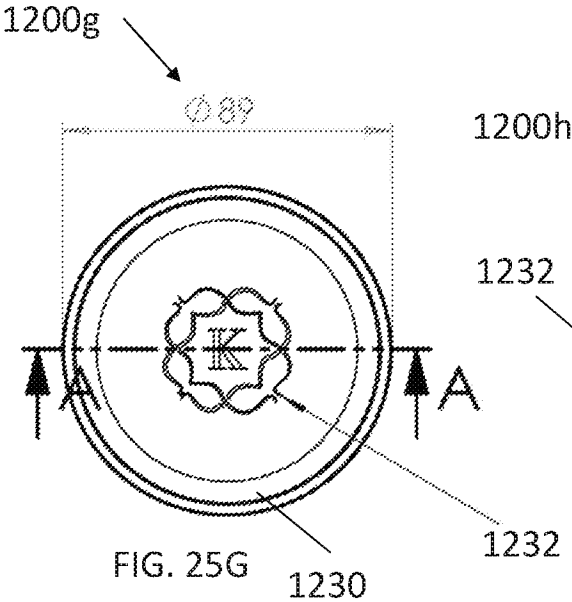
Figure 25I:
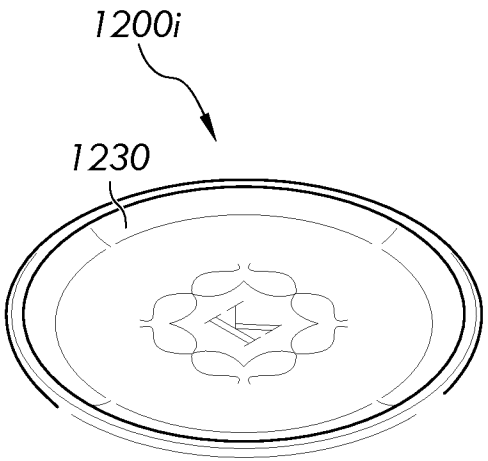

FIGS. 25E-25F show an example embodiment of a tray from a lengthwise side diagram view and widthwise side diagram view.

FIG. 25G-25K show an example embodiment of an ash tray from a side diagram view, side-cross sectional diagram view, top diagram view, bottom diagram view and mockup.

Figure 26A:
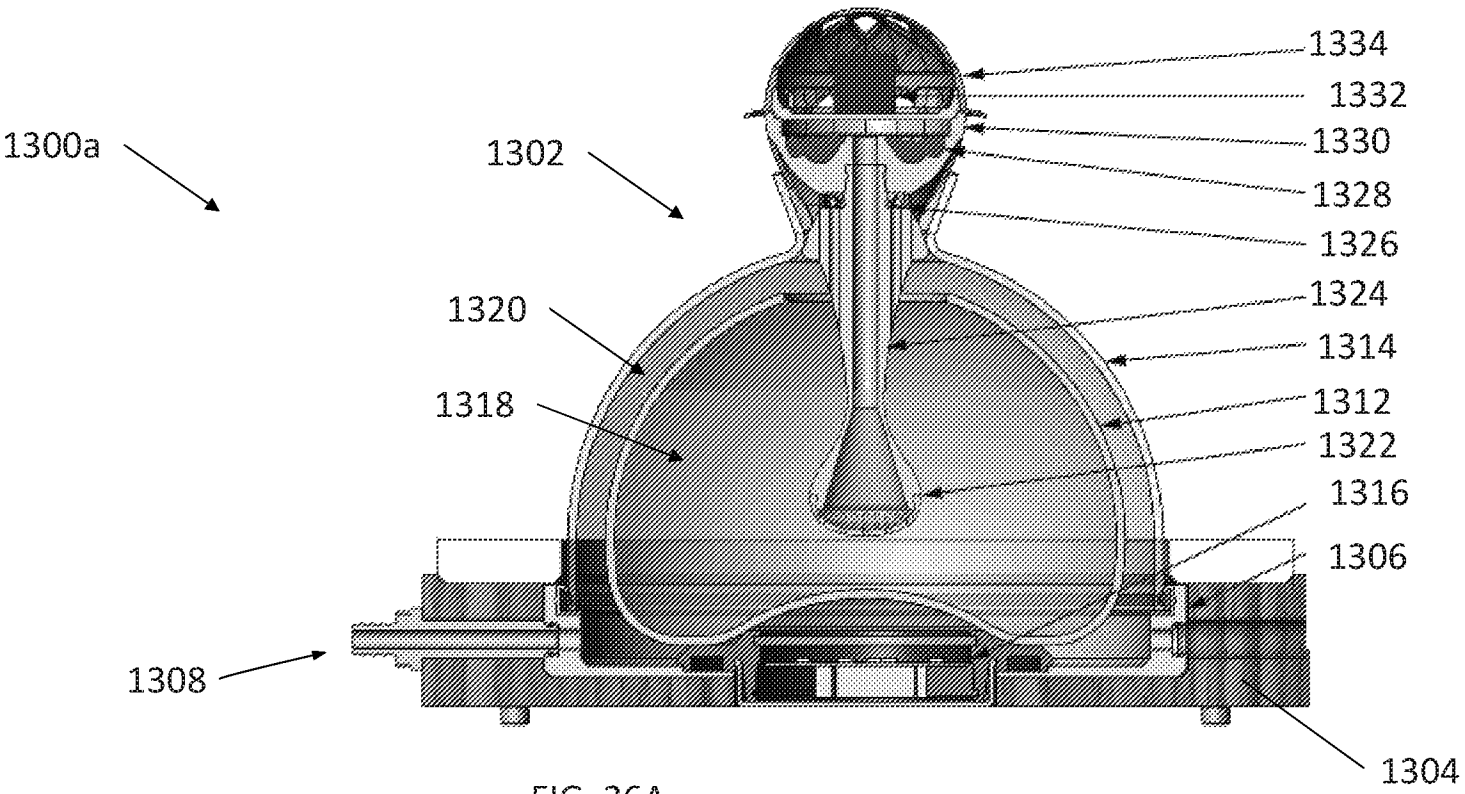

FIG. 26A shows an example embodiment a side cross-sectional diagram view of a domed water pipe with supporting tray.

Figure 26B:
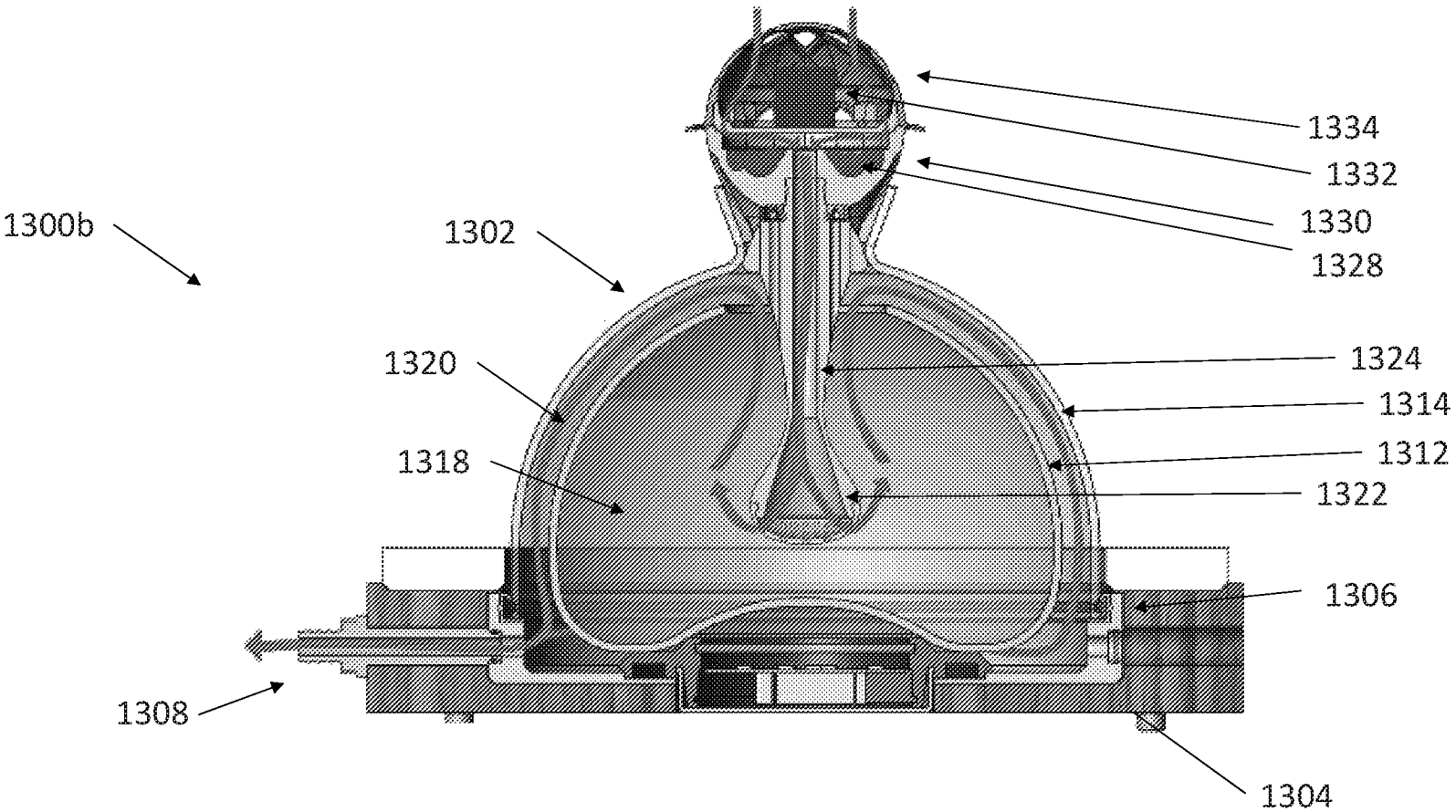

FIG. 26B shows an example embodiment of a side cross-sectional diagram view domed water pipe with supporting tray including an intake airflow cycle.

Figure 26C:
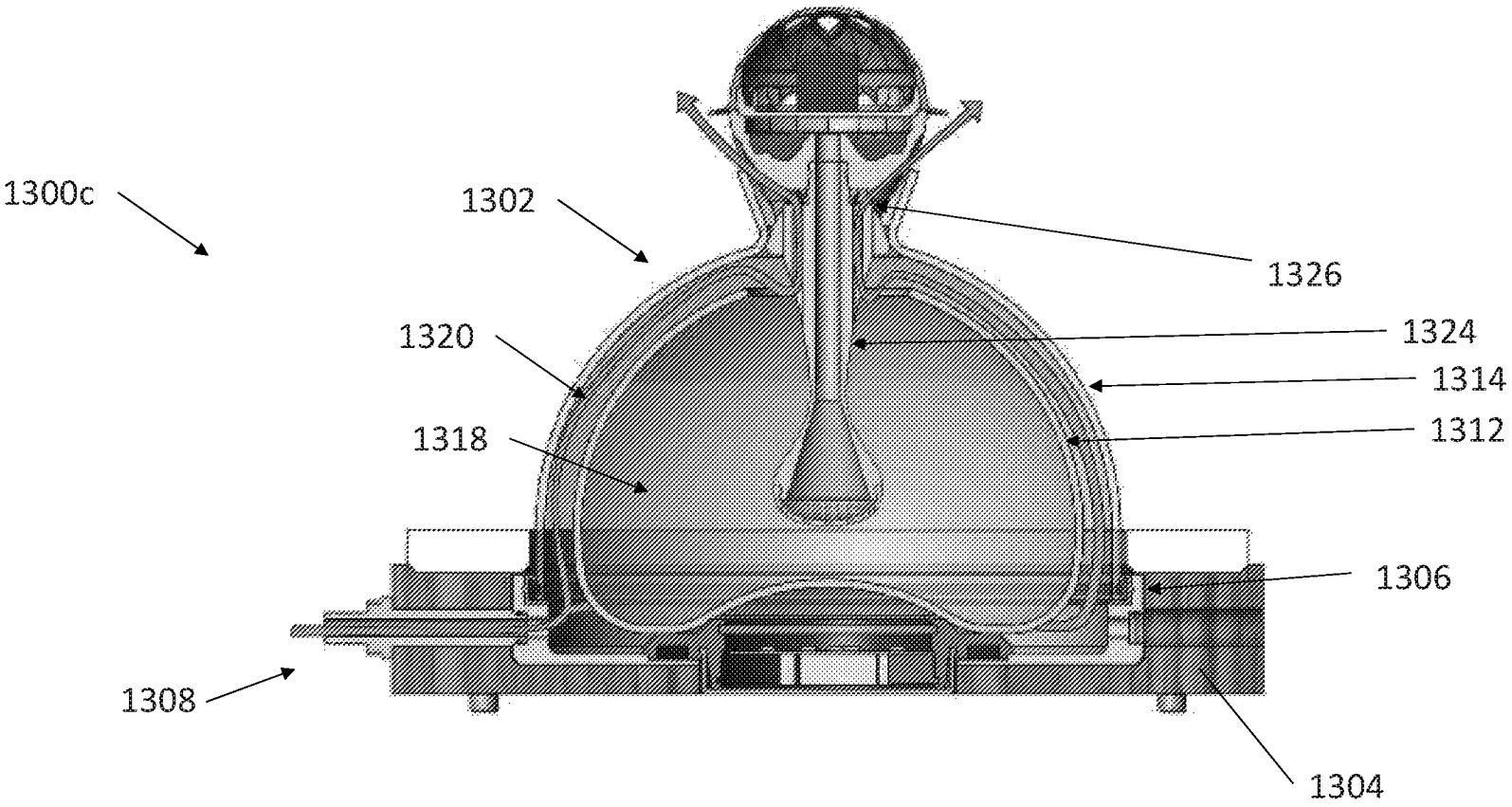

FIG. 26C shows an example embodiment of a side cross-sectional diagram view domed water pipe with supporting tray including a first purge airflow cycle.

Figure 26D:
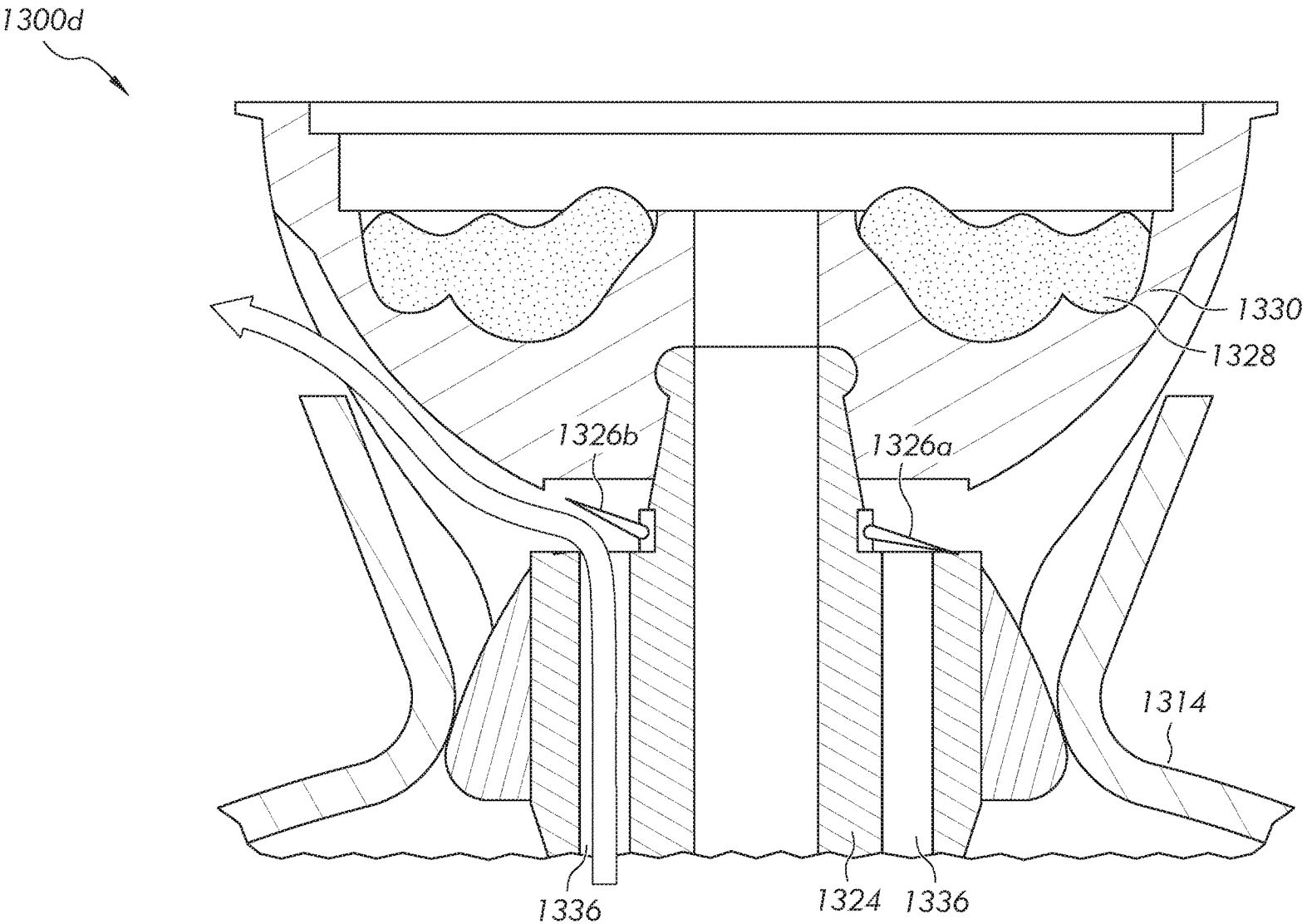

FIG. 26D shows an example embodiment of a side cross-sectional diagram view of domed water pipe head purge detail of a head area.

Figure 26E:
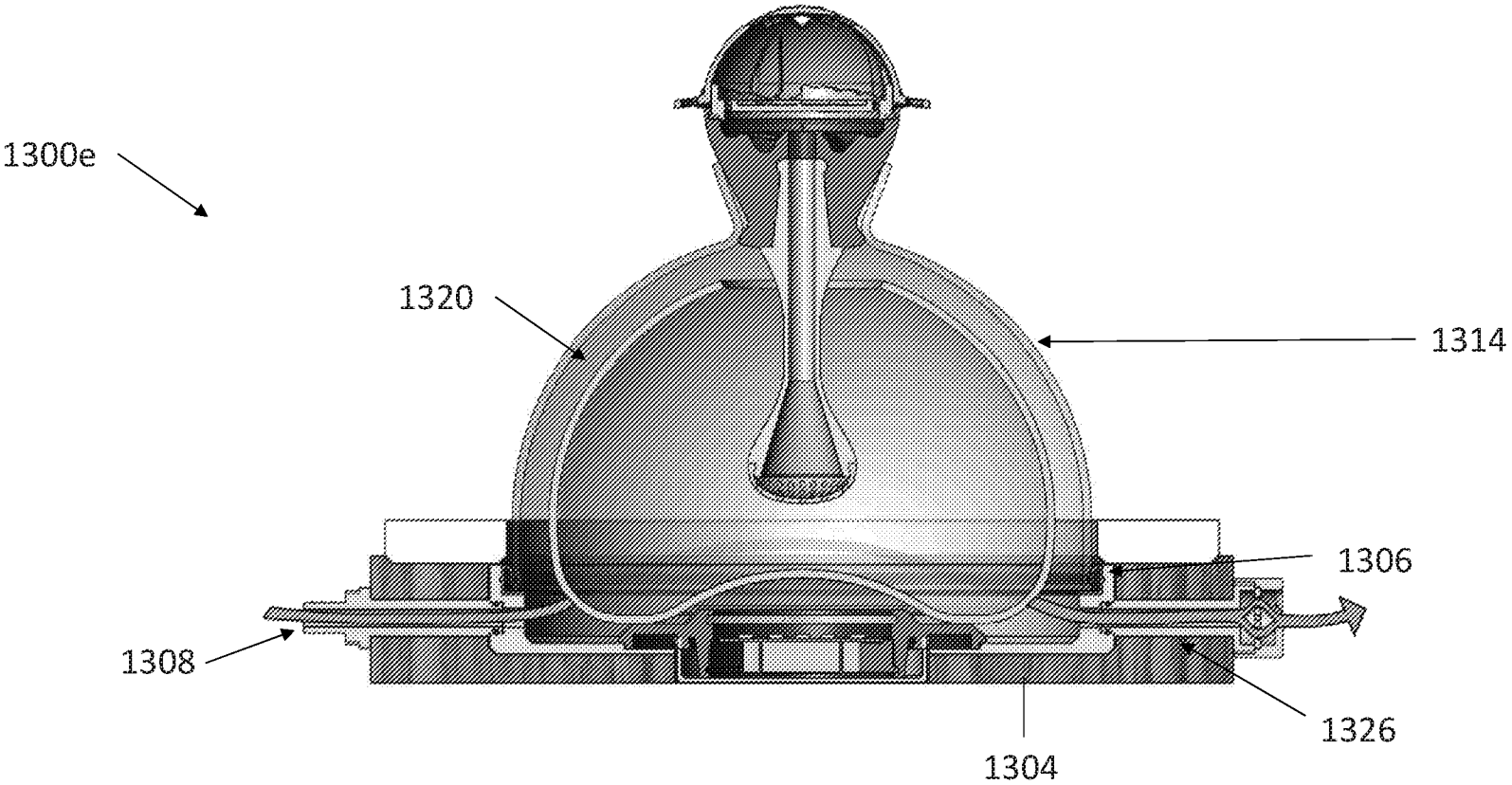

FIG. 26E shows an example embodiment of a side cross-sectional diagram view of domed water pipe with supporting tray including a second purge airflow cycle.

Figure 27A:
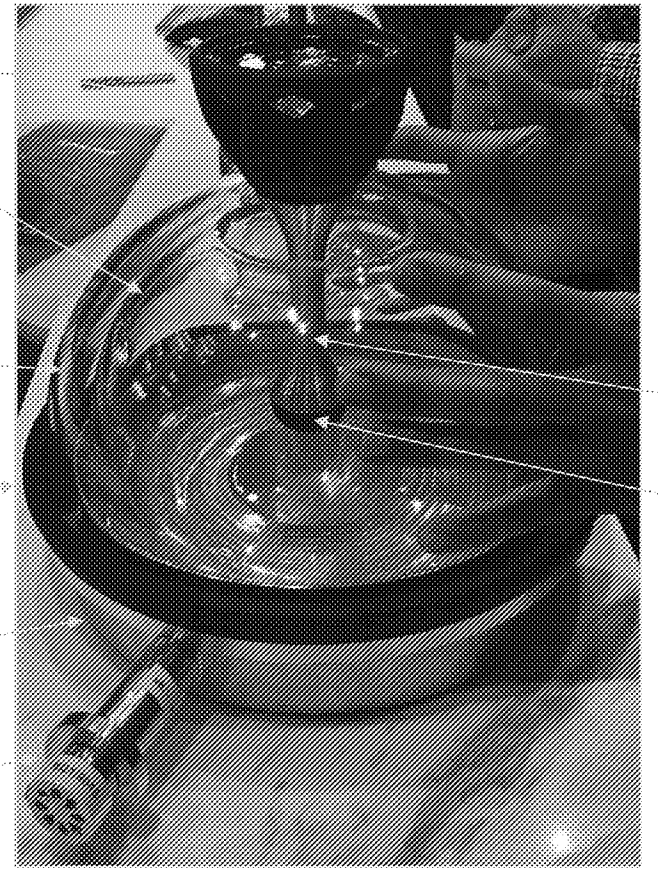

FIG. 27A shows an example embodiment a view of a domed water pipe.

Figure 27B:
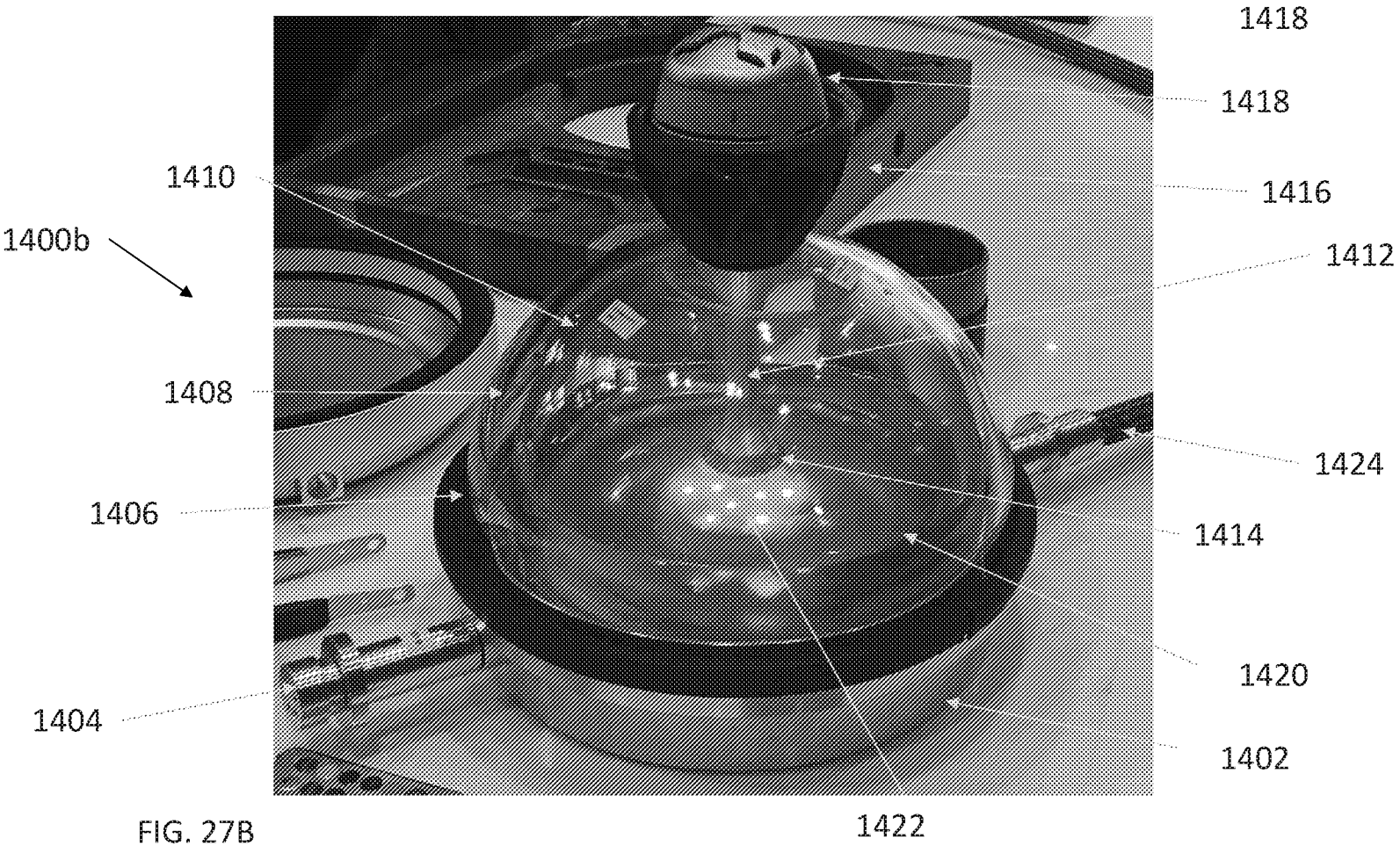

FIG. 27B shows an example embodiment a view of a domed water pipe with functional LED puck turned on.

Figure 27C:
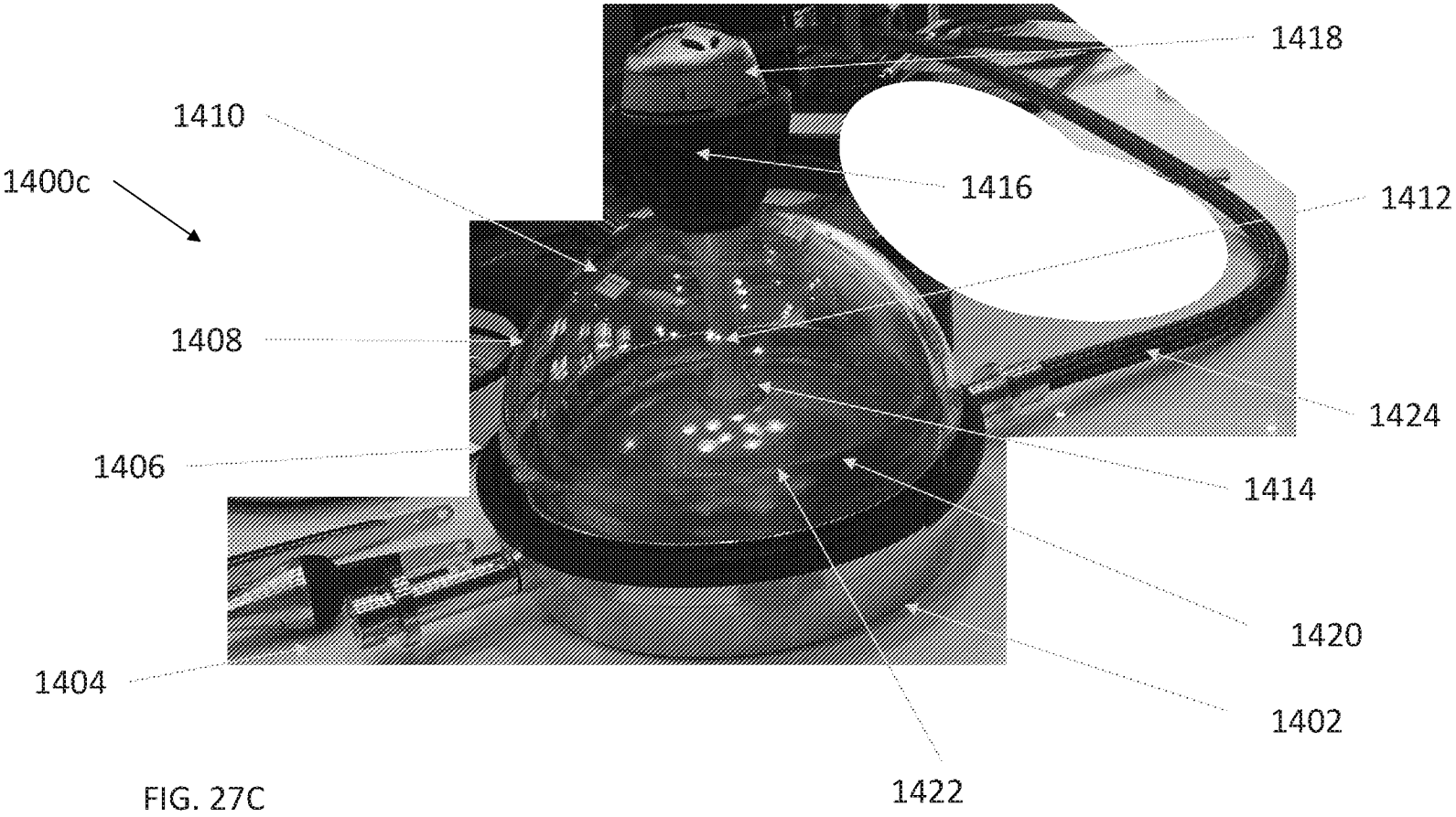

FIG. 27C shows an example embodiment a view of a domed water pipe with functional LED puck turned on.

Figure 27D:
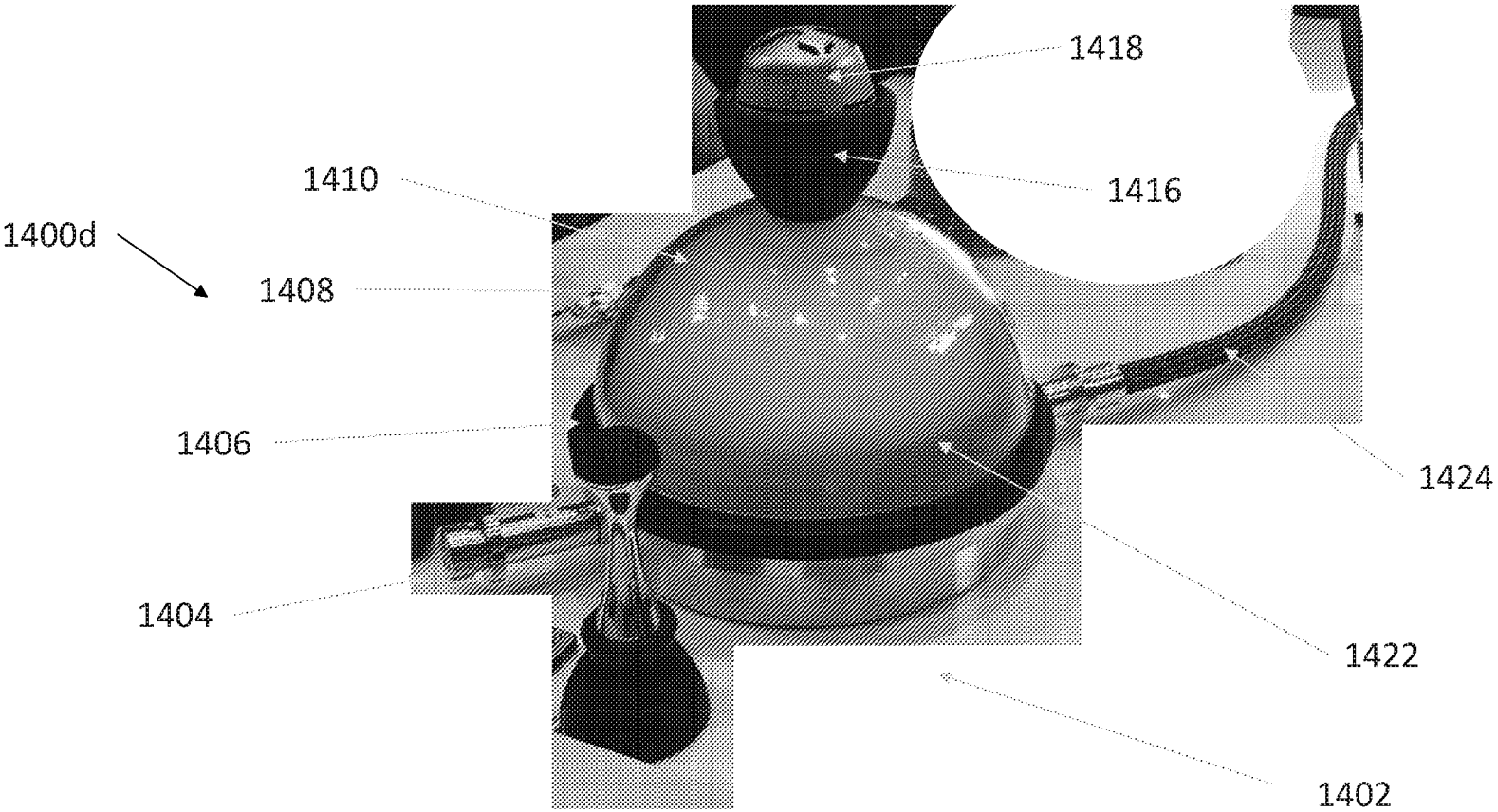

FIG. 27D shows an example embodiment a view of a domed water pipe with functional LED puck turned on and smoke inside the outer vessel.

Figure 27E:
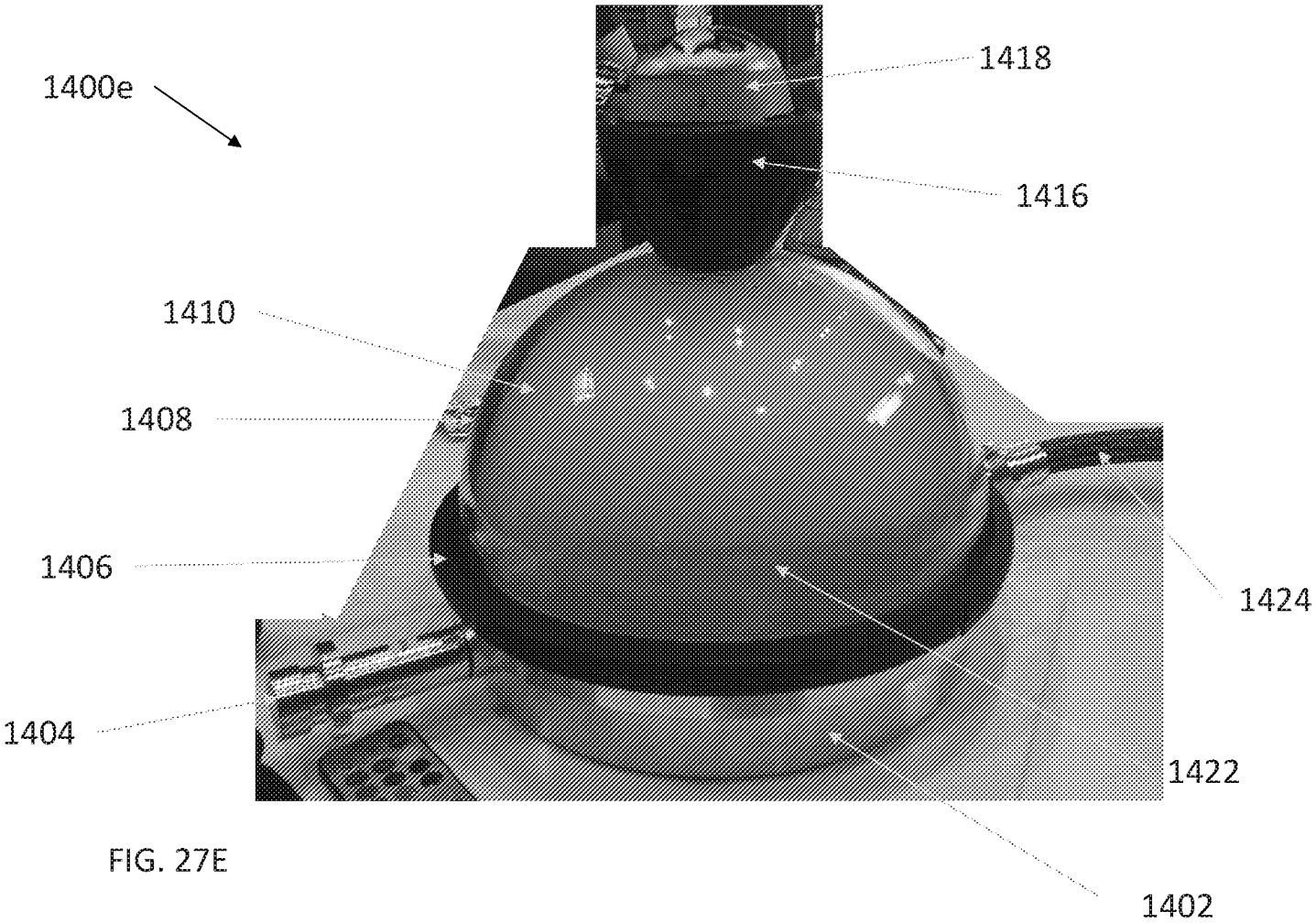

FIG. 27E shows an example embodiment a view of a domed water pipe with functional LED puck turned on and smoke inside the outer vessel.

Figure 28B:
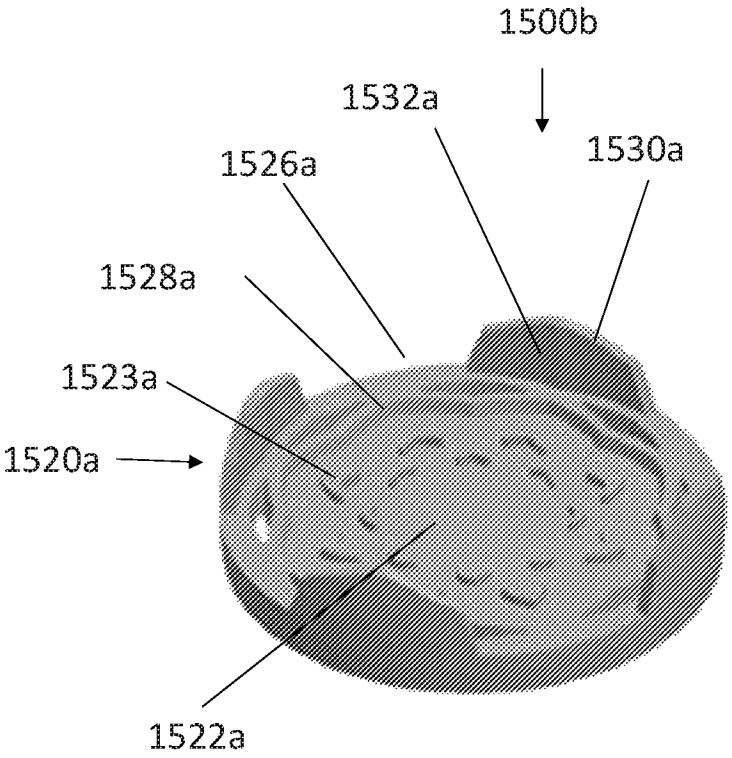
Figure 28A:
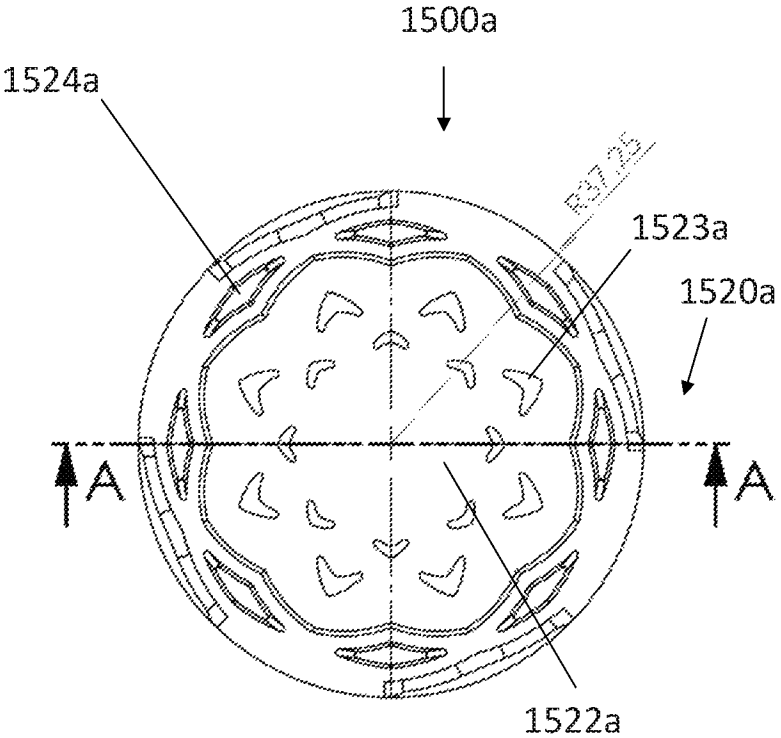

FIGS. 28A-28B show an example embodiment of a heat management device base plate from a top view diagram and mockup.

Figures 28C, 28D:
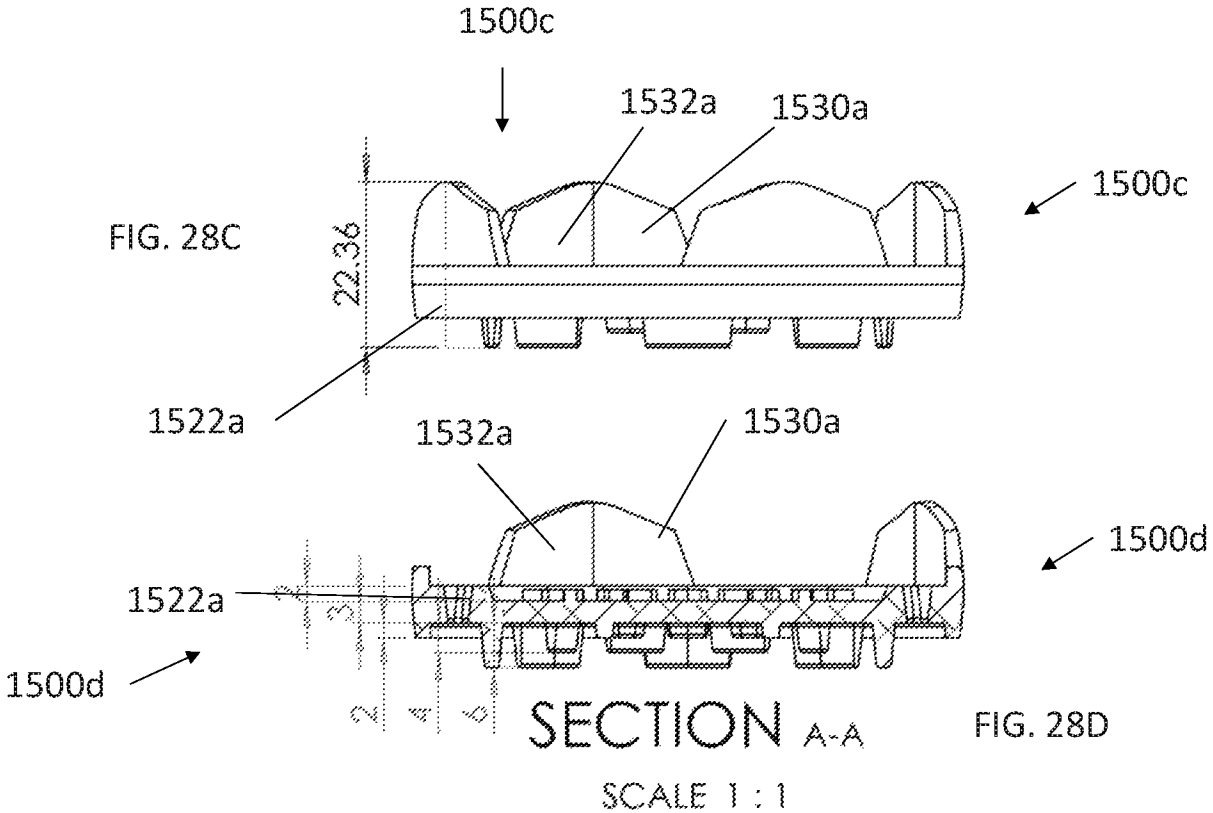

FIGS. 28C-28D show an example embodiment of a heat management device base plate from a side view diagram and side cross-sectional diagram.

Figure 28F:
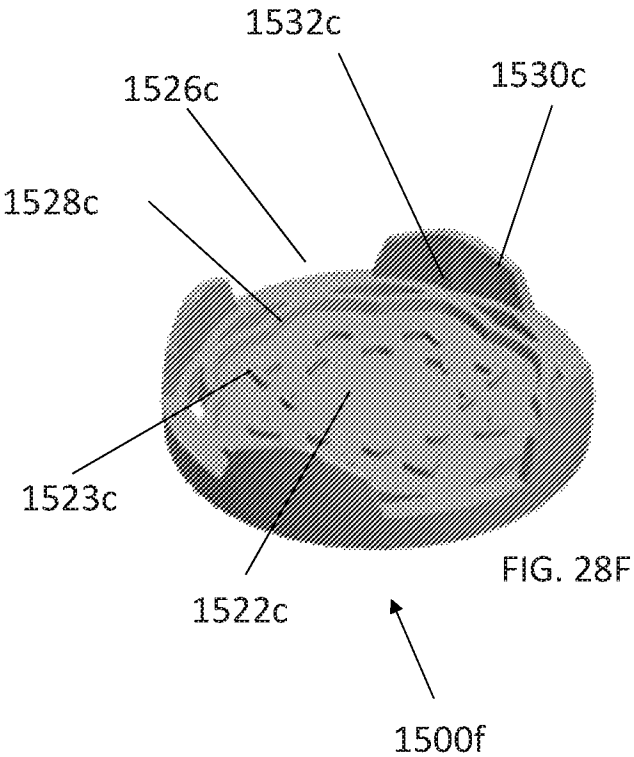
Figure 28E:
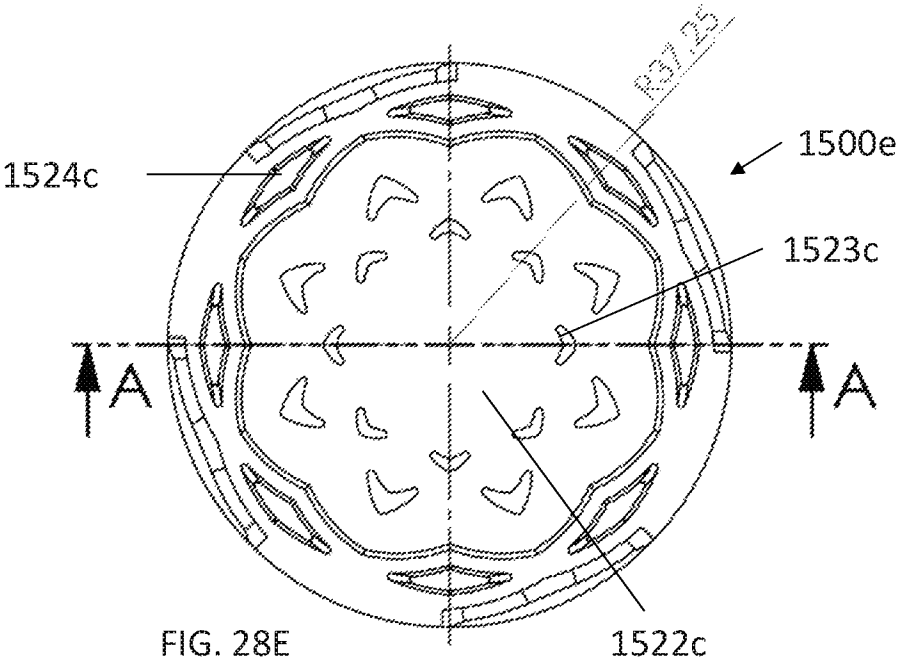

FIGS. 28E-28F show an example embodiment of a heat management device base plate from a top view diagram and mockup.

Figure 28G:
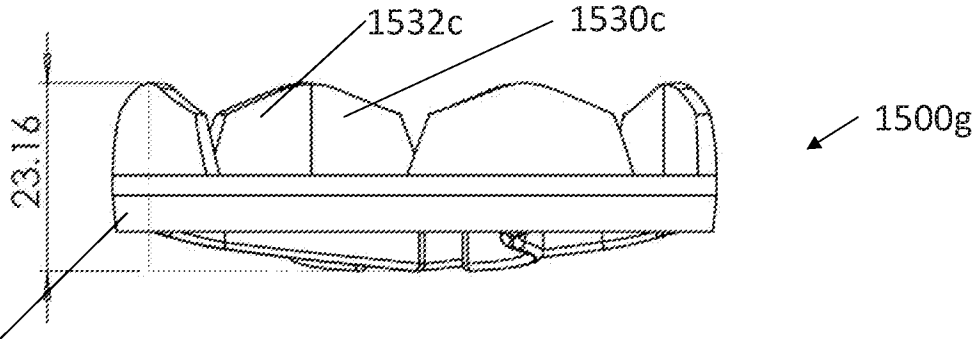
Figure 28H:
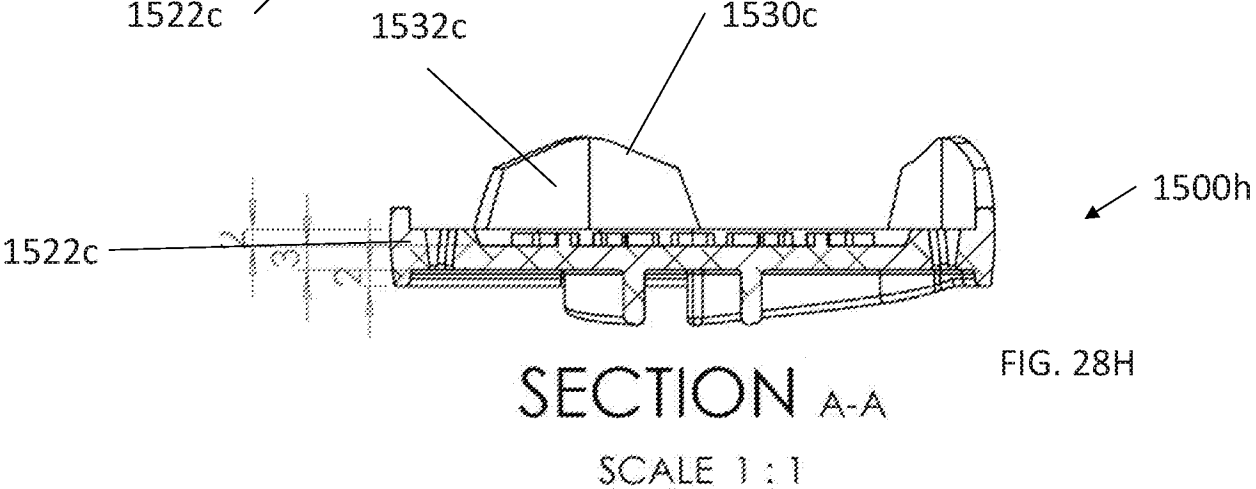

FIGS. 28G-28H show an example embodiment of a heat management device base plate from a side view diagram and side cross-sectional diagram.

Figure 28J:
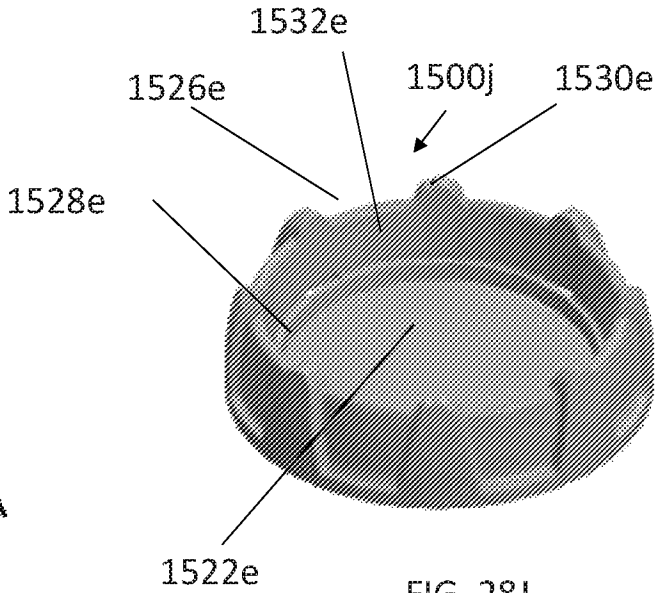
Figure 28I:
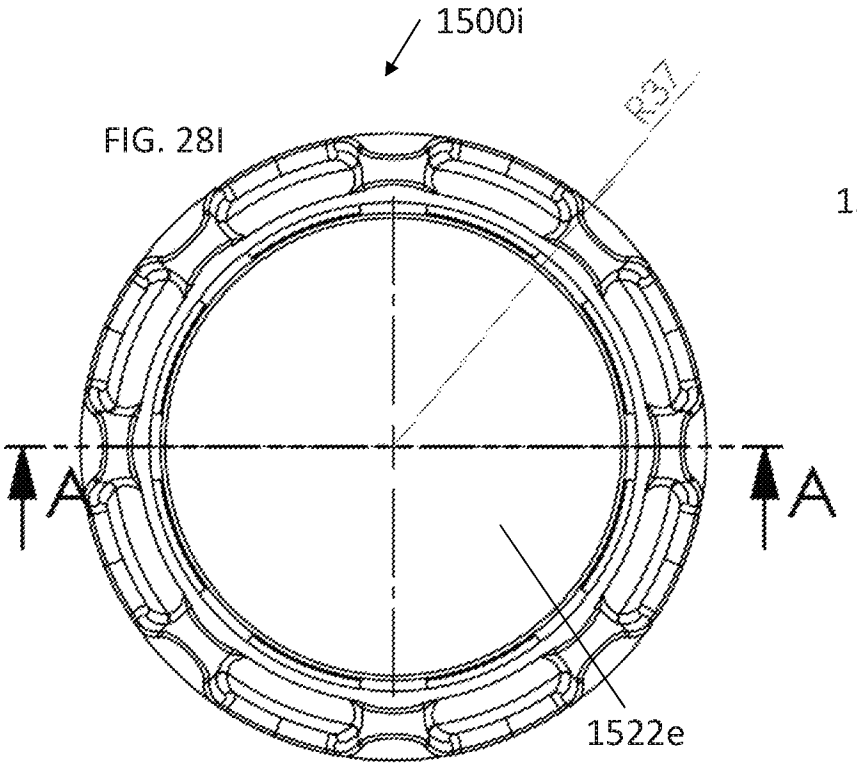

FIGS. 28I-28J show an example embodiment of a heat management device base plate from a top view diagram and mockup.

Figures 28K, 28L:
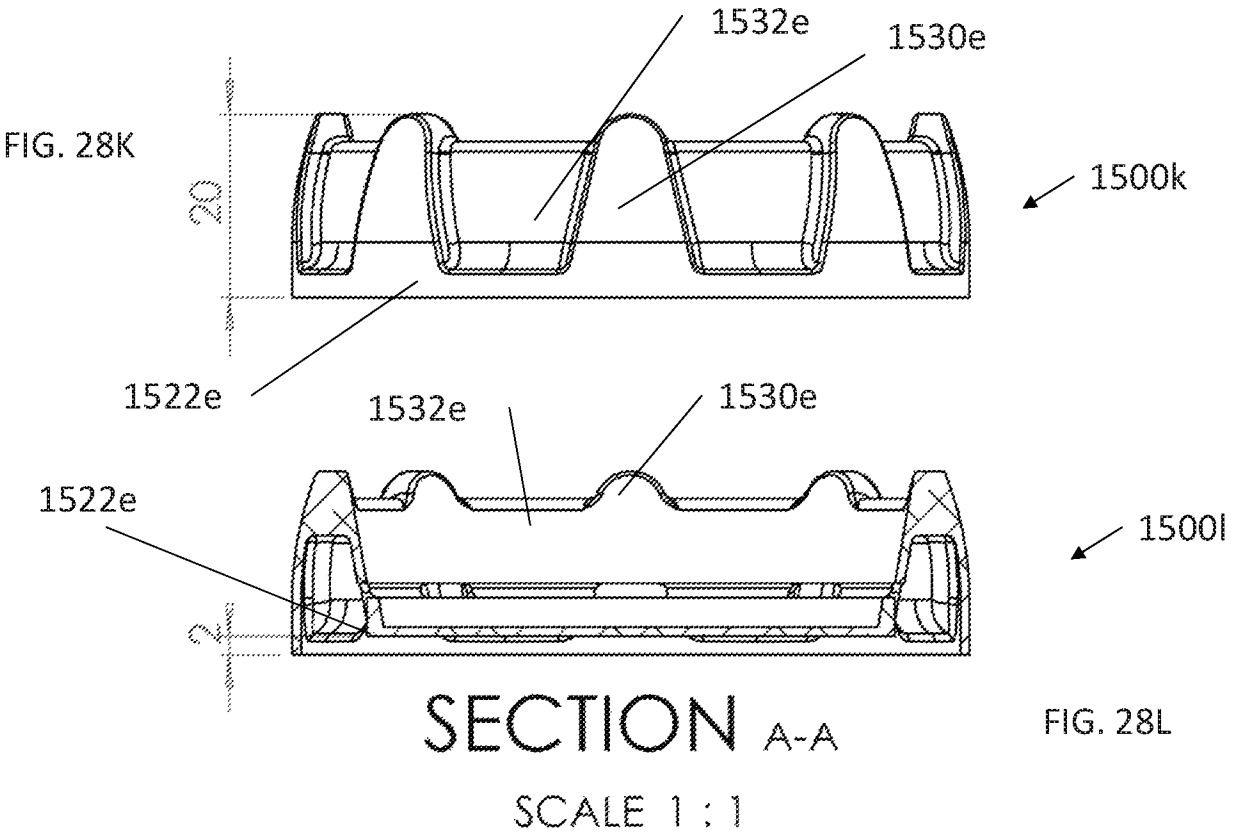
Figure 28O:
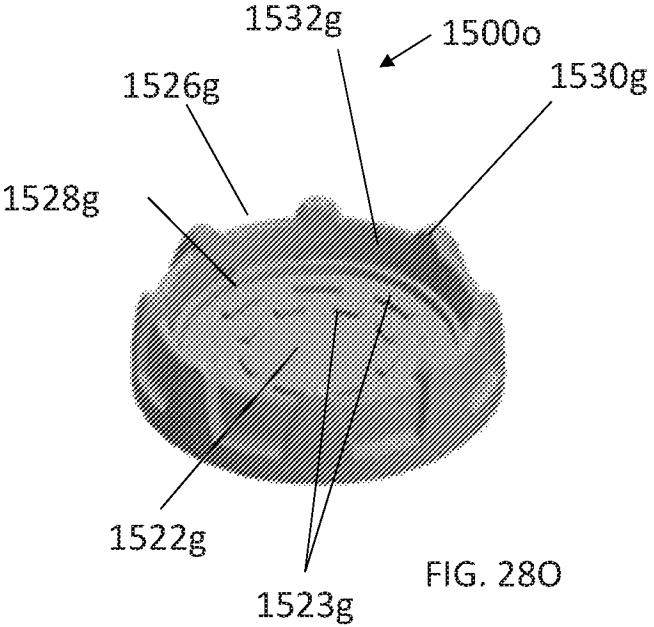
Figure 28N:
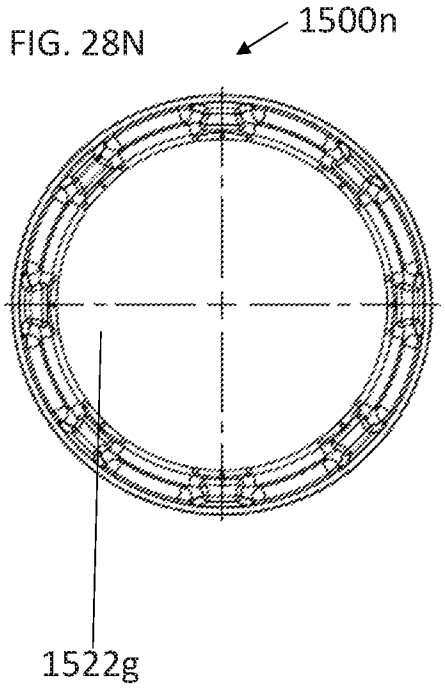

FIGS. 28K-28L show an example embodiment of a heat management device base plate from a side view diagram and side cross-sectional diagram.

Figure 28M:
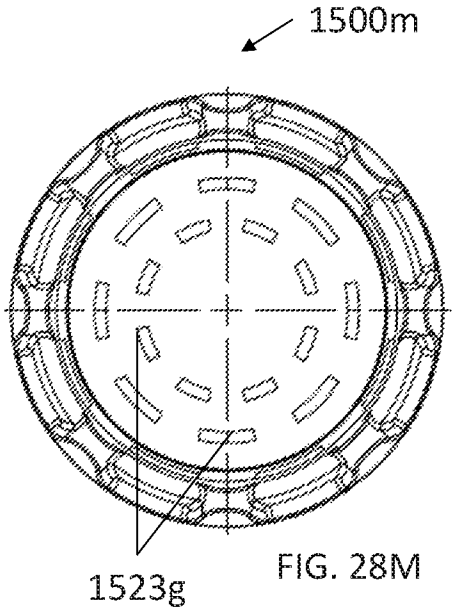

FIGS. 28M-280 show an example embodiment of a heat management device base plate from a top view diagram, bottom view diagram and mockup.

Figure 28Q:
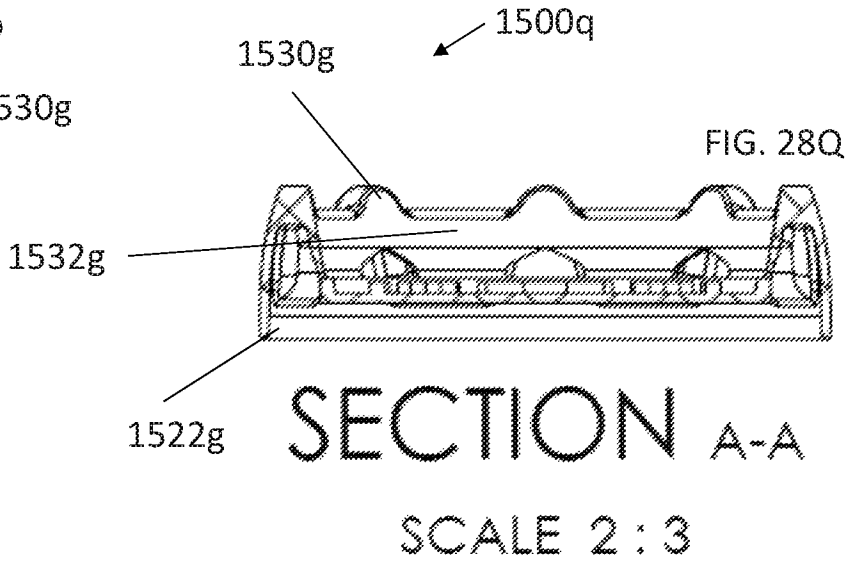
Figure 28P:
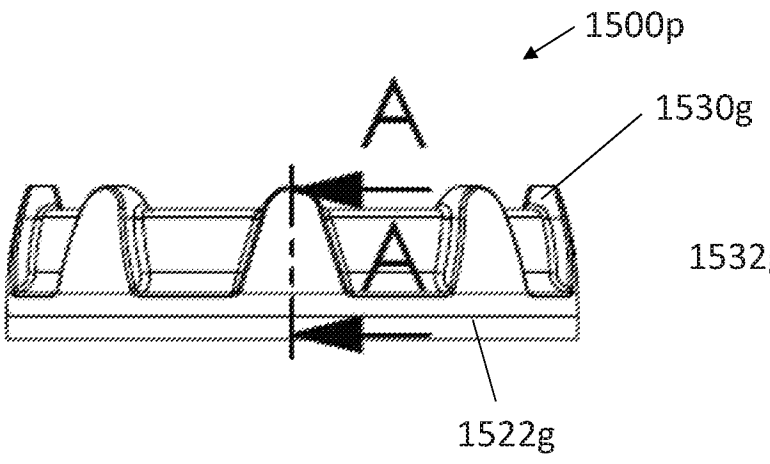

FIGS. 28P-28Q show an example embodiment of a heat management device base plate from a side view diagram and side cross-sectional diagram.

Figure 28T:
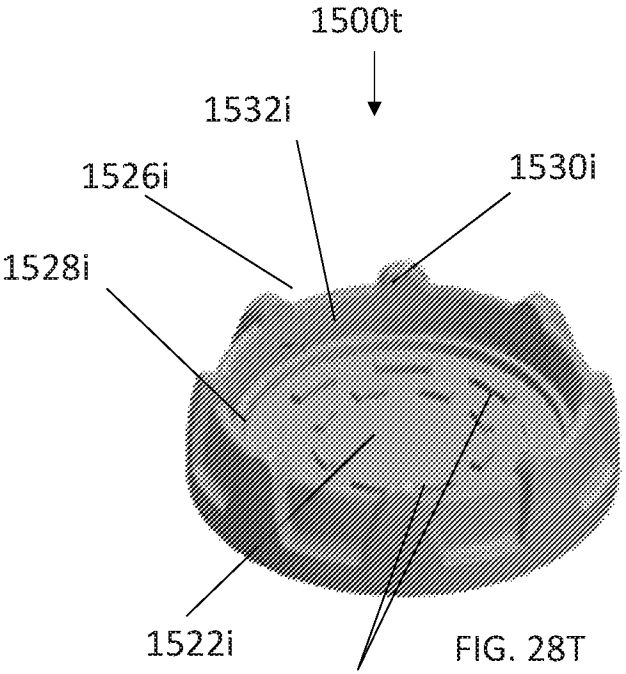
Figure 28S:
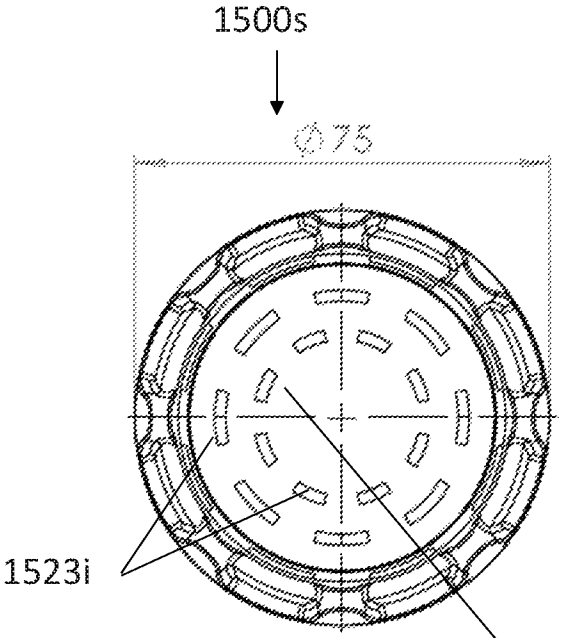
Figure 28R:
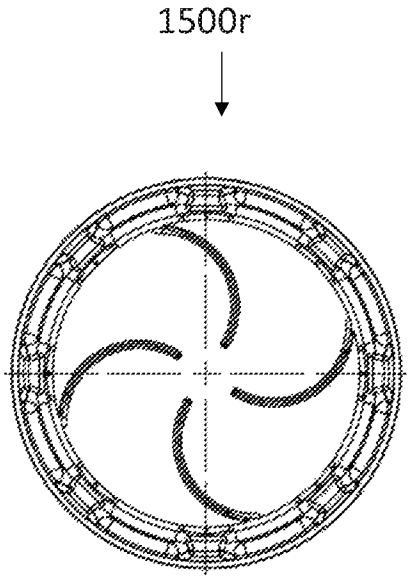

FIGS. 28R-28T show an example embodiment of a heat management device base plate from a bottom view diagram, top view diagram and mockup.

Figure 28V:
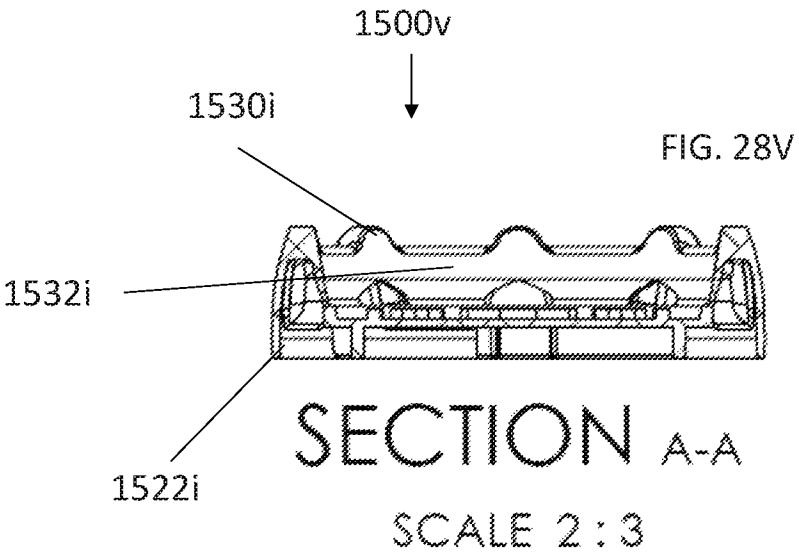
Figure 28U:
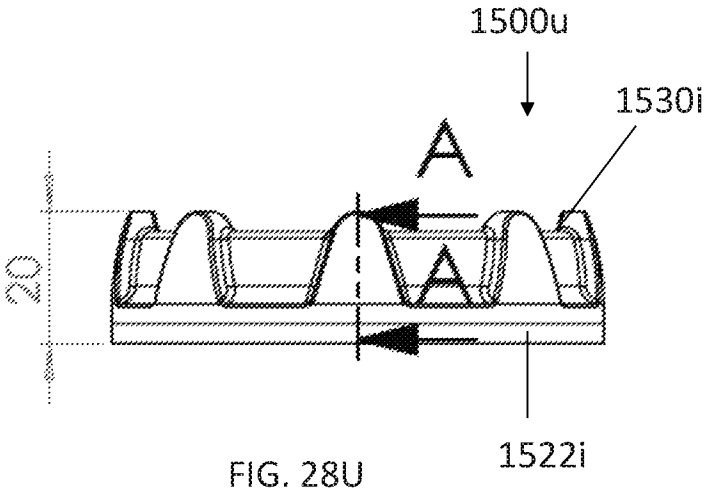

FIGS. 28U-28V show an example embodiment of a heat management device base plate from a side view diagram and side cross-sectional diagram.

Figure 28X:
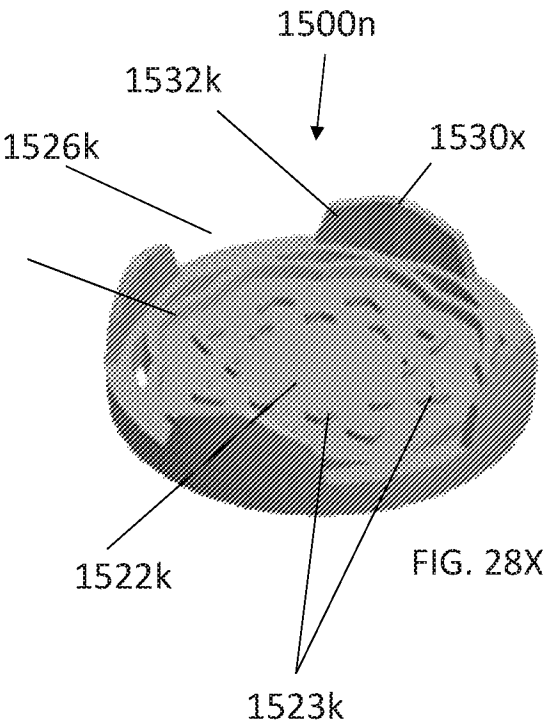
Figure 28W:
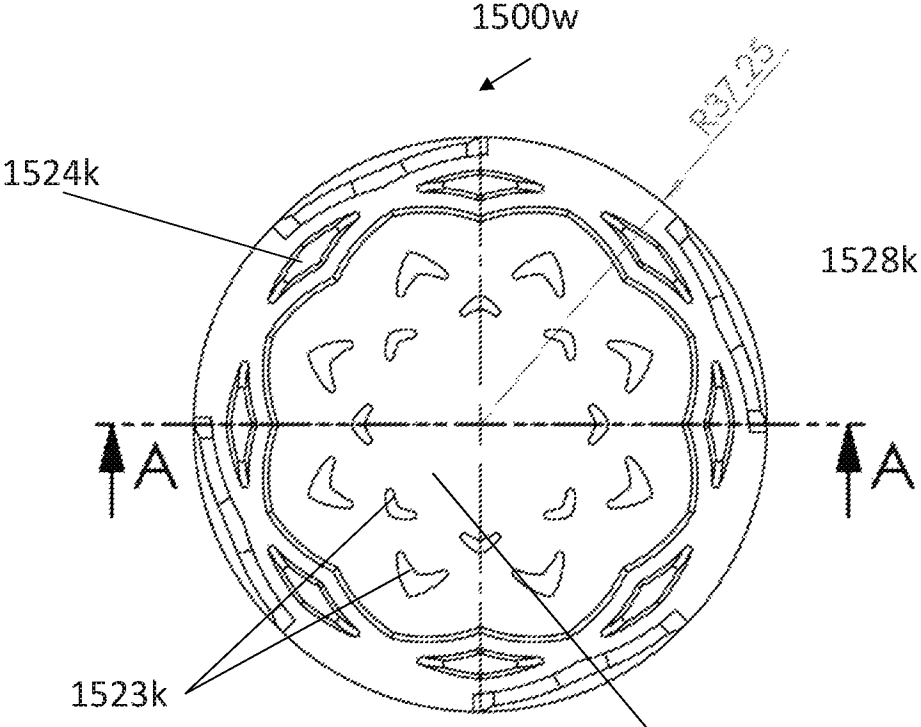

FIGS. 28W-28X show an example embodiment of a heat management device base plate from a top view diagram and mockup.

Figure 28Y:
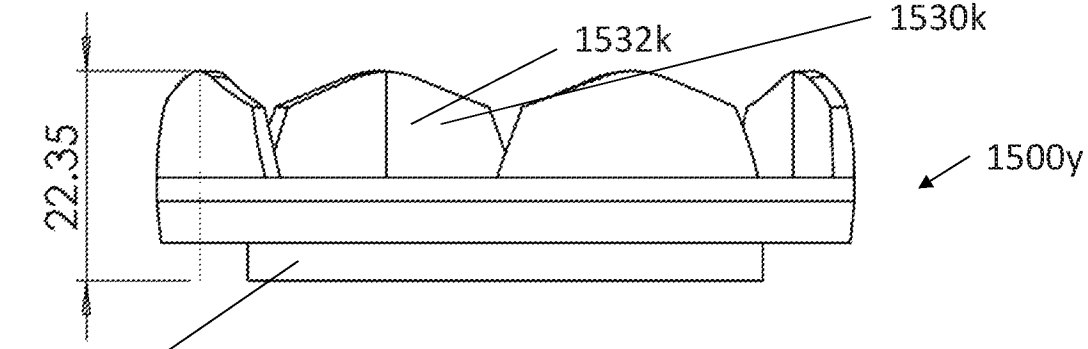
Figure 28Z:
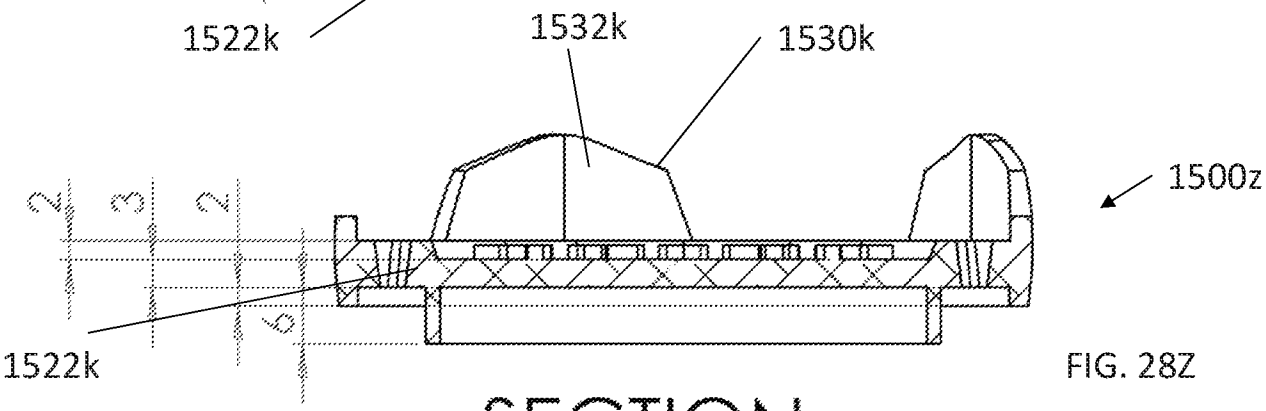

FIGS. 28Y-28Z show an example embodiment of a heat management device base plate from a side view diagram and side cross-sectional diagram.

Figure 29B:
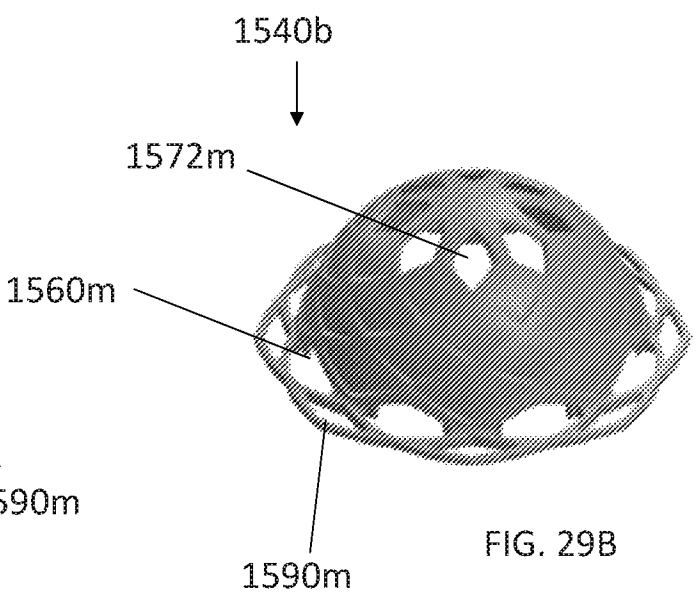
Figure 29A:
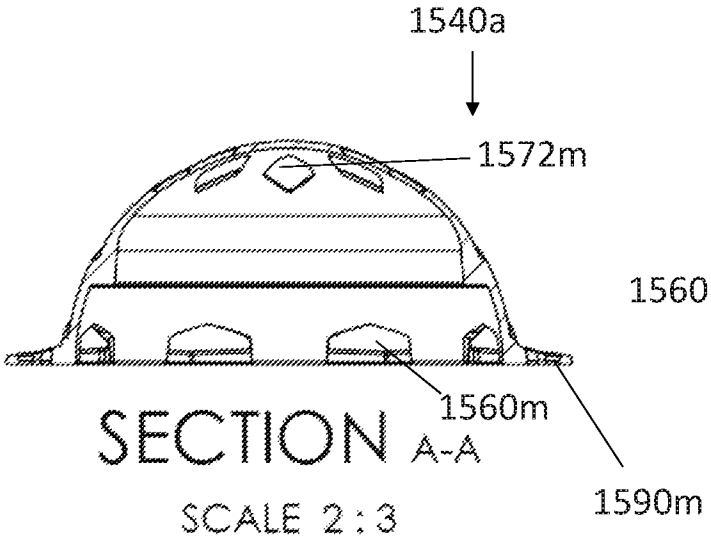

FIGS. 29A-29B show an example embodiment of a heat management device domed lid from a side cross sectional view diagram and mockup.

Figure 29D:
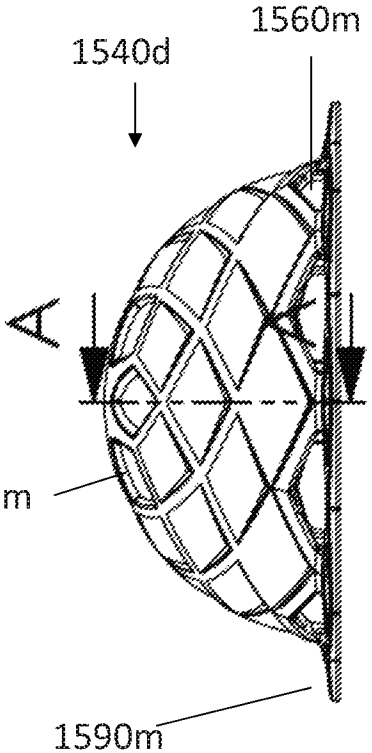
Figure 29C:
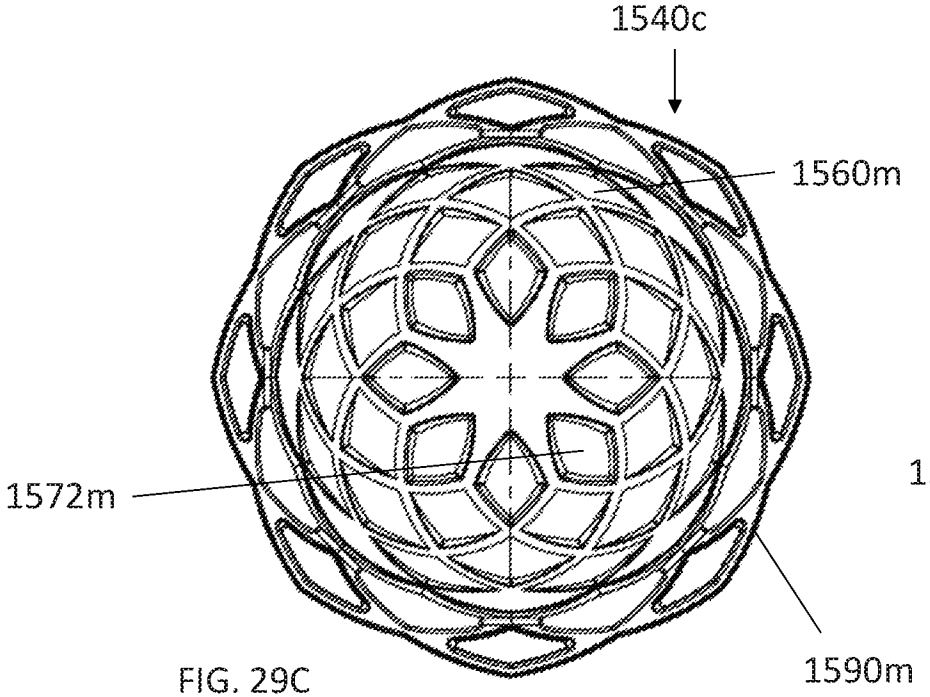

FIGS. 29C-29D show an example embodiment of a heat management device domed lid from a top view and side view diagram.

Figure 29F:
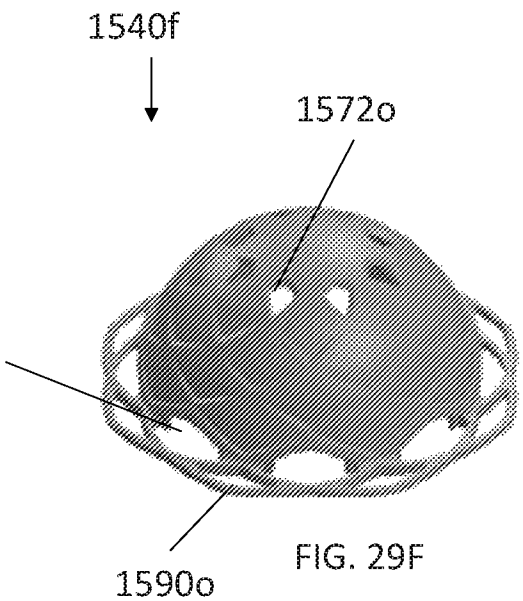
Figure 29E:
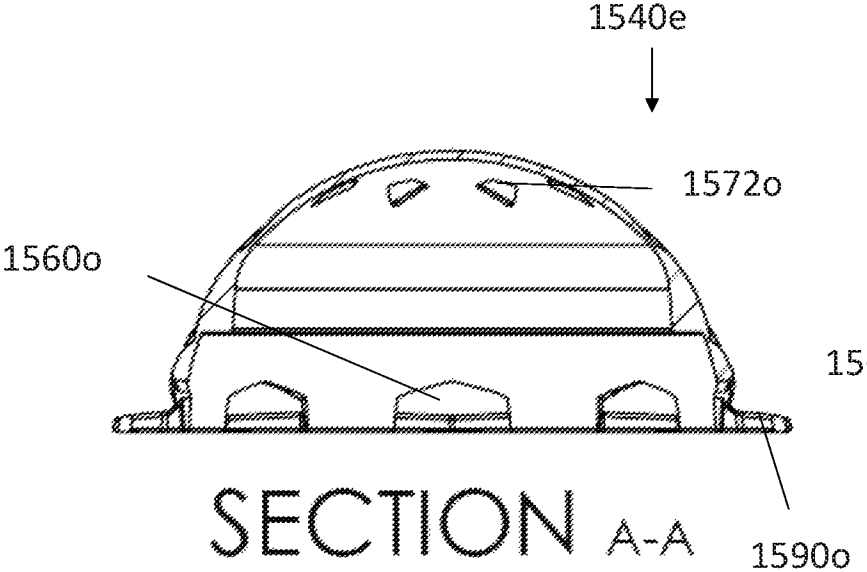

FIGS. 29E-29F show an example embodiment of a heat management device domed lid from a top view and side view diagram.

Figure 29H:
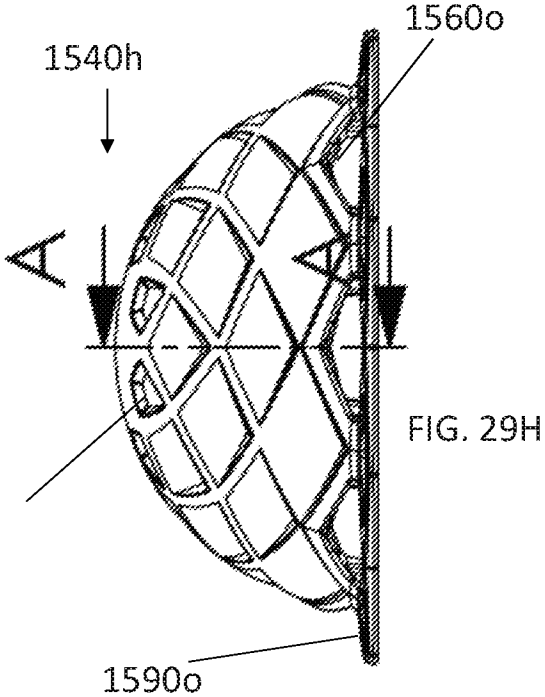
Figure 29G:
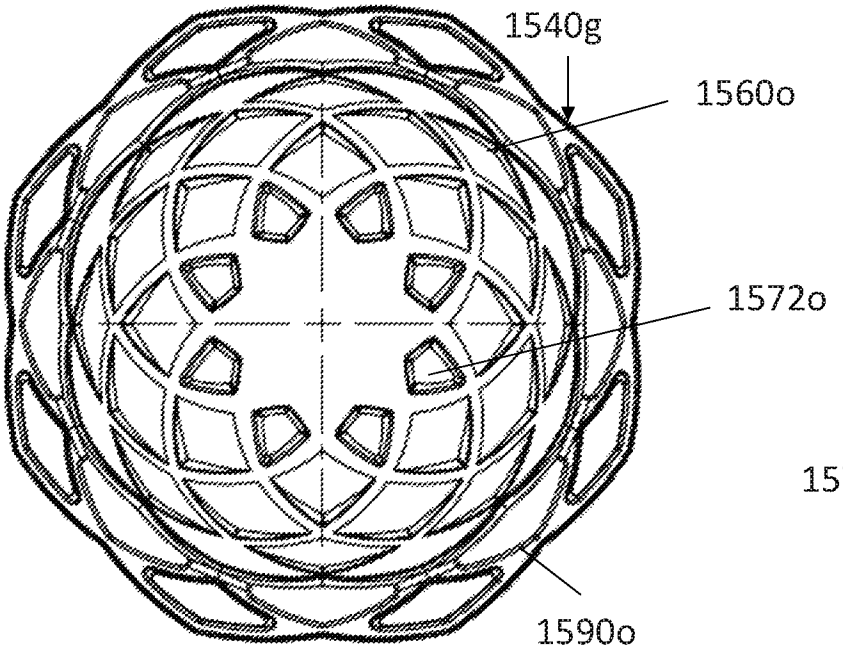

FIGS. 29G-29H show an example embodiment of a heat management device domed lid from a top view and cross-sectional diagram.

FIGS. 291-29J show an example embodiment of a heat management device domed lid from a side cross sectional view diagram and mockup.

Figure 29L:
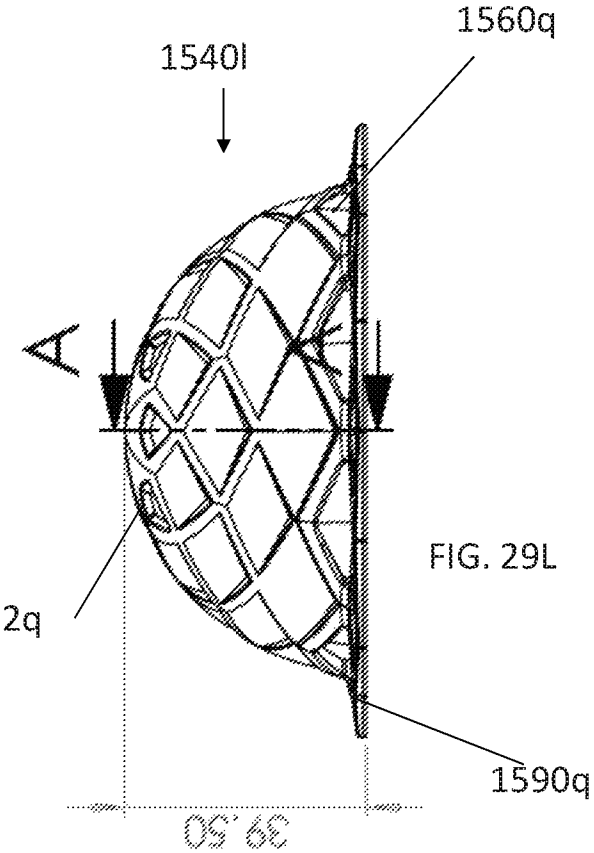
Figure 29K:
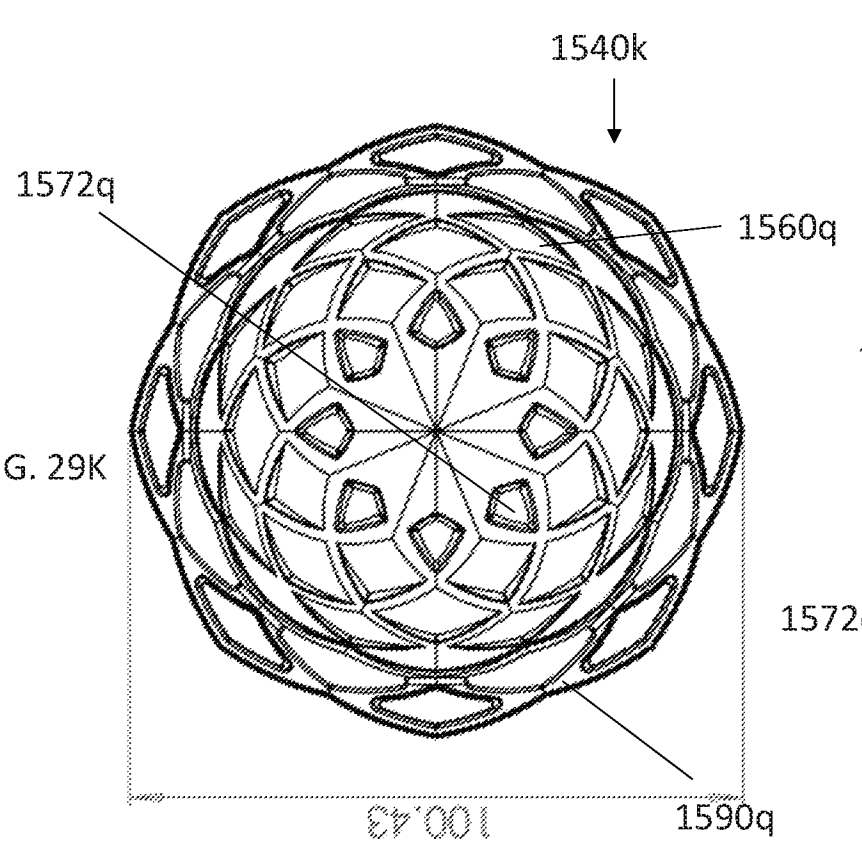

FIGS. 29K-29L show an example embodiment of a heat management device domed lid from a top view and side view diagram.

Figure 29N:
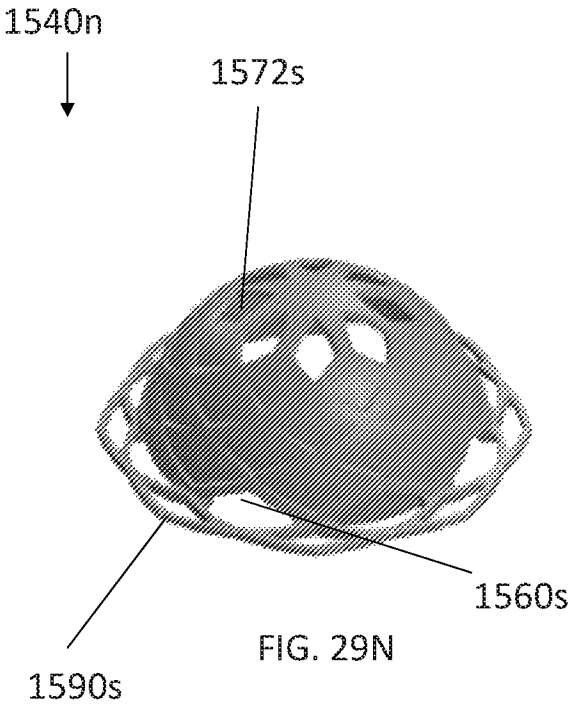
Figure 29M:
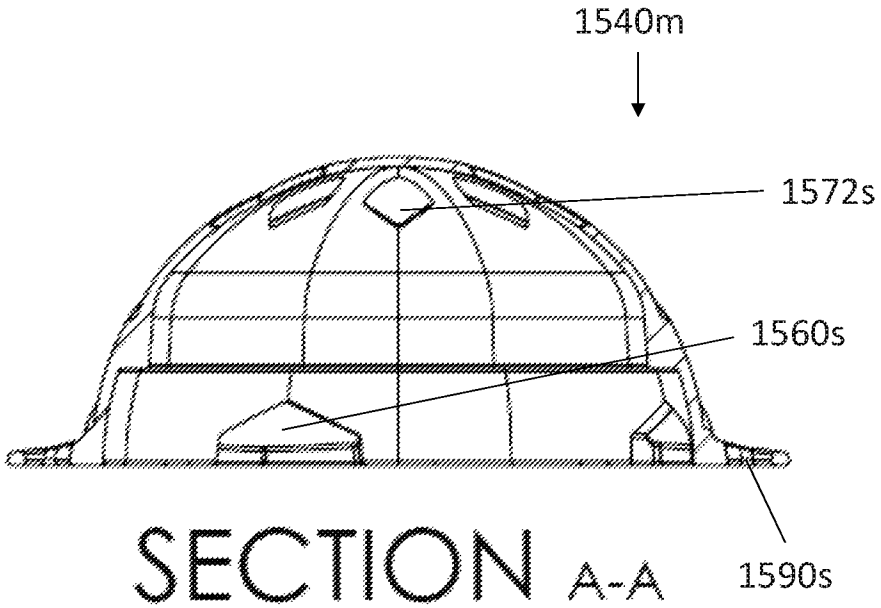

FIGS. 29M-29N show an example embodiment of a heat management device domed lid from a side cross sectional view diagram and mockup.

Figure 29P:
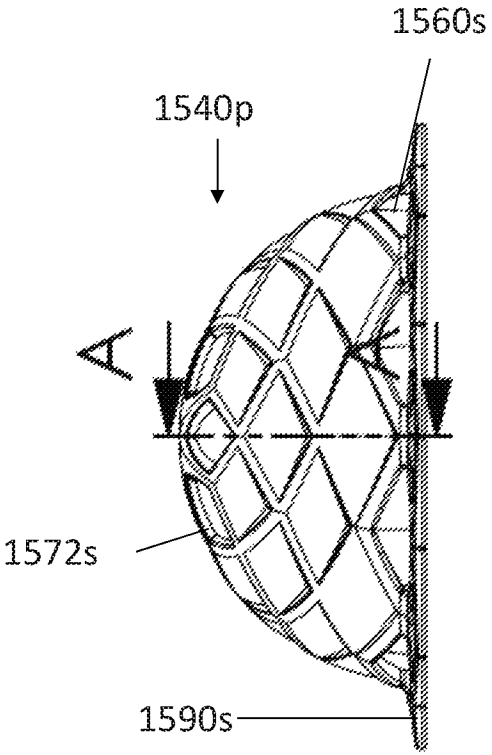
Figure 29O:
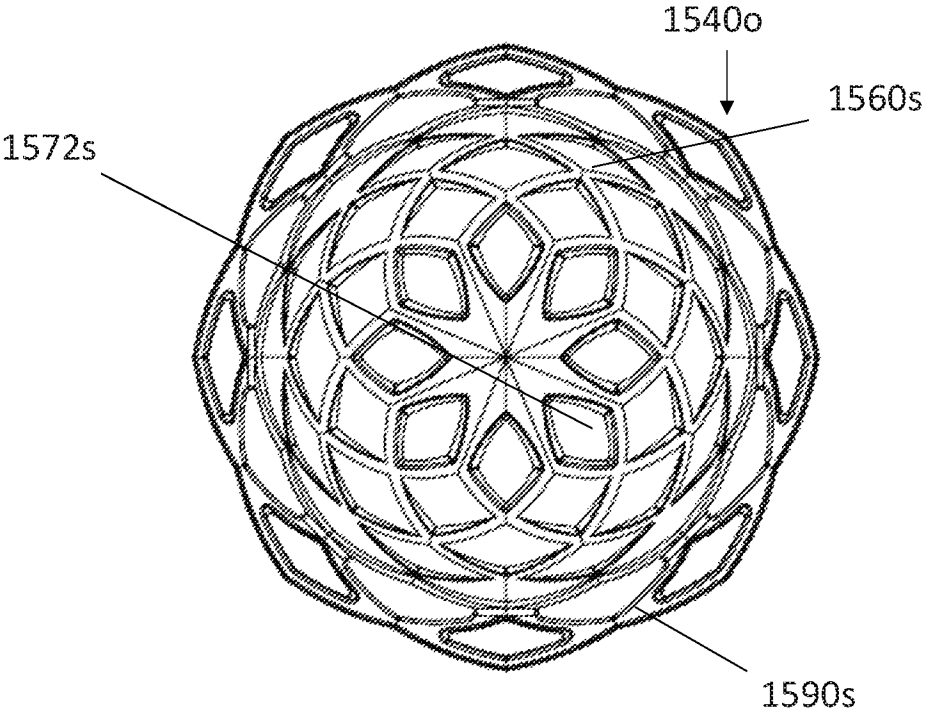

FIGS. 290-29P show an example embodiment of a heat management device base plate from a top view and side view diagram.

Figures 30A, 30B, 30C:
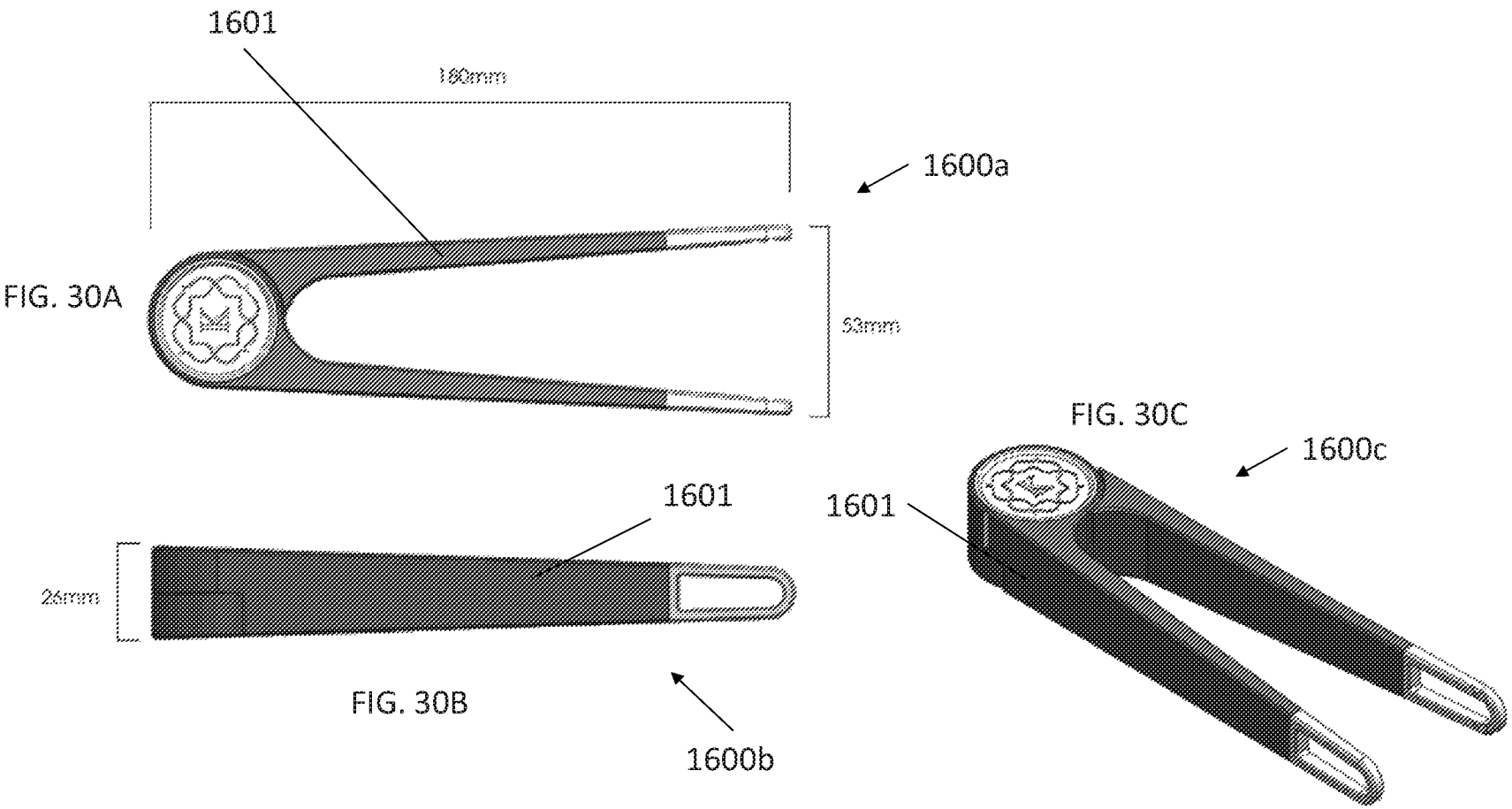

FIGS. 30A-30C show an example embodiment of tongs from a top view, side view, and perspective view.

Figure 30D:
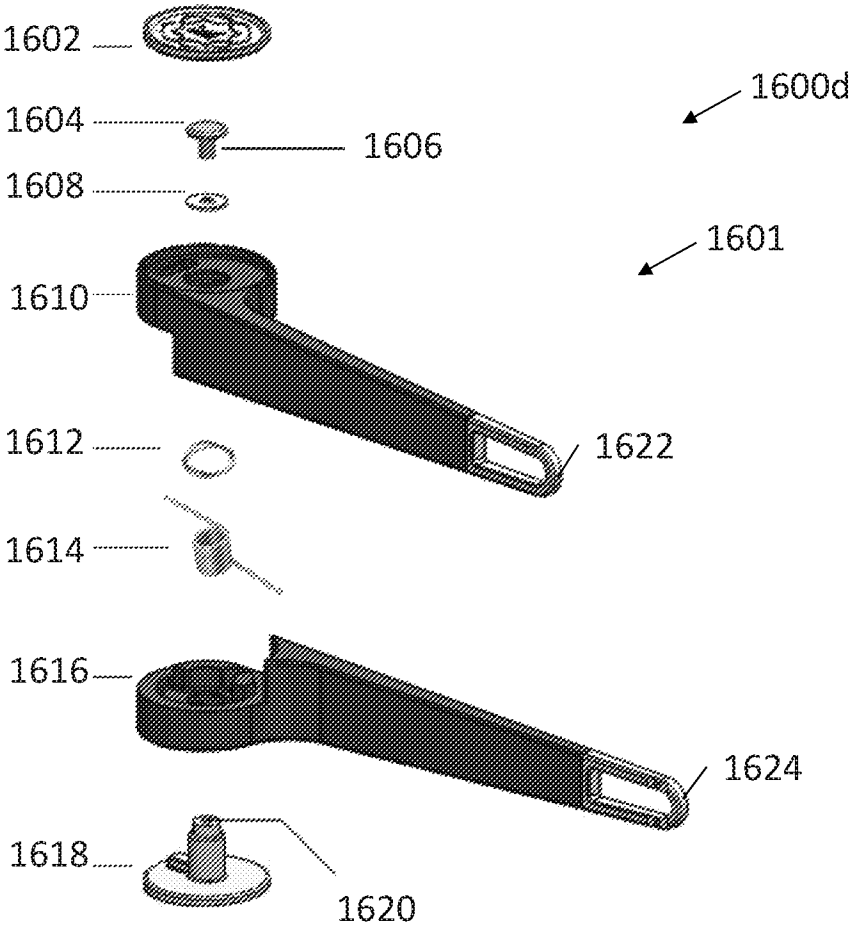

FIG. 30D shows an example embodiment of an exploded tongs diagram

Figures 30E, 30F:
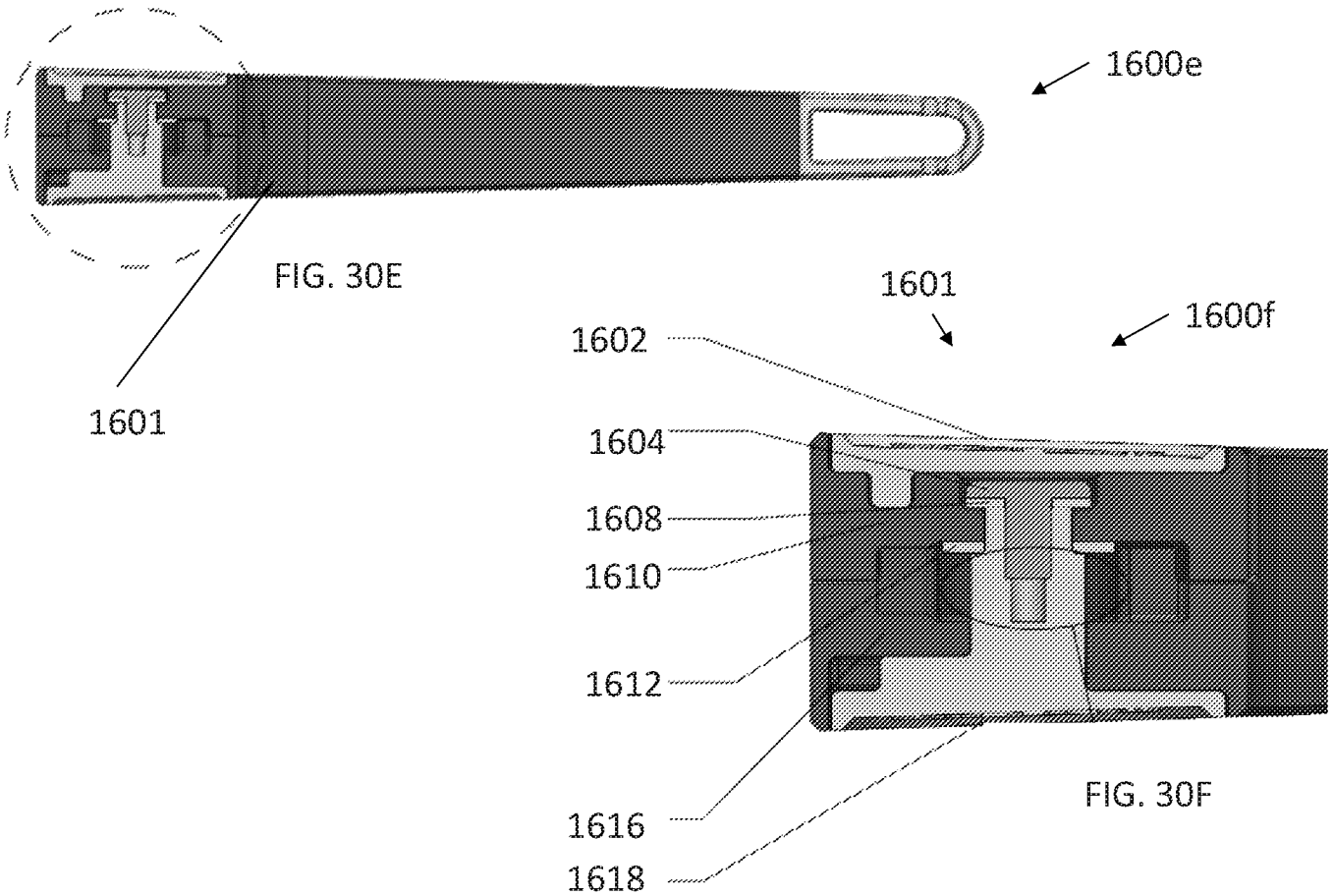

FIGS. 30E-30F show an example embodiment of tongs side cross-sectional diagram and detail.

Figures 31A, 31B, 31C:
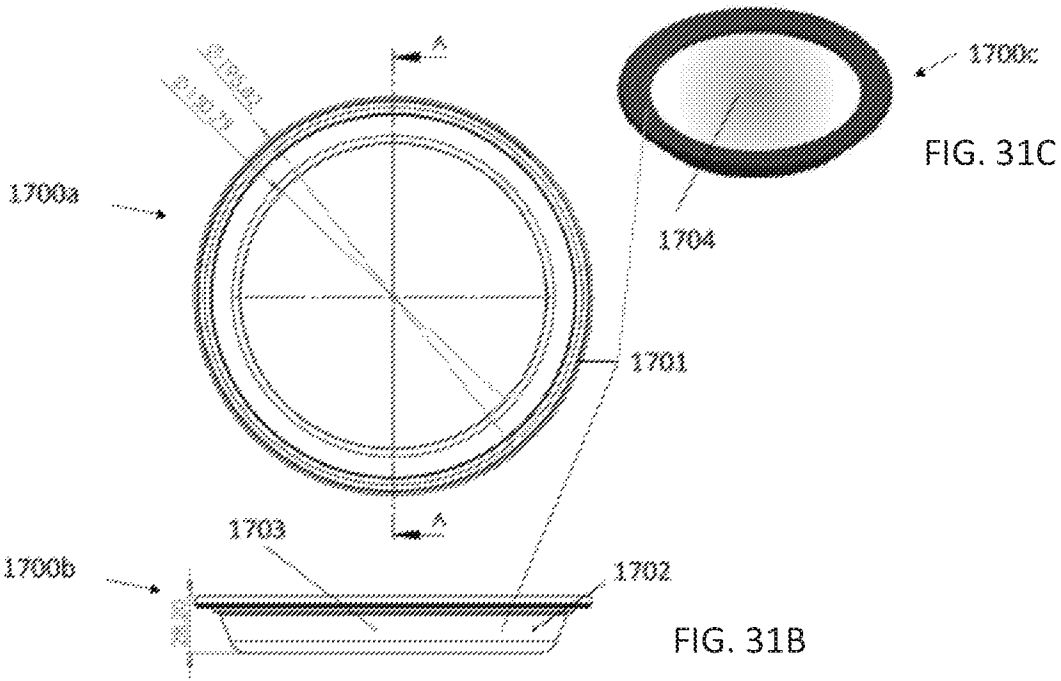

FIGS. 31A-31C show an example embodiment of a lighting puck from a top view, side view and perspective view.

Figure 31F:
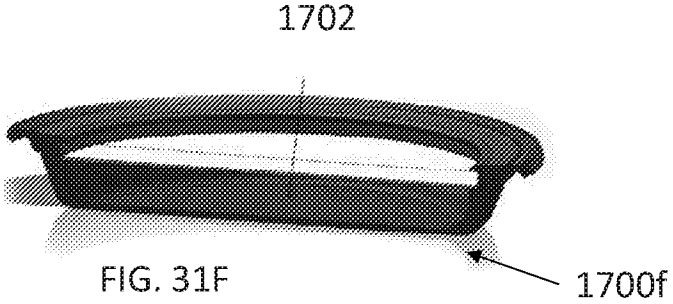
Figure 31D:
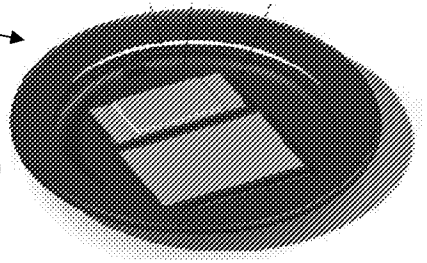
Figure 31E:
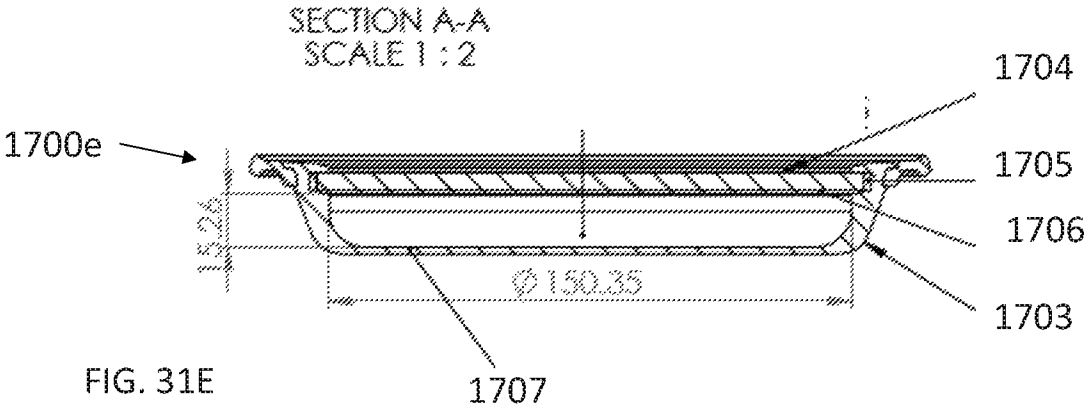
Figure 31K:
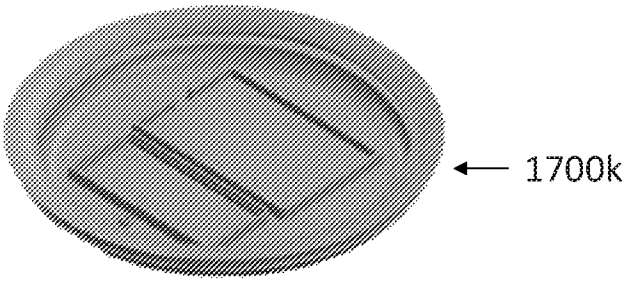
Figure 31J:
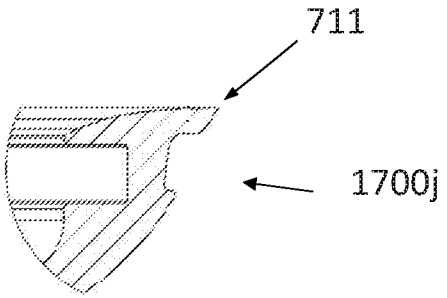
Figure 31G:
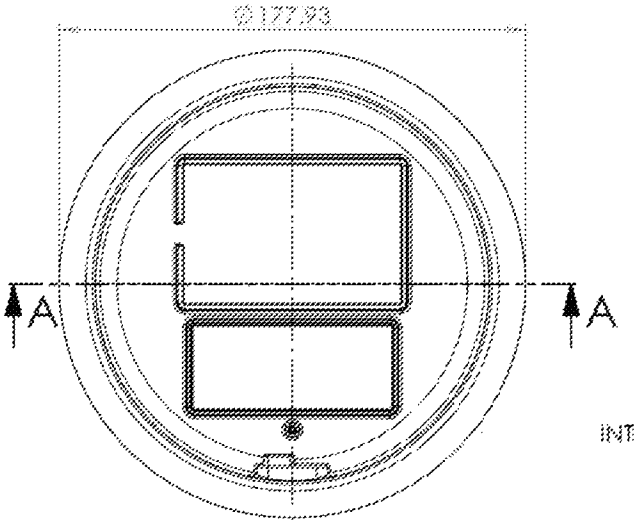
Figure 31H:
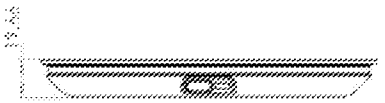
Figure 31I:
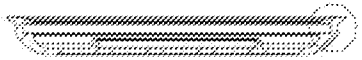

FIGS. 31D-31F show an example embodiment of a lighting puck from a top perspective view, side cross sectional view and perspective cross sectional view.

FIGS. 31G-31K show an example embodiment of a lighting puck from a top view, side views, detail view and perspective view.

Figure 31N:
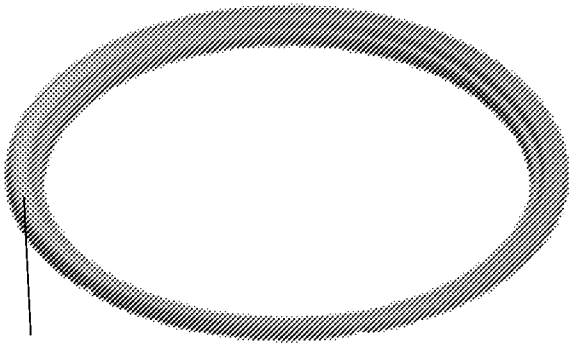
Figure 31M:
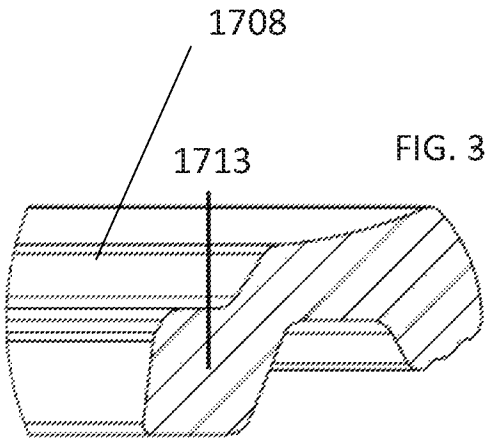
Figure 31L:
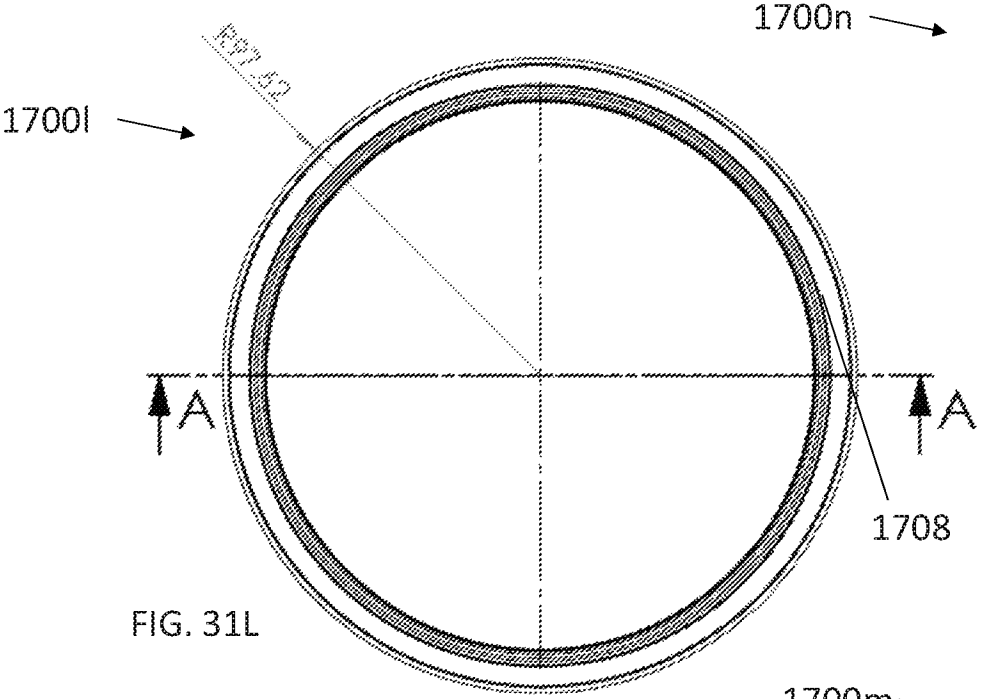

FIGS. 31L-31N show an example embodiment of a lighting puck from a top view, side view and perspective view.

Figures 31O, 31P:
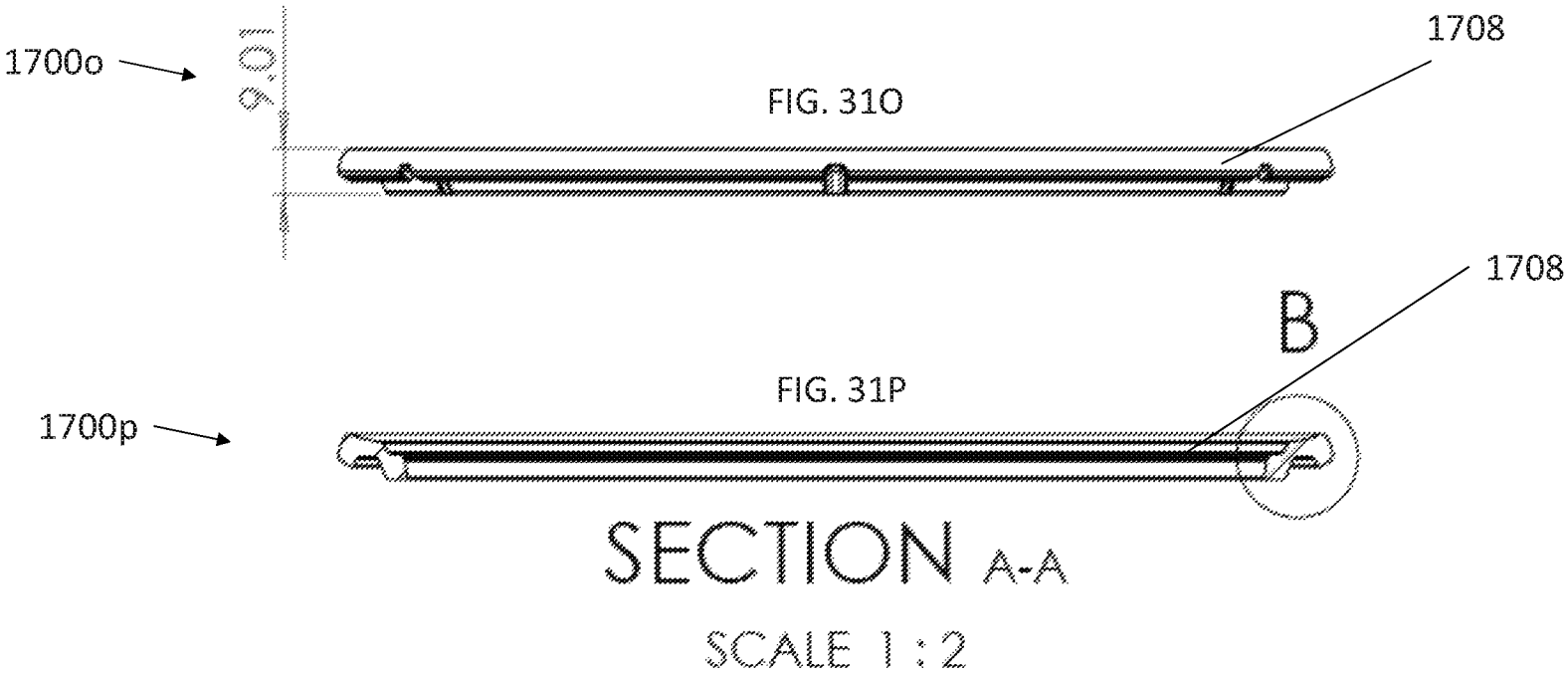

FIGS. 310-31P show an example embodiment of a lighting puck rim from a side view and cross-sectional side view.

Figure 31R:
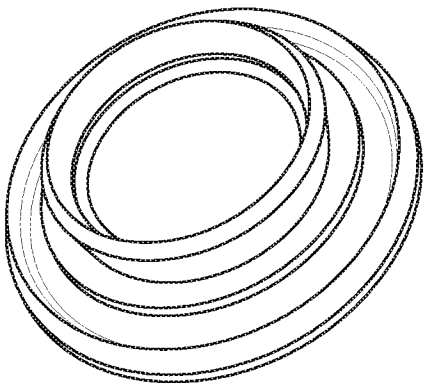
Figure 31S:
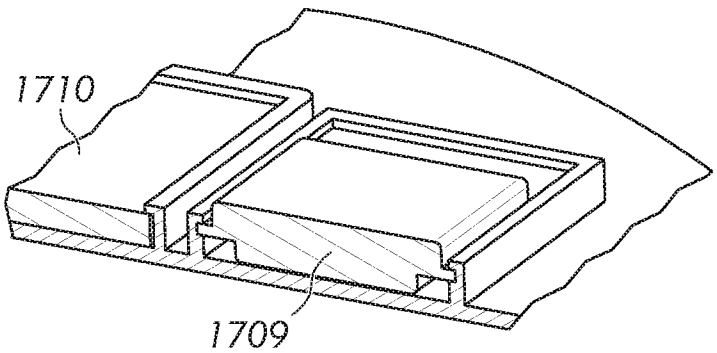
Figure 31Q:
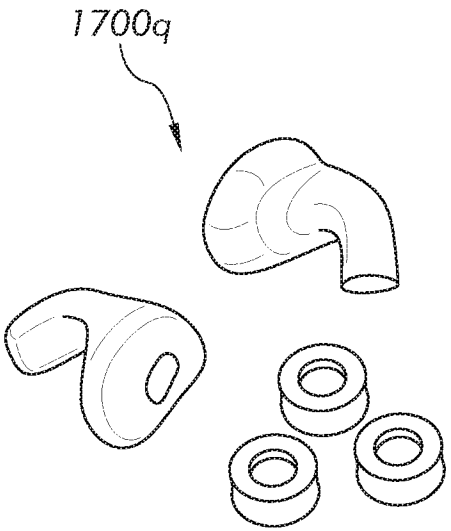

FIGS. 31Q-31S show an example embodiment of a lighting puck sensor membrane, silicone rim, and detail view.

Figure 31U:
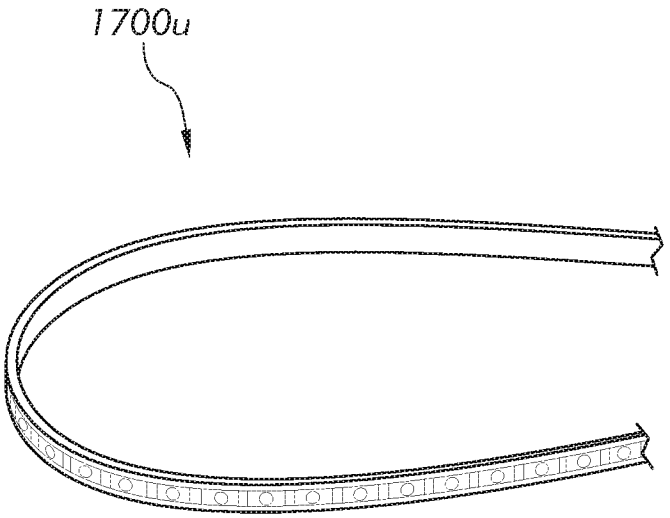
Figure 31T:
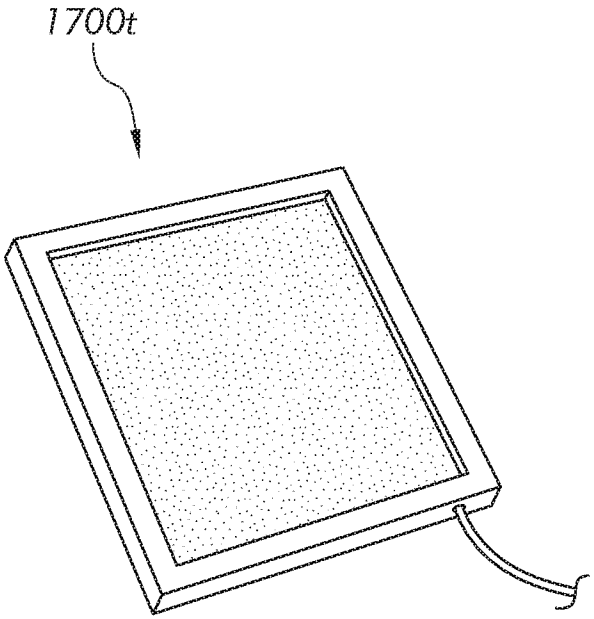

FIGS. 31T-31U show an example embodiment of a lighting puck LED panel LED strip.

Figure 32C:
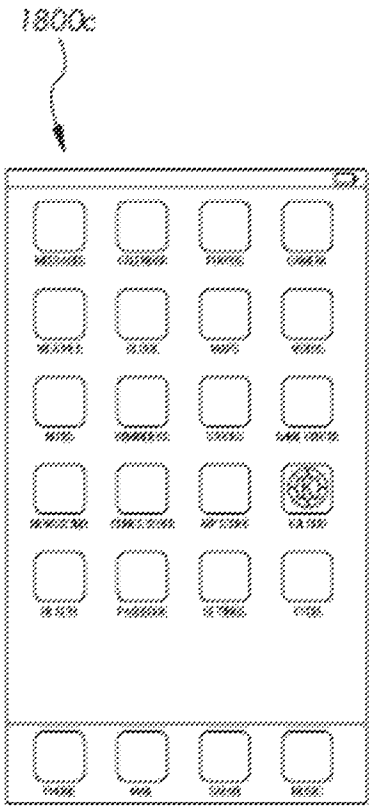
Figure 32B:
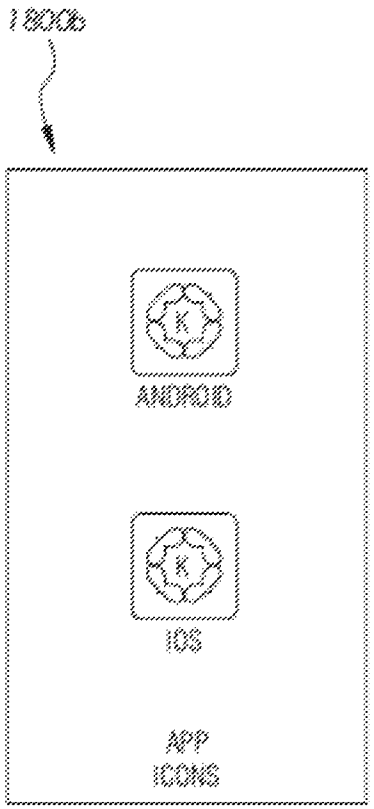
Figure 32A:
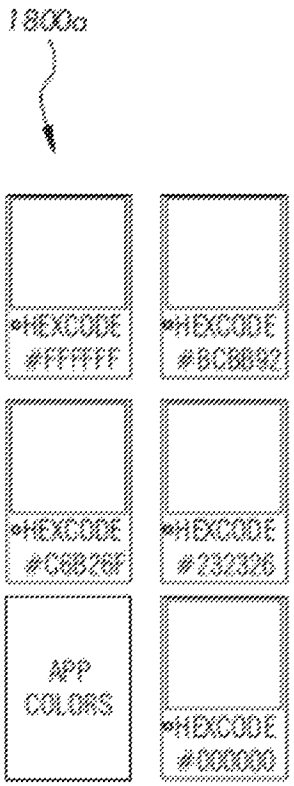
Figure 32D:
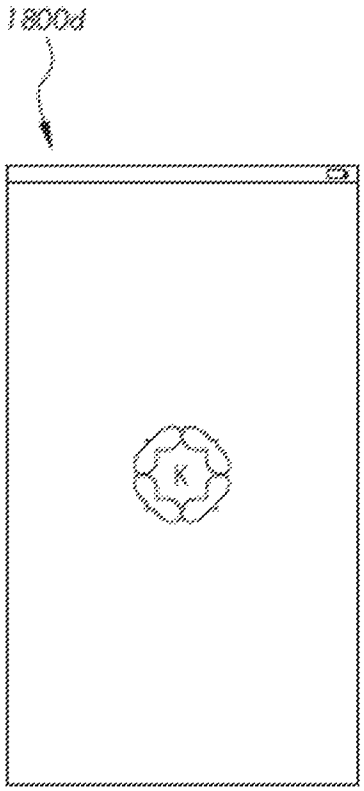
Figure 32E:
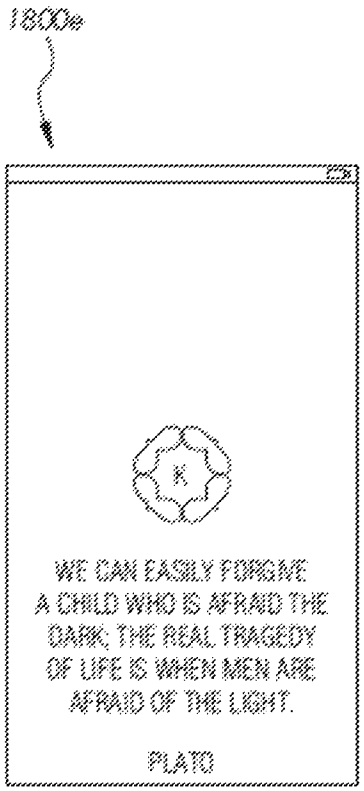
Figure 32F:
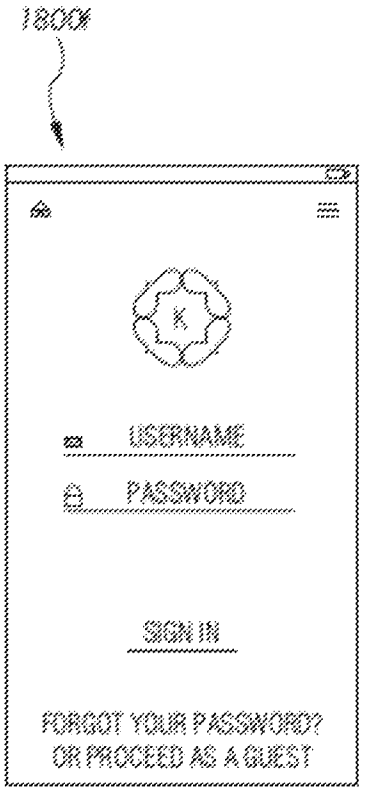
Figure 32G:
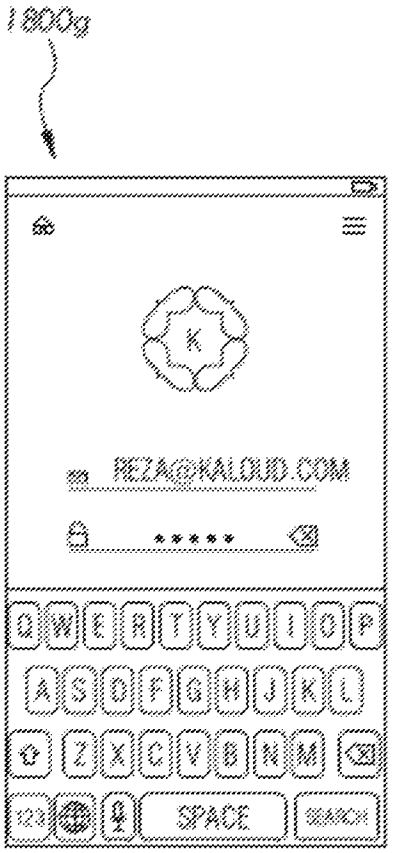
Figure 32H:
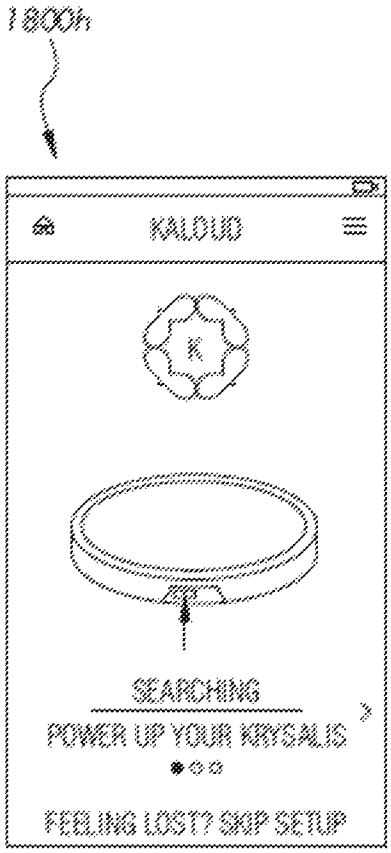
Figure 32I:
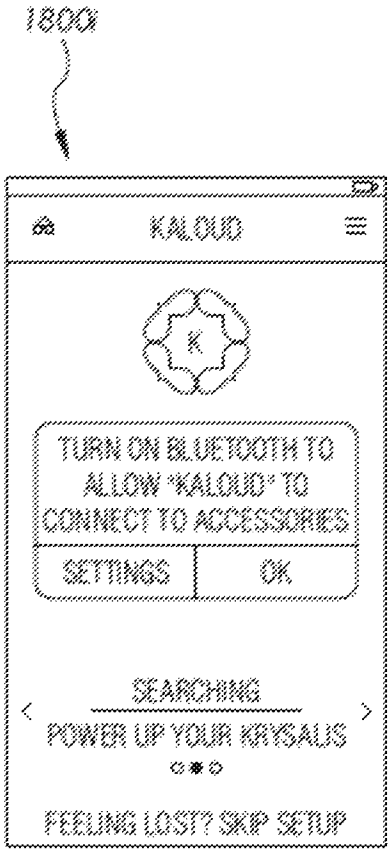
Figure 32J:
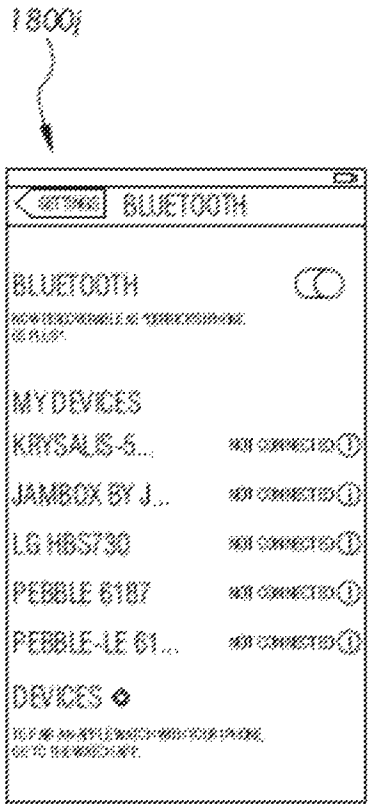
Figure 32K:
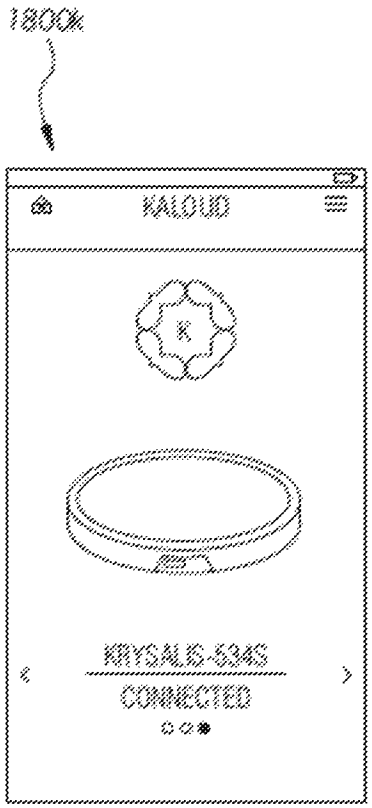
Figure 32L:
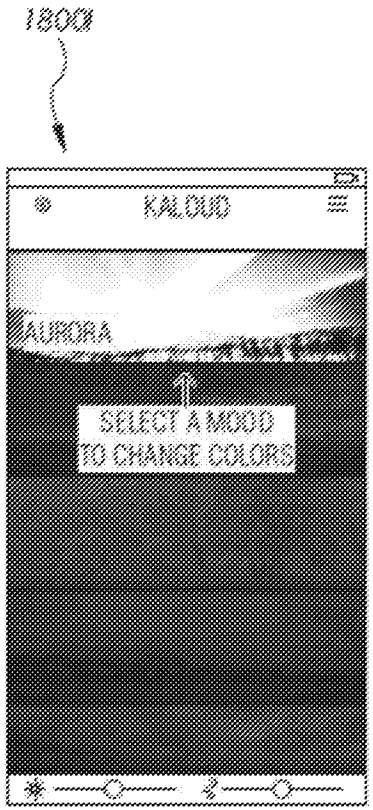
Figure 32O:
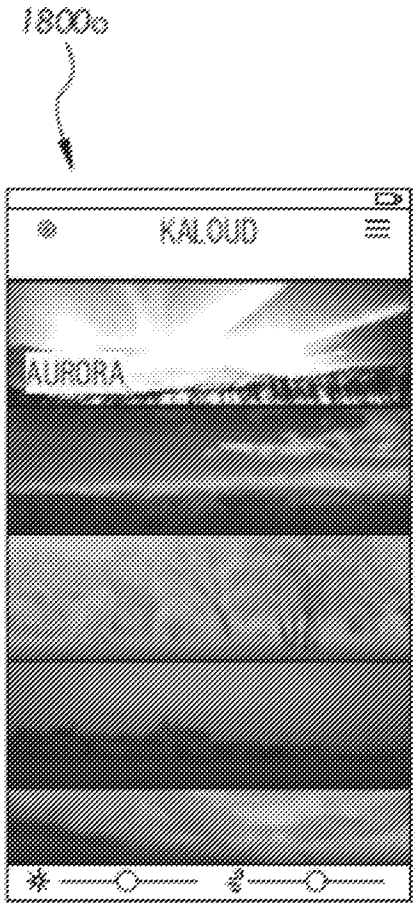
Figure 32N:
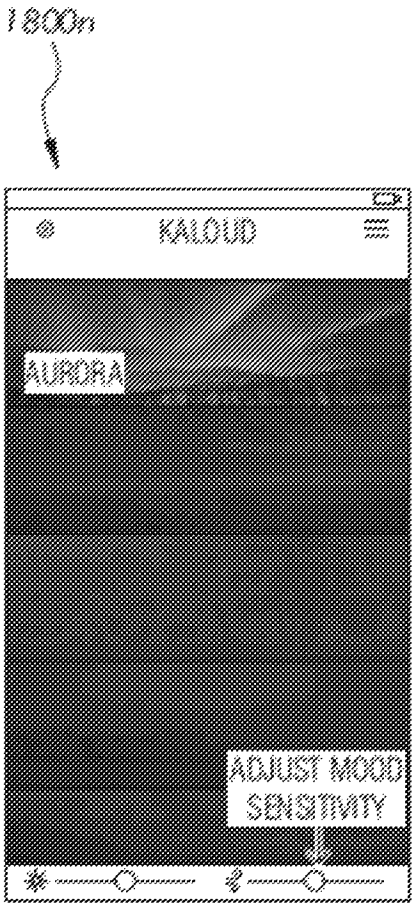
Figure 32M:
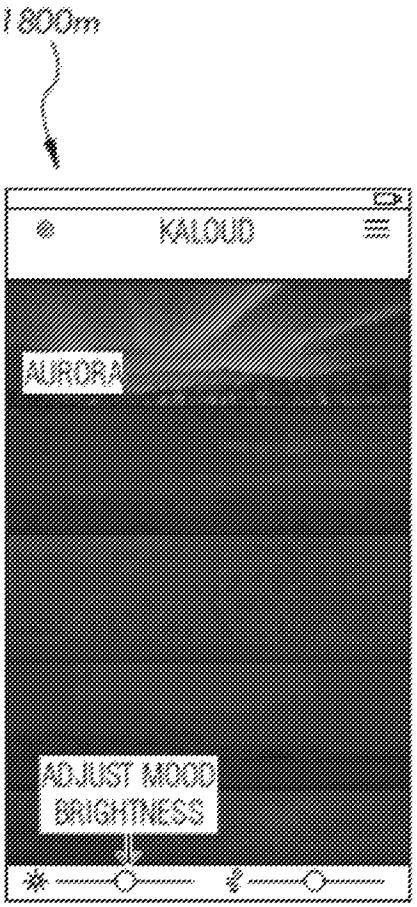
Figure 32P:
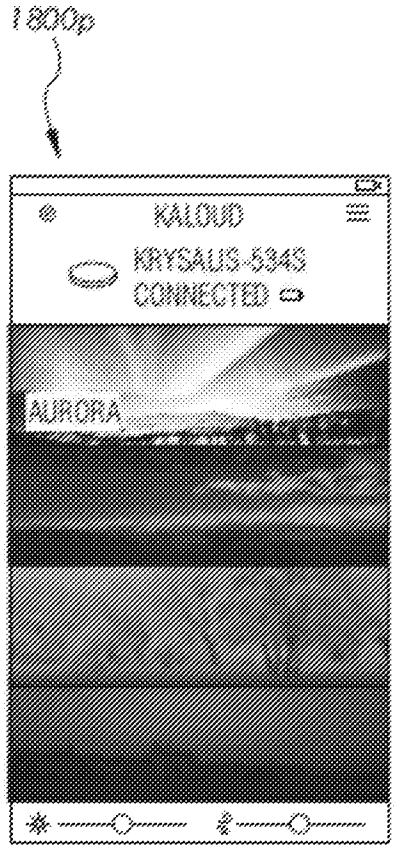
Figure 32Q:
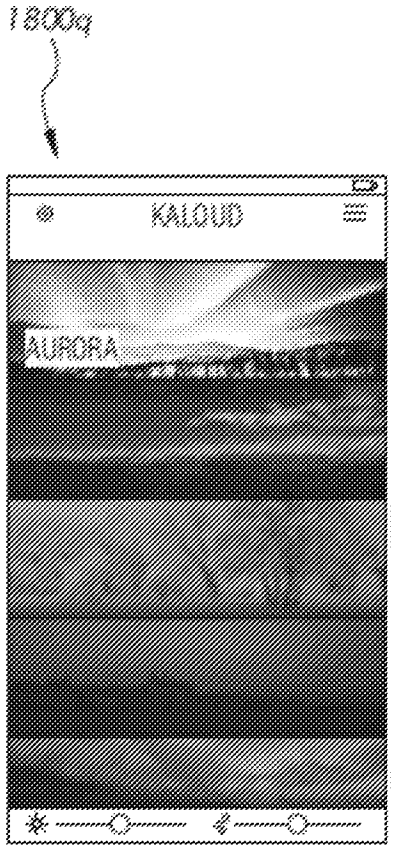
Figure 32R:
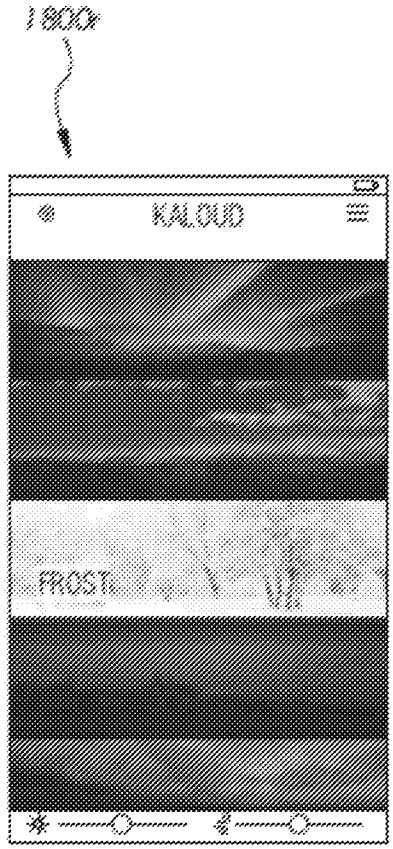
Figure 32V:
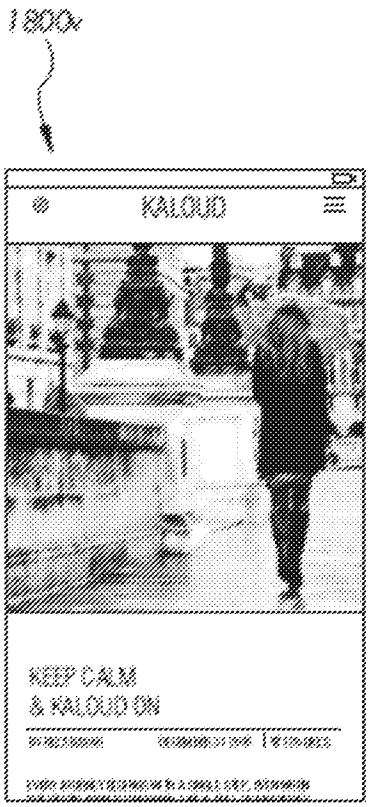
Figure 32W:
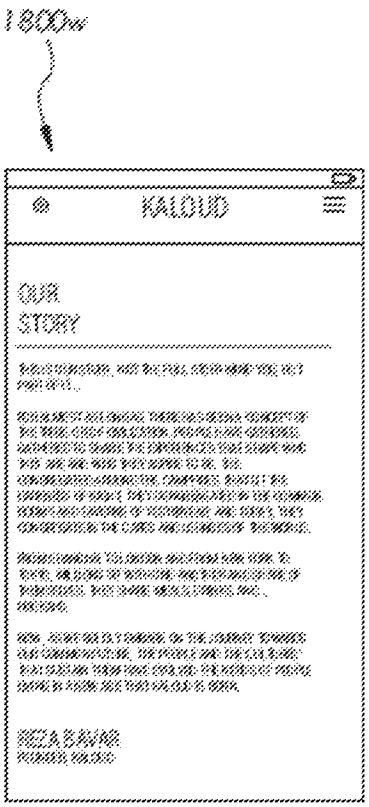
Figure 32X:
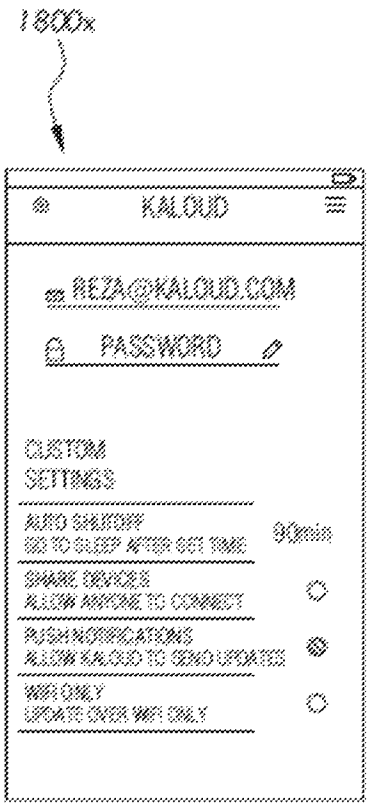
Figure 32Y:
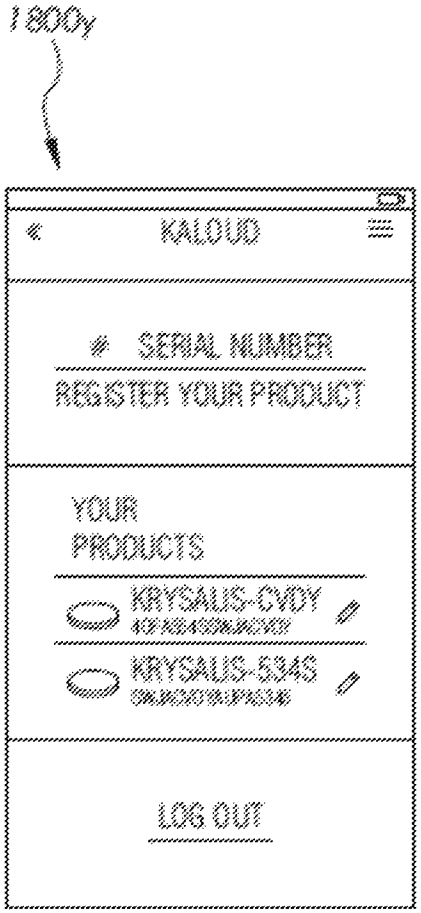

FIGS. 32A-32Y show example embodiments of user interface screens for use with an LED lighting puck.

Figure 33A:
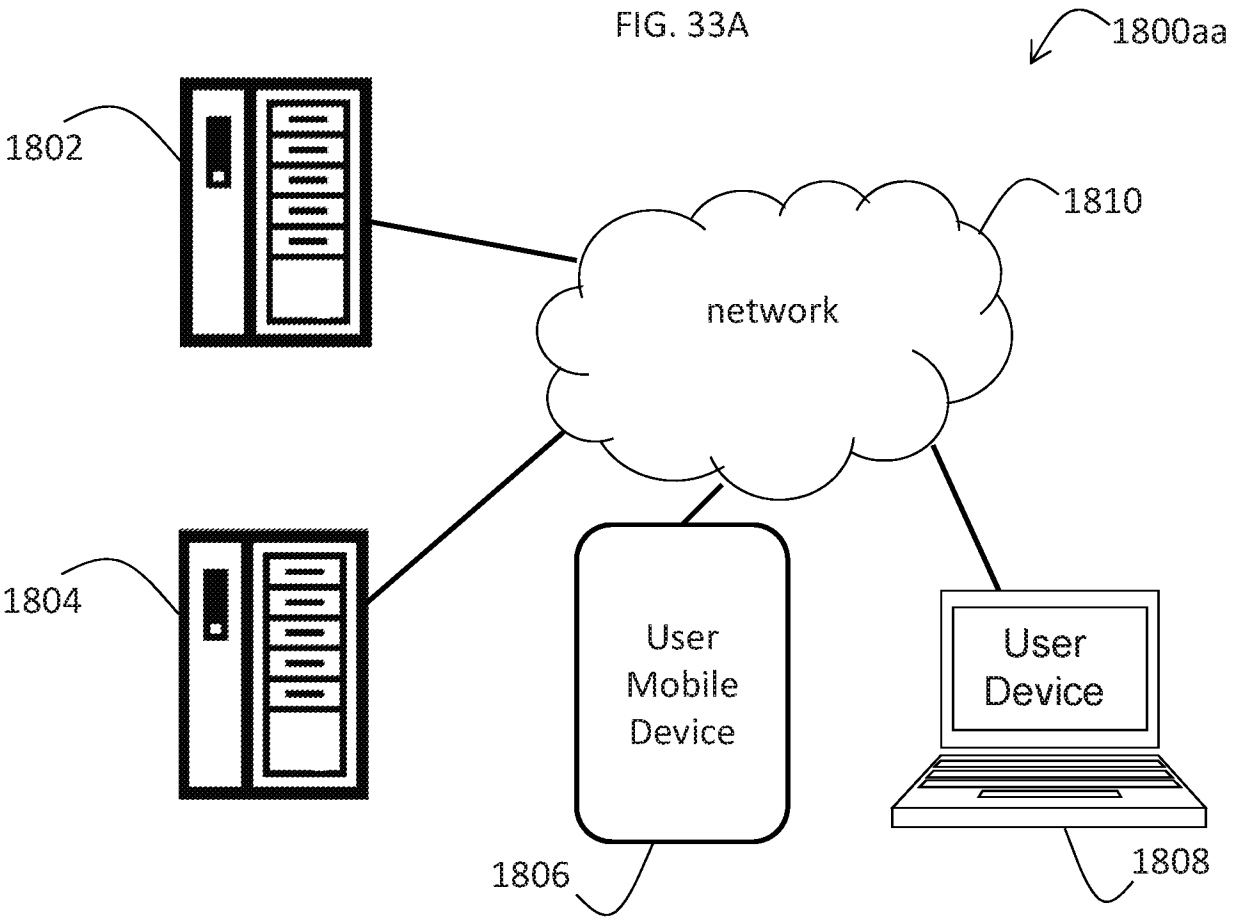

FIG. 33A shows an example embodiment of a basic network setup.

Figure 33B:
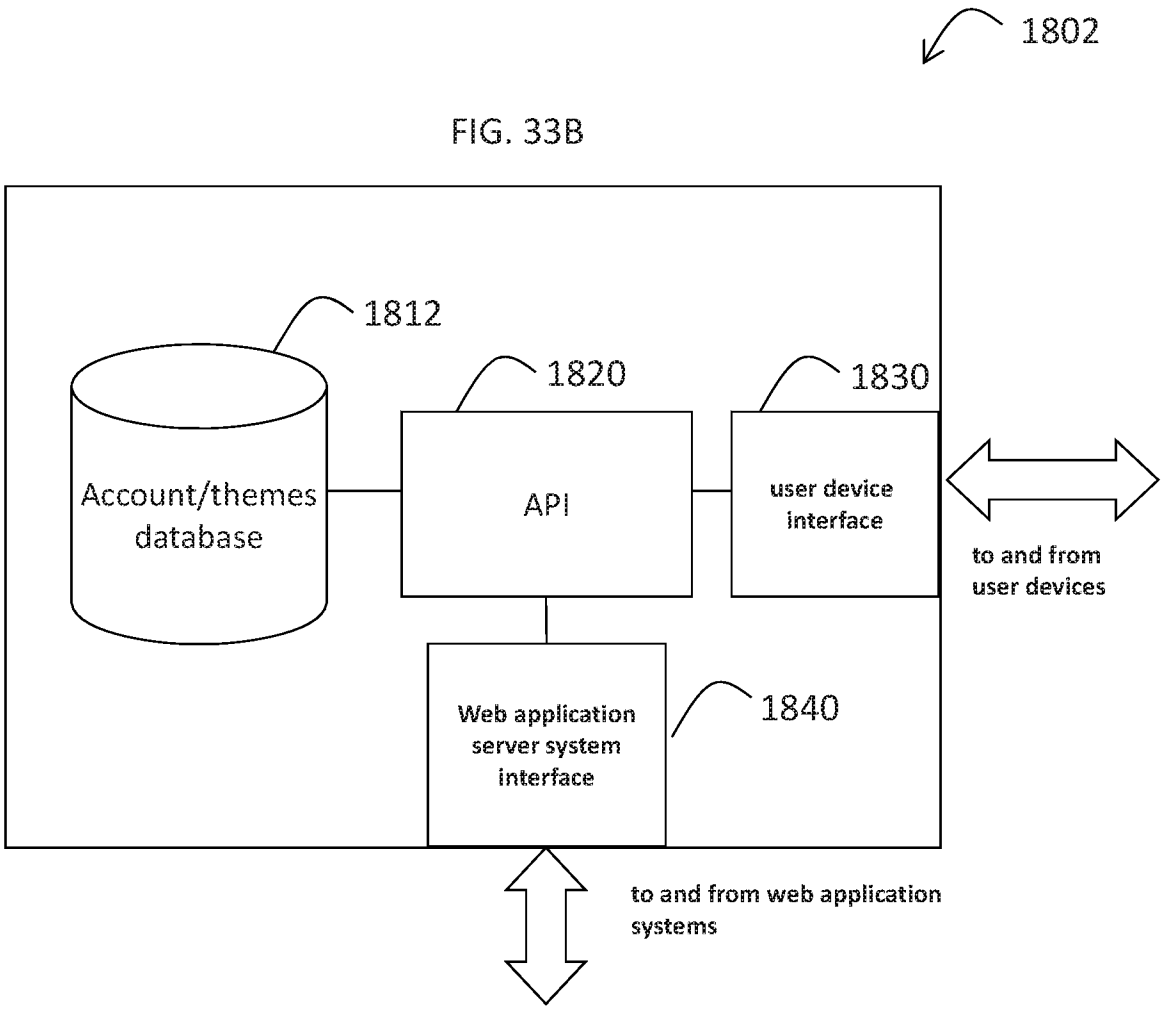

FIG. 33B shows an example embodiment of a network connected server system.

Figure 33C:
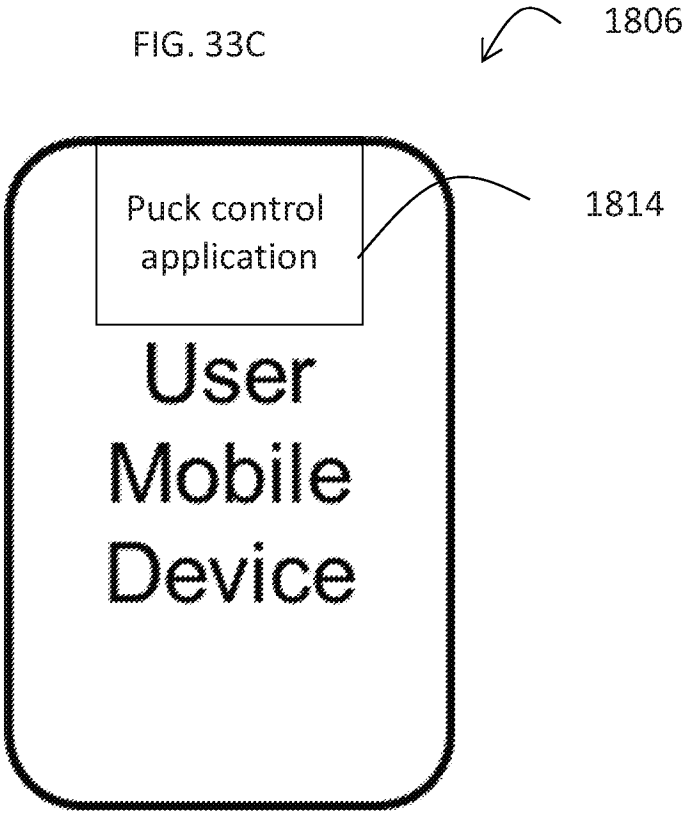

FIG. 33C shows an example embodiment of a user device.

Figure 34A:
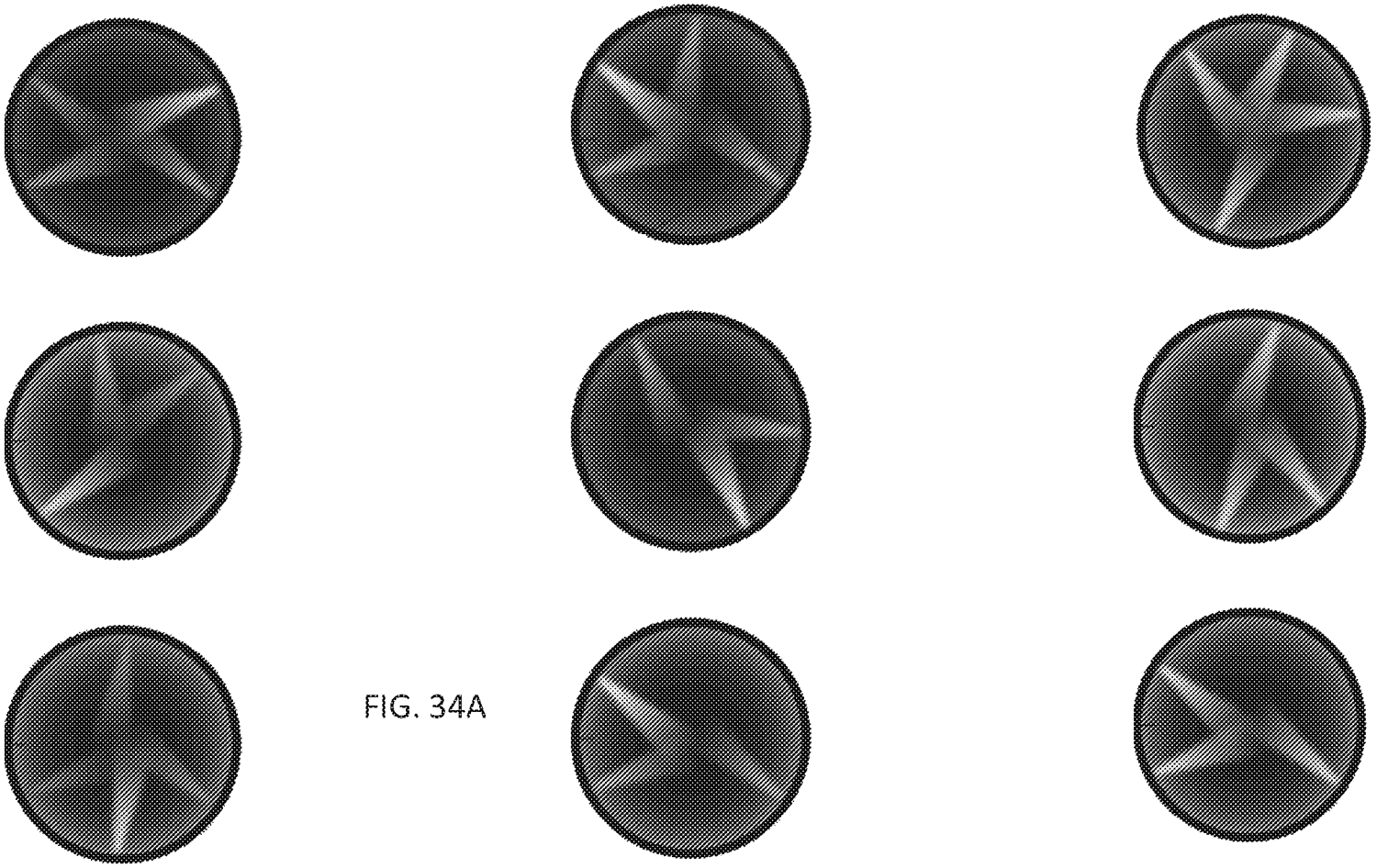
Figure 34B:
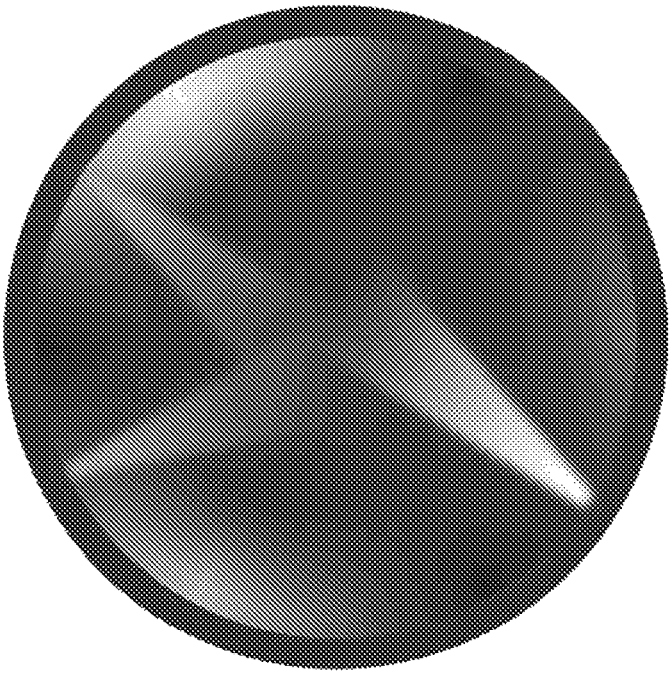
Figure 34C:
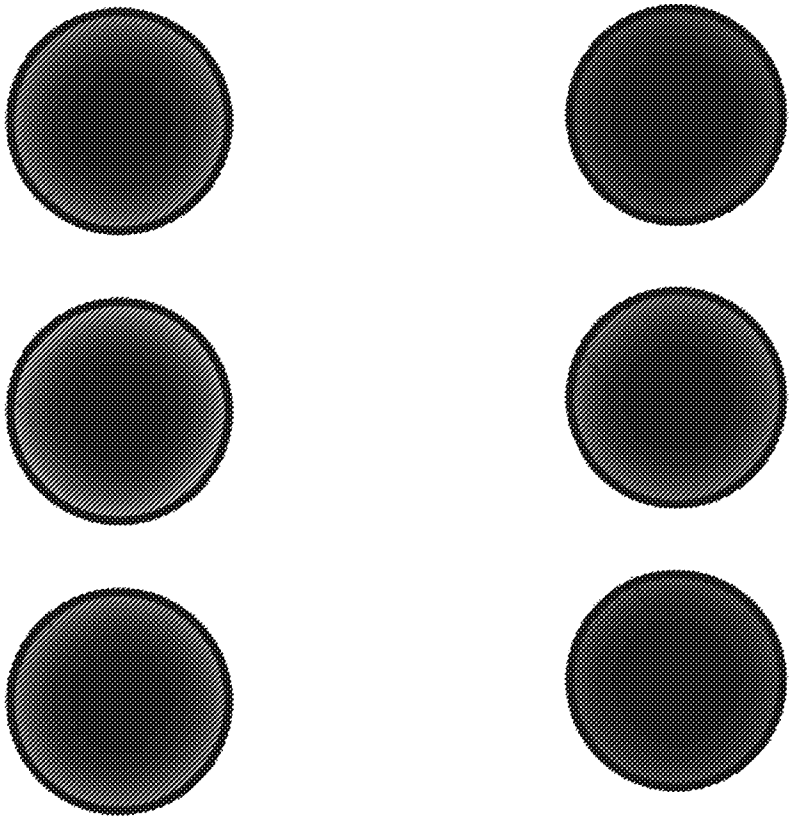

FIGS. 34A-34C show example embodiments of lighting schemes for an LED lighting puck.

FIGS. 35A-35G show example embodiments of an LED lighting puck and steps for construction thereof.

Figure 36C:
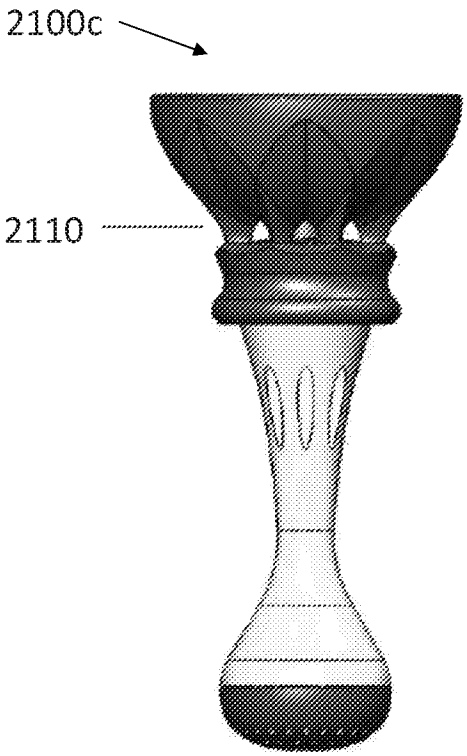
Figure 36B:
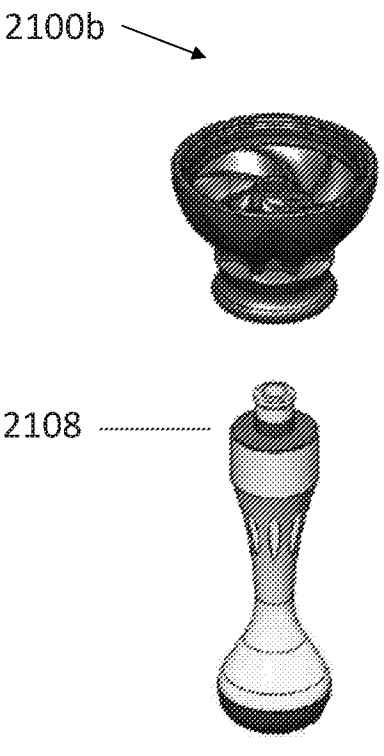
Figure 36A:
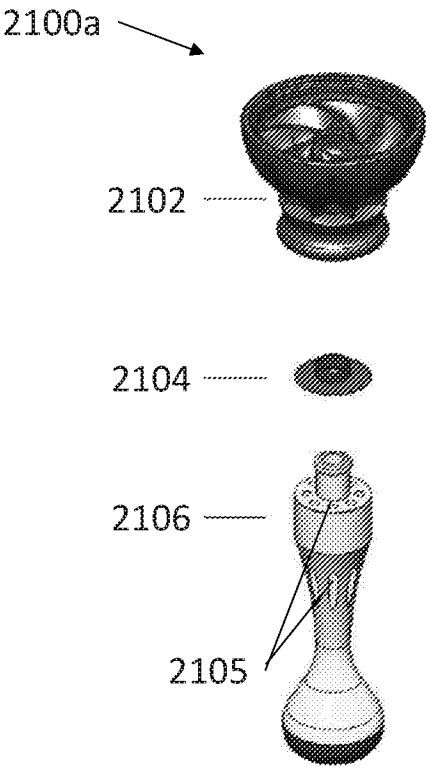

FIGS. 36A-36C show an example embodiment of an upward purge valve assembly process.

Figure 36D:
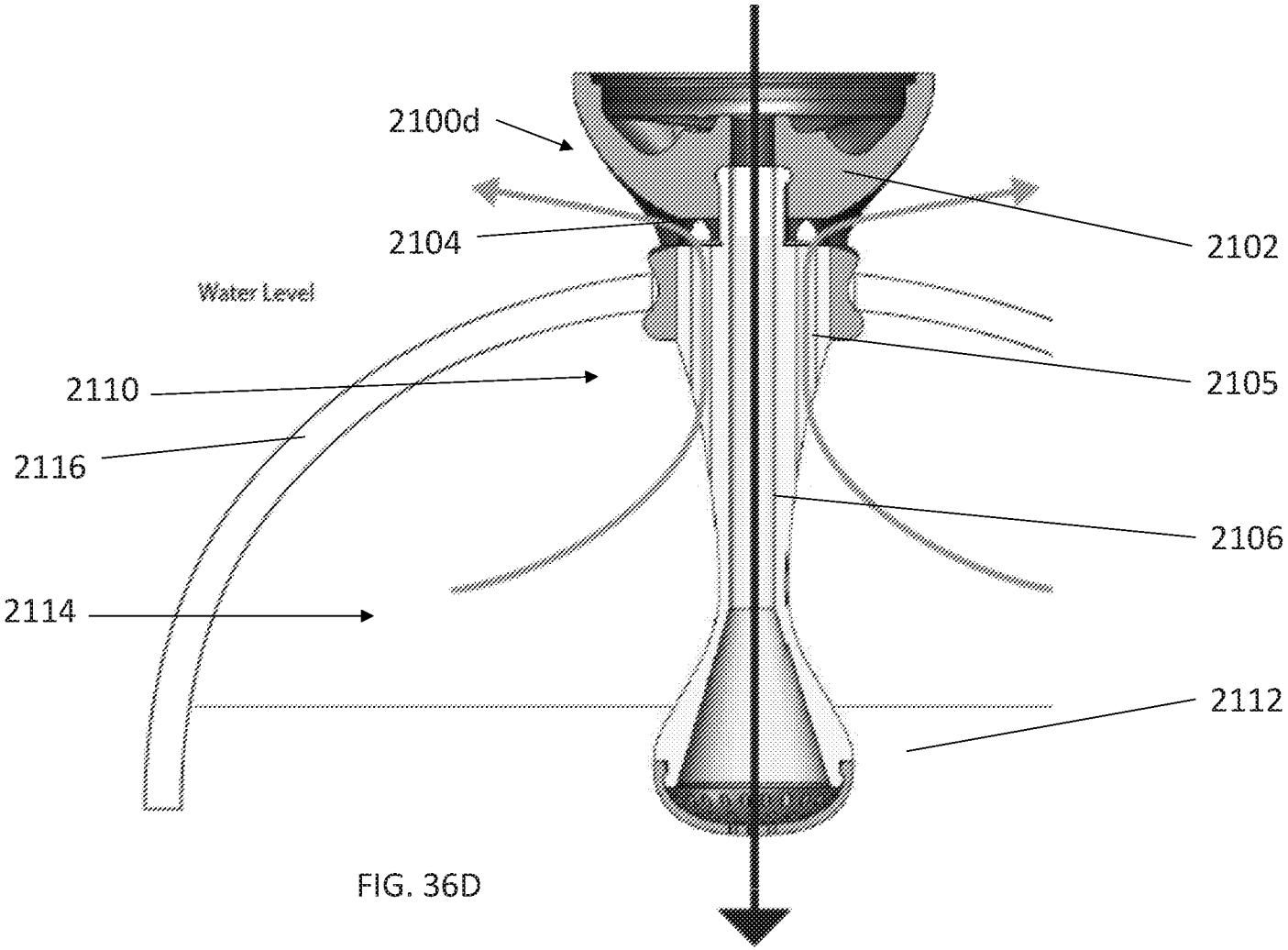

FIG. 36D shows an airflow diagram for an upward purge valve assembly.

Figures 37A, 37B:
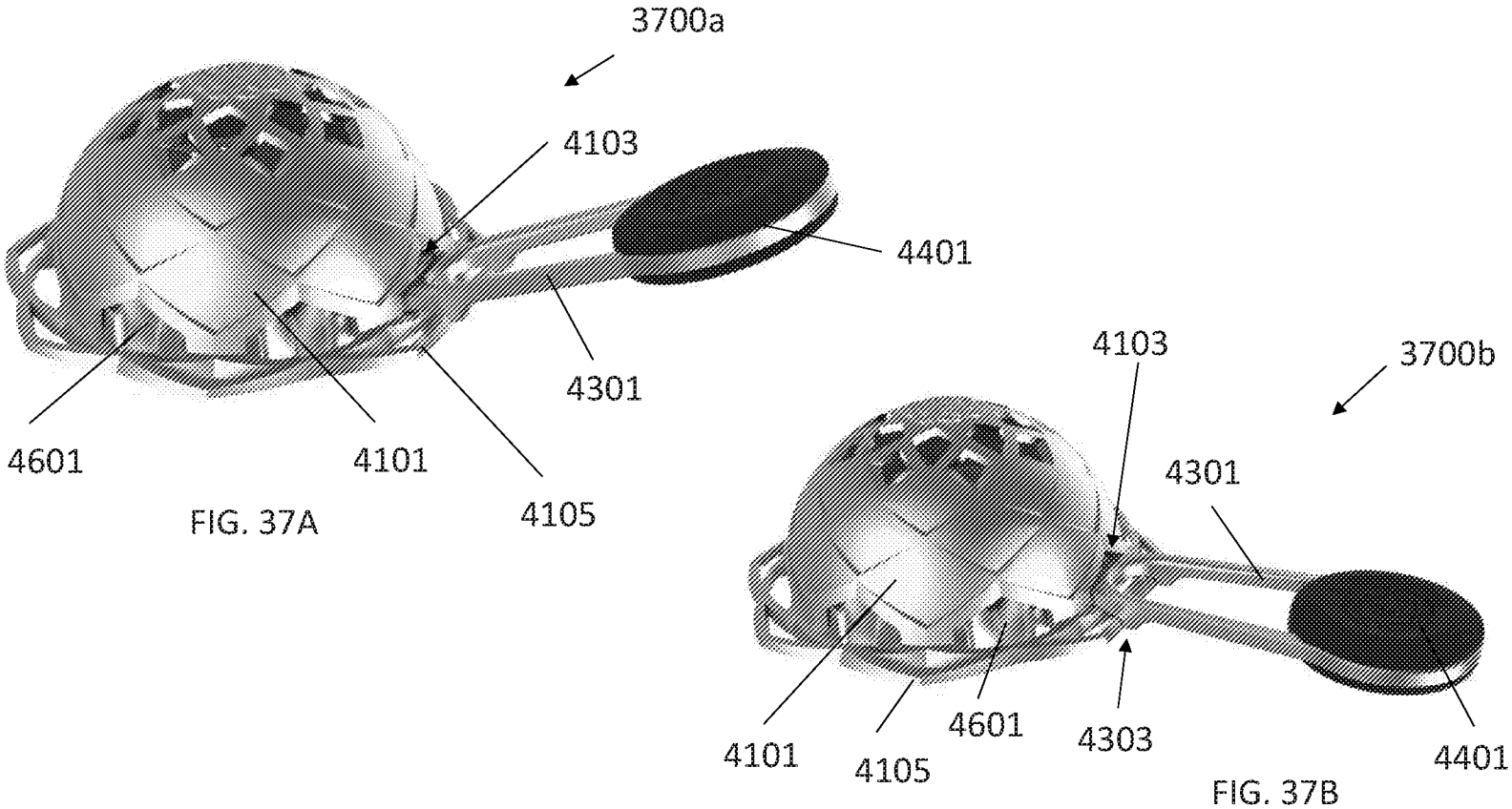

FIGS. 37A-37B show an example embodiment of a heat management device domed lid, base plate, and key arm and cap from a perspective view in two orientations.

Figure 38B:
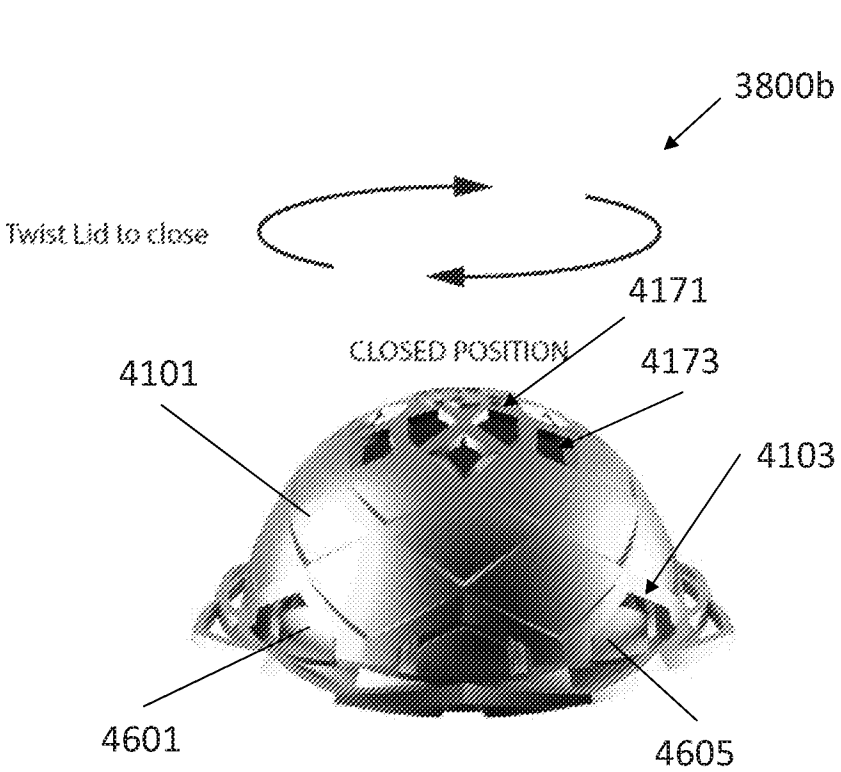
Figure 38A:
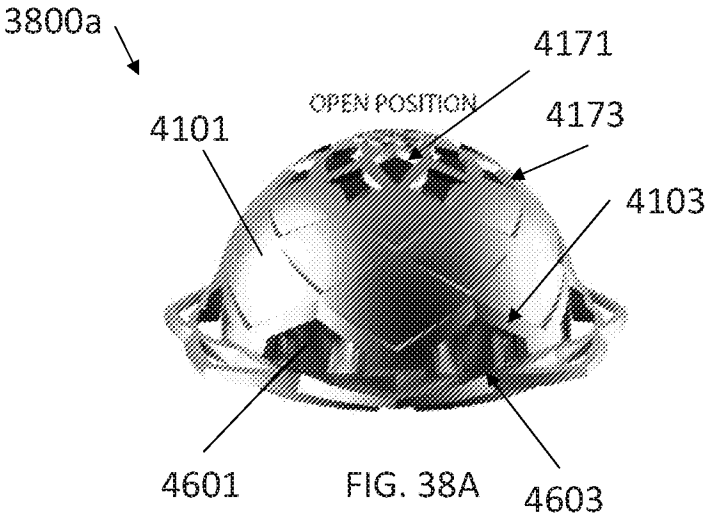

FIGS. 38A-38B show an example embodiment of a heat management device domed lid and base plate from a perspective view showing movement with relation to each other.

Figure 39:
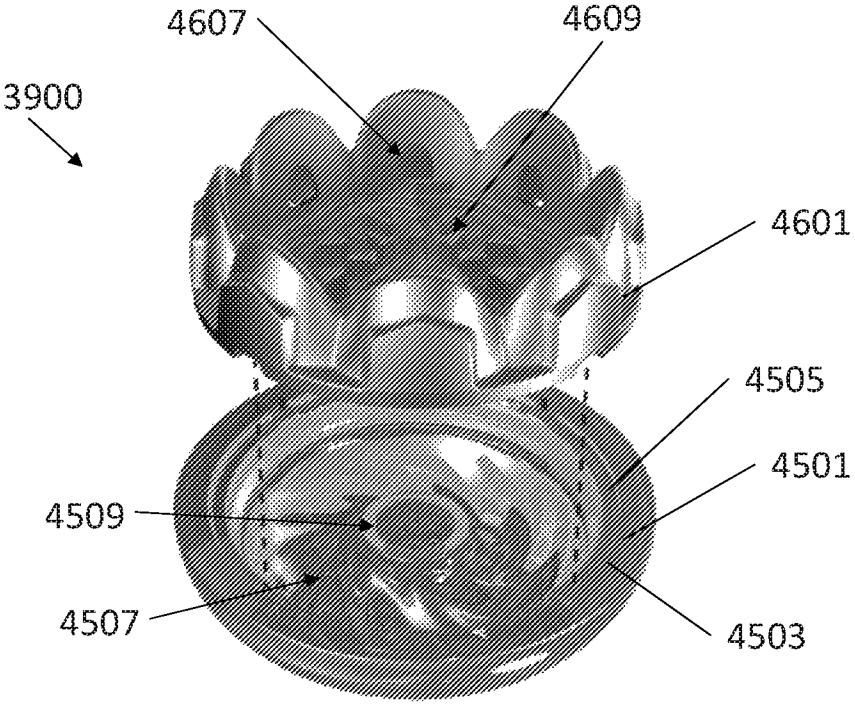

FIG. 39 shows an example embodiment of a glass bowl top and a heat management device base plate from a perspective view.

Figure 40A:
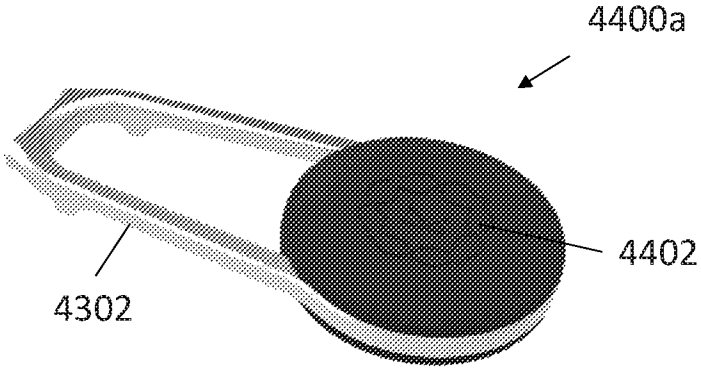
Figure 40B:
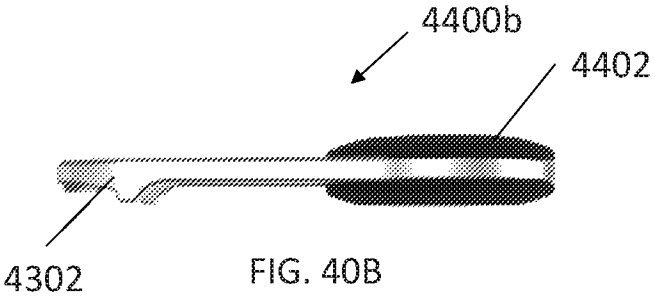

FIGS. 40A-40B show an example embodiment of a key arm and cap from a perspective view and side view.

FIGS. 41A-41H show example embodiments of a heat management device domed lid with different sizes, shapes, and quantities of vent openings.

FIGS. 42A-42D show an example embodiment of a heat management device domed lid from a side cross-sectional view, perspective mockup view, top view, and side view, respectively.

Figure 42B:
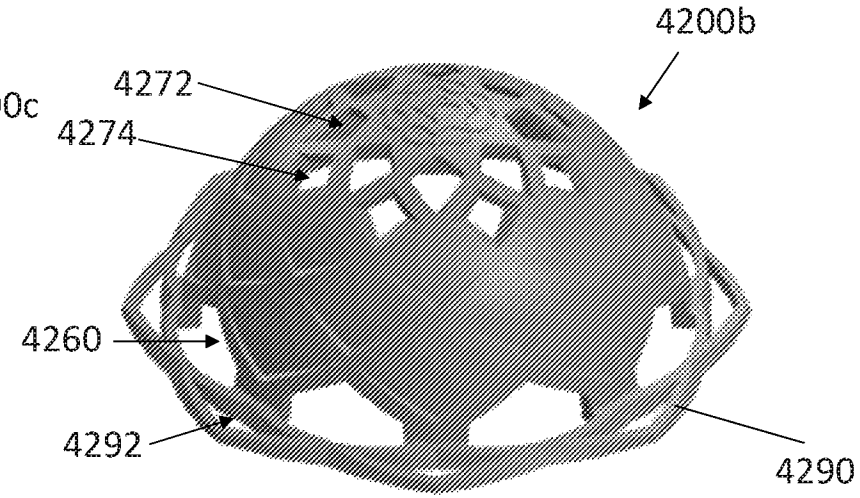
Figure 42A:
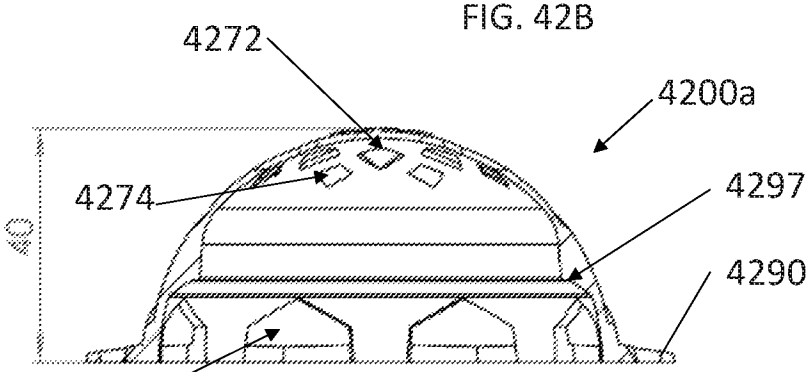
Figure 42C:
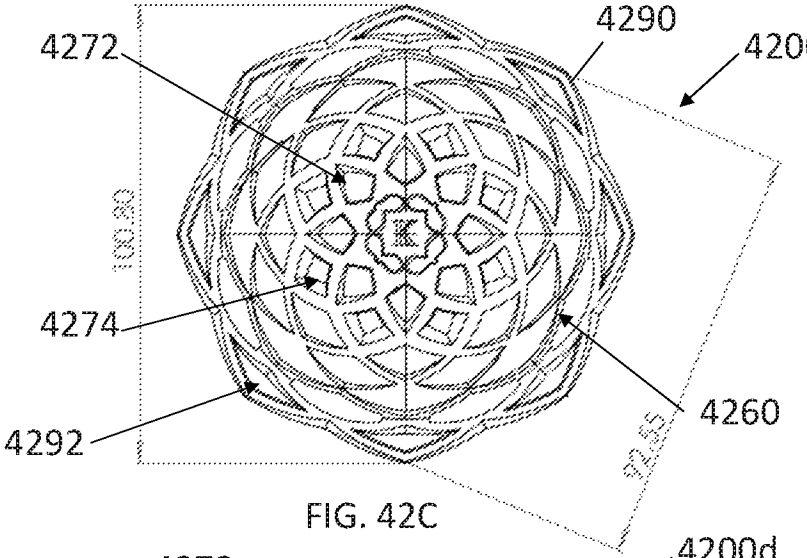
Figure 42D:
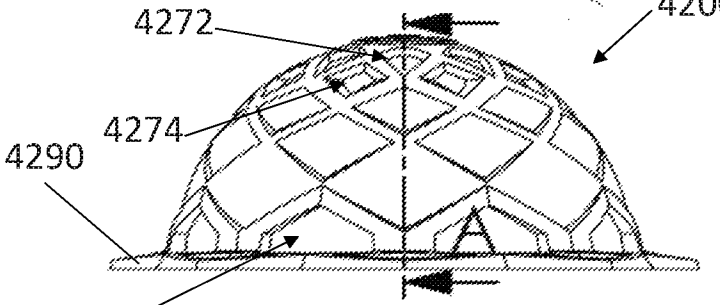
Figure 42E:
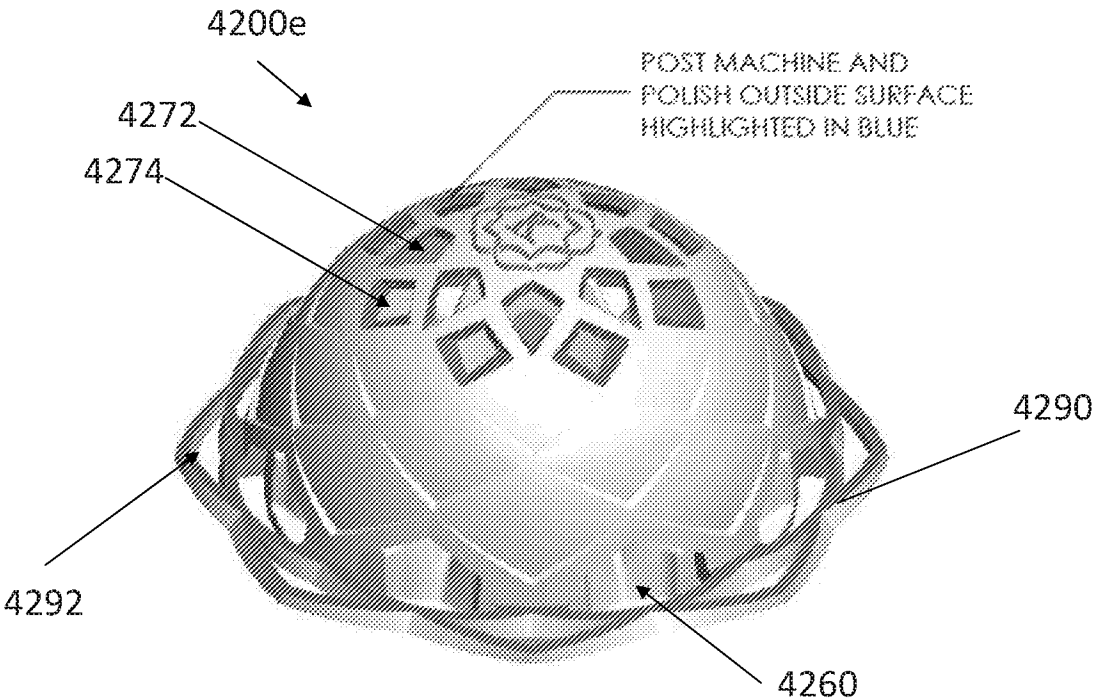

FIG. 42E shows an example embodiment of a heat management device domed lid from a perspective mockup view.

FIGS. 43A-43E show an example embodiment of a heat management device key arm from an end view, perspective mockup view, bottom view, top view, and side view, respectively.

FIGS. 44A-44E show an example embodiment of a heat management device key cap from a top view, perspective mockup view, front view, back view, and side view, respectively.

FIGS. 45A-45D show an example embodiment of a bowl from a side view, perspective mockup view, top view, and side cross-sectional view, respectively.

Figure 46B:
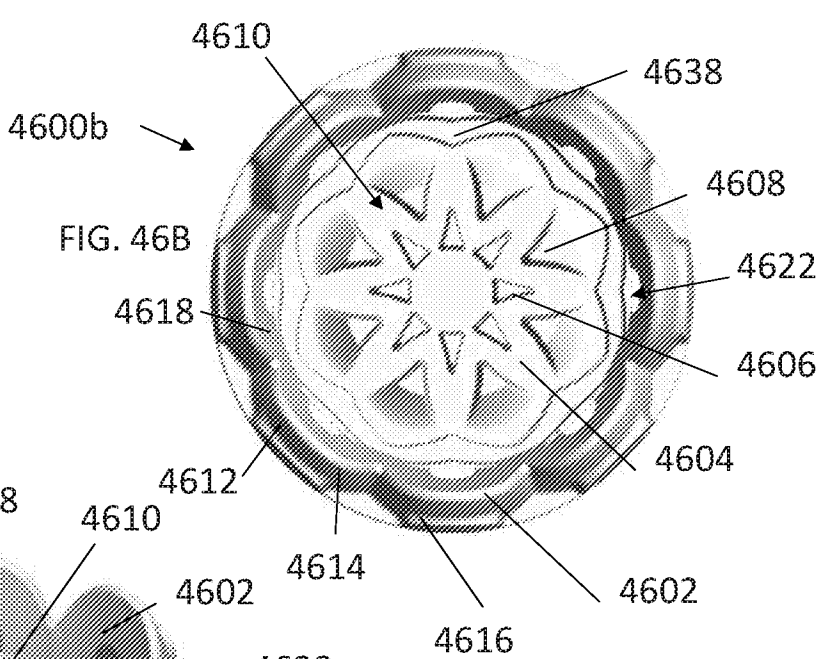
Figure 46A:
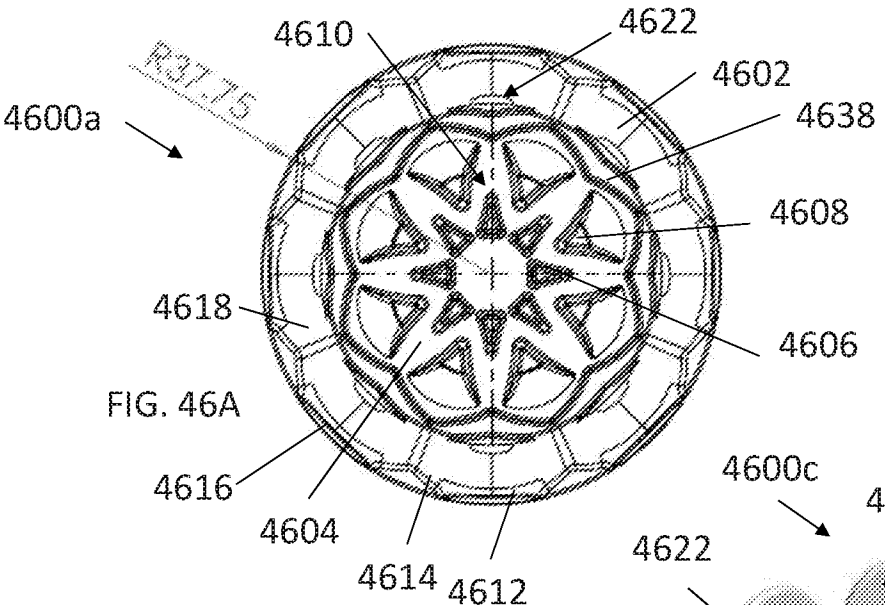
Figure 46C:
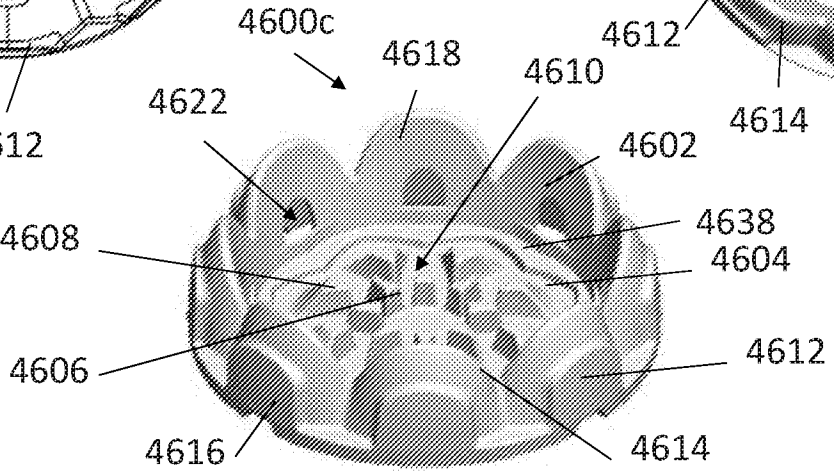
Figure 46E:
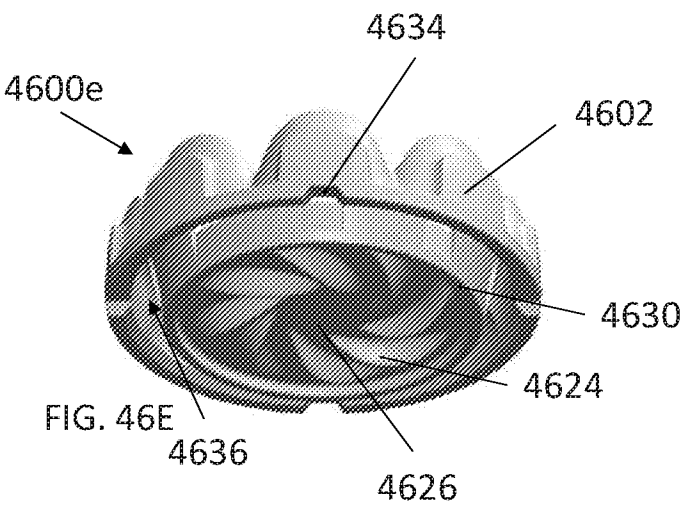
Figure 46D:
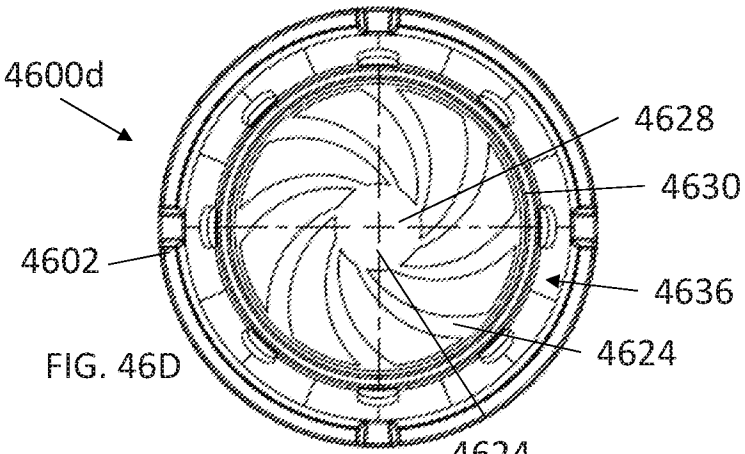
Figure 46F:
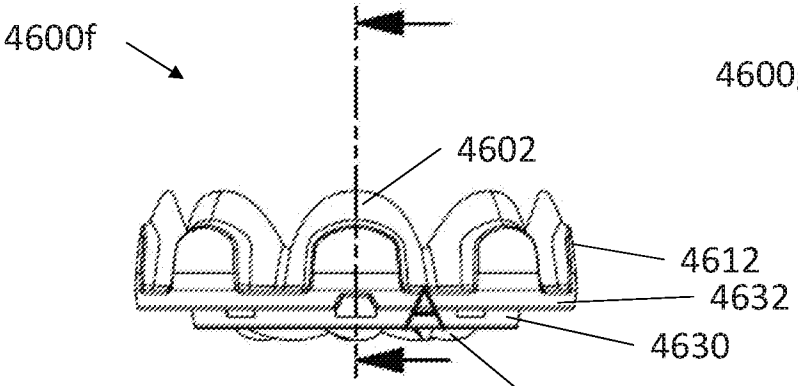
Figure 46G:
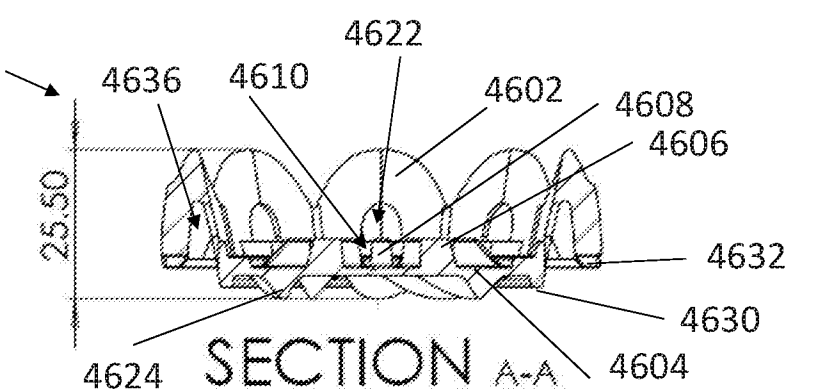

FIGS. 46A-46C show an example embodiment of a heat management device base plate from a top view, top mockup view, and top perspective mockup view, respectively.

FIGS. 46D-46G show an example embodiment of a heat management device base plate from a bottom view, bottom perspective mockup view, side view, and side cross-sectional view, respectively.

Figures 46H, 46I:
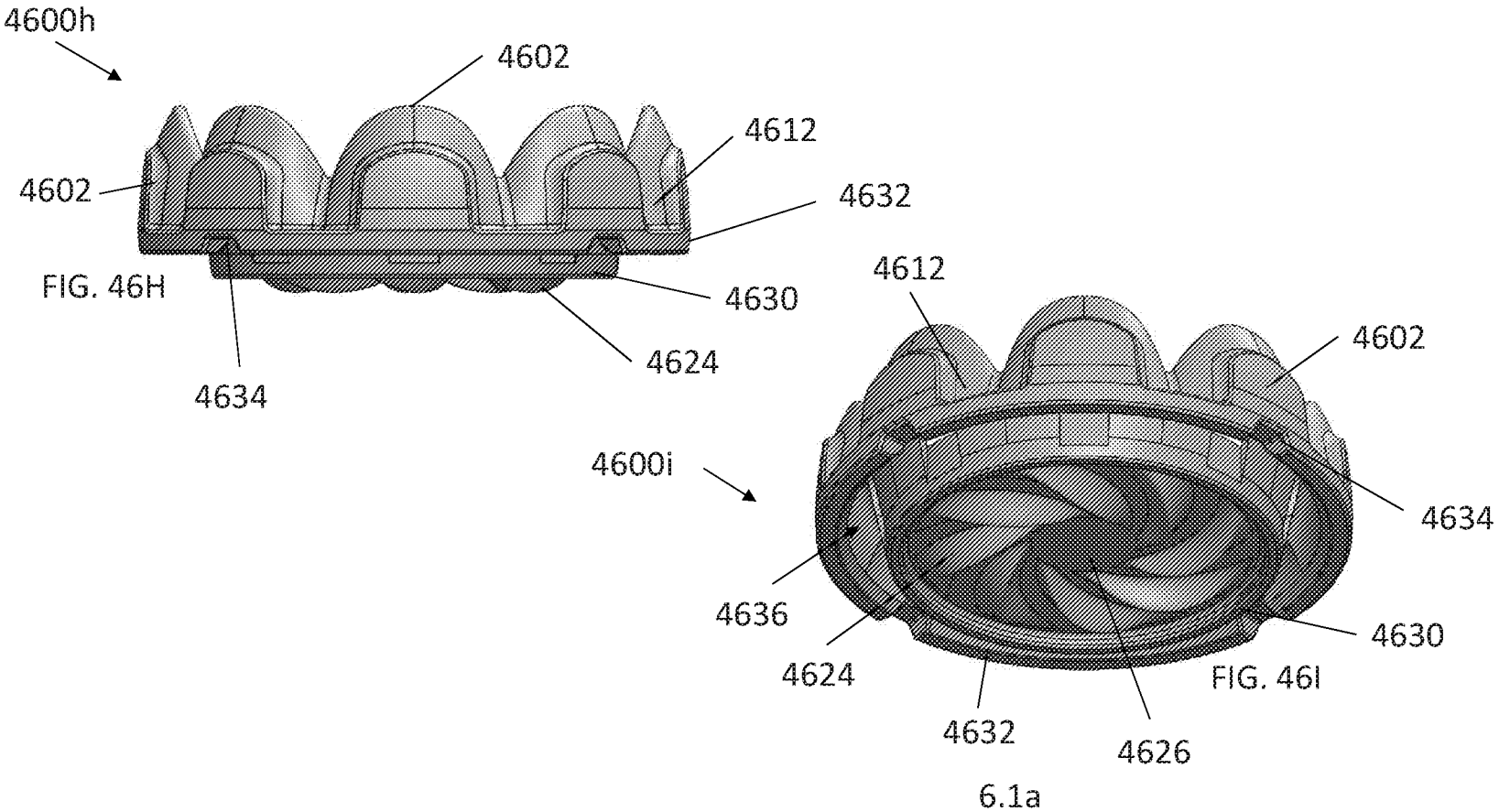

FIGS. 46H-46I show an example embodiment of a heat management device base plate from a side mockup view and bottom perspective view, respectively.

FIGS. 46J-46K show an example embodiment of a heat management device base plate from a top perspective mockup view and top mockup view, respectively.

Figure 47B:
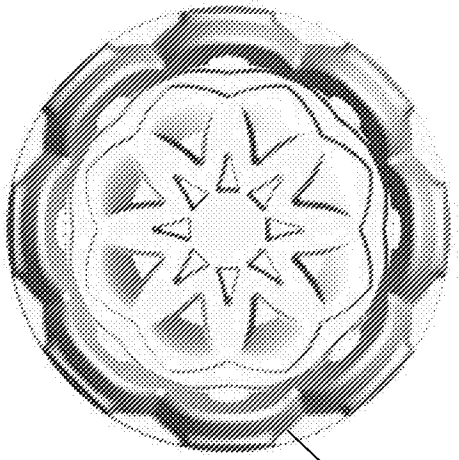
Figure 47C:
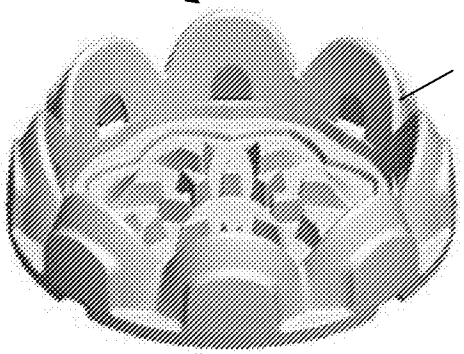
Figure 47A:
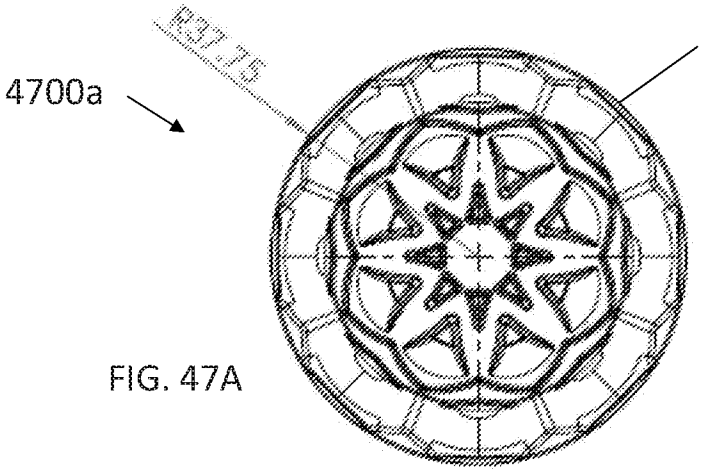
Figure 47D:
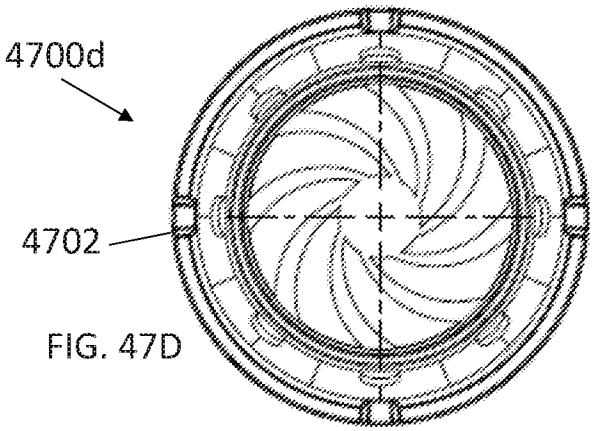

FIGS. 47A-47C show an example embodiment of a heat management device base plate from a top view, top mockup view, and top perspective mockup view, respectively.

FIGS. 47D-47G show an example embodiment of a heat management device base plate from a bottom view, bottom perspective mockup view, side view, and side cross-sectional view, respectively.

Figure 48B:
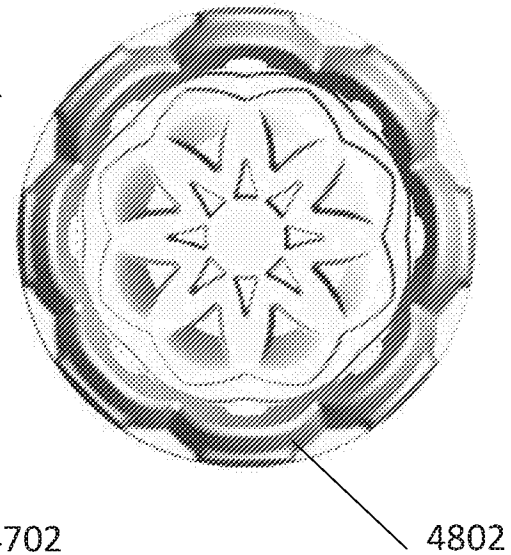
Figure 48C:
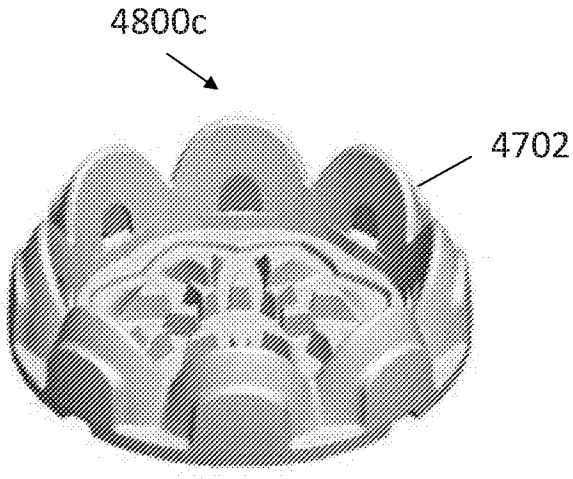
Figure 48A:
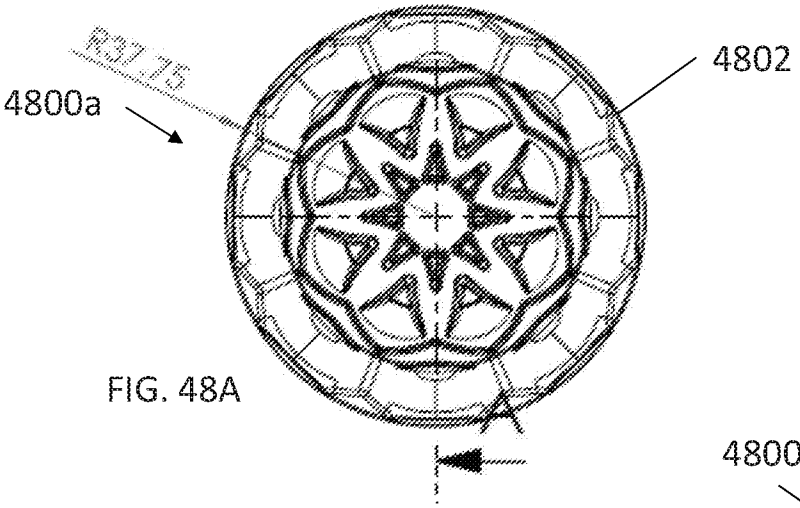
Figure 48E:
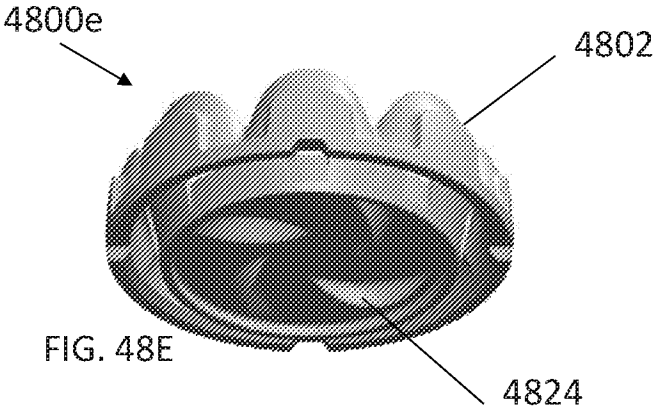
Figure 48G:
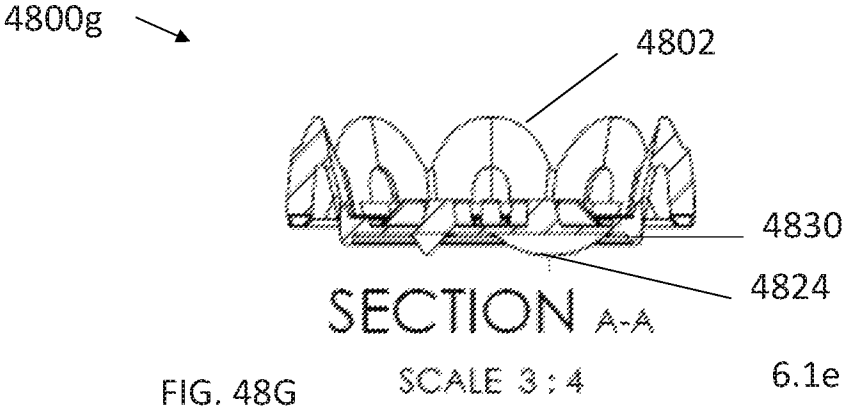
Figure 48D:
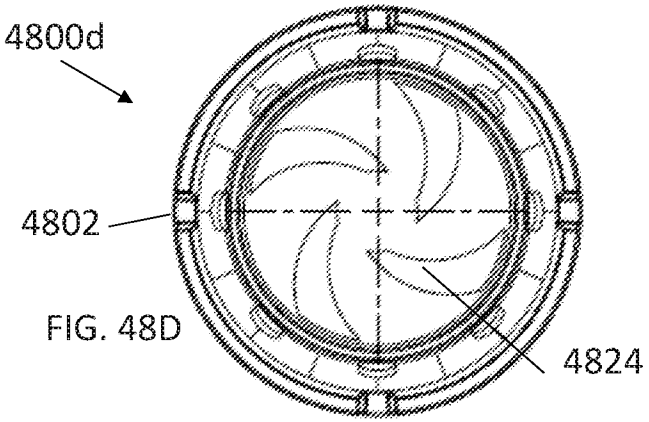
Figure 48F:
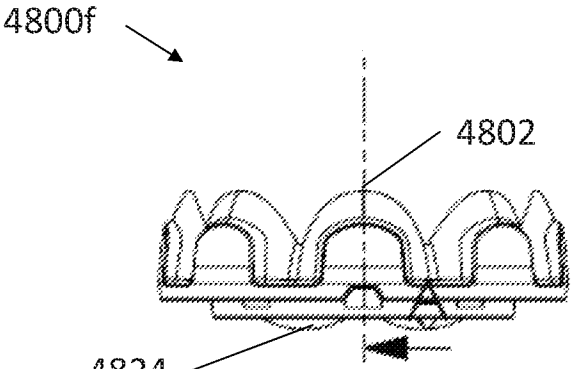

FIGS. 48A-48C show an example embodiment of a heat management device base plate from a top view, top mockup view, and top perspective mockup view, respectively.

FIGS. 48D-48G show an example embodiment of a heat management device base plate from a bottom view, bottom perspective mockup view, side view, and side cross-sectional view, respectively.

Figures 49A, 49B, 49C:
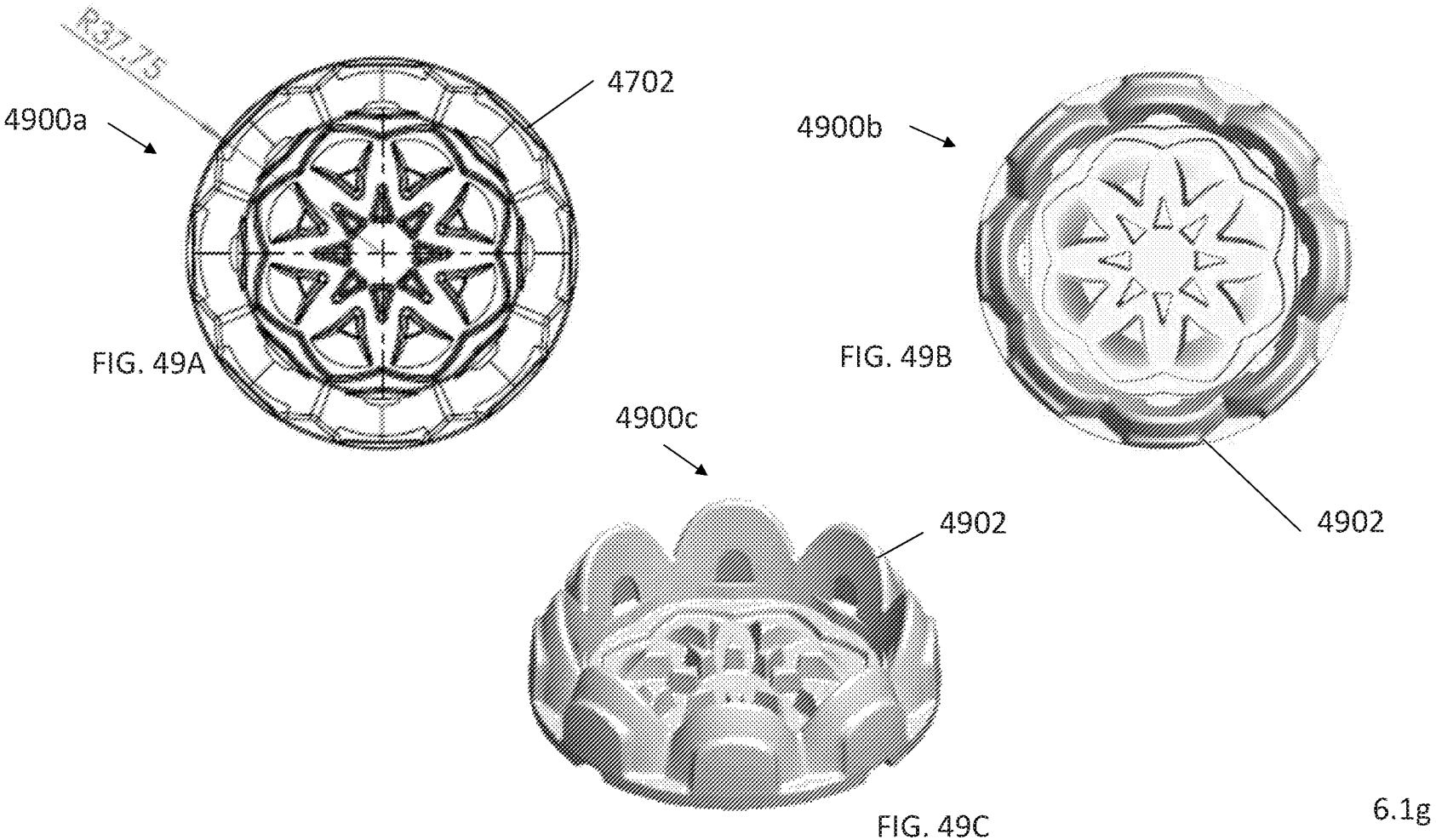
Figure 49D:
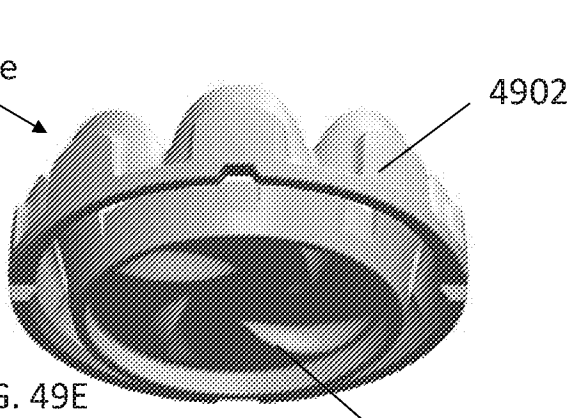
Figure 49E:
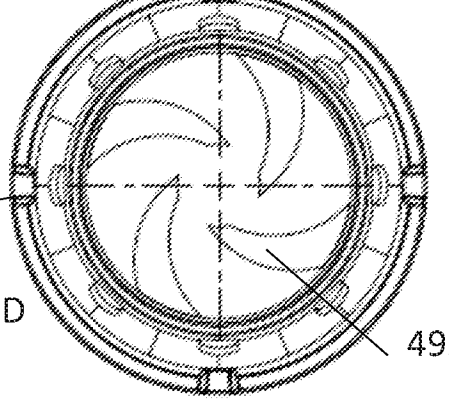
Figure 49F:
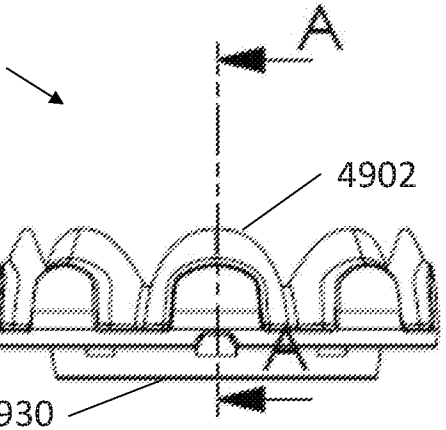
Figure 49G:
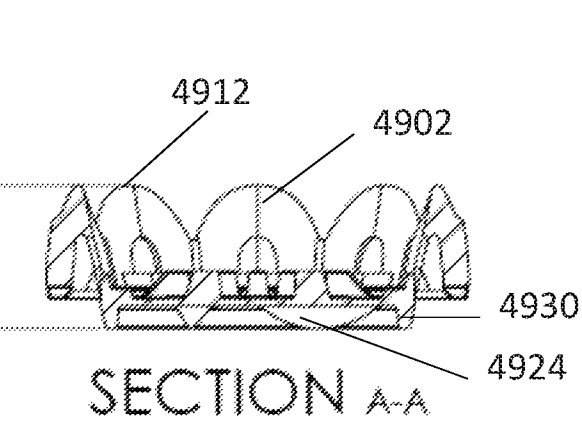

FIGS. 49A-49C show an example embodiment of a heat management device base plate from a top view, top mockup view, and top perspective mockup view, respectively.

FIGS. 49D-49G show an example embodiment of a heat management device base plate from a bottom view, bottom perspective mockup view, side view, and side cross-sectional view, respectively.

Figure 50B:
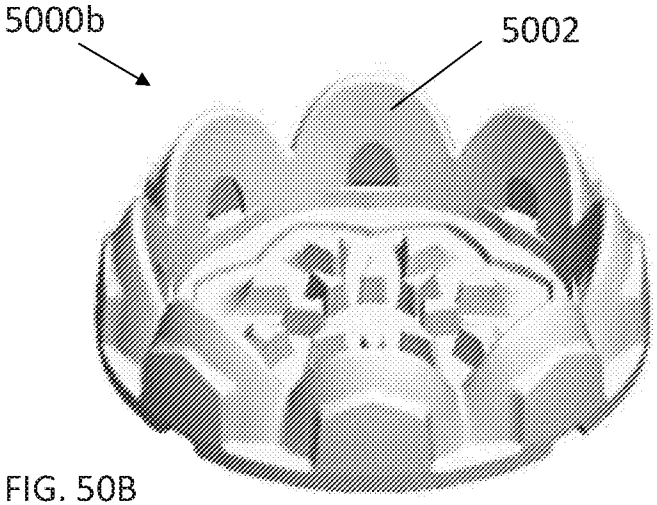
Figure 50A:
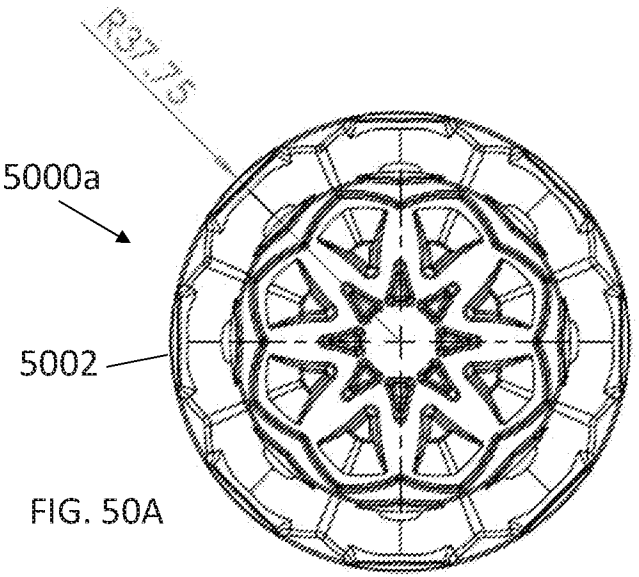
Figure 50D:
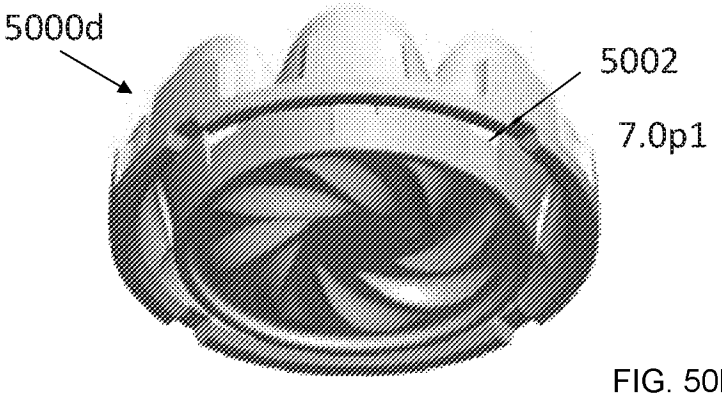

FIGS. 50A-50B show an example embodiment of a heat management device base plate from a top view and top perspective mockup view, respectively.

FIGS. 50C-50F show an example embodiment of a heat management device base plate from a bottom view, bottom perspective mockup view, side view, and side perspective mockup view, respectively.

Figure 51B:
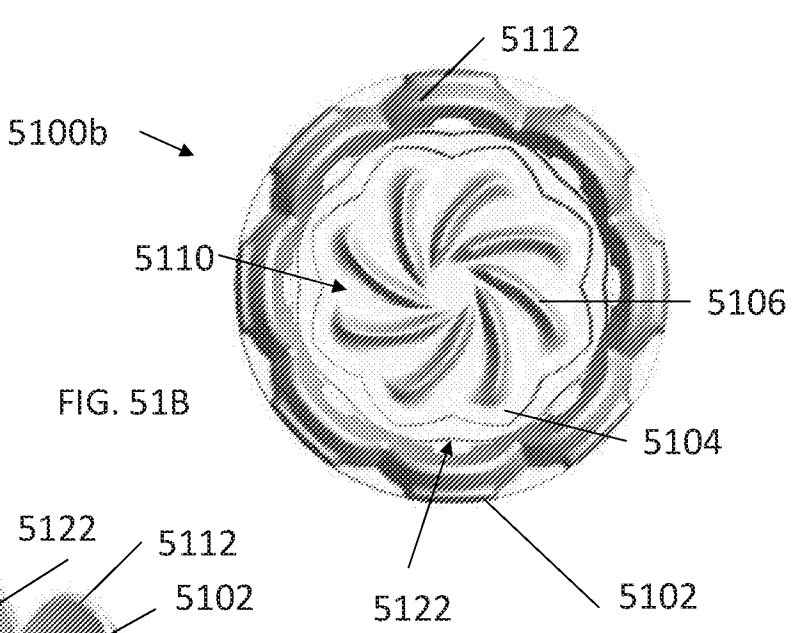
Figure 51A:
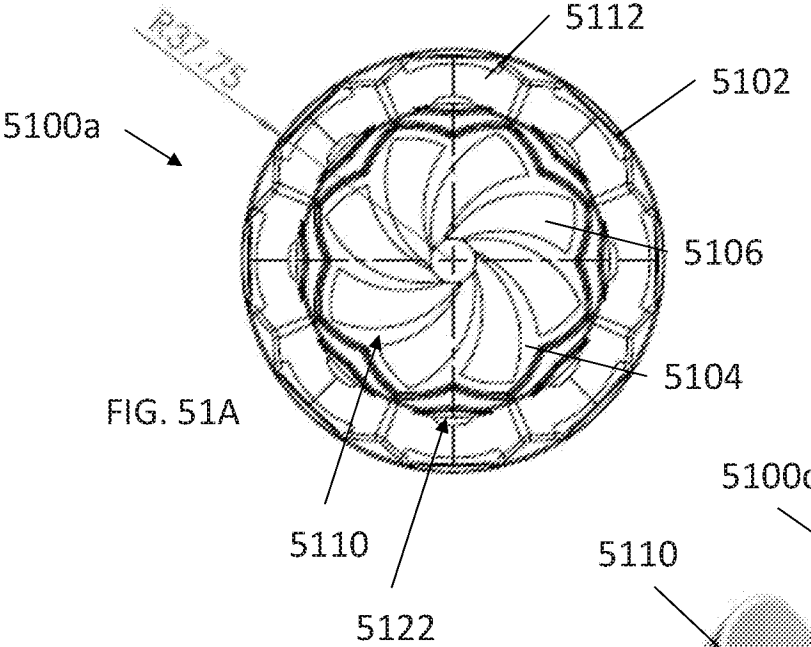
Figure 51C:
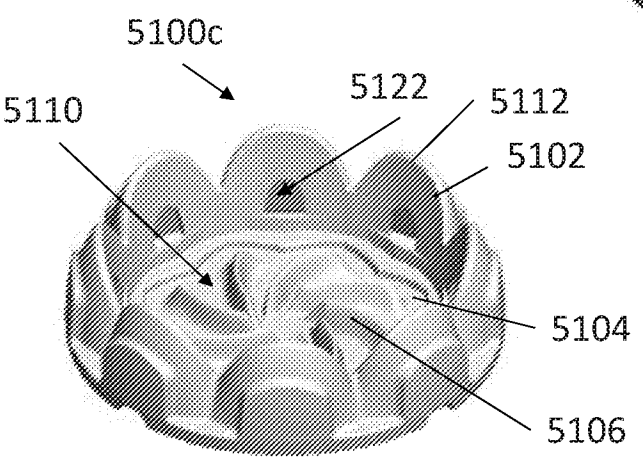
Figure 51E:
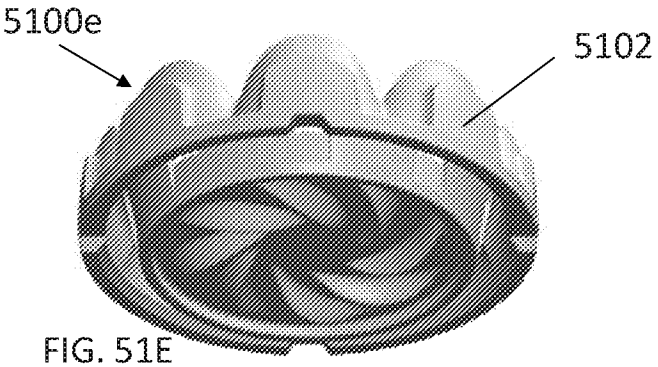
Figure 51G:
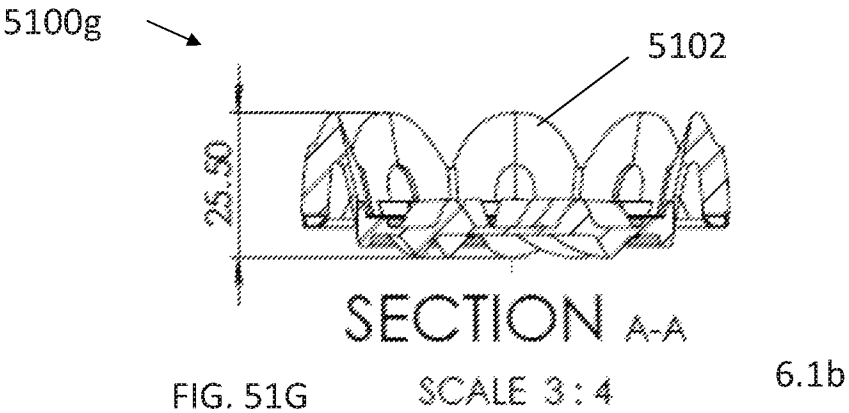
Figure 51D:
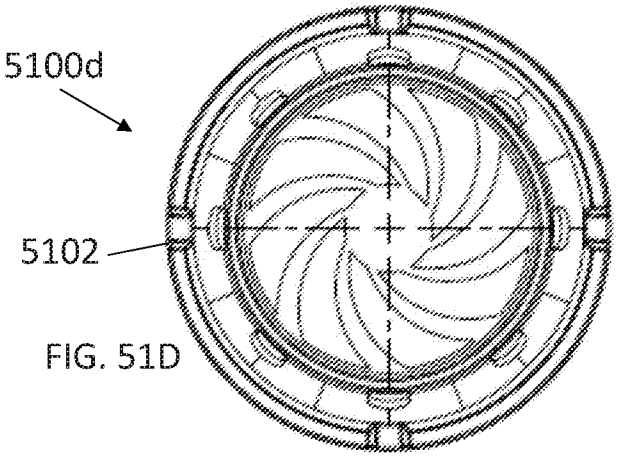
Figure 51F:
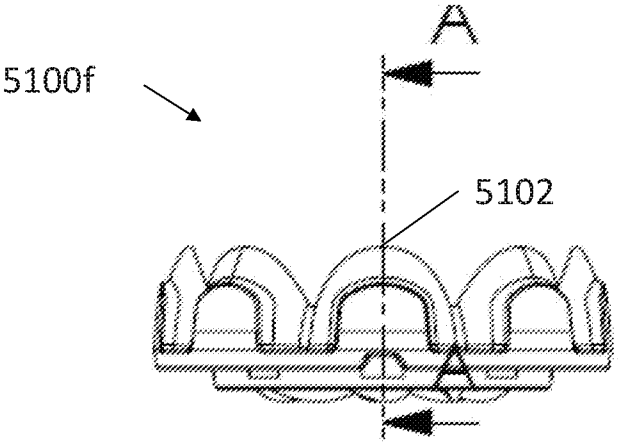

FIGS. 51A-51C show an example embodiment of a heat management device base plate from a top view, top mockup view, and top perspective mockup view, respectively.

FIGS. 51D-51G show an example embodiment of a heat management device base plate from a bottom view, bottom perspective mockup view, side view, and side cross-sectional view, respectively.

Figure 52A:
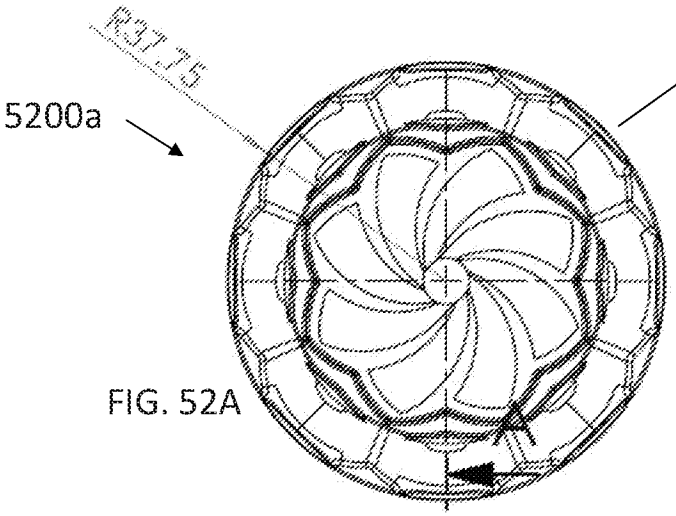
Figure 52B:
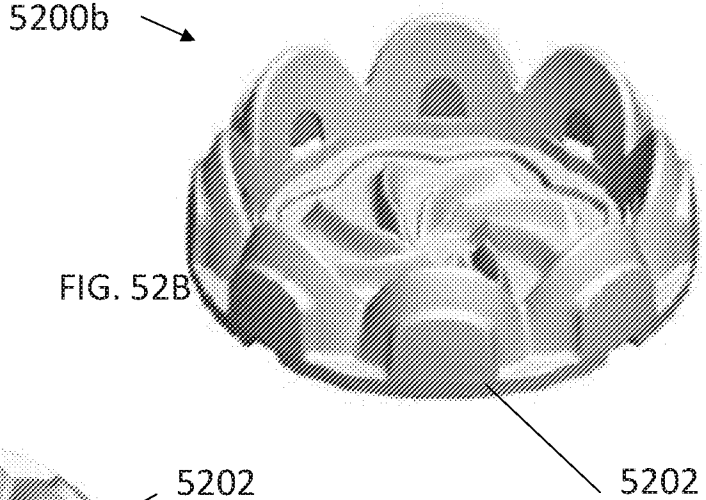
Figure 52C:
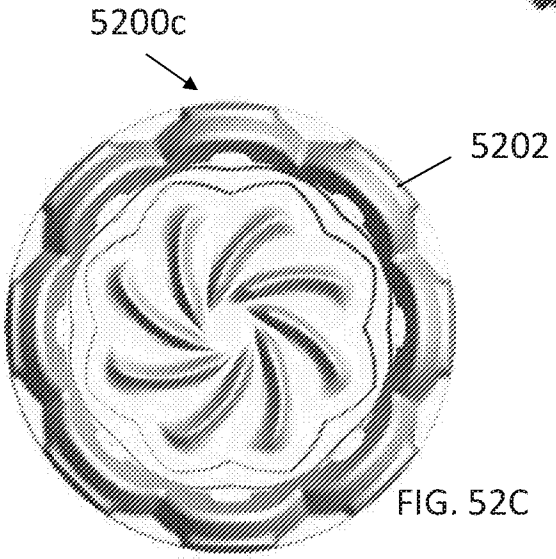
Figure 52E:
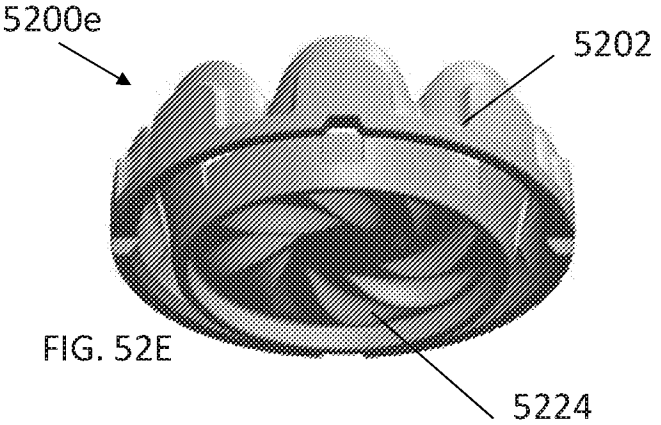
Figure 52G:
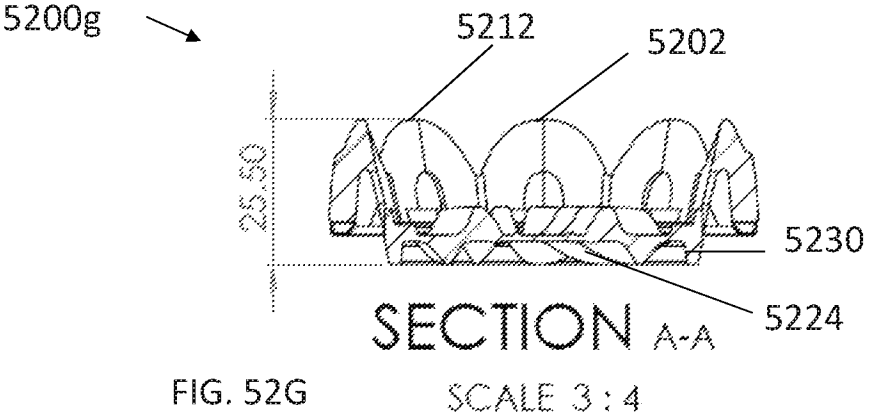
Figure 52D:
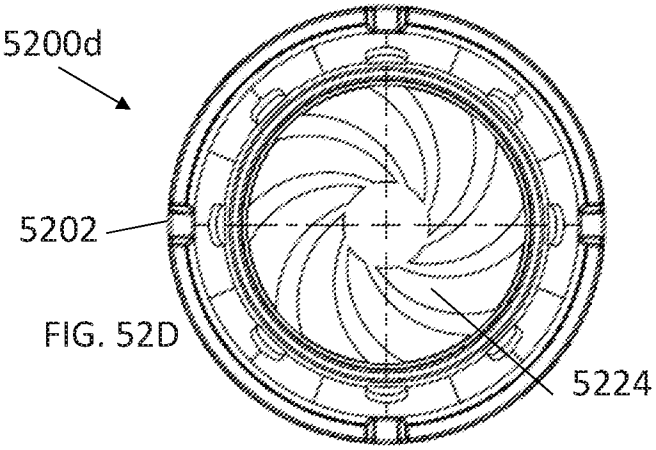
Figure 52F:
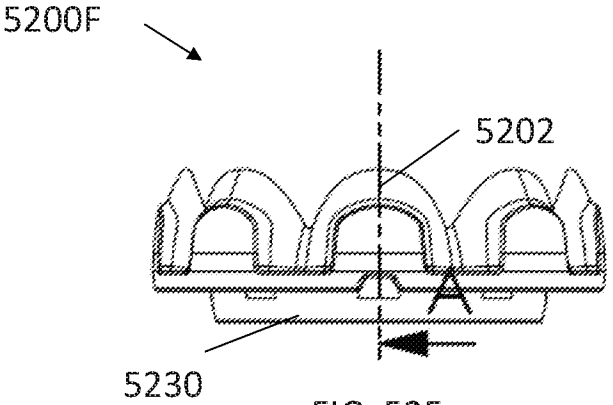

FIGS. 52A-52C show an example embodiment of a heat management device base plate from a top view, top mockup view, and top perspective mockup view, respectively.

FIGS. 52D-52G show an example embodiment of a heat management device base plate from a bottom view, bottom perspective mockup view, side view, and side cross-sectional view, respectively.

Figure 53E:
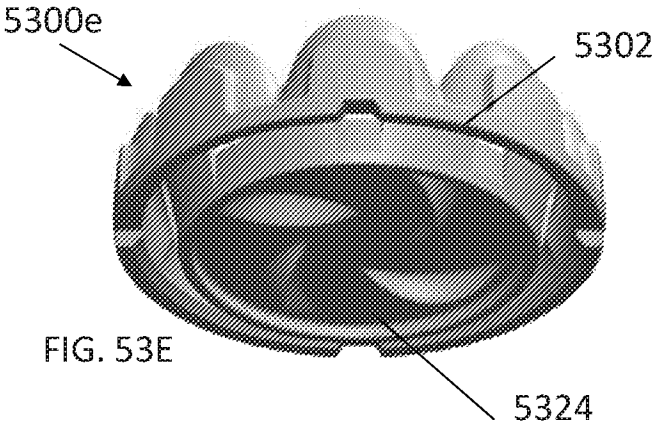
Figure 53G:
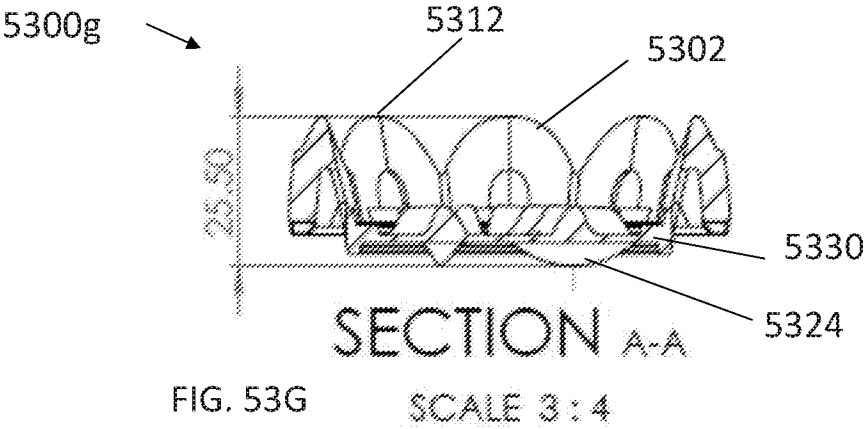
Figure 53D:
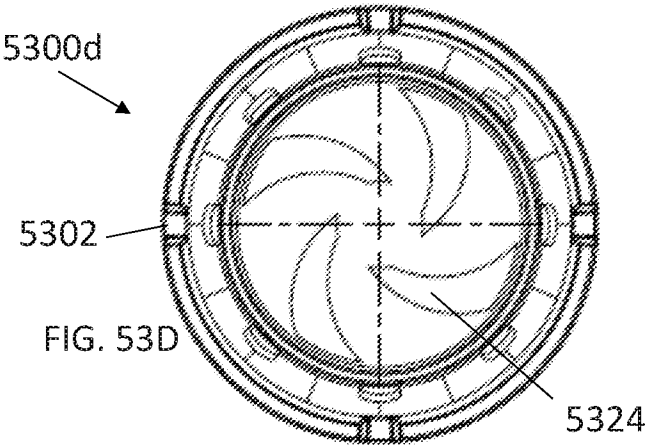
Figure 53F:
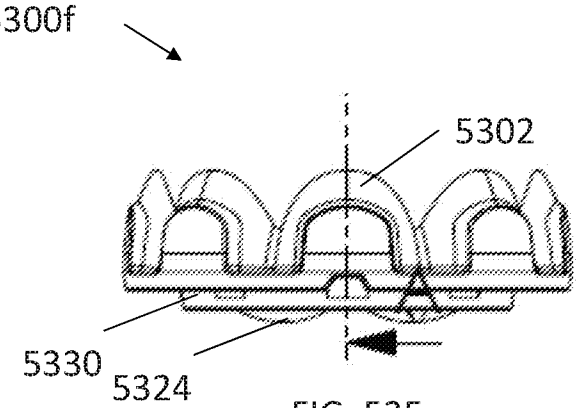

FIGS. 53A-53C show an example embodiment of a heat management device base plate from a top view, top mockup view, and top perspective mockup view, respectively.

FIGS. 53D-53G show an example embodiment of a heat management device base plate from a bottom view, bottom perspective mockup view, side view, and side cross-sectional view, respectively.

Figure 54B:
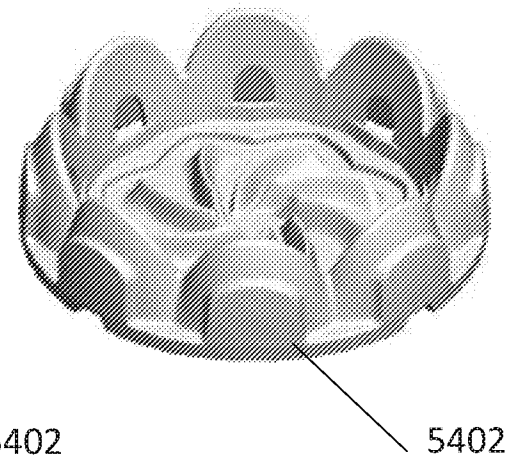
Figure 54C:
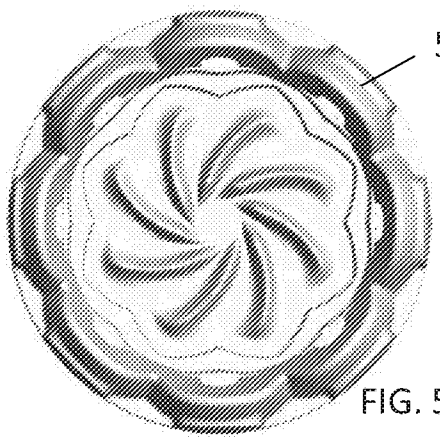
Figure 54A:
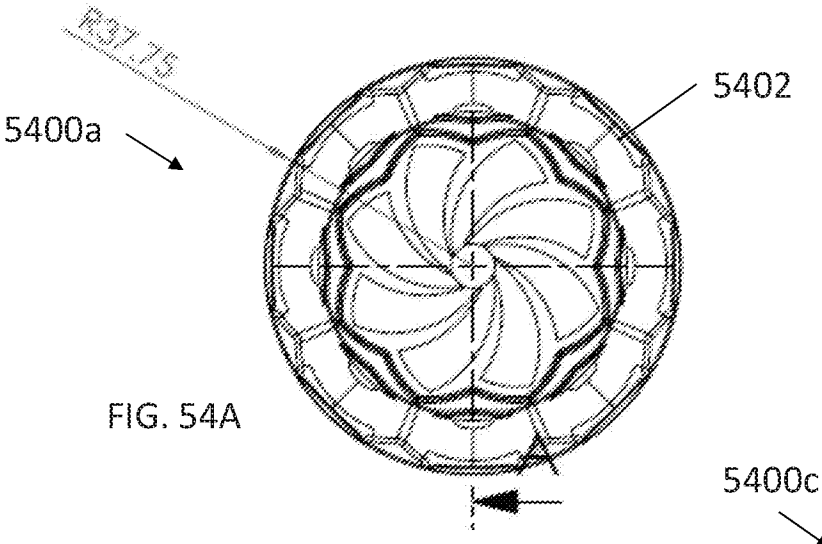
Figure 54E:
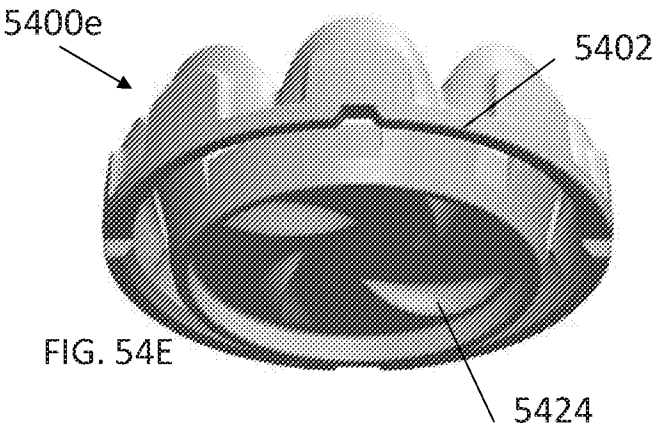
Figure 54G:
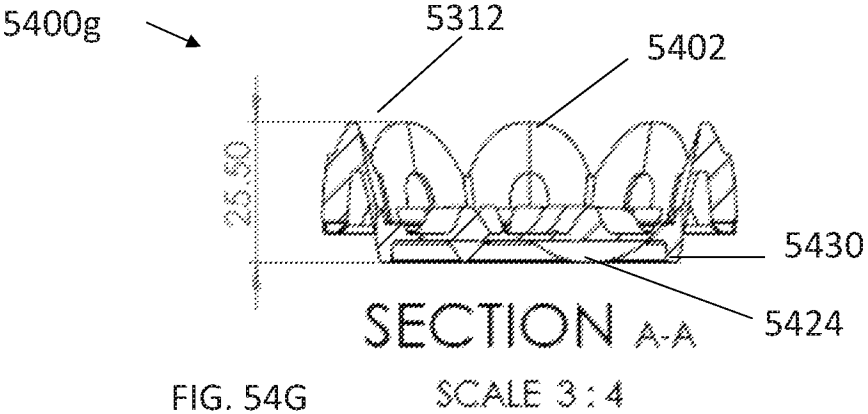
Figure 54D:
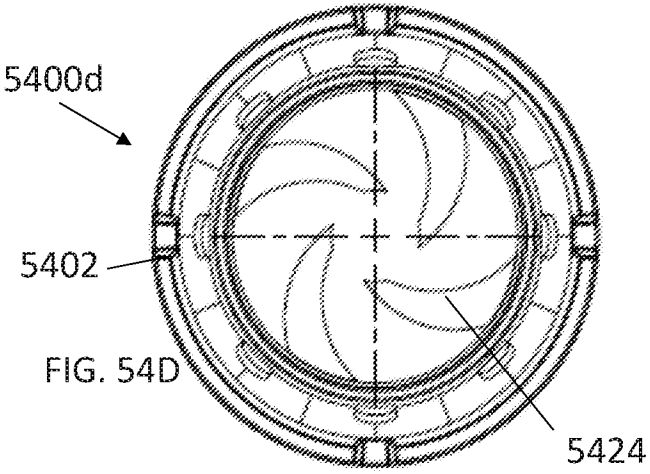
Figure 54F:
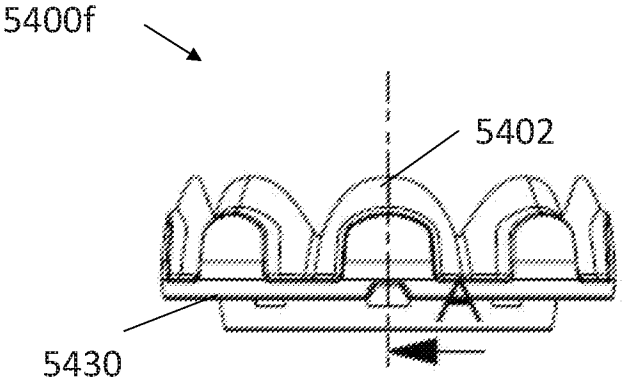

FIGS. 54A-54C show an example embodiment of a heat management device base plate from a top view, top mockup view, and top perspective mockup view, respectively.

FIGS. 54D-54G show an example embodiment of a heat management device base plate from a bottom view, bottom perspective mockup view, side view, and side cross-sectional view, respectively.

Figure 55:
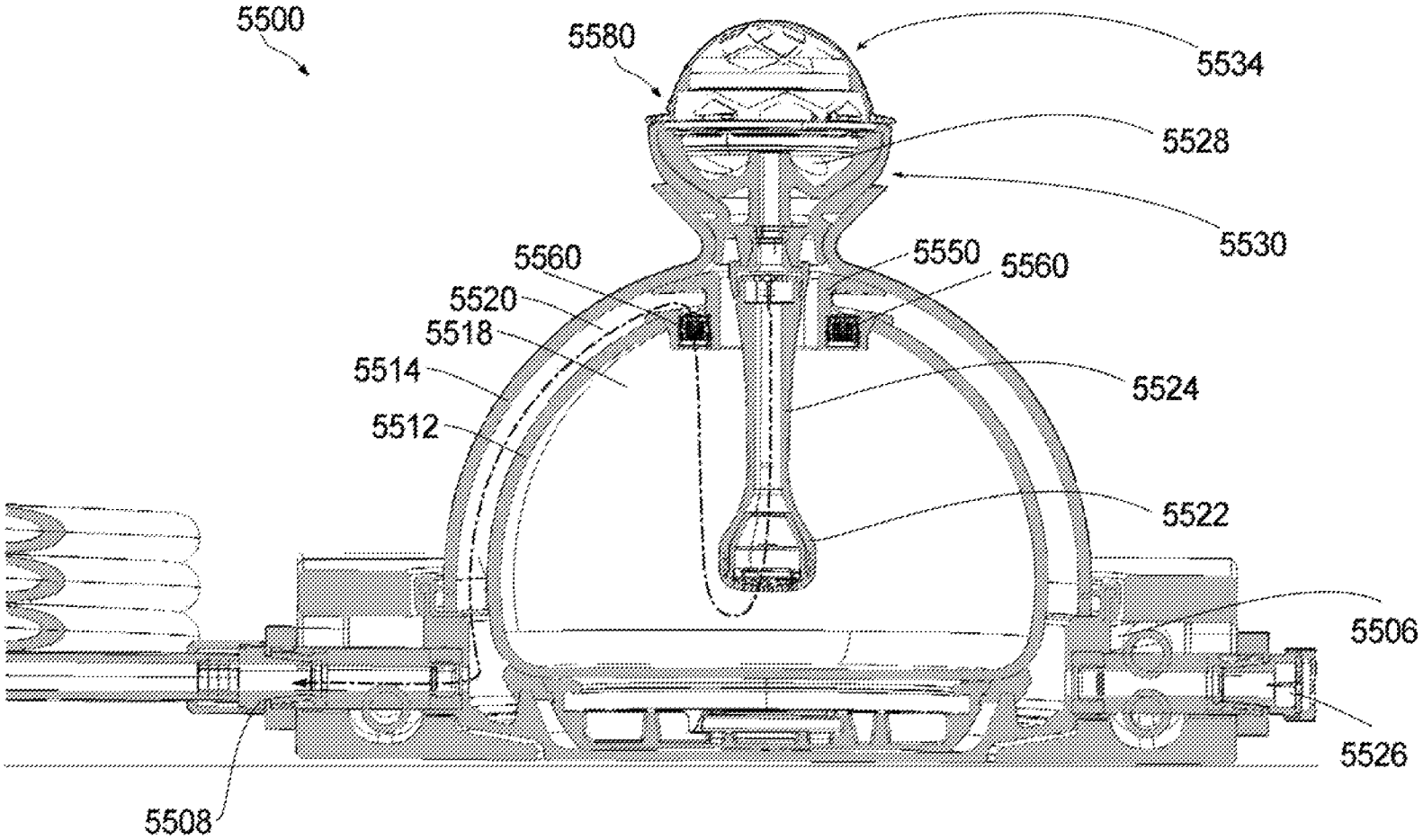

FIG. 55 shows an example cross-sectional view of a water pipe system according to one embodiment.

Figure 56:
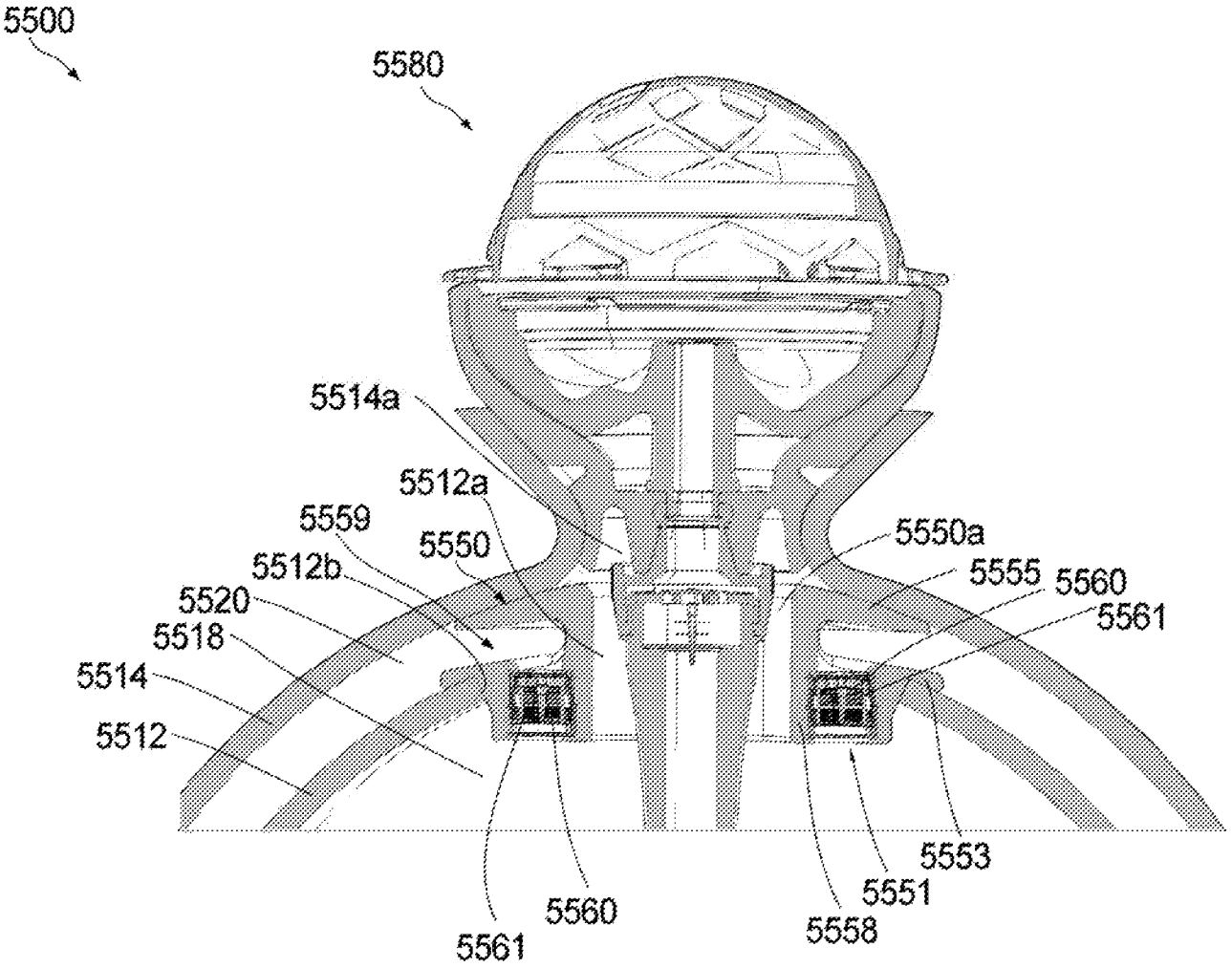

FIG. 56 shows an enlarged view of a section of FIG. 55.

Figure 57:
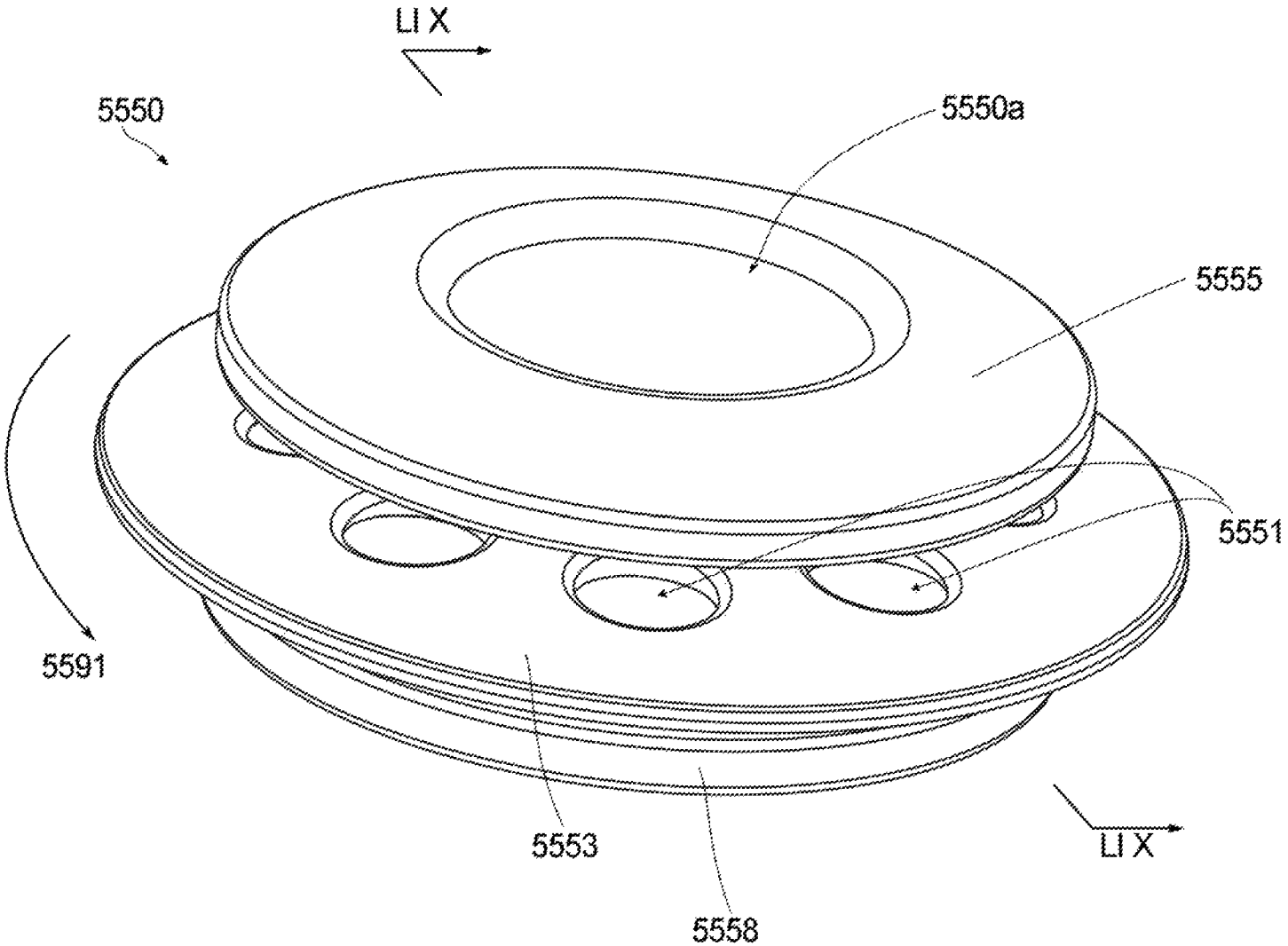
Figure 58:
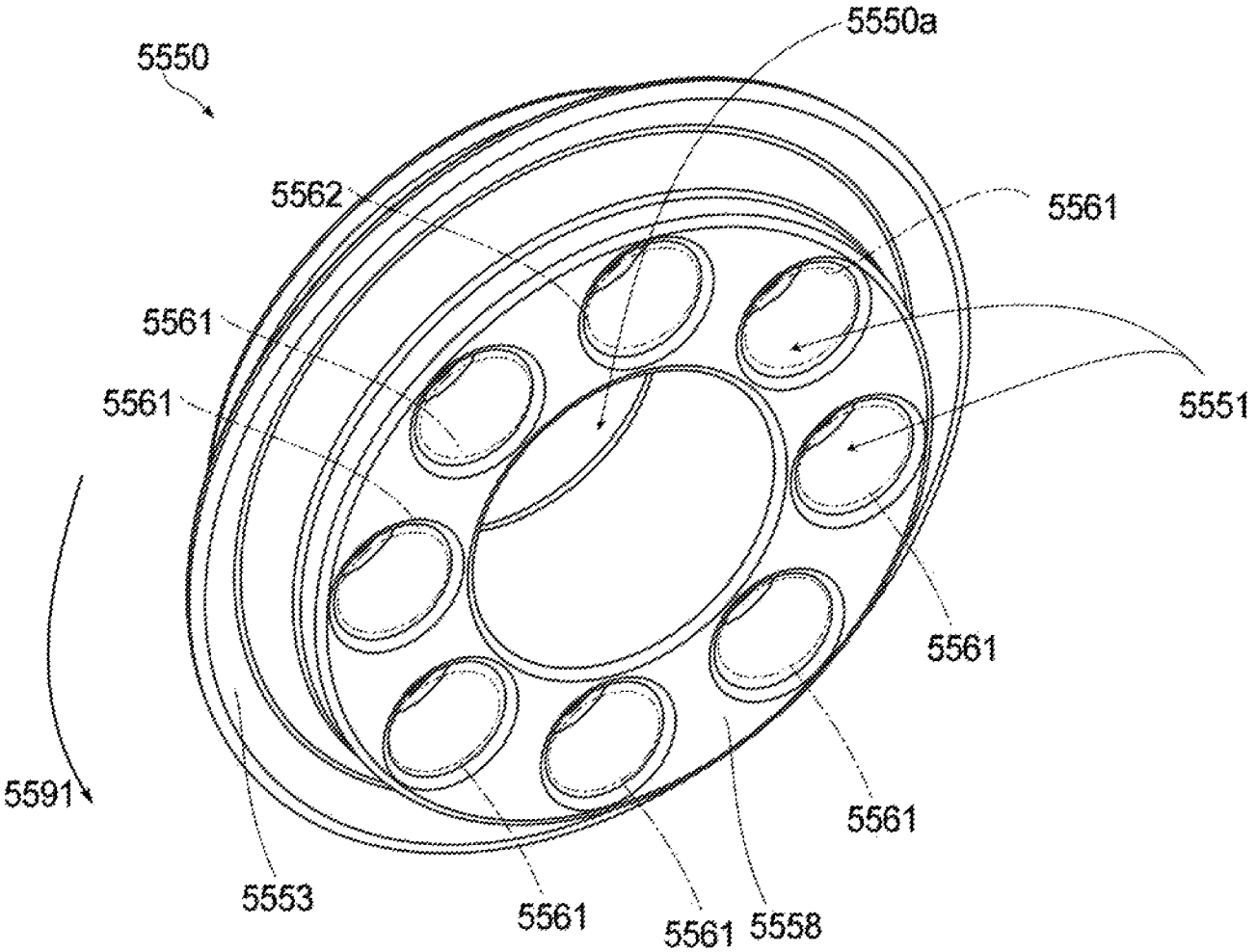

FIGS. 57 and 58 show example perspective views of a gasket according to one embodiment.

Figure 59:
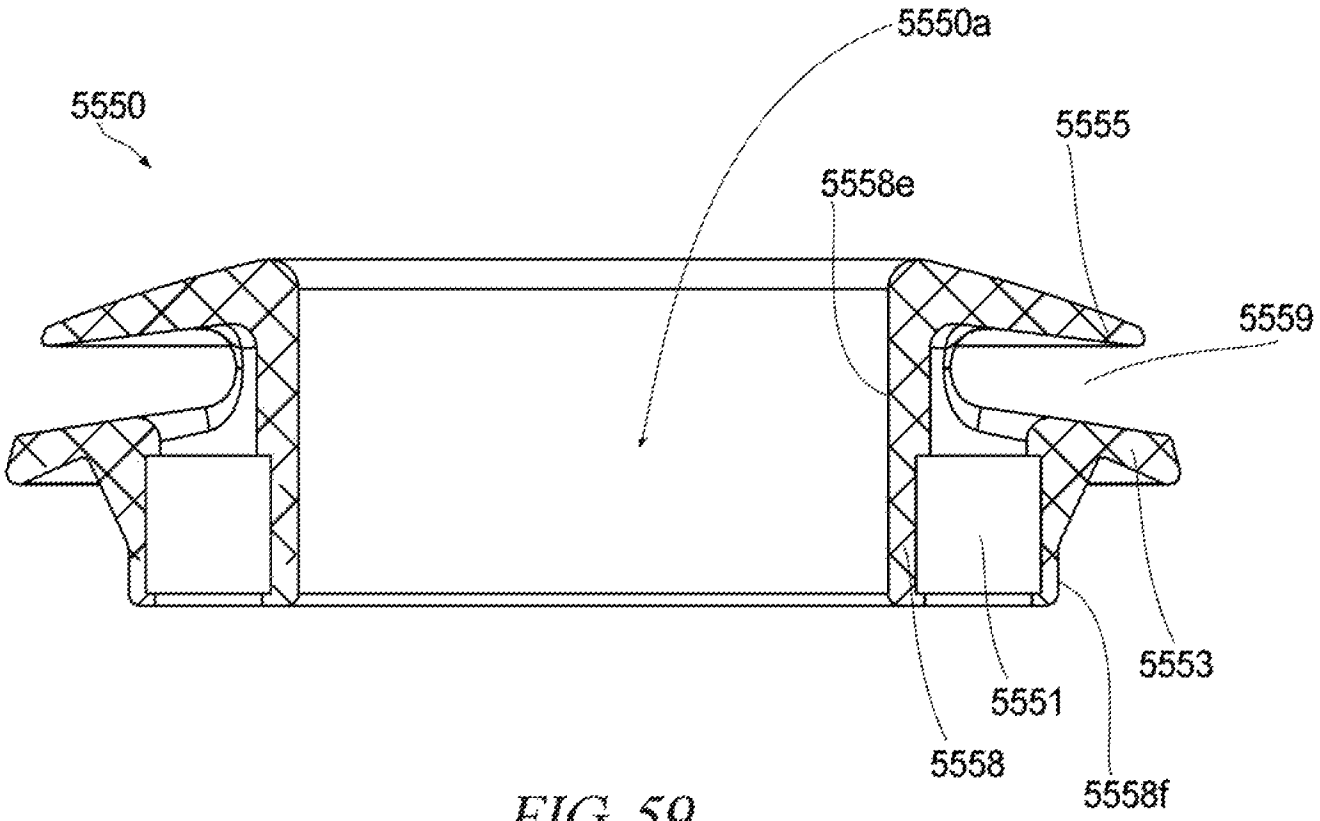

FIG. 59 is an example cross-sectional view of a gasket that is taken along a LIX-LIX line in FIG. 57.

Figure 60:
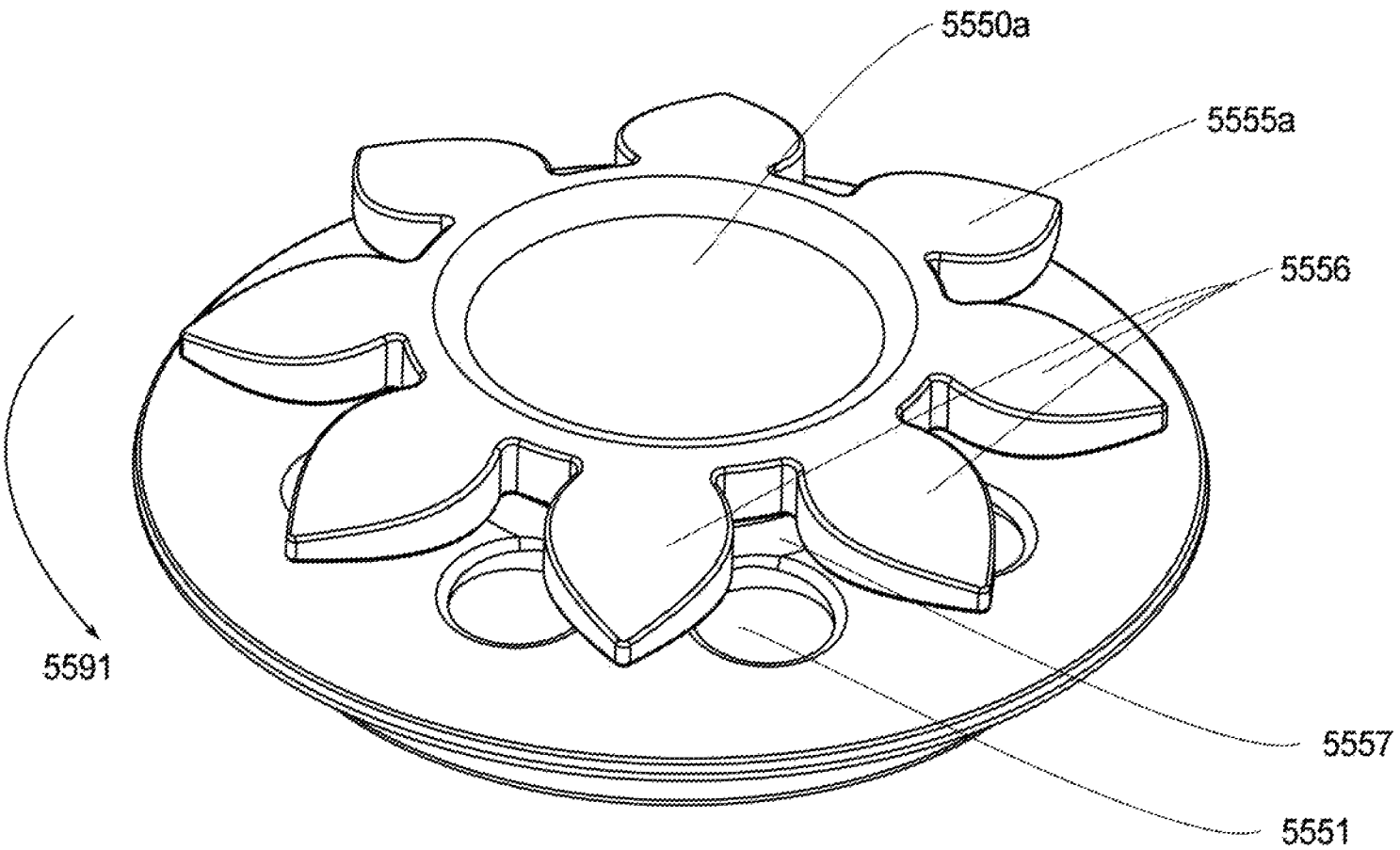

FIG. 60 shows an example perspective view of a gasket according to one embodiment.

Figure 61:
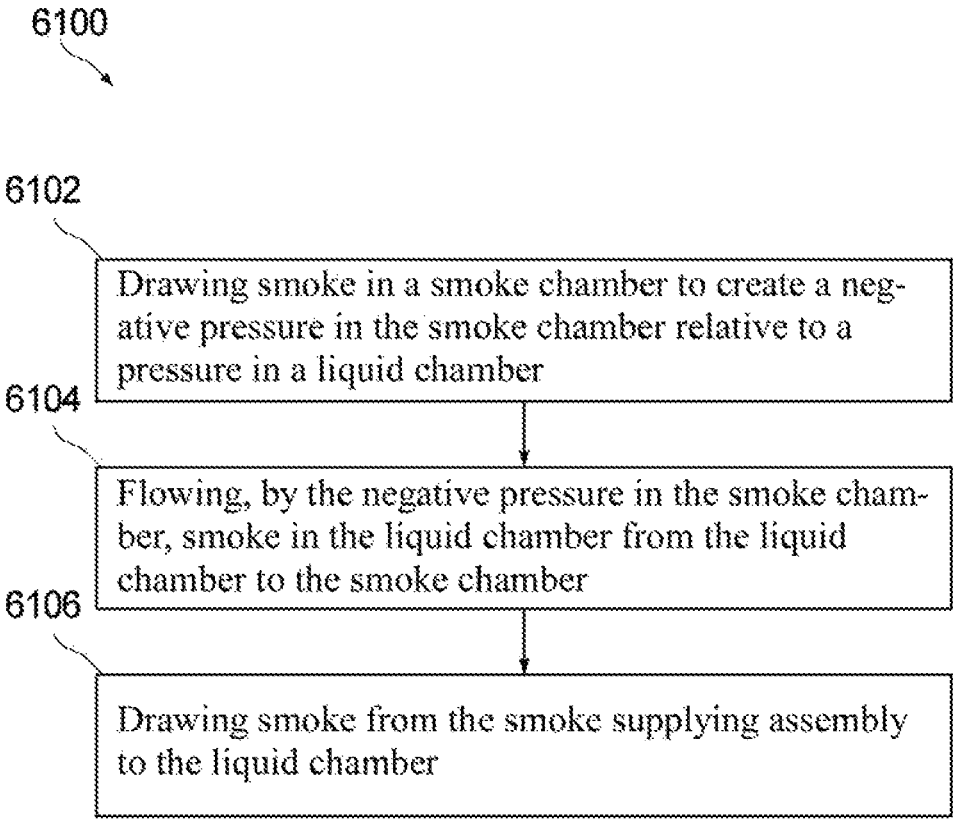

FIG. 61 illustrates an example method using a water pipe system in the form of a block diagram according to one embodiment.

Figure 62:
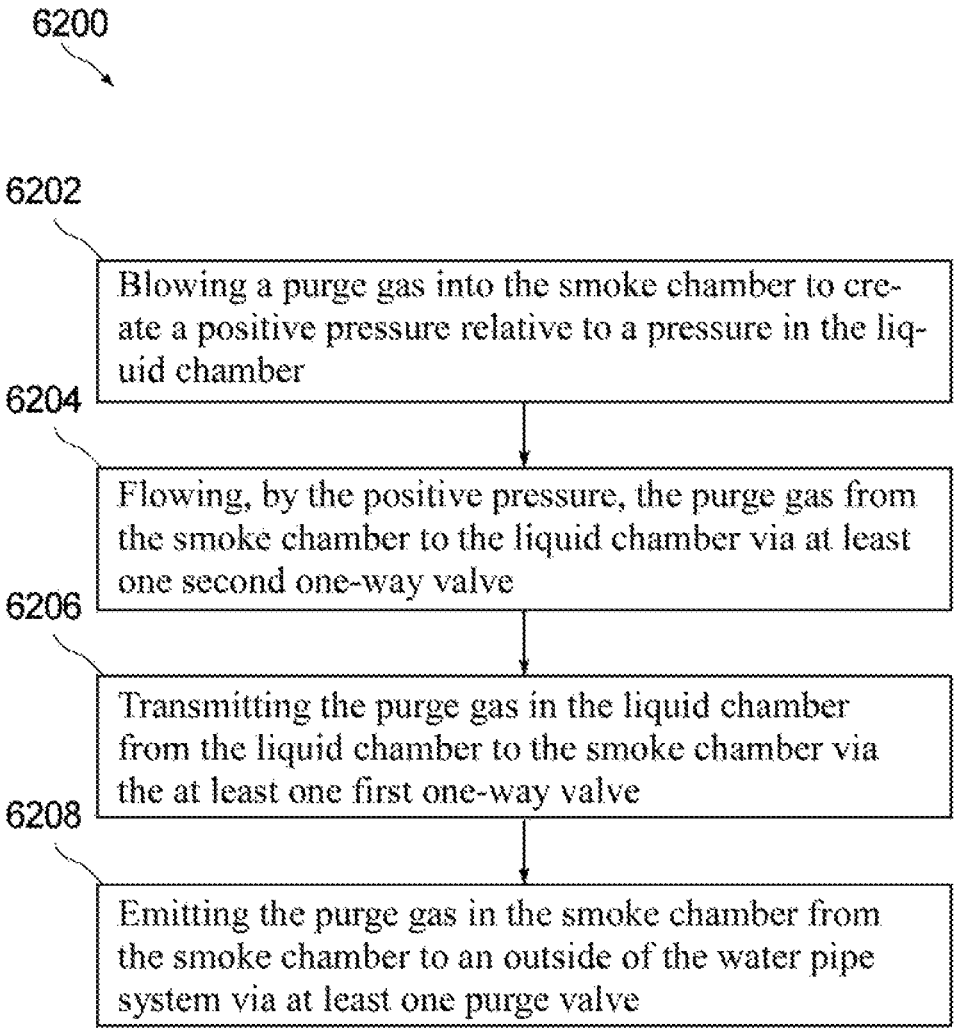

FIG. 62 illustrates an example method using a water pipe system in the form of a block diagram according to one embodiment.

Figure 63:
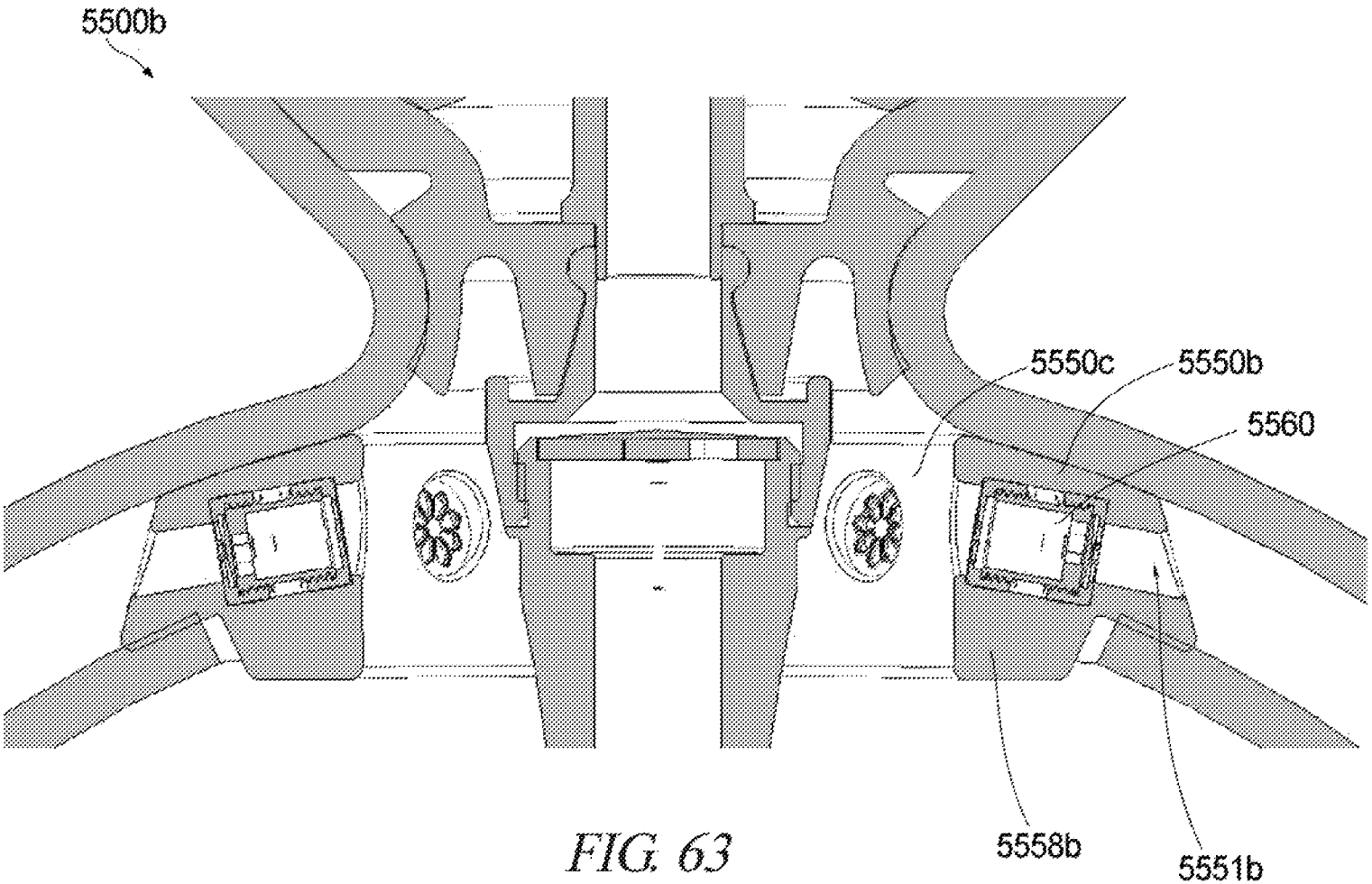

FIG. 63 shows an example cross-sectional view of a water pipe system according to one embodiment.

Figure 65:
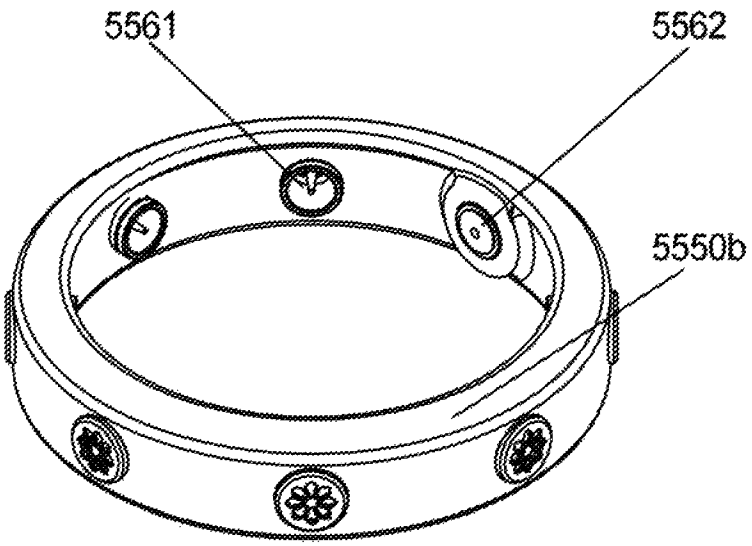
Figure 64:
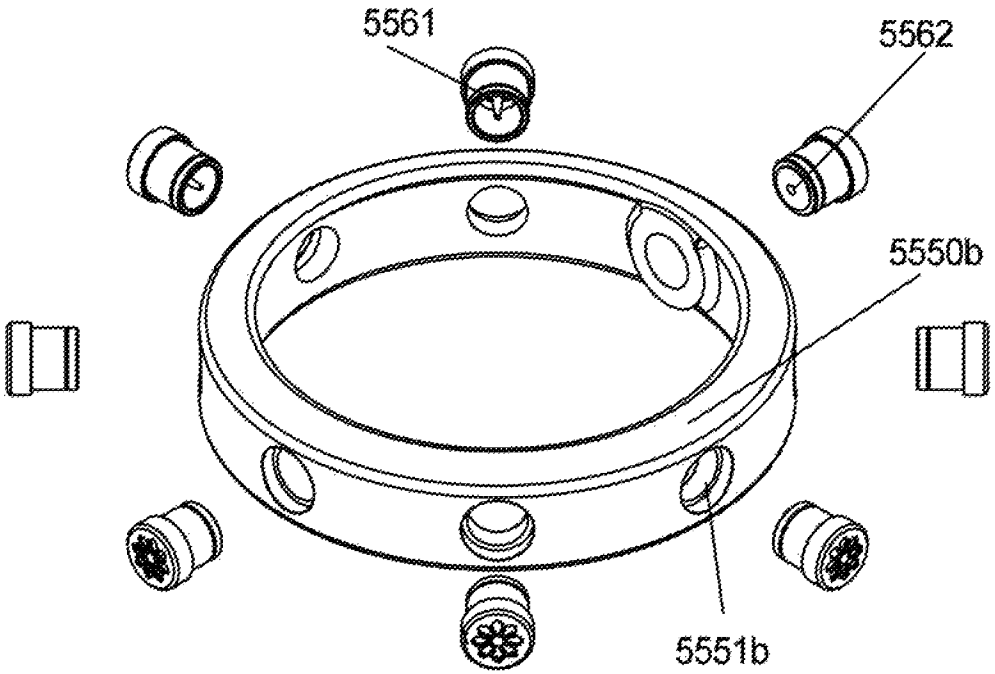

FIGS. 64 and 65 show example perspective views of a gasket and valves in the water pipe system shown in FIG. 63, with FIG. 64 showing an exploded view.

DETAILED DESCRIPTION OF THE PREFERRED EMBODIMENTS

The following description of the preferred embodiments of the invention is not intended to limit the invention to these preferred embodiments, but rather to enable any person skilled in the art to make and use this invention. Further, the figures herein are not meant to be limiting based on any scale or size relation illustrated but rather are meant to be example embodiments illustrative of concepts. Although any methods, materials, and devices similar or equivalent to those described herein can be used in the practice or testing of embodiments, the preferred methods, materials, and devices are now described.

The above described drawing figures illustrate the described invention and method of use in at least one of its preferred, best mode embodiment, which is further defined in detail in the following description. Those having ordinary skill in the art may be able to make alterations and modifications to what is described herein without departing from its spirit and scope. While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated. All features, elements, components, functions, and steps described with respect to any embodiment provided herein are intended to be freely combinable and substitutable with those from any other embodiment unless otherwise stated. Therefore, what is illustrated is set forth only for the purposes of example and should not be taken as a limitation on the scope of the present invention.

Figure 1:
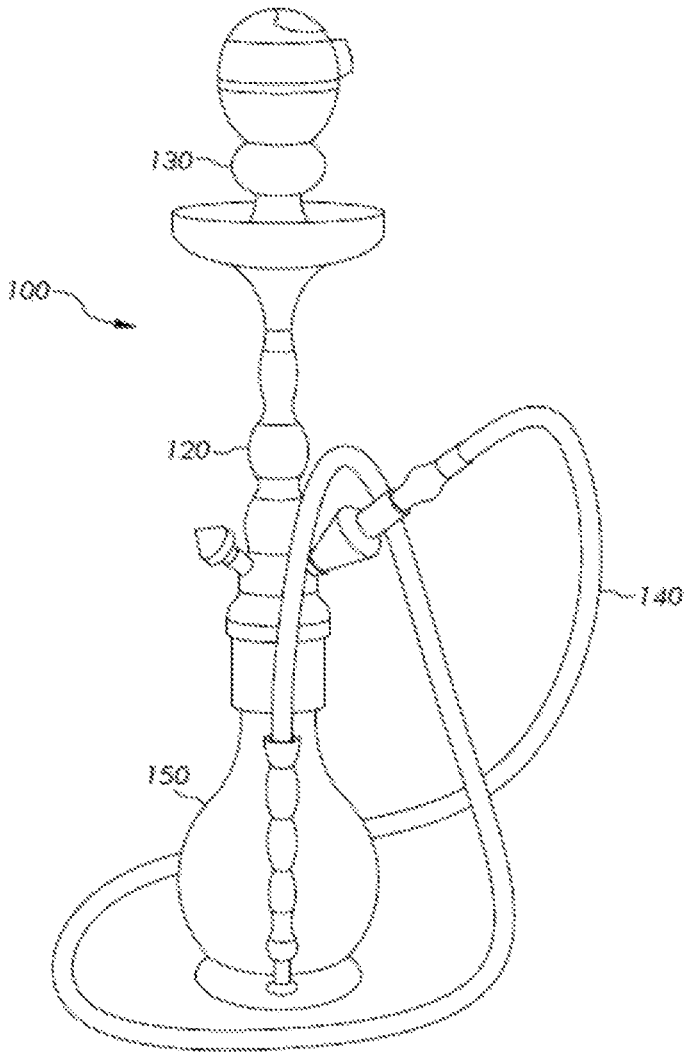
FIG. 1 (PRIOR ART)
FIG. 1 shows an example embodiment of a prior art water pipe.

FIG. 1 shows an example embodiment of a prior art water pipe, known also as a hookah pipe 100. As shown in FIG. 1, a head 130, body 120, base 150 and hose 140 are the primary components in a typical water pipe device. As shown in FIG. 1A, in general, the base 150 comprises a concave vessel having an open top portion for containing water or other liquid therein. The body 120 has a stem that extends into the base such that a distal end of the stem is partially submerged within the liquid contained in the base 150. The body 120 couples with an open top portion of the base 150 so as to form a substantially airtight seal therewith. Accordingly, a first base grommet may be provided to couple the body 120 and the base 150 so as to form the substantially airtight seal. In this manner, a chamber is formed by the base 150 and body 120. A hose 140 couples with the body 120 such that a proximal portion of the hose 140 has an airtight seal with the body 120. Accordingly, a hose grommet may be provided to couple the hose 140 and the body 120 so as to form the substantially airtight seal. In some embodiments, a hose valve (not shown) may be intermediate the hose 140 and the body. The head 130 couples to a proximal end of the body 120 such that a substantially airtight seal is formed therebetween. Accordingly, a third grommet may be provided to couple the head 130 and the body 120 so as to form the substantially airtight seal. In operation, organic matter to be smoked may be contained within a bowl of the head 130, and the head 130 can be covered with a cover, such as punctured foil, or a ventilated cover described in U.S. patent application Ser. No. 13/489,475, filed on Jun. 6, 2012, the entire contents and disclosure of which is herein incorporated by reference. Coals or other combustible heating material can be placed on or in the cover to heat the organic matter to be smoked, such as tobacco.

Critically, the head 130, body 120 and hose 140 each comprise a hollow tube such that when the base 150, head 130, body 120 and hose 140 are coupled, an airflow path is formed. A user of prior art hookah 100 will generally inhale at the distal end of hose 140 and thus draw heated air into head 130, causing the organic material therein to burn, releasing smoke that is subsequently drawn through the through body 120 and through the liquid in base 150. The smoke then rises through the liquid into the area above the liquid in base 150, becoming filtered in the process, and out through the hose 140 to be smoked by the user.

Other water pipe components, such as purge valves, ashtrays, base flavorings, etc. are generally known in the art and, while not specifically described herein, are intended to be useable in combination with the presently described embodiments without departing from the scope of the invention.

Figure 2A:
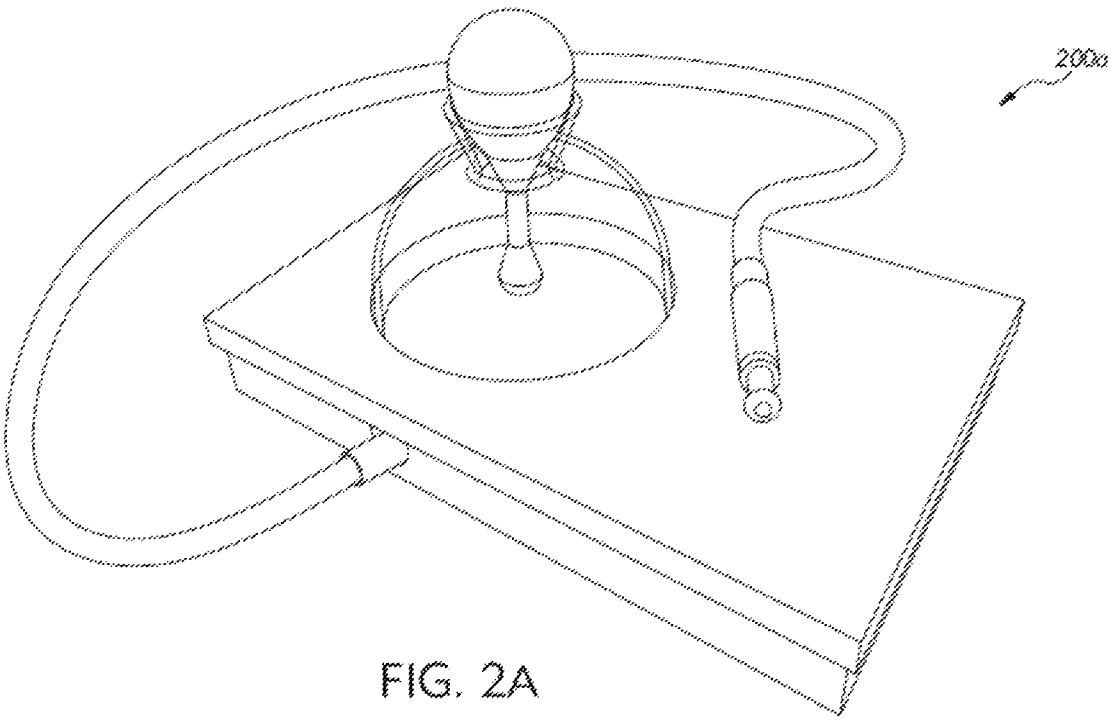
FIG. 2A shows an example embodiment image of a perspective view of a domed water pipe with supporting tray with an attached hose.
Figure 2B:
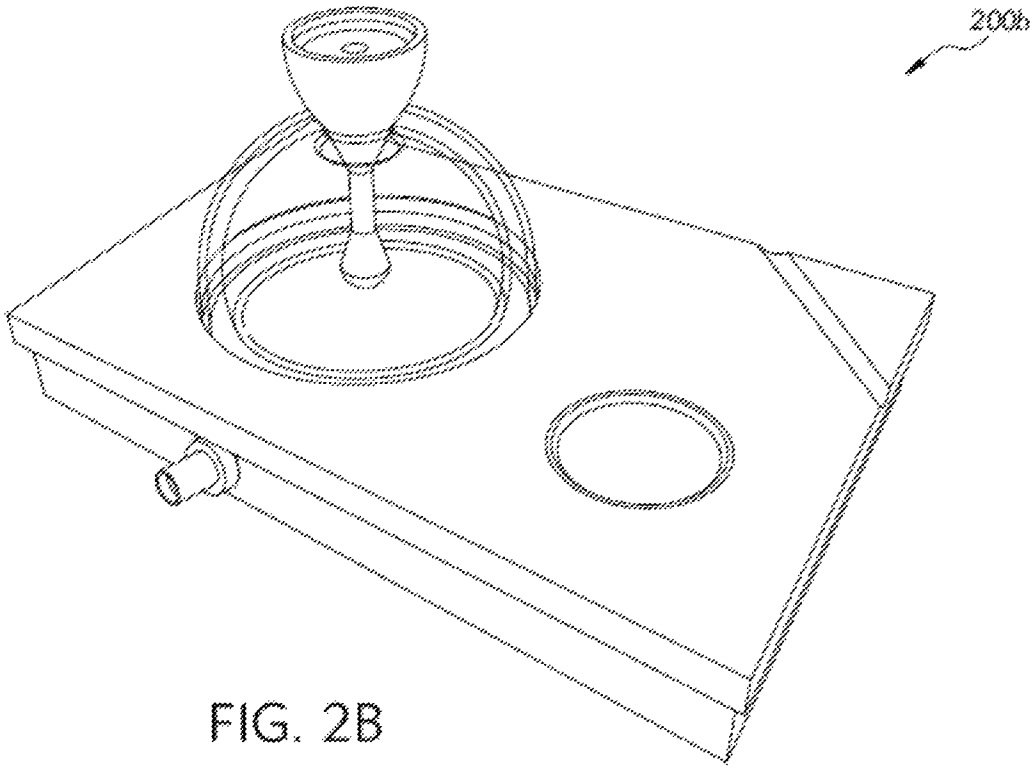
FIG. 2B shows an example embodiment image of a perspective view of a domed water pipe with supporting tray.
Figure 2C:
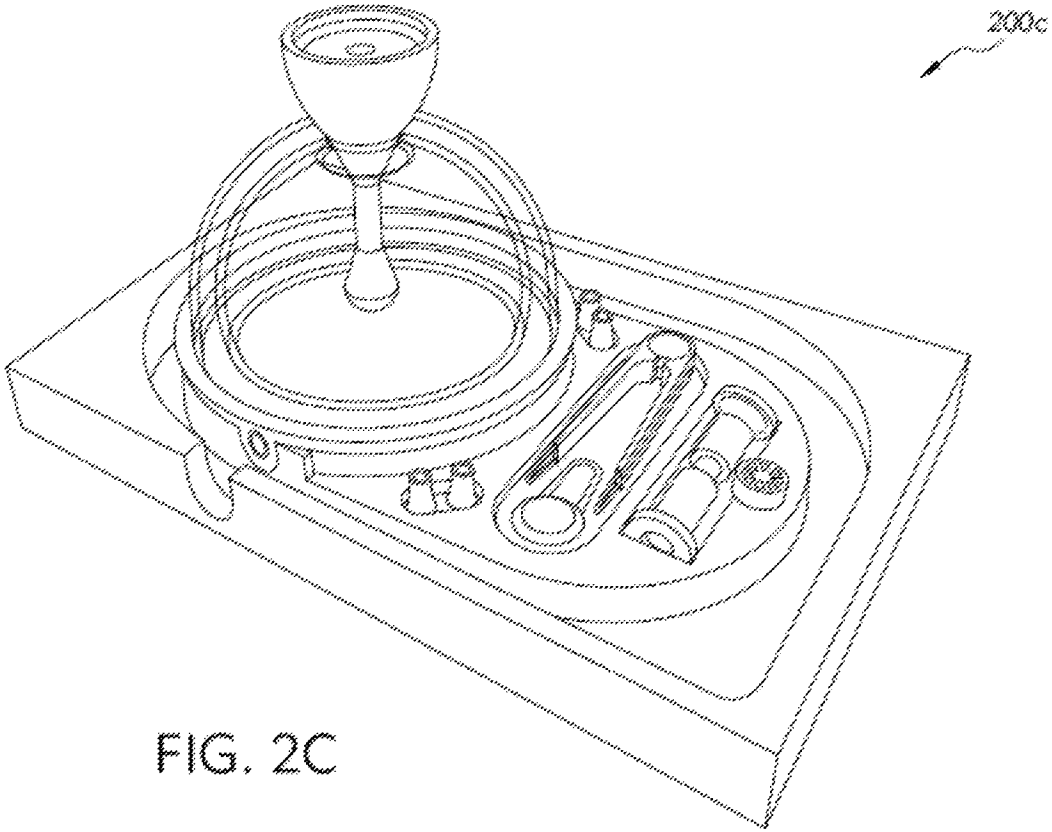
FIG. 2C shows an example embodiment image of a perspective view of a domed water pipe with supporting tray with a storage compartment.
Figure 2D:
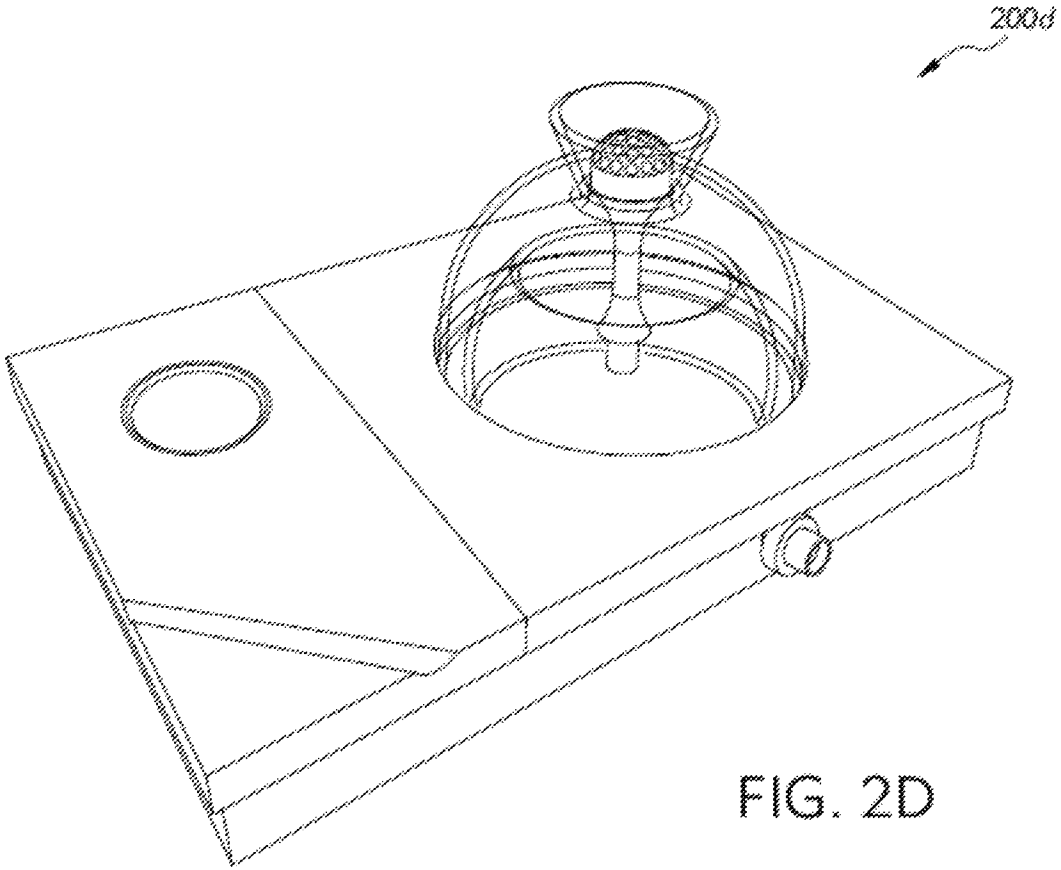
FIG. 2D shows an example embodiment image of a perspective view of a domed water pipe with supporting tray.

FIGS. 2A-2D show various example embodiments of domed water pipes. In particular, FIG. 2A shows an example embodiment image of a perspective view 200*s* of a domed water pipe with supporting tray with an attached hose. FIG. 2B shows an example embodiment image of a perspective view 200*b* of a domed water pipe with supporting tray. FIG. 2C shows an example embodiment image of a perspective view 200*c* of a domed water pipe with supporting tray with a storage compartment. FIG. 2D shows an example embodiment image of a perspective view 200*d* of a domed water pipe with supporting tray with a second bowl unit.

Figure 3A:
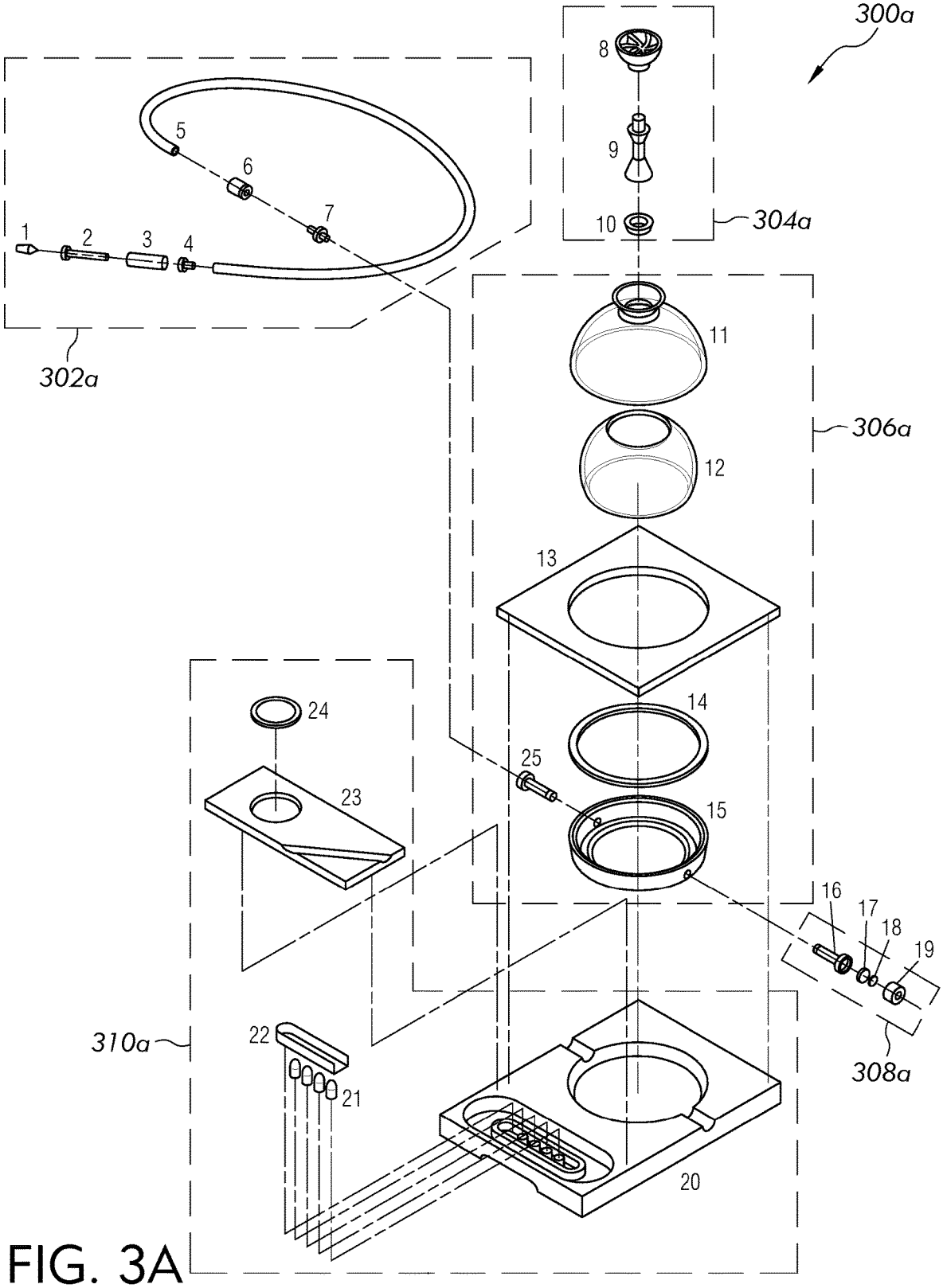
FIG. 3A shows an example embodiment of an exploded view of a domed water pipe with supporting tray.

FIG. 3A shows an example embodiment of an exploded view 300*a* of a domed water pipe with supporting tray. As shown in the example embodiment, multiple subsections will be described in turn, including a hose subsection 302*a*, a bowl subsection 304*a*, a manifold and glass subsection 306*a*, a purge valve subsection 308*a* and a tray subsection 310*a*. It should be understood that these subsections are not exhaustive and particular components can be considered in conjunction and operate with respect to components of other subsections. Furthermore, the components shown in FIG. 3A are not exhaustive and may include assemblies and sub-assemblies in various embodiments. The breakdown into subsections is to assist the reader with respect to clarity. Couplings, materials, orientations and other specifics related to the various components will be described with respect to individual parts in each figure description herein.

As shown in the example embodiment, hose subsection 302*a* can include components such as a hose tip 1, a MP body 2, a MP cover 3, a MP nipple 4, a hose 5, a hose end cover 6 and a hose plug 7. Bowl subsection 304*a* can include a bowl 8, a down-stem 9, and an aerator 10. Manifold and glass subsection 306*a* can include an outer vessel 11, an inner vessel 12, a first cover 13, a gasket 14, a manifold body 15 and a hose socket 25. Purge valve subsection 308*a* can include a purge nipple 16, a purge plate 17, an umbrella valve 18 and a purge cap 19. Tray subsection 310*a* can include a base 20, spare MP tips 21, tongs 22, a second cover 23 and an ash tray 24. Components and operation of each subsection will be described in turn herein, as well as interaction between the subsections.

Figure 3B:
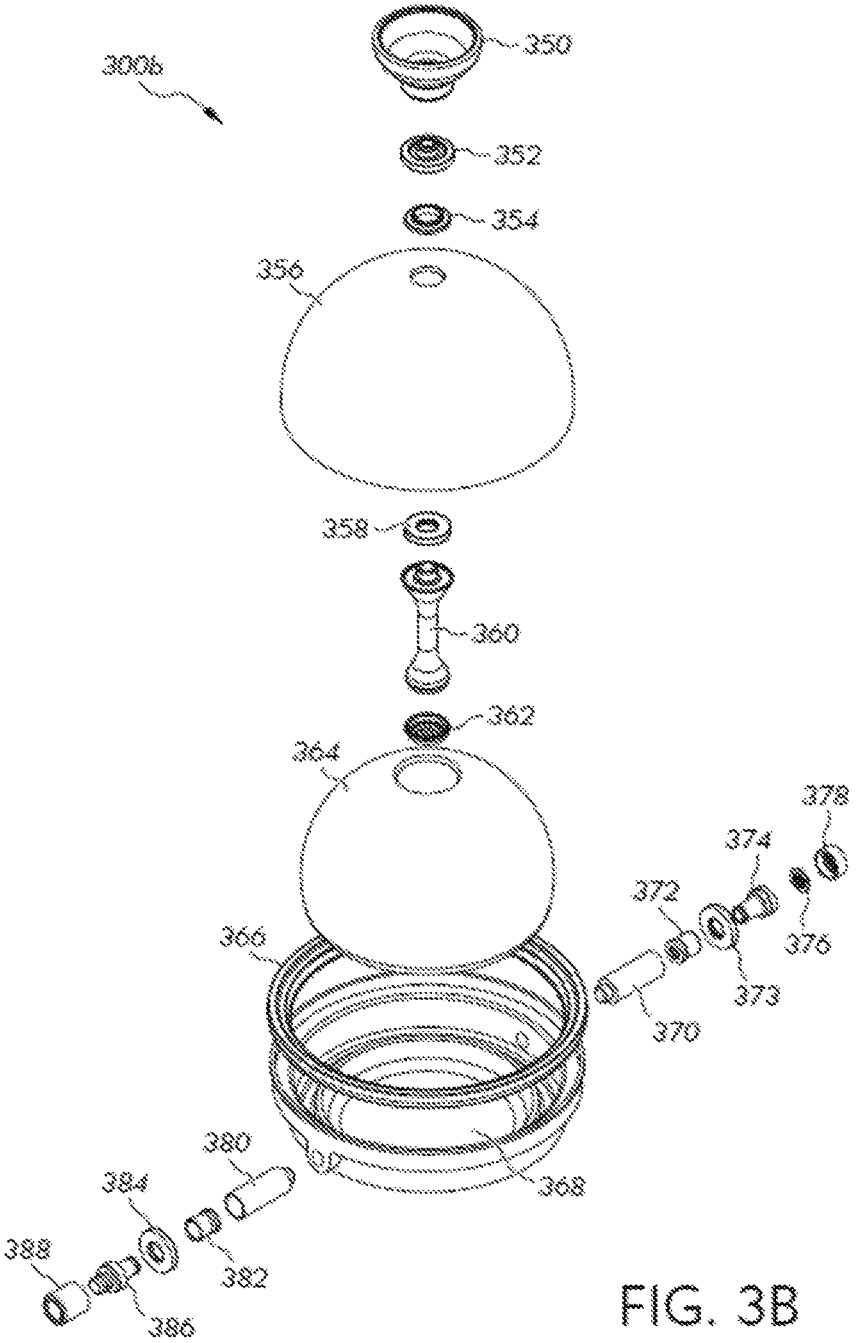
FIG. 3B shows an example embodiment of an exploded view of a domed water pipe.

FIG. 3B shows an example embodiment of an exploded view 300*b* of a domed water pipe. As shown in the example embodiment, a bowl 350 can be partially or completely silicone, silicone combined with materials such as wood, stone, glass, metal, or other some other material, or completely other materials and can be coupled with a bowl nipple 352 and separated from an exterior surface of an outer chamber 356 by a stem gasket 354. A stem gasket 358 can separate a proximal end of a downstem 360 from an interior surface of outer chamber 356 and removably couple with bowl 350, stem gasket 354 or both through a hole in the top of upper chamber 356. Downstem 360 can have a distal end that couples with an aerator cap 362 that rests within an interior of an inner chamber 364 in operation. Inner chamber can rest within an interior of a manifold 368 and exterior chamber 356 can be sealably coupled with manifold 368 by a main seal 366. In some embodiments, multiple sub-chambers can exist within inner chamber 364.

Coupled with a side of manifold 368 can be a manifold extender 370 can house a hose plug grommet 372 and be covered by an escutcheon 373. In turn, a purge nipple can fit within hose plug grommet 372 and be covered by a purge plate 376 and purge cover 378. Coupled with manifold 368 in another location can be a manifold extender 380, housing hose plug grommet 382. This can be covered by an escutcheon 384 that covers a hose receiver 386 and hose end cap that is operable to be coupled with a hose (not shown).

Figure 3C:
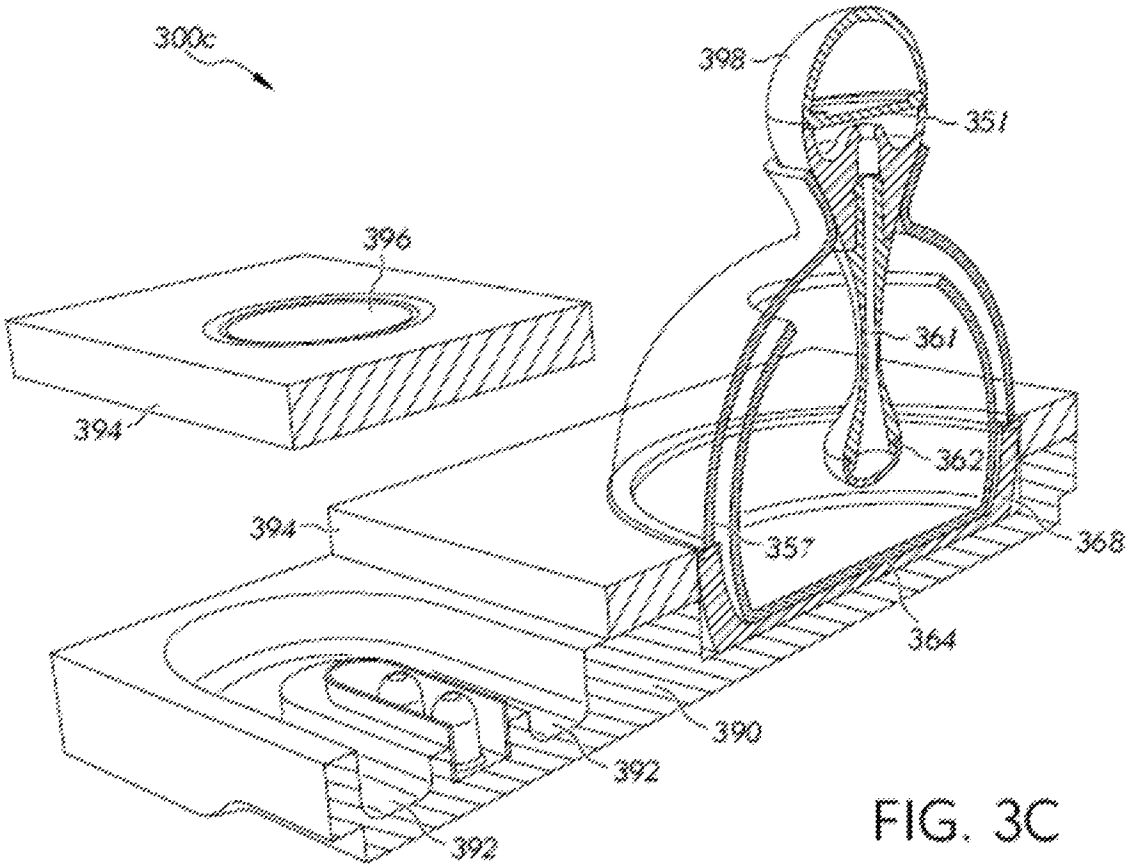
FIG. 3C shows an example embodiment of an exploded, side cross-sectional, view of a domed water pipe with supporting tray.
Figure 3D:
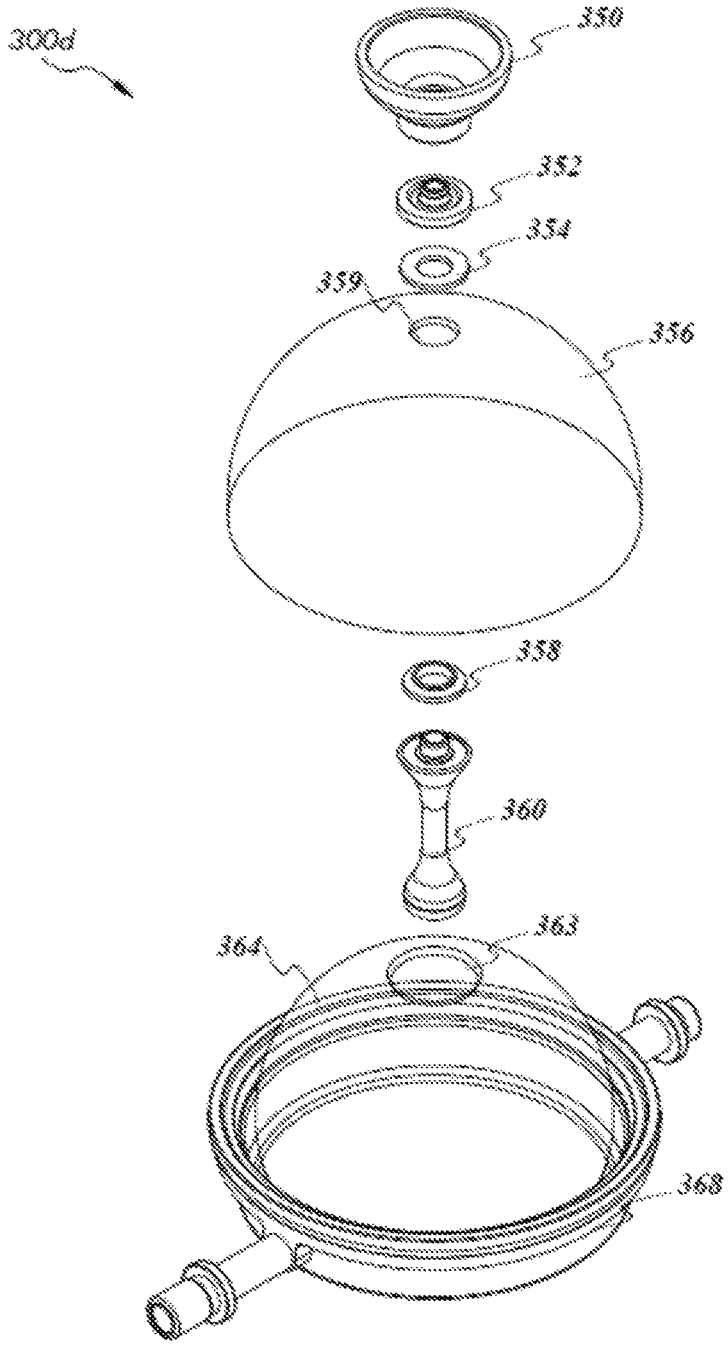
FIG. 3D shows an example embodiment of an exploded view of a domed water pipe.

FIG. 3C shows an example embodiment of a side cutaway view 300*c* of a domed water pipe with a tray 390 and covering 394. As shown in the example embodiment, a cap 398 can rest on or be coupled with a bowl 351, which can be directly coupled with a downstem 361 that is coupled with an aerator cap 362. Inner chamber 364 can be housed within manifold 368 and outer chamber 357. Tray 390 can have interior compartments 392. Cover 394 can be one or more pieces and can have a removable ashtray 396. Bowl 351, downstem 360 and aerator cap 362 can be supported by a flared upper section of outer chamber 357.

Figure 3E:
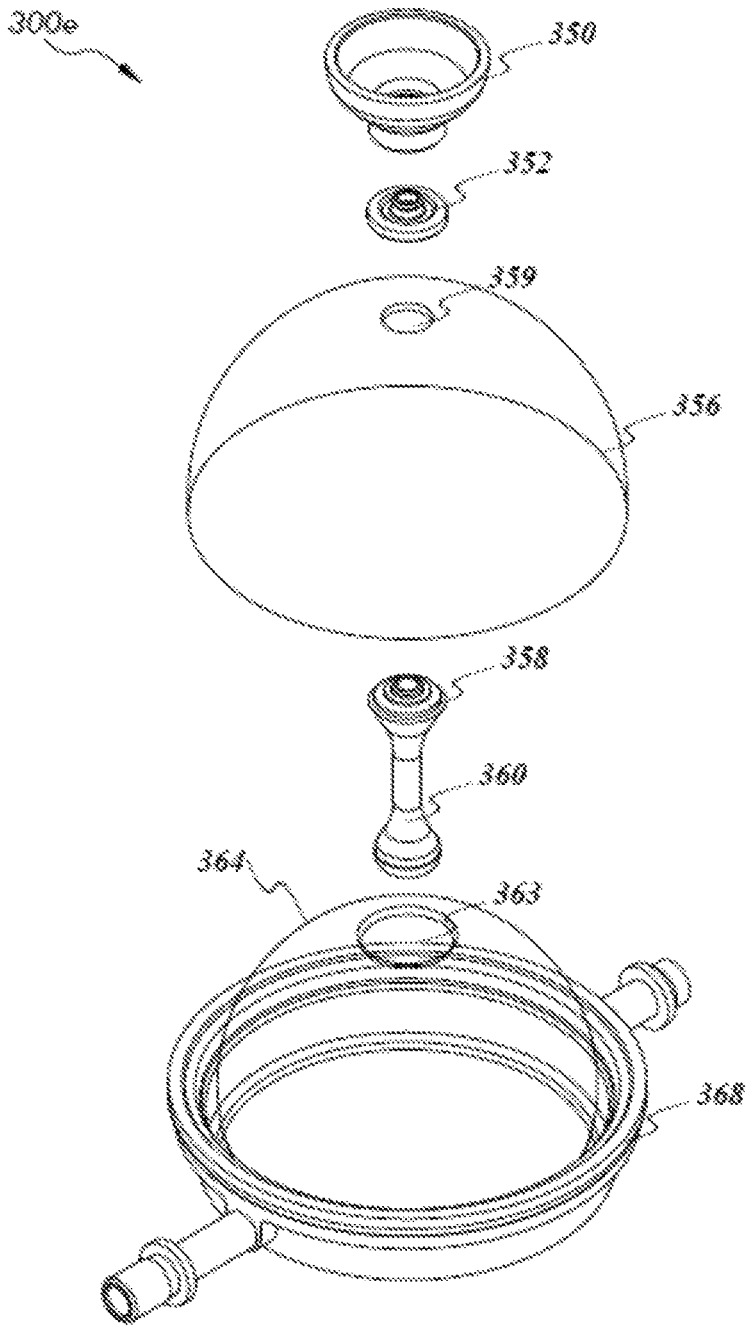
FIG. 3E shows an example embodiment of an exploded view of a domed water pipe.
Figure 3F:
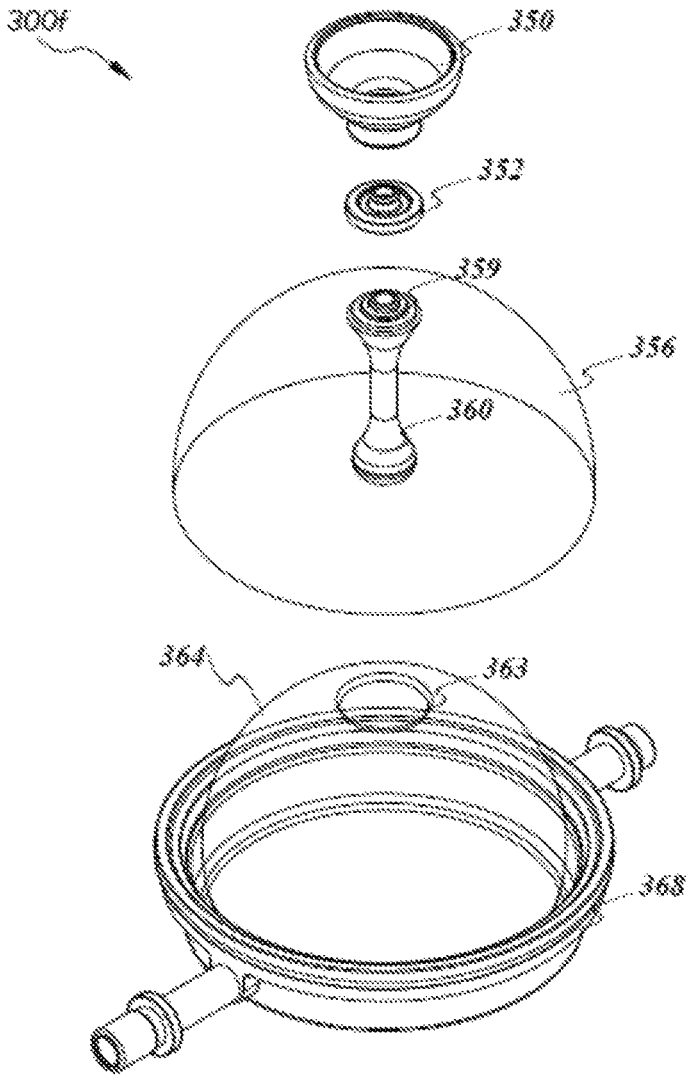
FIG. 3F shows an example embodiment of an exploded view of a domed water pipe.
Figure 3G:
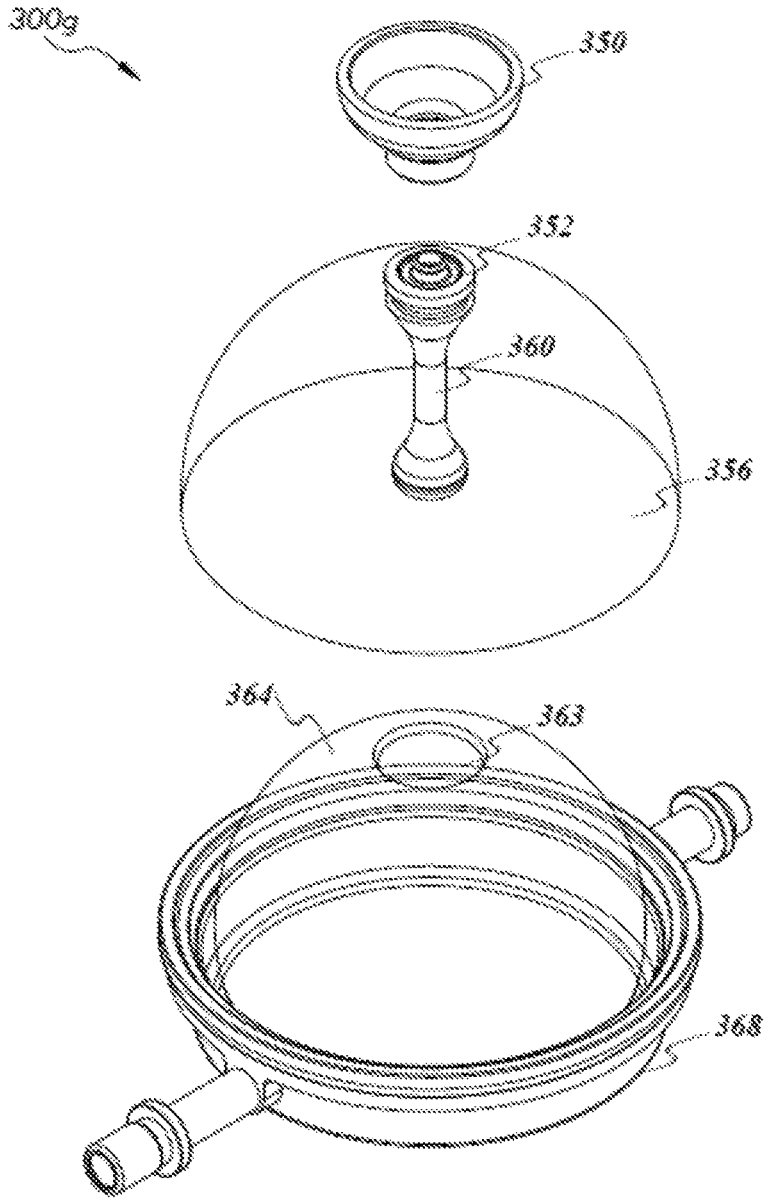
FIG. 3G shows an example embodiment of an exploded view of a domed water pipe.
Figure 3H:
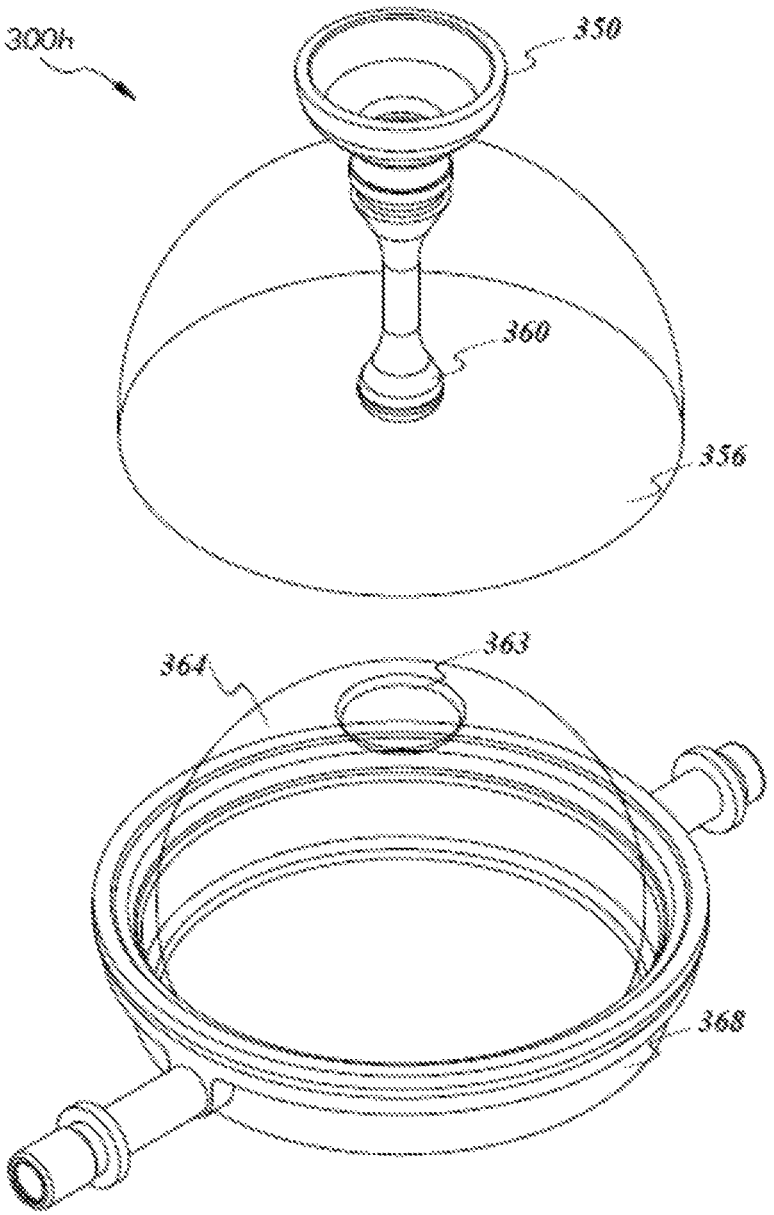
FIG. 3H shows an example embodiment of an exploded view of a domed water pipe.
Figure 3I:
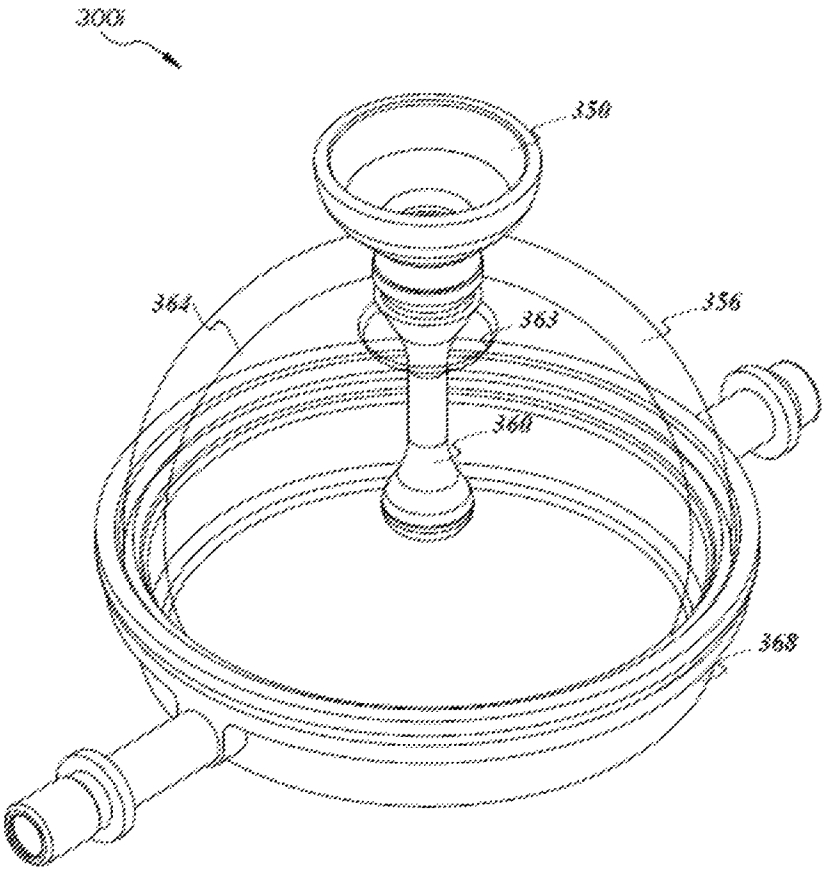
FIG. 3I shows an example embodiment of a fully assembled domed water pipe.
Figure 3J:
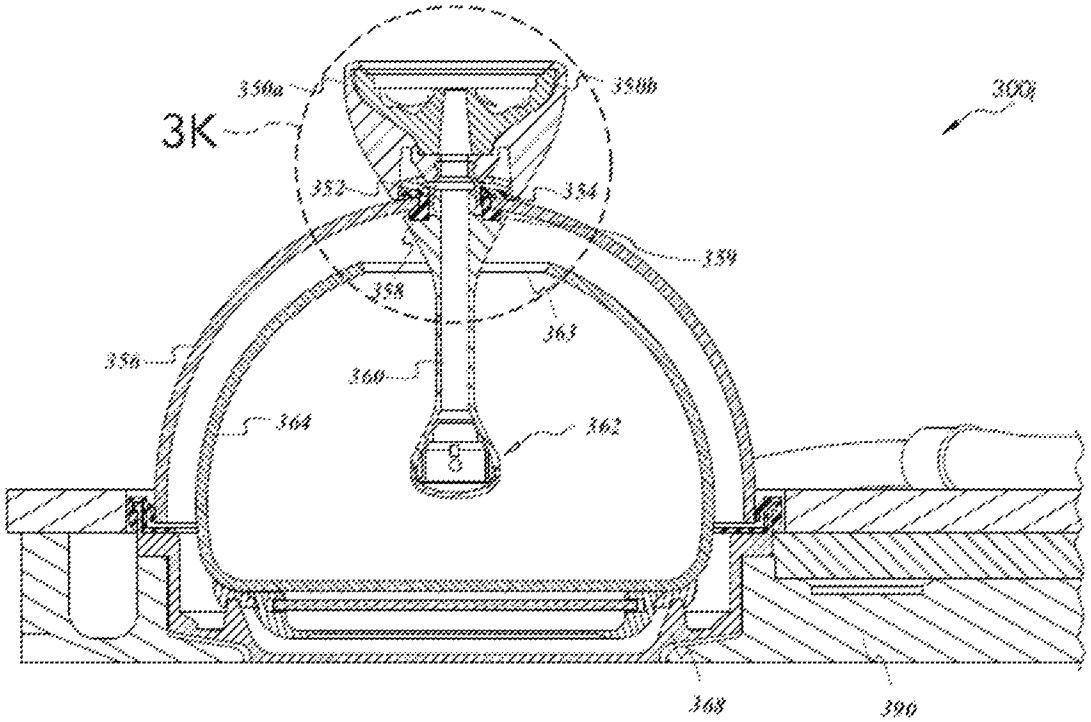
FIG. 3J shows a fully assembled, side cross-sectional, example embodiment of a domed water pipe and tray, in which a manifold is housed within the supporting tray.

FIGS. 3D-3K show an example embodiment of an exploded view 300*d*-300*k* respectively of an assembly process for a two-portion coupling air draw system mechanism as shown in FIG. 3B. As shown in the example embodiment, a bowl 350 can include a silicone housing 350*a* and glass core 350*b* as shown in FIG. 3J. This can be removably coupled to a bowl nipple 352 via an appropriate mechanism, such as a threaded screwing mechanism. A nipple gasket 354 can be placed over and coaxial with a central axis hole 359 of an outer vessel 356 exterior. Similarly, a downstem gasket 358 can be coupled with a downstem 360 and be arranged coaxially with the central axis hole 359 of the outer vessel 356 interior surface. Then the upper end of the downstem 360 can be coupled with the lower end of the bowl nipple 352 such that they are assembled in a fixed fashion with respect to each other and the outer vessel 356.

As described in FIG. 3E, fittings for gaskets 352, 358 can be snug and pressing gaskets 352, 358 together with their respective components 352, 360 can be sufficient in some embodiments. As shown in FIG. 3E, in some embodiments the downstem 360 and gasket 358 assembly is placed into position on the interior surface of the outer vessel 356 before the bowl nipple 352 and gasket 354 assembly are coupled to them on the exterior surface of the outer vessel 356 via the central axis hole 359, as shown in FIG. 3F. Next, as shown in FIG. 3F, the bowl 350 may then be coupled with the bowl nipple 352. Finally, the outer vessel 356 can be coupled with a manifold 368 assembly by firmly pressing it into place while carefully navigating the downstem 360 into a central axis hole 363 at the top of inner vessel 364 as shown.

FIG. 3J shows an example embodiment of a water pipe for a two portion coupling air draw system mechanism from a cross sectional side view 300*j*.

Figure 3K:
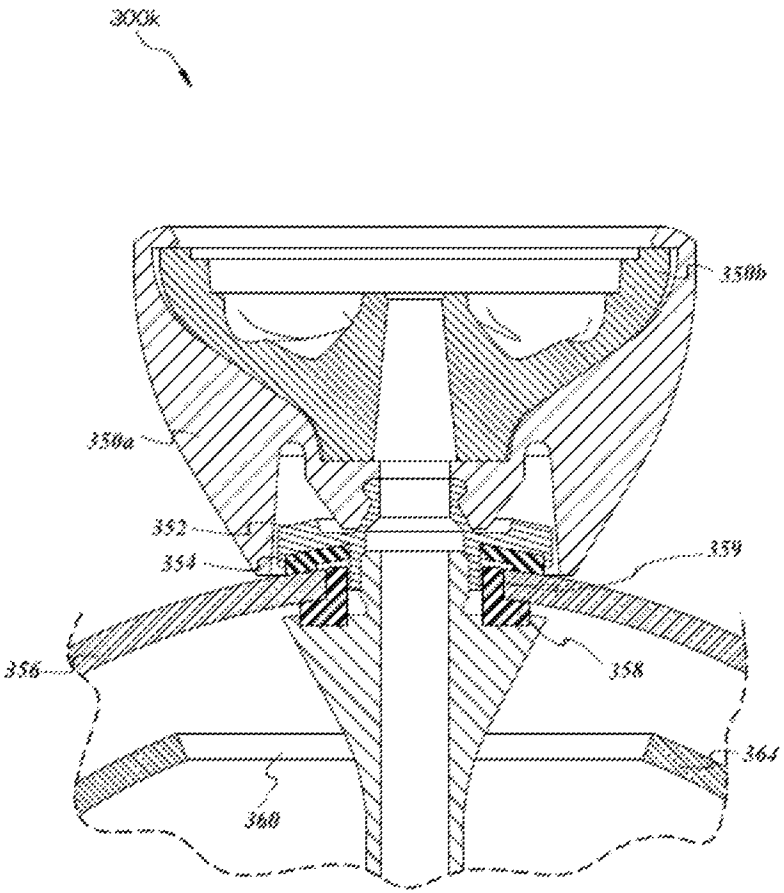
FIG. 3K shows a close-up example embodiment of the seal formed by a top and bottom down stem assemblies with an outer glass vessel.
Figure 4A:
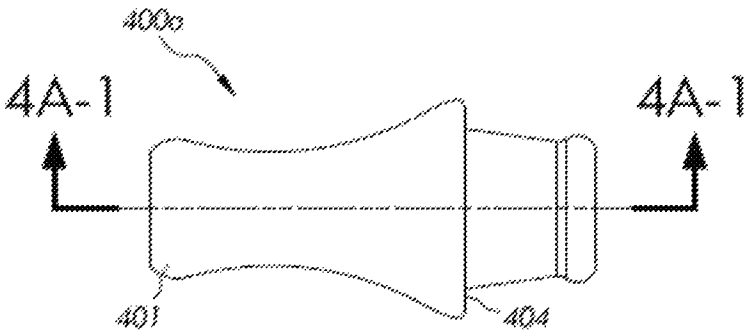
FIGS. 4A-4D show an example embodiment of a hose tip side diagram, side cross-sectional diagram, side image, mockup and end view diagram.
Figure 4B:
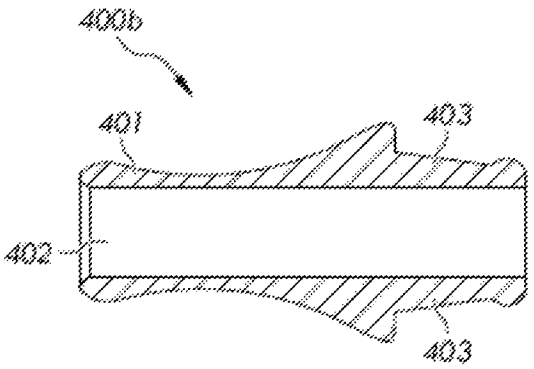
Figure 4C:
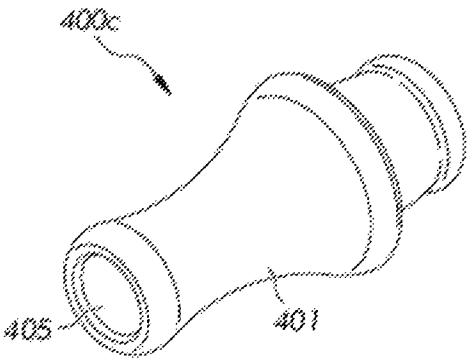
Figure 4D:
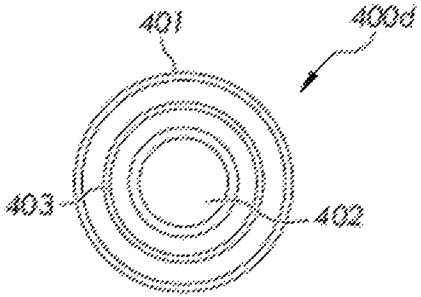
Figure 5B:
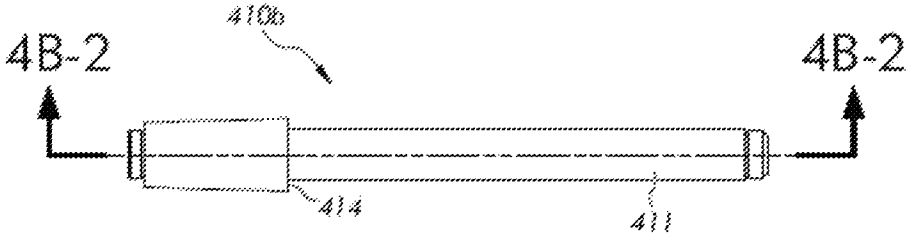
FIGS. 5A-5D show an example embodiment of an MP Body end diagram, side diagram, side cross-sectional diagram and mockup.
Figure 5A:
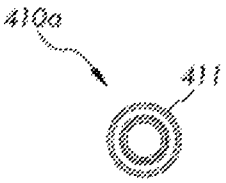
Figure 5D:
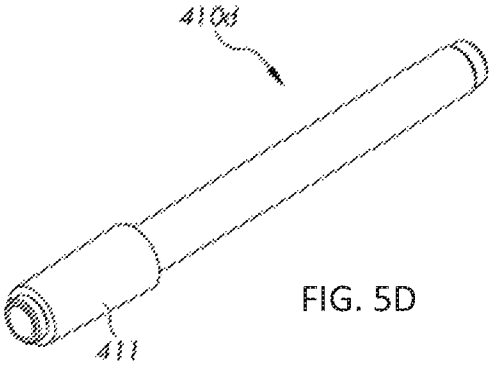
Figure 5C:
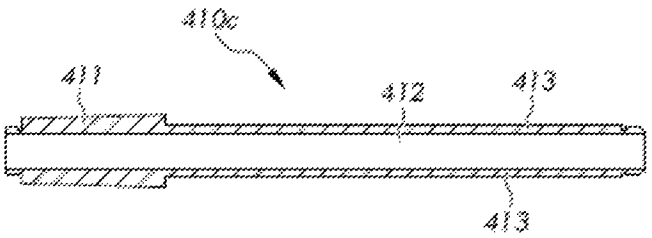
Figure 6B:
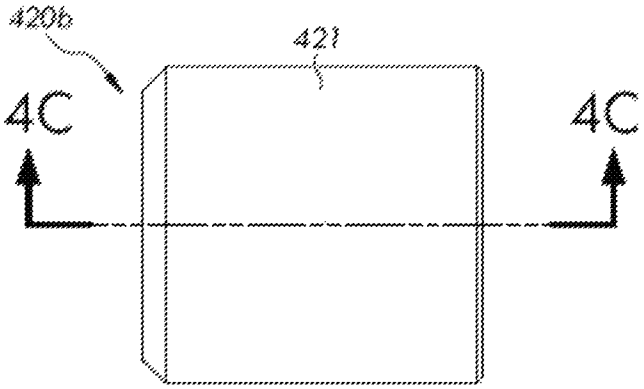
FIGS. 6A-6D show an example embodiment of a hose end cover side cross-sectional diagram, end diagram, side diagram and mockup.
Figure 6D:
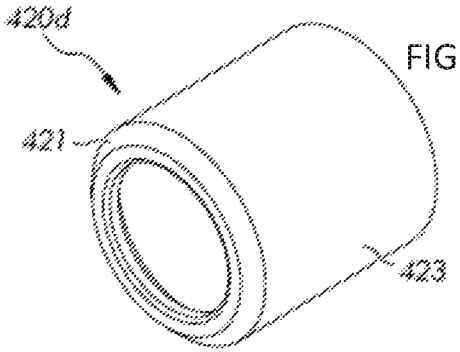
Figure 6A:
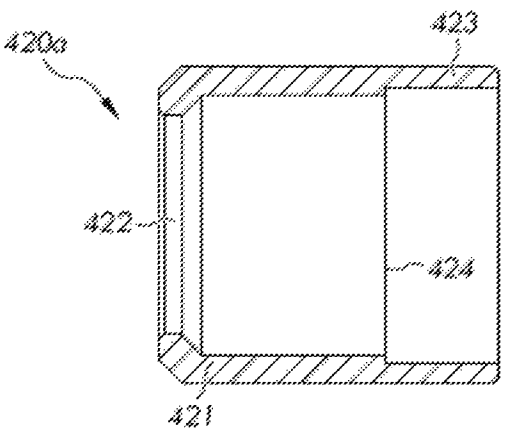
Figure 6C:
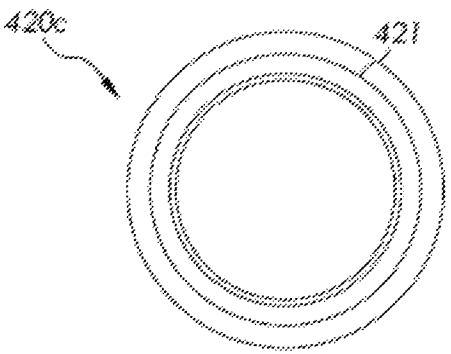
Figure 7B:
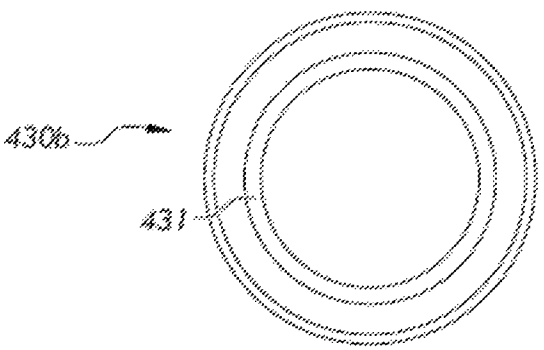
FIGS. 7A-7D show an example embodiment of an MP tip adapter.
Figure 7D:
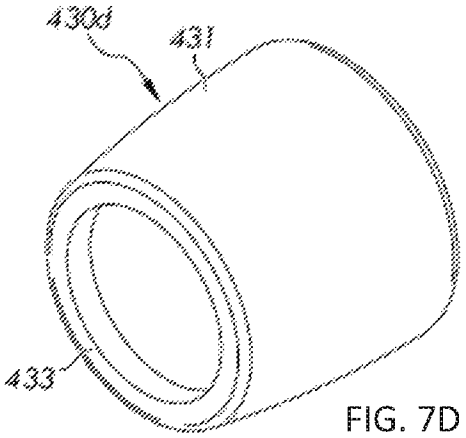
Figure 7A:
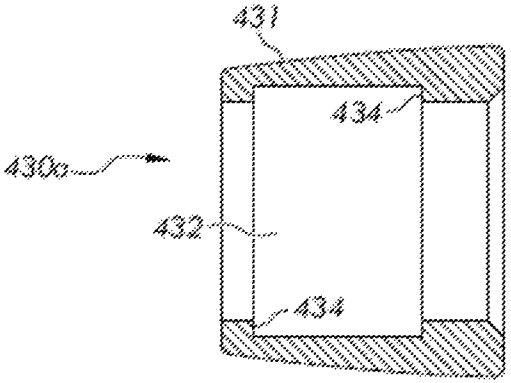
Figure 7C:
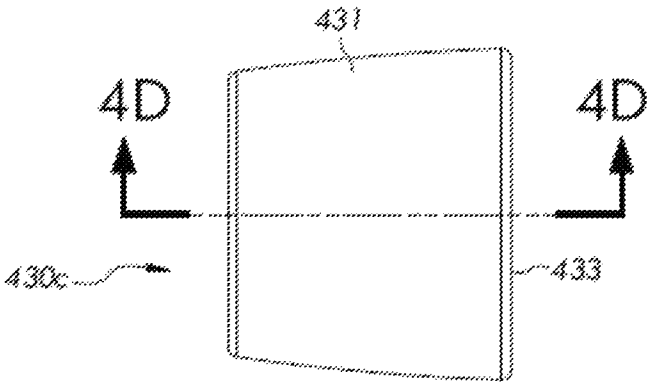

FIG. 3K shows an example embodiment of a water pipe head detail 300*k* for a two portion coupling air draw system mechanism from a cross sectional side view.

Hose Subsection

FIGS. 4A-4D show an example embodiment of a hose tip 401 side diagram 400*a*, side cross-sectional diagram 400*b*, mockup 400*c* and end view diagram 400*d*, respectively. In various embodiments hose tips can be metal, plastic, rubber or other appropriate material and may be fixed or removable. In some embodiments, they can include gripping mechanisms such as ridges, bumps or others that may be arranged in functional patterns or designs to aid in grasping. As shown in side cross-sectional diagram 400*b*, tip 401 includes a hollow cylindrical center 402 that is surrounded by a wall 403. A ridge 404 can provide a stopping point such that tip 401 can be coupled with a hose or intermediary component. Users will inhale through hole 405 in a proximal end of tip 401. Tip 401 can be about 35.51 millimeters long in some embodiments. Hose tip 401 can be an example embodiment of hose tip 1 of FIG. 3A.

FIGS. 5A-5D show an example embodiment of an MP body 411 end diagram 410*a*, side diagram 410*b*, side cross-sectional diagram 410*c* and mockup 410*d*. As shown in the example embodiment, MP body 411 can include a hollow cylindrical center 412 that is surrounded by a wall 413. A ridge 414 can provide a stopping point such that MP body 411 can be coupled with a hose or intermediary component. MP body 411 can be about 200 millimeters long in some embodiments MP body 411 can be an example embodiment of MP body 2 of FIG. 3A.

FIGS. 6A-6D shows an example embodiment of a hose end cover 421 side cross-sectional diagram 420*a*, end diagram 420*b*, side diagram 420*c* and mockup 420*d*. As shown in the example embodiment, hose end cover 421 can include a hollow cylindrical center 422 that is surrounded by a wall 423. In some embodiments, a grommet can be fixed or removable within hollow cylindrical center 422. An interior ridge 424 can provide a stopping point such that hose end cover 421 can be coupled with a hose or intermediary component. Hose end cover 421 can be about 30 millimeters long in some embodiments. Hose end cover 421 can be an example embodiment of hose end cover 6 of FIG. 3A.

FIGS. 7A-7D show an example embodiment of an MP nipple and tip adapter 431 side cross-sectional diagram 430*a*, end diagram 430*b*, side diagram 430*c* and mockup 430*d*. As shown in the example embodiment, MP nipple and tip adapter 431 can include a hollow cylindrical center 432 that is surrounded by a wall 433. In some embodiments, a grommet can be fixed or removable within hollow cylindrical center 432. At least one interior ridge 434 can provide a stopping point such that MP nipple and tip adapter 431 can be coupled with a hose or intermediary component. MP nipple and tip adapter 421 can be about 30 millimeters long in some embodiments.

Figure 8:
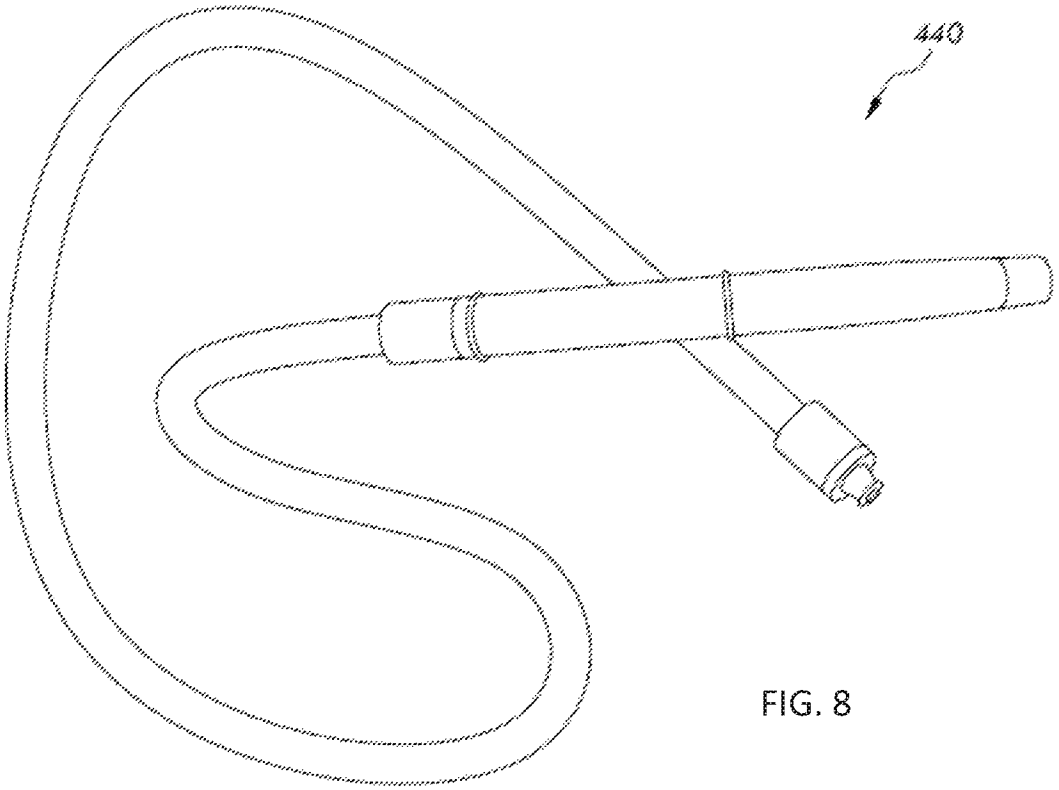
FIG. 8 shows an example embodiment of a hose.
Figure 9D:
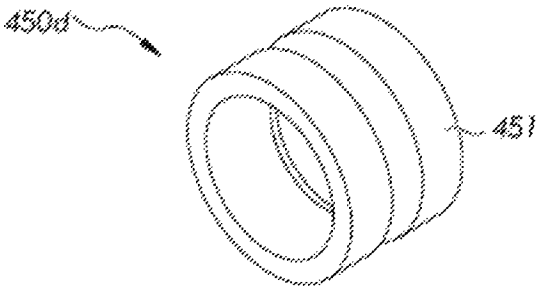
FIGS. 9A-9D show an example embodiment of a MP grommet.
Figure 9B:
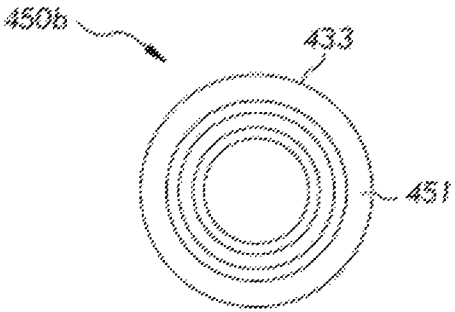
Figure 9A:
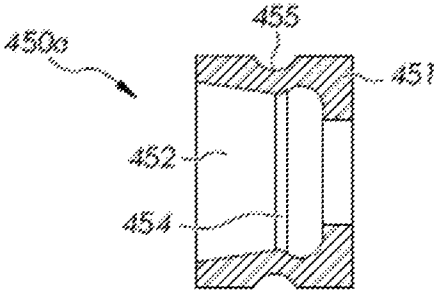
Figure 9C:
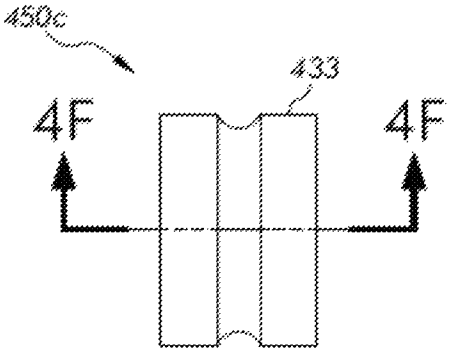
Figure 10B:
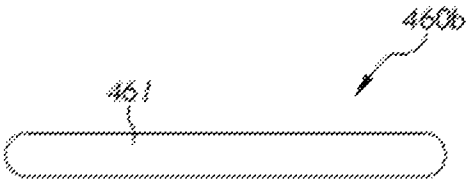
FIGS. 10A-10D show an example embodiment of a MP large washer.
Figure 10D:
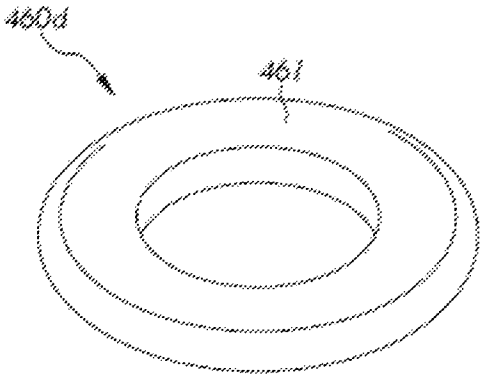
Figure 10A:
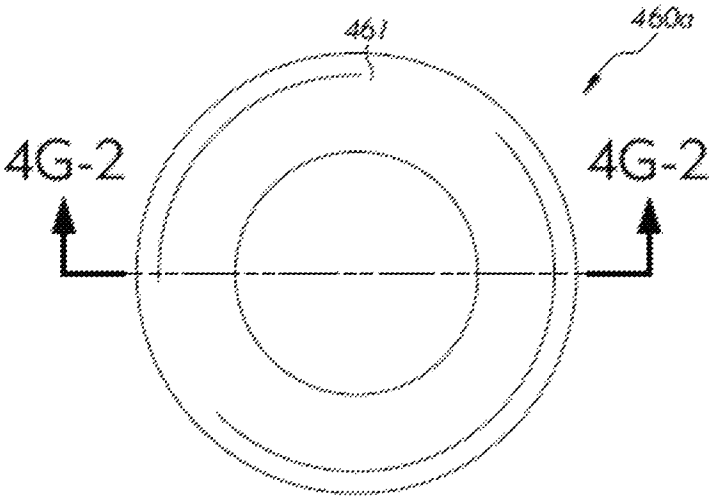
Figure 10C:
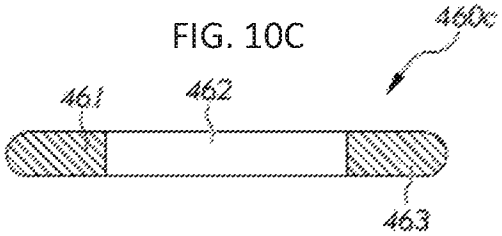
Figure 11B:
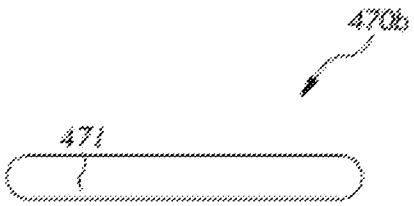
FIGS. 11A-11D show an example embodiment of a MP small washer.
Figure 11D:
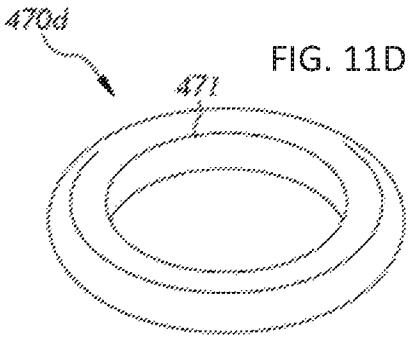
Figure 11A:
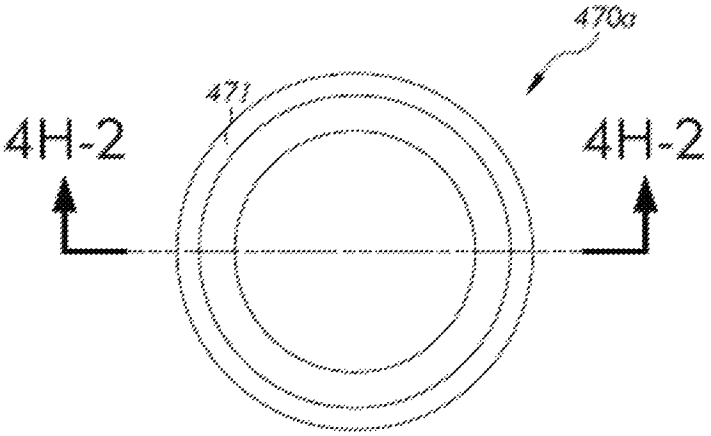
Figure 11C:
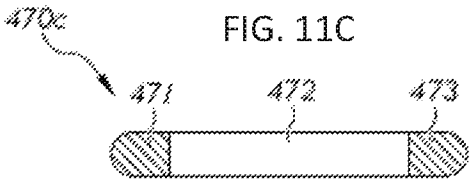
Figure 12B:
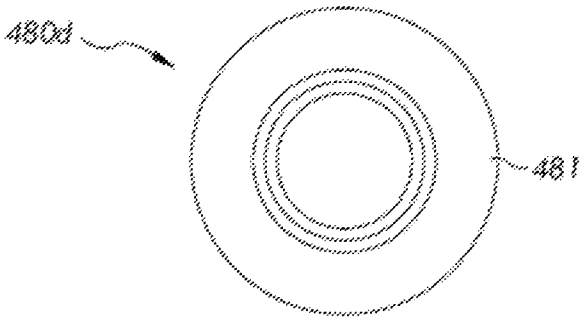
FIGS. 12A-12D show an example embodiment of an MP hose receiver
Figure 12D:
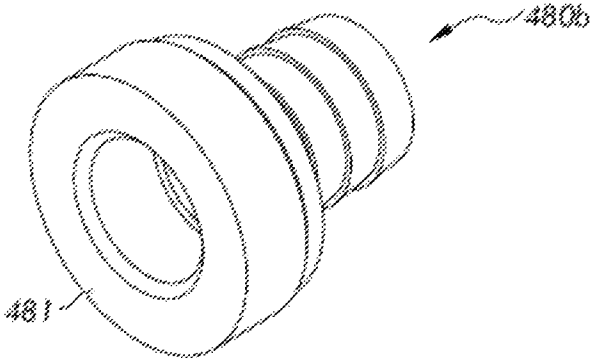
Figure 12A:
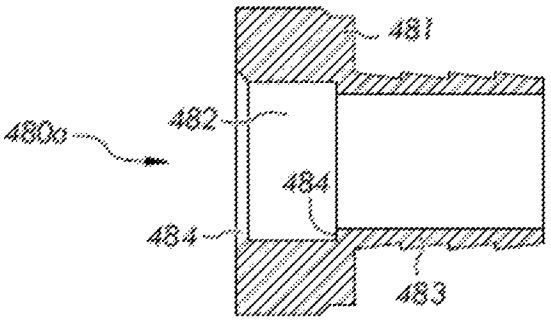
Figure 12C:
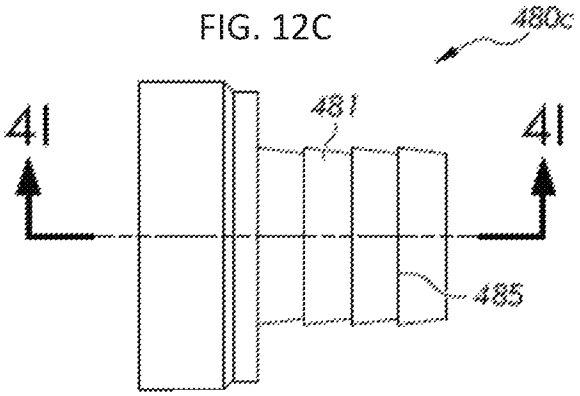
Figure 13B:
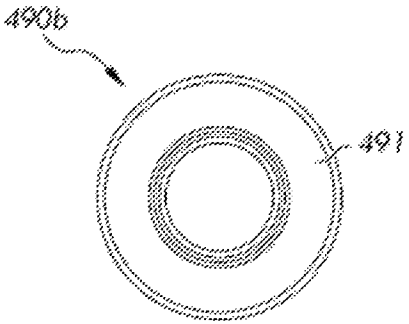
FIGS. 13A-13D show an example embodiment of a MP hose end receiver.
Figure 13D:
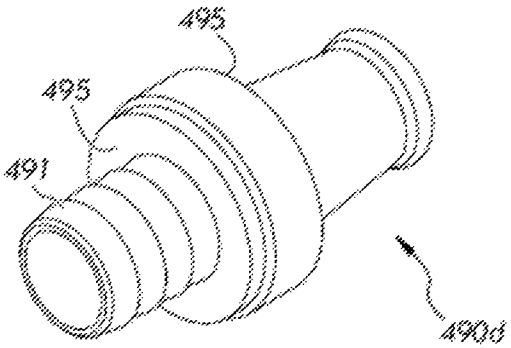
Figure 13A:
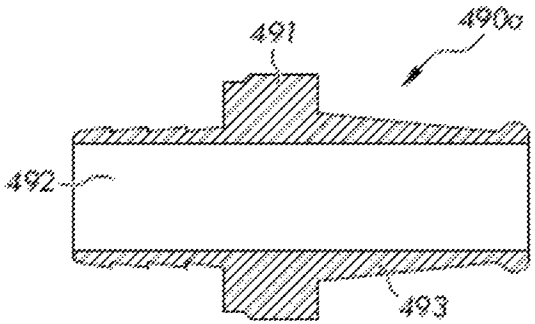
Figure 13C:
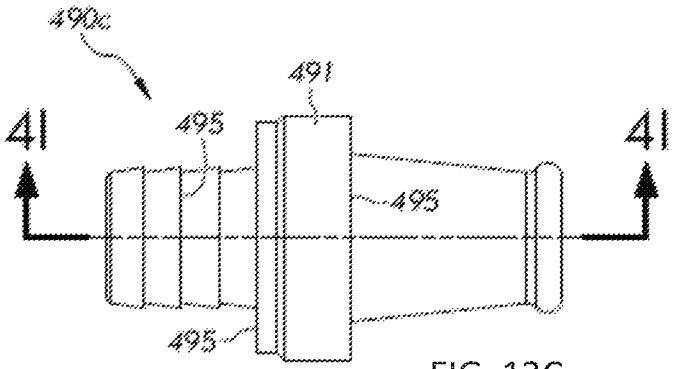
Figures 14A, 14B, 14C, 14D:
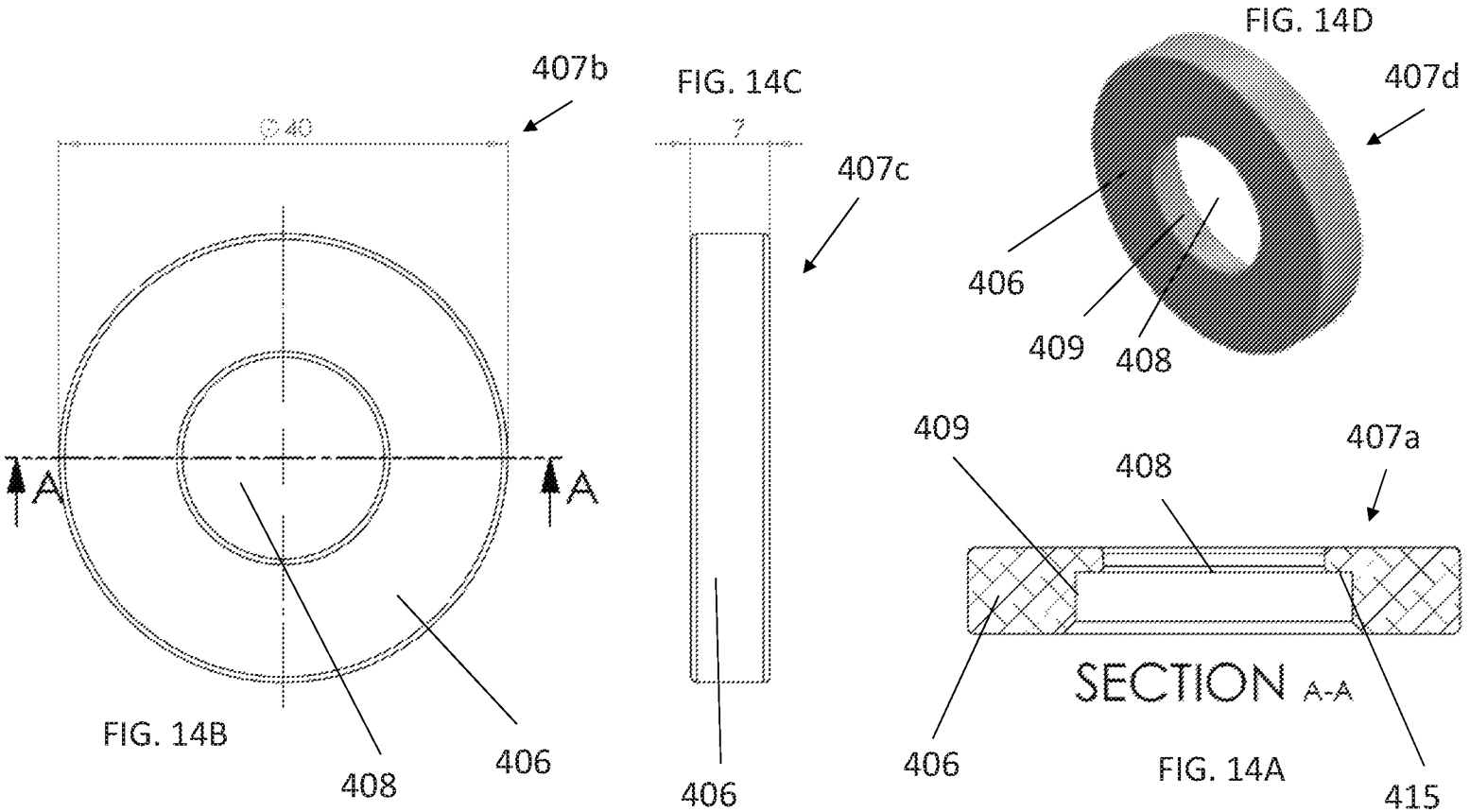
FIGS. 14A-14D show an example embodiment of a hose end plug escutcheon
Figures 15A, 15B, 15C, 15D:
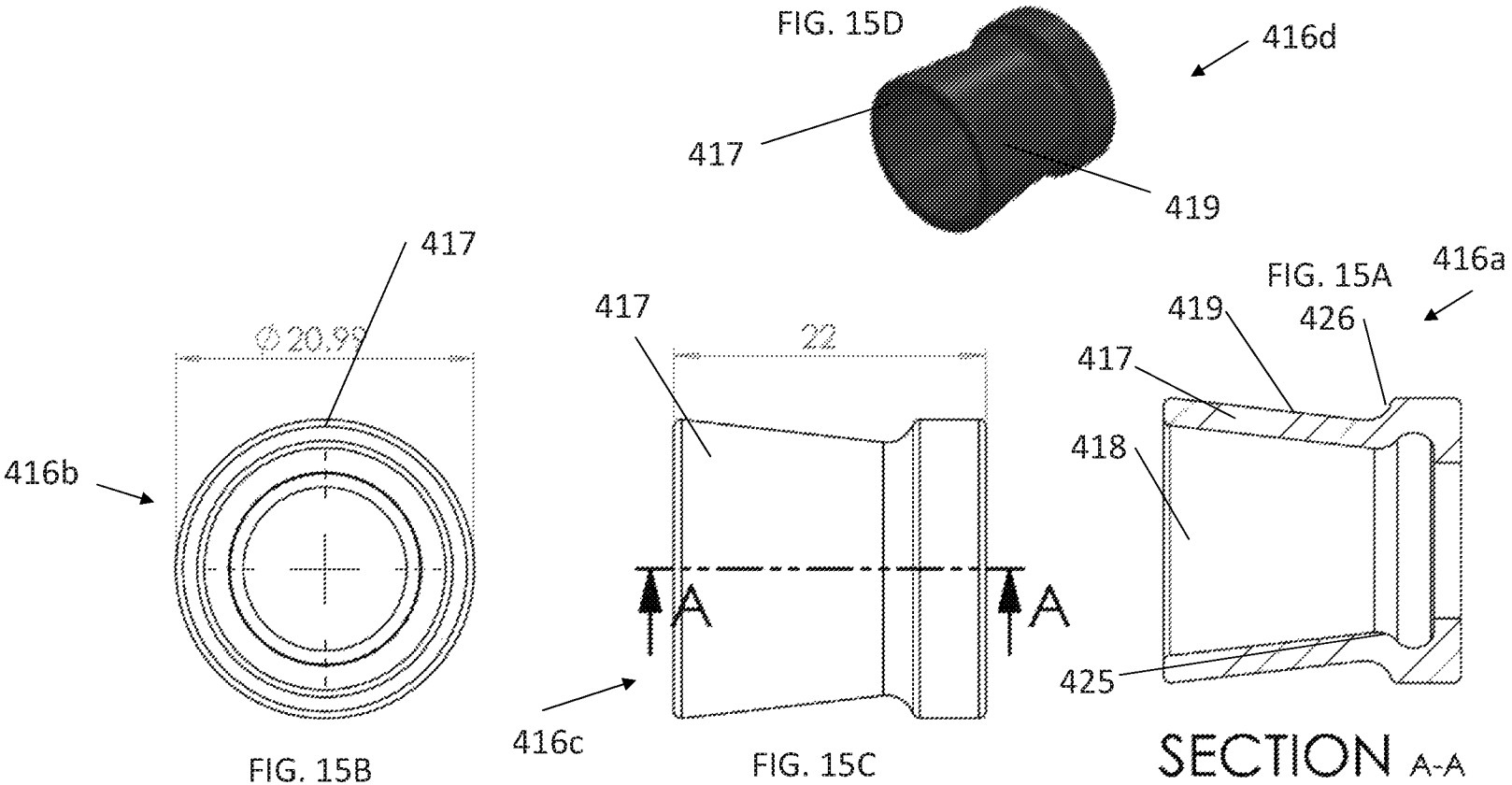
FIGS. 15A-15D show an example embodiment of a hose plug grommet.
Figure 16C:
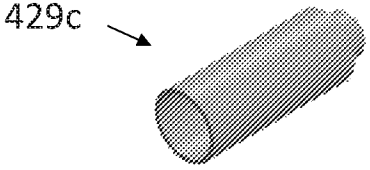
FIGS. 16A-16C show an example embodiment of a manifold extension.
Figure 16A:
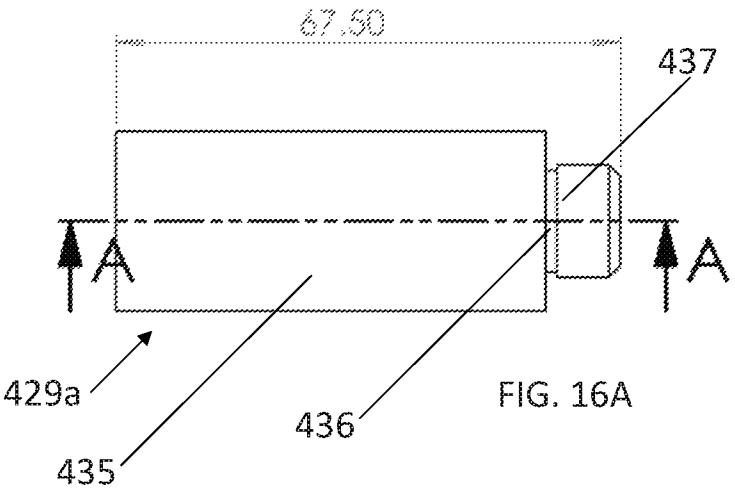
Figure 16B:
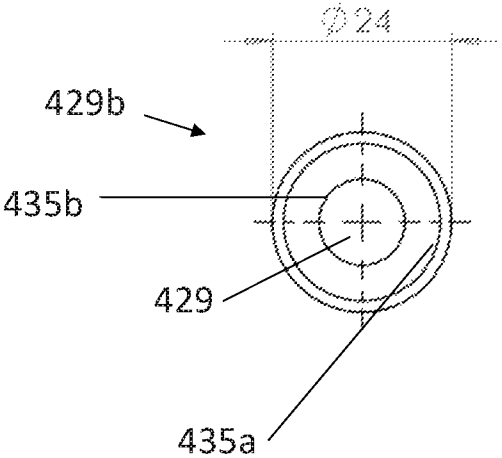
Figure 17A:
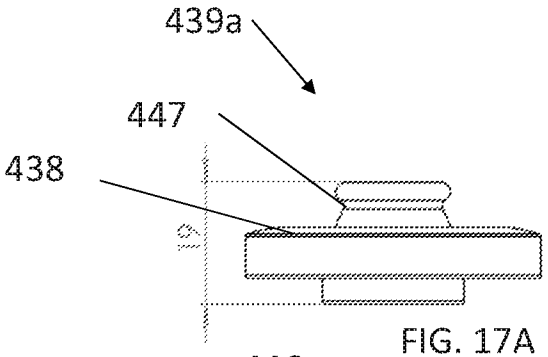
FIGS. 17A-17D show an example embodiment of a bowl nipple.
Figure 17B:
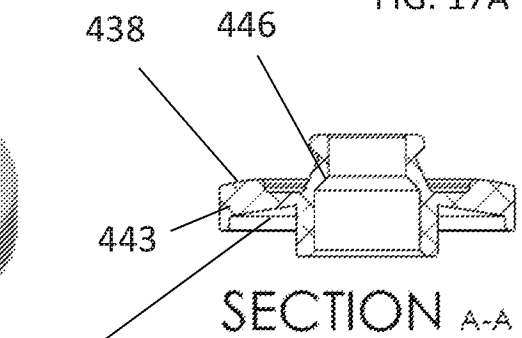
Figure 17D:
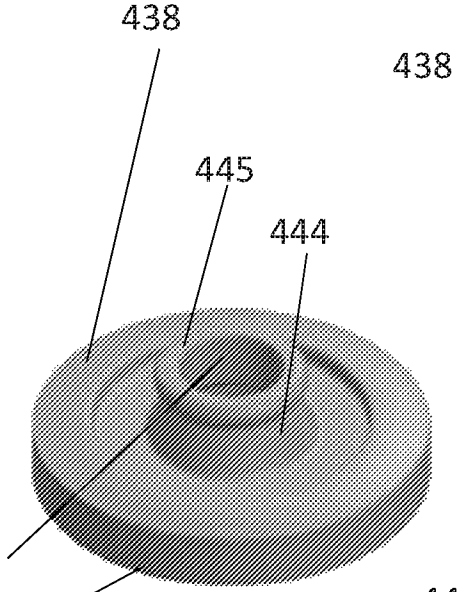
Figure 17C:
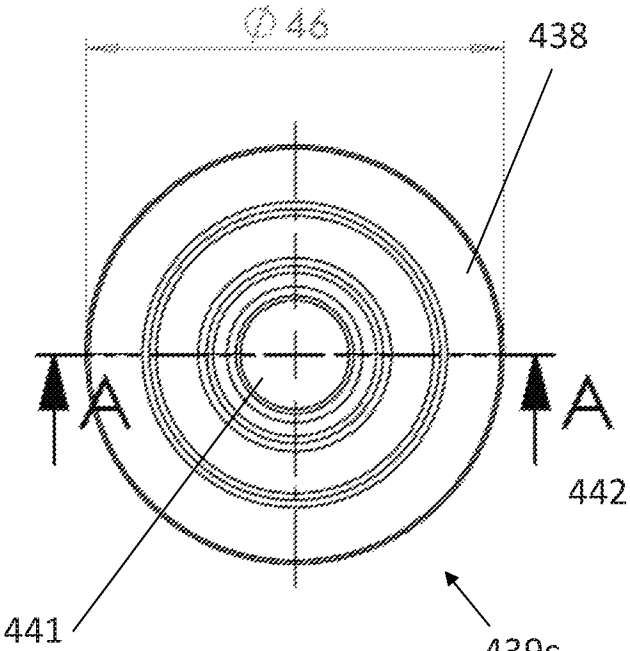

FIG. 8 shows an example embodiment of a hose 440. Hose 440 can be a flexible cylindrical length and can include a hollow cylindrical interior. Hose 440 can be an example embodiment of hose 5 of FIG. 3A. In some embodiments, multiple hoses and purge systems can be used, as should be understood.

FIGS. 9A-9D show an example embodiment of a MP Grommet 451 side cross-sectional diagram 450*a*, end diagram 450*b*, side diagram 450*c* and mockup 450*d*. As shown in the example embodiment, MP Grommet 451 can include a hollow cylindrical center 452 that is surrounded by a wall 453. In some embodiments, a grommet can be fixed or removable within hollow cylindrical center 452. At least one interior ridge 454 can provide a stopping point such that MP Grommet 451 can be coupled with a hose or intermediary component. MP Grommet 451 can include an exterior circumferential ridge 455 in order to couple with interior components of other components to remain in a fixed location with respect to the other component. MP Grommet 451 can be about 10.5 millimeters long in some embodiments.

FIGS. 10A-10D show an example embodiment of a MP large washer 461 side cross-sectional diagram 460*c*, end diagram 460*a*, side diagram 460*b* and mockup 460*d*. As shown in the example embodiment, MP large washer 461 can include a hollow cylindrical center 462 that is surrounded by a wall 463. In some embodiments, a grommet or other component can be fixed or removable within hollow cylindrical center 462. MP large washer 461 can be about 3 millimeters long in some embodiments.

FIGS. 11A-11D show an example embodiment of a MP small washer 471 side cross-sectional diagram 470*c*, end diagram 470*a*, side diagram 470*b* and mockup 470*d*. As shown in the example embodiment, MP small washer 471 can include a hollow cylindrical center 472 that is surrounded by a wall 473. In some embodiments, a grommet or other component can be fixed or removable within hollow cylindrical center 472. MP small washer 471 can be about 3 millimeters long in some embodiments.

FIGS. 12A-12D show an example embodiment of a MP hose receiver 481 side cross-sectional diagram 480*a*, end diagram 480*b*, side diagram 480*c* and mockup 480*d*. As shown in the example embodiment, MP hose receiver 481 can include a hollow cylindrical center 482 that is surrounded by a wall 483. In some embodiments, a grommet can be fixed or removable within hollow cylindrical center 482. At least one interior ridge 484 can provide a stopping point such that MP hose receiver 481 can be coupled with a hose or intermediary component. MP hose receiver 481 can include at least one exterior circumferential ridge 485 in order to couple with interior components of other components to remain in a fixed location with respect to the other component. MP hose receiver 481 can be about 26 millimeters long in some embodiments. FIGS. 12A-12D can be an example embodiment of MP nipple 4 of FIG. 3A.

FIGS. 13A-13D show an example embodiment of a hose end receiver 491 side cross-sectional diagram 490*a*, end diagram 490*b*, side diagram 490*c* and mockup 490*d*. As shown in the example embodiment, hose end receiver 491 can include a hollow cylindrical center 492 that is surrounded by a wall 493. Hose end receiver 491 can include at least one exterior circumferential ridge 495 in order to couple with interior components of other components to remain in a fixed location with respect to the other component. Hose end receiver 491 can be about 48.5 millimeters long in some embodiments. Hose end receiver 491 can be an example embodiment of hose plug 7 of FIG. 3A.

FIGS. 14A-14D show an example embodiment of a hose end plug escutcheon 406 side cross-sectional diagram 407*a*, end diagram 407*b*, side diagram 407*c* and mockup 407*d*. As shown in the example embodiment, end plug escutcheon 406 can be cylindrical or disk shaped and can include a hollow cylindrical center 408 that is surrounded and defined by a circumferential wall 409. Hose end plug escutcheon 406 can include at least one interior circumferential ridge 415 in order to couple with or otherwise retain other components, such as a grommet. Hose end plug escutcheon 406 can be about 40 millimeters diameter wide at its widest in some embodiments and about 7 millimeters thick. Hose end plug escutcheon can be an example embodiment of escutcheon 384 of FIG. 3B.

FIGS. 15A-15D show an example embodiment of a hose plug grommet 417 side cross-sectional diagram 416*a*, end diagram 416*b*, side diagram 416*c* and mockup 416*d*. As shown in the example embodiment, hose plug grommet 417 can include a hollow cylindrical center 418 that is surrounded by a wall 419. In some embodiments, another grommet or component can be fixed or removable within hollow cylindrical center 418. At least one interior ridge 425 can provide a stopping point such that hose plug grommet 417 can be coupled with a hose or intermediary component. Hose plug grommet 417 can include an exterior circumferential ridge 426 in order to couple with interior components of other components to remain in a fixed location with respect to the other component. Hose plug grommet 417 can be about 22 millimeters long in some embodiments and about 20.99 millimeters in diameter at its widest. Hose plug grommet 417 can be an example embodiment of hose plug grommet 382 of FIG. 3B.

FIGS. 16A-16D show an example embodiment of a manifold extension 427 side diagram 428*a*, end diagram 428*b* and mockup 428*c*. As shown in the example embodiment, manifold extension 427 can include a hollow cylindrical center 429 that is surrounded by a wall 435. Wall 435 can be unitary in some embodiments and can include a wider diameter section 435*a* and narrower diameter section 435*b*. These sections can transition abruptly or gradually at a neck 436. Wider diameter 435*a* section can allow for insertion of other components such as grommets, while narrower diameter section 435*b* can include coupling mechanisms on an exterior surface 437 such as ridges for inserting and coupling within other components such as a manifold. Manifold extension 427 can be about 67.5 millimeters long in some embodiments and about 24 millimeters in diameter at its widest. Manifold extension 427 can be an example embodiment of manifold extender 370 and 380 of FIG. 3B.

FIGS. 17A-17D show an example embodiment of a bowl nipple 438 side diagram 439*a*, side cross sectional diagram 439*b*, end diagram 439*c* and mockup 439*d*. As shown in the example embodiment, bowl nipple 438 can include a hollow cylindrical center 441 that is surrounded by an interior wall 442. Wall 442 can be unitary in some embodiments and can include a wider diameter section and narrower diameter section. An exterior of bowl nipple 438 can include a generally cylindrical shaped disk 443 at a distal end that has a tapered section 444 and a thicker cylindrical disk 445 at a proximal end. These sections can transition abruptly or gradually. Tapered section 444 can include ridges for coupling using a screwing mechanism in some embodiments. An interior of hollow cylindrical center 441 can include at least one ridge 446 for insertion of other components such as grommets, while an exterior surface 447 can include features such as ridges for inserting and coupling within other components such as a bowl. Bowl nipple 438 can be about 19 millimeters thick in some embodiments and about 46 millimeters in diameter at its widest. As shown in the example embodiment, a channel 448 can be located coaxially around cylindrical center 441 and may include an arched rim for holding or coupling with a grommet or gasket. As shown, channel 448 may have an exterior wall that does not extend as far distally as wall 442. Bowl nipple 438 can be an example embodiment of bowl nipple 352 of FIG. 3B.

Bowl Subsection

FIG. 18A shows an example embodiment diagram 500*a* of a bowl 502 and downstem 530 with aerator subassembly 540 in an upside-down orientation.

FIG. 18B an example embodiment diagram 500*b* of a bowl 502 and downstem 530 in an upside-down orientation.

FIG. 18C shows an example embodiment diagram 500*c* of a bowl 502 and downstem 530 with aerator subassembly 540 in an upside-down orientation. Downstem 530 can be an example embodiment of downstem 8 of FIG. 3A. Aerator subassembly 540 can be an example embodiment of aerator 10 of FIG. 3A FIG. 18D shows an example embodiment diagram 500*d* of a bowl 502 and downstem 530 with aerator subassembly 540.

FIG. 18E shows an example embodiment diagram 500*e* of a bowl 502 with separate chambers 504 and downstem 530 with aerator subassembly 540. As shown in the example embodiment, separate chambers 504 or compartments for tobacco or other organic material can provide containment in different locations within bowl 502. Chambers 504 are defined by walls 507 that can slope and meet at a lower end and a circumferential wall 508. In the example embodiment, the separate chambers 504 are shown in a spiral configuration with a central pipe 506 at the center. The separate compartments 504 can provide flavor mixing advantages not present in the art. For instance, one compartment 504 can be used for a first flavor of tobacco, or other organic material, while a second compartment 504 can be used for a second flavor, until each compartment 504 is filled. Unique and easily reproducible combinations can be created by a user based on this design. This is in stark contrast to the traditional single compartment design.

As shown for example in FIG. 18E, a bowl 502 preferably generally comprises a substantially hemispherical bowl head 505 extending vertically and radially from a substantially cylindrical bowl stalk 509. As shown, bowl stalk 509 may be flared outward at its bottom end to facilitate easier manipulation. The bowl 502 preferably further comprises interior 510 and exterior 511 surfaces separated by a rim portion 503. In some embodiments, located central to the bowl head 505, and forming a portion of the inner surface of the bowl 502, may be a hollow tube 506 extending the length of the bowl 502 from the bowl head 505 through the bowl stalk 509.

Bowl head 505 preferably further comprises a plurality of compartments 504*g* therein for containing the organic matter or other material to be smoked. Accordingly, internal walls 507 may separate adjacent compartments 504*g*. A plurality of internal walls 507 may extend inward from the interior surface of the bowl head to hollow tube 506, forming the plurality of compartments 504*g*. Accordingly, each internal wall 507 may partially or wholly separate adjacent compartments 504*g*. Compartments 504*g* may have varied dimensions and may be uniform or sized differently in different embodiments. In the example embodiment, each compartment is of equal depth and similar dimensions and shape. Each compartment may have a "U" shaped cross-sectional profile when viewed from a side. Alternatively, each compartment may have a "V" shape, open-top square shape, open-top rectangular shape or other shapes.

As shown in FIG. 5W, in some embodiments the compartments 504*g* are slightly recessed from an upper elevation of the rim 503, forming a space 318 between a cover and the organic matter to be smoked so as to promote airflow from the organic matter to the hollow tube 506.

In at least one embodiment, bowl 502 is made of silicone material. Silicone may have advantages such as improved insulation around the head 505 and improved heat distribution inside the head 505 and may also provide improved uniformity of heat distribution. Improved insulation around head 505 may provide an improved user experience since users are less likely to burn themselves when handling bowl 502 when it is hot. Improved heat distribution inside head 505 may provide an improved user experience since it promotes even heating characteristics for organic matter in compartments 504*g*. As such, organic matter may be evenly heated and less likely to have some portions burn while others remain unheated. In other embodiments clay, marble, glass, or other appropriate materials may be used.

In accordance with the bowl of FIG. 18E, a user can insert a metered amount of tobacco, shisha or other organic material into one or more of compartments 504*g* before or after coupling bowl 502 with a stem of a water pipe in order to prepare the bowl 502 for smoking.

In another example embodiment, compartments can be arranged concentrically around the central pipe. In the example embodiment, the separate compartments are slightly recessed from the top of the head. That is, the barriers between separate compartments do not extend to the upper end of the head. In the example embodiment, this can create a small gap between the lower surface of a plate for coal support and the upper surface of the tobacco, or other organic material, to be heated where the tobacco, or other organic material, is inserted in the compartments to the same upper height as the upper end of the ridge barriers. This arrangement can serve to protect the tobacco, or other organic material, from becoming too hot and burning which can create an unpleasant and harsh smoke for the user. The small gap can also serve as a small compartment for pleasant smoke created by the heated tobacco, or other organic material, to reside before being drawn downward through the central pipe. In some embodiments, they can extend to the upper end of the head.

FIG. 18F shows an example embodiment diagram 500*f* of a bowl 502 and downstem 530.

FIG. 18G shows an example embodiment cross-sectional diagram 500*g* of a bowl 502, plate 520 and coupled cap 550. Bowl 502 can be an example embodiment of bowl 350 of FIG. 3D.

FIG. 18H shows an example embodiment cross-sectional diagram 500*h* of a bowl 502, plate 520 and coupled cap 530.

FIGS. 18G-18H show a perspective view of a head with separate compartments for tobacco, or other organic material, containment. In typical prior art heads, a single compartment is provided for housing tobacco. In the example embodiment, a plurality of separate compartments are shown for housing tobacco, or other organic material. Each compartment shown can extend radially outward in a spiral from a central pipe that extends through the head for a portion or from top to nearly the bottom. In operation, the central pipe can allow a user to draw air from above the central pipe through the central pipe. The separate compartments shown each have identical dimensions although in other embodiments differing dimensions can be used. For example, a single compartment can be half of the head while the other half of the head can be split in two for a total of three compartments. Similarly, in some embodiments compartments can be arranged differently.

FIGS. 18G-18H a perspective cross-sectional view 500*g* and side cross-sectional view 500*h* of an example embodiment of a dual component bowl 502*g* in accordance with the present invention. In various embodiments, an outer bowl 502*h* is provided with an inner bowl 502*i* which can be a different material and can be fixed or removable with respect to outer bowl 502*h*. In the example embodiment, outer bowl 502*h* is a silicone bowl which does not readily transfer heat and provides some insulating features Inner bowl 502*i* is a glass bowl which provides heat transfer properties. Inner bowl 502*i* can be manufactured with a spiral pattern 1206, which in some embodiments can function similarly to the spiral features creating individual compartments. Further description of dual component bowls is given with respect to FIGS. 3D and 3E in U.S. patent application Ser. No. 14/948,168, which is incorporated by reference herein in its entirety.

As shown in FIG. 18H, air can be drawn into cap 550, through holes in platform 520 and through a central hole of bowl 502*g*.

FIG. 18I shows an example embodiment exploded view diagram 500*i* of a bowl 502, plate 520 and coupled cap 550.

FIGS. 18J-18M show an example embodiment top diagram 500*j*, side diagram 500*k*, side cross-sectional diagram 500*l* and mockup 500*m* of a bowl 502*j*.

FIGS. 18N-18Q show an example embodiment side diagram 500*n*, side cross-sectional diagram 500*o*, top diagram 5009 and mockup 500*q* of a bowl 502*k*.

FIGS. 18R-18U show an example embodiment of a down stem 561 side diagram 560*s*, side cross sectional diagram 560*t*, end diagram 560*r* and mockup 560*u*. As shown in the example embodiment, down stem 561 can include a hollow cylindrical center 562 that is surrounded by an interior wall 563. Wall 563 can be unitary in some embodiments and can include a wider distal diameter section 562*a*, tapered section 562*b* and narrower proximal diameter section 562*c*. An exterior of down stem 561 can include a generally cylindrical shape 567 with a proximal tapered section 564 ending in a ridge 565, whereby a proximal end section 566 extends further and generally has the same exterior circumference as cylindrical section 567. Proximal end section can include ridges for coupling using a screwing mechanism in some embodiments, while in other embodiments it may be smooth. A distal taper 568 can end in a distal cylindrical section 569 that includes a coupling mechanism such as a ridge for coupling with a diffuser cap. These sections can transition abruptly or gradually. An interior of hollow cylindrical center 562 can include at least one ridge 570 for insertion and retention of other components such filters and aerators. Down stem 561 can be about 123.25 millimeters long in some embodiments and about 45.03 millimeters in diameter at its widest. Down stem 561 can be an example embodiment of down stem 361 of FIG. 3C.

FIG. 18V shows an example embodiment of a down stem 561 coupled with a bowl 502*m*.

FIGS. 18W-18Y show an example embodiment of a diffuser cap 581 side diagram 580*y*, side cross sectional diagram 580*w*, and mockup 580*x*. As shown in the example embodiment, diffuser cap 581 can include a hollow cylindrical center 582 that is defined by a cylindrical interior wall 583 and a convex wall 584. Wall 584 can be unitary in some embodiments and can include various perforations or holes 585 that allow for air to pass through it. Cylindrical interior wall 583 can include ridges or other mechanisms that allow for coupling with a down stem distal end. Diffuser cap 581 can be about 13 millimeters long in some embodiments and about 38 millimeters in diameter at its widest. Diffuser cap 581 can be an example embodiment of aerator cap 362 of FIG. 3B.

FIGS. 18Z, 18AA show an example embodiment of a top end view 580*a* and bottom end view 580*z* of a diffuser cap.

FIG. 19A shows an example embodiment exploded view diagram 600*a* of an aerator subassembly. This aerator subassembly can fit within a downstem distal end and be held in place by a diffuser cap in various embodiments. As shown in the example embodiment, a filter top 602 can rest over and cover a filter mesh 610. Filter mesh 610 can in turn rest on carbon pellets 622, carbon sponge 620 or both. One or all of filter top 602, filter mesh 610, carbon 622 in the shape of pellets, rods, squares, or any other regular or irregular shape and carbon sponge 620 can be housed within filter body 630. In various embodiments, filter top 602 can be coupled with filter body 630. In some embodiments, coupling can be accomplished with ultra-sonic welding.

FIGS. 19B-D show an example embodiment diagram of a filter top 602 from a top view 600*b*, side view 600*c* and perspective view 600*d*. As shown in the example embodiment, filter top 602 can include solid ribs 604 and holes 606 that allow airflow through filter top 602. These holes can be arranged in a regular or irregular pattern. Filter top 602 can have a wall 1121 that defines a cylindrical empty chamber 1125. Filter top 602 can have a thickness and have a diameter of about 30.4 millimeters at its widest in some embodiments.

It should be noted that carbon filtration can be used in various locations in different embodiments. As such, carbon sponges (e.g. 620), carbon pellets (e.g. 622), filter meshes (e.g. 610) and other components may be housed within one or more enclosures in different locations. These can include, but are not limited to, a channel around an edge or edges of a manifold (e.g. 368 of FIG. 3B), a hose tip (e.g. 401 of FIGS. 4A-4D), an MP core (e.g. 411 of FIGS. 5A-5D), a hose receiver (e.g. 481 of FIGS. 12A-12D), a hose end receiver (e.g. 491 of FIGS. 13A-13D), a manifold extension (e.g. 427 of FIGS. 16A-16D), or any other location as would be appropriate and effective for their purpose of filtering particulates from airflow within water pipes.

FIGS. 19E-19H show an example embodiment diagram of a filter mesh 610 from a top view 600*e*, side view 600*f*, perspective view 600*g* and image view 600*h*. As shown in the example embodiment, filter mesh 610 can be a mesh or other fabric, operable to allow airflow therethrough. This fabric can be chosen as appropriate but should generally have a filtering effect on smoke drawn therethrough. Various fabrics are considered including synthetic and natural fabrics. Filter mesh 610 can have a thickness of about 1 millimeter and have a diameter of about 25 millimeters at its widest in some embodiments.

FIGS. 19I-19J show an example embodiment diagram of a carbon sponge 620 from a top view 600*i* and a side view 600*j*. As shown in the example embodiment, carbon sponge can have a diameter of about 19.06 millimeters and a thickness of about 8 millimeters.

FIGS. 19K-190 show an example embodiment diagram of a filter body 630 from a top view 600*k*, bottom view 600*l*, side view 600*m*, side cross-sectional view 600*n* and mockup 600*o*. As shown in the example embodiment, filter body 630 can include a cylindrical portion 632 and a flared portion 634. Filter body 630 can have at least one wall 640 that defines the cylindrical portion 632 and flared portion 634. At least one interior ridge 636 can provide a stopping point such that filter body 630 can be coupled with intermediary components. Flared portion can terminate in a rib structure 642 with holes 638 that allow airflow through filter body 630. These holes 638 can be arranged in a regular or irregular pattern. Filter body 630 can have a length of 24.04 millimeters, cylindrical portion 632 can have a diameter of about 30.4 millimeters at its widest and flared portion can have a diameter of about 30.4 millimeters at an end opposite cylindrical portion 632 in some embodiments.

In some embodiments, substances other than tobacco can be smoked through the water pipes disclosed herein. In some of these embodiments, additional, substitute or complementary components may be required for safety, health, enjoyment and other functional reasons.

Manifold and Glass Subsection

FIGS. 20A-20B show an example embodiment of an outer vessel 701 top view diagram 702*a* and isometric view diagram 702*b*. As shown in the example embodiment, outer vessel 701 can be defined by a wall 704 that is generally dome shaped in a half sphere. A circular hole 703 can be substantially centrally located at the top of the dome. The bottom of the dome can be substantially open. Outer vessel can be about 254 millimeters in diameter at its widest. Outer vessel 701 can be an example embodiment of outer vessel 11 of FIG. 3A.

FIGS. 20C-20E show an example embodiment of an outer vessel 701 side view diagram 702*c*, side cross-sectional diagram 702*d* and side cross-sectional detail diagram 702*e*. As shown in the example embodiment, outer vessel 701 can be about 138 millimeters tall in total. Wall 704 can include a domed height of about 126 centimeters and a vertical true cylindrical height of about 12 millimeters at the bottom of outer vessel 701. Hole 703 can be about 30 millimeters in diameter. Wall 704 can be about five millimeters thick and hole 703 can be cut from wall 704 before being ground and polished to smooth out edges. Similarly, the bottom edge of wall 704 can be cut, ground flat and polished.

FIGS. 20F-20H show an example embodiment of an inner vessel 721 an inner vessel picture 720*a*, mockup 720*b* and top view diagram 720*c*. As shown in the example embodiment, inner vessel 721 can be defined by a unitary bottom 725 and wall 724 that is generally dome shaped in a half sphere. A circular hole 723 can be substantially centrally located at the top of the dome. Bottom 725 of inner vessel can have a lower surface that is generally flat. Inner vessel 721 can be an example embodiment of inner vessel 12 of FIG. 3A.

FIGS. 201-20K show an example embodiment of an inner vessel 721 side view diagram 720*d*, side cross-sectional diagram 720*e* and side cross-sectional detail diagram 720*f*. As shown in the example embodiment, inner vessel 721 can be about 146.73 millimeters tall in total and about 213.93 millimeters in diameter at its widest. Hole 723 can be between 57 and 59 millimeters in diameter. Wall 724 can be about five millimeters thick and hole 723 can be cut from wall 724 before being ground and polished to smooth out edges and achieve desired angles.

FIGS. 20L-20M show an example embodiment of an outer vessel 731 top view diagram 730*g* and isometric view diagram 730*h*. As shown in the example embodiment, outer vessel 731 can be defined by a wall 734 that is generally dome shaped in a half sphere. A circular hole 732 can be substantially centrally located at the top of the dome. As shown in the example embodiment, a flared lip 733 can be provided where hole 732 is narrowest. Flared lip 733 can provide a mounting location for a bowl subassembly that can be supported by an upward facing surface of flared lip 733. The bottom of the dome can be substantially open. Outer vessel 731 can be about 254 millimeters in diameter at its widest, while hole 732 can be about 42 millimeters at its narrowest. Outer vessel 731 can be an example embodiment of outer vessel 326 of FIG. 3C.

FIGS. 20N-20P show an example embodiment of an outer vessel 731 side view diagram 730*i*, side cross sectional view diagram 730*j* and hole detail 730*k*. As shown in the example embodiment, outer vessel 731 can be about 165 millimeters tall in total. Wall 734 can include a domed height of about 138.36 centimeters and a vertical true cylindrical height of about 12 millimeters at the bottom of outer vessel 731. Wall 704 can be about five millimeters thick and flared lip 733 can be cut from wall 704 before being ground and polished to smooth out edges. Similarly, the bottom edge of wall 704 can be cut, ground flat and polished. Flared lip 733 can make about a 90-degree angle with the complementary portion of flared lip 733 located on the opposite side of hole 732.

FIG. 20Q shows an example embodiment 7301 of an outer vessel coupled with a main seal and manifold from a cross-sectional side view. As shown in the example embodiment, an outer vessel 731 can be removably coupled with a manifold 902 by a main seal 810. This coupling can be substantially airtight and prevent air leaks in various embodiments. As such, the coupling can be tuned to various tolerances.

FIGS. 20R-20S show an example embodiment of an outer vessel coupled with a main seal and manifold from a cross-sectional side view 730*m* and detailed view 730*n*.

These mechanisms will be described further with respect to FIGS. 21A-21H and 22A-22F.

FIG. 20T shows an example embodiment of an outer vessel 731 side cross-sectional view diagram 730*o*. As shown in the example embodiment, a bowl 730 can rest in or otherwise be coupled with a flared lip 733 of an outer chamber 731.

FIGS. 20U-20V show an example embodiment of an outer vessel 731 side cross-sectional view diagram 730*p* and detailed view 730*q*. As shown in the example embodiment, a bowl 730 can rest in or otherwise be coupled with a flared lip 733 of an outer chamber 731 and be affected by different tolerances due to the material of outer chamber 731. For example, when glass is used three different adaptable areas may require consideration and adjustment in developing appropriate couplings. Curvature flex 741 allows for bowls of a silicone material to hold to a full range of curvatures on the inner and upward facing flared lip 733. An adjustable height 742 of bowl 760 allows for changes in flared lip 733 thickness to be accounted for, even when changing. Adjustable height 742 can also provide for adaptation of locations where bowl 760 interfaces with the glass, relative to a height position of the curve accounted for by curvature flex 741. An adaptable inner diameter 743 can be accomplished by providing a moat 765 or other channel on an interior underside of bowl 760, around a central axis. This allows an outer arm 766 to flex inward toward the central axis of the bowl and thereby account for various inner diameter changes of outer chamber 731.

In various embodiments, inner and outer vessels can be different shapes and sizes and can be made of various materials. These can include cube shapes, donut shapes, cylinder shapes, irregular shapes, regular shapes and others as appropriate and glass, wood, stone, and others, as appropriate. Additionally, a diameter or other measurement at an upper opening of a hole in an outer vessel and a diameter or other measurement of a bottom opening of a hole in the outer vessel can be sized as desired or appropriate. This also applies to openings for an inner vessel. It should be understood that this applies to various differently sized embodiments.

In some embodiments, ice or other air or fluid cooling chambers can exist within inner or outer vessels or within an interior space of a tray. These can allow for air cooling to allow for improved smoking experiences for users. One or more of inner and outer vessels can be glass in various embodiments and may have dome shapes of varying volumes, as should be understood. In many embodiments, glass chambers can be hand blown and may be within 2 mm accuracy to a standard size. In some embodiments, glass can have nanocoating of one or more materials to protect it from corrosion or other undesirable effects. In some embodiments, one or both of an inner or outer chamber can have an etching to show users one or more recommended liquid filling levels for liquid to cool smoke. In some embodiments, an outer chamber neck can eliminate a need for some sealing components, as a downstem assembly may effectively seal the neck. In some embodiments, a secondary cooling system can be provided, including an electronic refrigeration system. In some embodiments, a plurality of inner chambers can be provided within an inner chamber, outer chamber or both. It should be understood that each of these can have a variety of different sized and shaped necks to provide different advantages and smoking experiences. In some embodiments, these can be suspended, coupled with, integrated with and otherwise related to the chambers themselves, while in other embodiments they may be separate from but otherwise related to the chambers themselves.

FIG. 21A shows an example image 800*a* of a purge valve assembly 830 coupled with a manifold 820, and manifold 820 coupled with a main seal 810.

FIGS. 21B-21E show an example embodiment of a main seal 810 top diagram 800*b*, side diagram 800*d*, side cross-sectional diagram 800*e* and mockup 800*c*. As shown in the example embodiment, main seal 810 can include a hollow cylindrical center 812 that is surrounded by a wall 814. In some embodiments, at least one interior ridge 816 can provide a support such that an upper vessel can be coupled with main seal 810. Main seal 810 can be about 277 millimeters wide at largest diameter in some embodiments. Main seal 810 can be an example embodiment of gasket 14 of FIG. 3A.

FIG. 21F shows an example embodiment of main seal 810 as a side cross-sectional detail diagram 800*f*. As shown in the example embodiment, main seal 810 can include a unitary wall 814 that includes a ridge 816, that serves as a horizontal shelf to support an outer chamber. A secondary shelf 818 can initially be somewhat horizontal and bend vertically downward such that it removably couples with an outer surface of the outer chamber and maintains the outer chamber in place when in use. Empty space 819 between a primary wall 815 and secondary wall 817 can allow for wall 814 to bend such that it provides a snug fit between a manifold body and an outer vessel.

FIGS. 21G-21H show an example embodiment of two images of a main seal 810 cross section.

FIG. 22A shows an example embodiment image of a manifold 902 from a top perspective view 900*a* that is coupled with a main seal 904. Also shown are purge valve opening 906 and hose opening 908. Manifold 902 can be an example embodiment of manifold body 15 of FIG. 3A.

FIG. 22B shows an example embodiment image of a manifold 902 from a side perspective view 900*b* that is coupled with a main seal 904. Also shown are purge valve opening 906 and hose opening 908.

FIGS. 22C-22F show an example embodiment of a manifold 902 top view diagram 900*c*, side view diagram 900*d*, side cross-sectional diagram 900*e* and mockup 900*f*. As shown in the example embodiment, manifold 902 can include a flat center surface 910 that is surrounded by a cylindrical inner wall 912. Around inner wall 912 can be a depression 914 and an outer wall 916. In some embodiments, additional ridges can and walls can be provided. Depression 914 can provide a location for a bottom seal to rest that can also extend over inner wall 912 and parallel and above center surface 910. As such, an opening can be provided that is partially defined by inner wall 912 and center surface 910.

An inner chamber can rest on the bottom seal, above inner wall. In some embodiments, an outer chamber can also rest on a portion of the bottom seal, circumferentially around the inner chamber. In some embodiments, a main seal can be coupled with an upper ridge 918 and the outer chamber can rest on a portion of the main seal. In the example embodiment, a maximum diameter of manifold 902 is about 273 millimeters and a maximum height of manifold 902 can be about 68 millimeters at its largest. Purge valve opening 906 and hose opening 908 can be cylindrically shaped holes that are located across from each other in outer wall 916.

FIGS. 22G-22J show an example embodiment of a bottom seal 932 from a top view diagram 930*a*, side view diagram 930*b*, side cross-sectional diagram 930*c* and mockup 930*d*. As shown in the example embodiment, bottom seal 932 can include hollow central cylindrical hole 934 that is defined by a cylindrical wall 936. Cylindrical wall 936 can include an upper portion 938 with a small exterior circumference and a lower portion with a larger exterior circumference. As shown in the example embodiment, a largest bottom seal 932 exterior circumference diameter can be 39 millimeters.

FIGS. 23A-23D show an example embodiment of a puck glass 1002 side diagrams 1000*a*, 1000*b*, bottom diagram 1000*c* and top diagram 1000*d*. As shown in the example embodiment, puck glass 1002 can have a design etched in its upper surface such that it provides ridges, light refraction through the glass or other functional features. As shown in the example embodiment, a largest puck glass circumference can be 154 millimeters, while the design can have a largest circumference of 140 millimeters. Puck glass 1002 can have about a five-millimeter thickness.

FIGS. 23E-23F show example embodiments of puck glass 1002 side diagrams 1000*e*, 1000*f*. As shown in the example embodiment, puck glass can have a thickness of 18 millimeters and can have chamfered edges or corners. Chamfers can be less than 0.5 millimeters in some embodiments and in various embodiments each surface of puck glass 1002 should be polished. In various other embodiments, chamfers can be different dimensions but generally they are 0.5 millimeters or less.

FIGS. 23G-23I show an example embodiment of a vessel gasket 1010 top view diagram 1000*g*, side view diagram 1000*h* and mockup 1000*i*. As shown in the example embodiment, vessel gasket 1010 can be disk shaped and can have a central hole with a diameter of about 22 millimeters and an outer diameter of about 42 millimeters. Vessel gasket can be about 3.18 millimeters thick.

FIG. 23J shows an example embodiment image 1000*j* of a cover 1020 coupled with a base 1030, ashtray 1040 and manifold 1050.

FIGS. 23K-23N show an example embodiment of a cover 1020 top view diagram 1000*k*, ash tray depression side view diagram 10001, channel side cross-sectional diagram 1000*m* and cover mockup 1000*n*. As shown in the example embodiment cover 1020 can include a hole 1022, channel 1024 and ash tray depression 1026. Cover 1020 can have a width of about 380 millimeters and a length of about 537.4 millimeters. Hole 1022 can have a diameter of about 280 millimeters, channel 1024 can have a depth of about 5 millimeters and a width of about 14.09 millimeters and ash tray depression 1026 can have a diameter of about 91 millimeters and a radial depth of about 14 millimeters.

Channel 1024 can traverse an upper surface of cover 1020 in any direction including obliquely across a corner, as shown. Channel 1024 can be sized to about the same as a standard hose, such that when not in use or while users are resting, a hose body or grip can be conveniently placed in the channel and not fall. Further, in some embodiments channel 1024 can include surface features to increase frictions such as bumps, ridges or others, such that hoses are less likely to move.

Ash tray depression 1026 can provide a convenient location to ash coals or other combustible material. Ash tray depression 1026 can also provide a location for a removable ash tray to be located when in use. While ash tray depression 1026 is generally circular and partially spherical in the example embodiment, those in the art would understand that other shapes and cross sections can be used, such as square, rectangular, oval or others.

Purge Valve Subsection

FIGS. 24A-24D show an example embodiment of a purge nipple 1101 side view diagram 1100*a*, side cross-sectional diagram 1100*b*, end diagram 1100*c* and mockup 1100*d*. As shown in the example embodiment, purge nipple 1101 can include a hollow cylindrical center 1102 that is surrounded by a wall 1103. In some embodiments, a grommet can be fixed or removable within hollow cylindrical center 1102. At least one interior ridge 1104 can provide a stopping point such that purge nipple 1101 can be coupled with intermediary or other components. Purge nipple 1101 can be about 34.9 millimeters long and have a diameter of 25 millimeters at its widest in some embodiments. Purge nipple 1101 can be an example embodiment of purge nipple 16 of FIG. 3A.

FIGS. 24E-24G show an example embodiment of a purge plate 1110 end view diagram 1110*e*, side diagram 1110*f* and mockup 1110*g*. As shown in the example embodiment, purge plate 1110 can include a hollow cylindrical center 1112 that is surrounded by one or more solid radial spokes 1114 that are separated by gaps 1113. Purge plate 1110 can be about 1.9 millimeters thick and have a diameter of 22 millimeters at its widest in some embodiments. Purge plate 1110 can be an example embodiment of purge plate 17 of FIG. 3A.

FIGS. 24H-24K show an example embodiment of an umbrella valve 1140 from a side cross sectional view 1100*p*, side view 1100 *q*, top view 1100*r* and mockup 1100*s*. While purge mechanisms are traditionally ball valves in water pipes, disclosed herein are umbrella valve purge components that provide advantages over the prior art.

As shown in the example embodiment, umbrella valve 1140 can include a stem 1142 that couples with other components of a valve assembly to maintain umbrella valve 1140 in position with the overall valve assembly. Umbrella valve 1140 can be maintained in place by stem 1142 in a bore or stem 1142 can be removed if necessary such that umbrella valve 1140 rests in place within the assembly. Umbrella valve 1140 can be generally disk shaped and may be slightly conical on one or both sides. It also can be polished in some embodiments. Umbrella valve 1140 can have a preload or may be standardized without a preload in various embodiments. As shown in the example embodiment, a preload can include a 0.2 millimeter maximum, while it can be customized in various other embodiments. This can be adjusted by 0.05 millimeters for various opening pressures.

In the example embodiment, umbrella valve has a diameter of 0.709 millimeters and has a height of 0.565 millimeters when attached to a stem length. In some embodiments, one or both sides of umbrella valve 1140 can have various surface features can exist that are circular, rounded, oval or shaped otherwise in order to provide different movement characteristics to umbrella valve 1140. In some embodiments, providing few surface features with large surface area can promote a high flow while including multiple features that are smaller can promote a higher backward pressure resistance.

FIGS. 24L-24N show an example embodiment of a purge cap 1120 end view diagram 1100*h*, side view diagram 1100*i* and mockup 1100*j*. As shown in the example embodiment, purge cap 1120 can include a solid center 1122 that is surrounded by one or more solid radial spokes 1124 that are separated by gaps 1123. Purge cap 1120 can have a wall 1121 that defines a cylindrical empty chamber 1125. Purge cap 1120 can have a wall length of about 12 millimeters and have a diameter of 28 millimeters at its widest in some embodiments. At least one interior ridge 1126 can provide a stopping point such that purge cap 1120 can be coupled with intermediary components. Purge cap 1120 can be an example embodiment of purge cap 19 of FIG. 3A.

FIGS. 240-24S show an example embodiment of images of a purge cap 1100*k*, purge plate 11001, purge cap and plate 1100*m*, purge nipple 1100*n* and purge cap and nipple sub-assembly 1100*o*.

Tray Subsection

FIG. 25A shows an example embodiment of a tray 1210 having an interior space 1220 coupled with a manifold 1201 in an image 1200*a* from a perspective view.

FIGS. 25B-25D show an example embodiment of a tray 1210 from a top view diagram 1200*b*, bottom view diagram 1200*c* and mockup 1200*c*. As shown in the example embodiment, tray 1210 can include an interior space 1220 that is surrounded by one or more tray walls 1224 defining at least one interior compartments 1226. Interior compartments 1226 can be uniquely shaped for storage of specific items and shaped generally for general or multipurpose use. Tray 1210 can have a manifold hole 1212 that defines a location for placing or coupling with a complementary sized manifold, dome or both. In some embodiments, there can also be seals to prevent manifolds, domes or both from moving with respect to tray 1210.

Tray 1210 can have an overall length of about 525.40 millimeters and have an overall width of about 368 millimeters in some embodiments. One or more handle relief locations in exterior side walls, lower surfaces or combinations of both can allow for users to easily move and transport tray 1210 by hand. Mating depressions 1228 can be provided in upper surfaces of tray 1210 in order to allow users to mate complementary sized protrusions in a lower surface of a cover to provide stability. Additionally or alternatively, seals can be provided between a cover and tray 1210. In some embodiments tray 1210 can be removably coupled with a cover using a latch or other component. Tray 1210 can be an example embodiment of base 20 of FIG. 3A.

It should be understood that trays can be sized and shaped differently in different embodiments and may include additional or reduced features and functionality. For example, trays can be circular, oval shaped, triangular, square or other base shapes and can be three dimensionally shaped such as pyramids, s or others. Additionally, trays can be manufactured from one or a combination of various materials including wood, stone, plastic, metal, carbon fiber and others in different embodiments.

FIGS. 25E-25F show an example embodiment of a tray 1210 from a lengthwise side diagram view 1200*e* and widthwise side diagram view 1200*f*. Tray 1210 can have an overall height of about 53 millimeters in some embodiments. As shown, one or more cutouts 1216 or holes can be provided in one or more walls of tray 1210 to allow hoses, purge manifolds or other components and assemblies to protrude out of the interior of tray 1210. Cutouts 1216 can include sealing components in some embodiments.

In various embodiments, various surfaces and walls of trays and covers can include beverage holders, food holders, plate holders, drawers, cabinets, cupboards and numerous other compartments, chambers and special or general-purpose surfaces.

FIG. 25G-25K show an example embodiment of an ash tray 1230 from a side diagram view 1200*j*, side-cross sectional diagram view 1200*k*, top diagram view 1200*g*, bottom diagram view 1200*h* and mockup 1200*i*. In many embodiments, ash trays 1230 can be removable for cleaning. As shown in the example embodiment ash tray can be 89 millimeters in diameter at its widest and 5 millimeters thick or tall. A ridged area 1232 can serve several purposes including gripping for movement, elevation for providing improved airflow and support for items placed on it and others. Ash tray 1230 can be an example embodiment of ash tray 24 of FIG. 3A.

Purge Cycle Operation

FIG. 26A shows an example embodiment a side cross-sectional diagram view 1300*a* of a domed water pipe 1302 with supporting tray 1304. As shown in the example embodiment, a tray can support a manifold 1306 having a hose attachment 1308 and space for a light 1316 located below an inner vessel 1312. Inner vessel 1312 can be used to contain a liquid chamber 1318 and an outer vessel 1314 can be placed over and around inner vessel 1314 to create a smoke chamber 1320. An aerator 1322 can be located at a distal end of a downstem 1324, such that it is at least partially submerged in liquid in liquid chamber 1318 when in use or prepared for use. Downstem 1324 can extend through holes in the upper surfaces of inner vessel 1312 and outer vessel 1314 and can include one or more purge valves 1326 located near its proximal end and at least partially above the upper hole in outer vessel 1314. Downstem 1324 can terminate in a bowl 1330 at its proximal end with one or more chambers for holding shisha 1328 or other organic material for smoking. Charcoal 1332 can be placed above shisha 1328 in order to heat it and can be covered by a cap 1334 in use, such that airflow can be regulated effectively.

FIG. 26B shows an example embodiment of a side cross-sectional diagram view of a domed water pipe 1302 with supporting tray 1304 including an intake airflow cycle 1300*b*. As shown in the example embodiment, during intake airflow cycle 1300*b*, a user can draw air through a hose attachment 1308. This causes air to travel through cap 1334 and around charcoal 1332. This air can then travel passed shisha 1328, which is being heated by charcoal 1332 within bowl 1330. Airflow continues through downstem 1324 and is initially cleaned in aerator 1322. Once inside liquid chamber 1318, the airflow is further cleansed by liquid contained therein. Airflow bubbles within liquid chamber and exits through the hole in the upper surface of inner vessel 1312 into the smoke chamber 1320 made between inner vessel 1312 and outer vessel 1314. This allows the air to be cooled by both the large surface area of the interior of outer vessel 1314 and the surface area inner vessel 1312, especially when liquid within liquid chamber 1318 is cool. Airflow then continues through gaps between manifold and smoke chamber 1320, through the hose attachment 1308, hose (not pictured) and into the user's lungs for enjoyment.

FIG. 26C shows an example embodiment of a side cross-sectional diagram view 1300*c* domed water pipe 1302 with supporting tray 1304 including a first purge airflow cycle. 1300*c*. As shown in the example embodiment, purge airflow cycle 1300*c*, a user can push air through a hose attachment 1308. This causes air to travel through manifold 1306 and into smoke chamber 1320. Once in smoke chamber, airflow continues through the one or more purge valves 1326 that is coupled or part of downstem 1324 before exiting the domed water pipe 1302. The operation of purge airflow cycle 1300*c* allows users to purge smoke chamber 1320 of overly heated or stale smoke that may remain within domed water pipe 1302.

FIG. 26D shows an example embodiment of a side cross-sectional diagram view domed water pipe 1302 head purge detail 1300*d*. As shown in the example embodiment, when one or more purge valve 1326 are coupled with or part of a downstem 1324, they can have multiple positions including closed 1326*a* and open 1326*b*. In operation, closed purge valves 1326 can operate by gravity or other mechanisms such that they close purge channels 1336. Then, in operation during a purge cycle, open purge valves 1326*b* can allow airflow to escape in a gap between bowls 1330 and one or more portions of an outer vessel 1314, here an outwardly flared upper cap area.

FIG. 26E shows an example embodiment of a side cross-sectional diagram view of domed water pipe 1302 with supporting tray 1304 including a second purge airflow cycle 1300*e*. As shown in the example embodiment, purge airflow cycle 1300*c*, a user can push air through a hose attachment 1308. This causes air to travel through manifold 1306 and into smoke chamber 1320. Once in smoke chamber, airflow continues through one or more purge valves 1326 in tray 1304 and coupled directly with manifold 1306 before exiting the domed water pipe 1302. The operation of purge airflow cycle 1300*c* allows users to purge smoke chamber 1320 of overly heated or stale smoke that may remain within domed water pipe 1302.

FIG. 27A shows an example embodiment of a domed water pipe assembly including a manifold 1402 with coupled purge valve 1404 and coupled main seal 1406. Also shown are outer chamber 1408, inner chamber 1410, downstem 1412, aerator 1414 and bowl 1416.

FIGS. 27B-27C show an example embodiment of a domed water pipe assembly including a manifold 1402 with coupled purge valve 1404 and coupled main seal 1406. Also shown are outer chamber 1408, inner chamber 1410, downstem 1412, aerator 1414 and bowl 1416 with coupled cap 1418. Inner chamber 1410 is shown as containing liquid 1420 and a lighting element 1422 can be seen through chambers 1408, 1410, as housed within manifold 1402 and below inner chamber 1408. Also shown is a hose 1424 coupled with manifold 1402.

FIGS. 27D-27E show an example embodiment of a domed water pipe assembly, including a manifold 1402 with coupled purge valve 1404 and coupled main seal 1406. Also shown are outer chamber 1408, inner chamber 1410 and bowl 1416 with coupled cap 1418. Inner chamber 1410 is shown as containing liquid 1420 and smoke is shown between inner chamber 1410 and outer chamber 1408.

FIGS. 28A-28Z show example embodiments of platforms where like numbered elements correspond between the figures in their generally functionality. For example, a platform 1520*a* of FIGS. 28A-28B corresponds generally with a platform 1520*c* of FIGS. 28E-28F.

FIGS. 28A-28D show an example embodiment of a grinder platform setup. FIGS. 28E-28H show an example embodiment of a spiral platform setup. FIGS. 28I-28L show an example embodiment of a rose platform setup. FIG. 28M-28Q show an example embodiment of a rose platform setup. FIG. 28R-28V show an example embodiment of another rose platform setup. FIG. 28W-28X show an example embodiment of a wall platform setup.

FIGS. 28A-28B show an example embodiment of a platform 1520 from a top view 1500*a* and side perspective view 1500*b*. As shown in FIGS. 28A-28B, platform 1520 preferably comprises a recessed tray 1522 for containing a heating source. In the example embodiment, a raised surface 1523 can provide a slight elevation over a normal tray (not shown) or recessed tray 522 for charcoal or other heating elements to promote airflow below them. In FIGS. 28A-28B, 28E-28F, and 28W-28X these are chevron shaped and as shown are in concentric rings whereby those in the inner ring are smaller and offset from those in the outer ring. In FIGS. 28M, 280 and 28S-28T these are rounded rectangular shaped about a central focal point and as shown are in concentric rings whereby those in the inner ring are smaller and offset from those in the outer ring. As shown in bottom view diagram 1500*r* of FIG. 28R, spiral and other ridge features can be included on a bottom surface of platform 1520 to provide airflow management in various embodiments.

The platform 1520 also preferably comprises a plurality of perimeter bowl vents 1524 for permitting airflow between a heating chamber and a bowl while in operation. As shown, eight perimeter bowl vents 1524 may be used although other numbers of perimeter bowl vents 1524 are also contemplated. The platform 1520 also preferably comprises a plurality of perimeter vertical protrusions 1530 that mate with corresponding protrusions 1544 of a cap to form adjustable side vents 1526 for controlling the airflow between the exterior atmosphere and the heating chamber. In various embodiments, this mating may occur using screws and threading. As shown in the example embodiment, platform 1520 can have a radius of about 37.25 millimeters.

As a cap 1540 is rotated relative to the platform 1520, for instance by rotating cap 1540 using a rim 1590, respective protrusions 1530 and spaces therebetween (i.e. the formed circumferential vents 1526) may transition between fully open, partially open and fully closed with respect to adjustable side vents 1560. In this manner, airflow to the heating chamber may be controlled. In some embodiments, the cap 1540 may further comprise additional upper vents 1572, which may or may not be adjustable in different embodiments. Perimeter bowl vents 1524 may have differing dimensions in various embodiments.

Platform 1520 may be comprised of aluminum, copper, steel, or any other material that is suitable for this purpose. Similarly, cap 1540 may be comprised of aluminum, copper, steel, or any other material that is suitable for this purpose.

Recessed tray 1522 may include walls 1528 which are flared inward from their upper edges. Walls 1528 may prevent coals or other heating elements from sliding or otherwise moving around within heating chamber 1570 during adjustment by users. The inward flare of walls 1528 may further promote airflow within heating chamber 1570 by channeling air toward the heating elements. In the example embodiment, recessed tray 1522 has a star configuration with eight points. Other embodiments may incorporate other shapes without departing from the scope of the invention. It has been discovered, however that the eight-pointed star configuration provides benefits over other shapes, including benefits of even heating and air flow, particularly when combined with the multi-chambered bowl described herein.

Circumferential vents 1526 may comprise alternating spaces between vertical protrusions 1530. The inner surface 1532 of each vertical protrusion 1530 may create a substantially "V" shape with the point directed inward, toward the center of heating chamber 1570 from the circumferential vents 1526 on either side of the vertical protrusion. Accordingly, air may be channeled toward heating elements on recessed tray 1522. Additionally, the point of each "V" may correspond with each star point of recessed tray 1522. It has been discovered that embodiments utilizing such an arrangement benefit from the created air channels which may promote circulation within heating chamber 1570 and promote even heating of the coals or other heating elements during use.

Perimeter bowl vents 1524 may be diamond shaped holes allowing airflow from the interior of heating chamber 1570 into a bowl. Each perimeter bowl vent 1524 is preferably located near, such as directly in front of, a circumferential vent 1526. This may promote a mixture of cool air from the exterior of the cap 1540 with heated air from the interior of heating chamber 1570 such that during inhalation by a user, strictly heated air is not the only air being pulled through the water pipe. An upper surface of plate 1520 can be a recessed holder to provide stability for a coal, such that the coal will not slide or fall off the upper surface of the plate by accident, as may occur if a user accidentally bumps the water pipe. The recessed holder can also have angled interior surfaces so as to direct airflow around and to and from a coal. The recessed holder can have a uniform flat bottom surface to promote uniform heating of tobacco, or other organic material, below the plate. The upper surface of the plate can have openings around the recessed holder to provide airflow to underlying tobacco, or other organic material, when the plate 1520 is placed atop a head.

Rim 1590 may be an outward extension of cap 540 from a central axis that allows users to rotate cap 1540 with respect to platform 1522. This may allow for different configurations of adjustable side vents 1560 with respect to circumferential vents 1526, allowing a user to control air flows into and out of heating chamber 1570. Rim 1590 is shown as a series of pointed extensions, attaching to cap 1540 at protrusions 1544. In some embodiments, rim may be insulated such that it may be handled by hand. Although rim 1590 is shown as circumferentially surrounding cap 1540, it should be understood that it may only protrude outward in a single location, in a plurality of locations, or in partial circumferential areas.

A user can place or otherwise couple a platform 1522 on a rim of a bowl filled with tobacco, shisha or other organic matter already prepared as described above. Then a user can place coals or other combustible material on platform 1522. Once the coals or other combustible material are in place, they can be heated by a heat source, for example a match or lighter, before a user places or otherwise couples a ventilated cap 1540 on platform 1522.

A cap can be a ventilated cover for protecting a coal from undesired wind. In some embodiments, the ventilated cover can be monolithic and has air vents at regular intervals around an upper circumference. Air vents can also be provided around a lower circumference of the cover. An outer structure can provide a cool handling location for grabbing, adjusting, or moving the cover, even with a lit, hot coal underneath.

FIGS. 29A-29P illustrate example embodiments of a ventilated cover 1540*a*-1540*t* for use in accordance with at least one embodiment of the present invention. The ventilated cover 1540 can include upper holes 1572 of varying sizes and shapes including diamonds, triangles and others, side ventilation holes 1560 and a rim 1590 for adjusting an orientation of cover 1540.

In some embodiments, the ventilated cover can be an adjustable structure with inner and outer sections. In such embodiments, inner and outer sections can be rotated with respect to each other in order to adjust the size of the air vents. This allows a user to customize the size of the air vents in varying environmental conditions, such as windy, still, indoor, or outdoor. Keys can also allow users to adjust ventilation covers. Additional description of the features and operation of similar covers is given in the patent and applications incorporated by reference in the cross-references herein.

Tongs with Spring Mechanism

FIGS. 30A-30C show an example embodiment of tongs 1601 for use with a selectively grasping a heating element from a top view, 1600*a*, side view 1600*b* and perspective view 1600*c*. As shown, tongs 1601 can be mechanized with a spring mechanism that biases them in one direction or another. Tongs can be about 180 millimeters long and 26 millimeters tall in general and about 53 millimeters wide in an open orientation.

FIG. 30D shows an example embodiment of an exploded diagram 1600*d* of tongs 1601, that can include a top cap 1602 over a low-profile flathead bolt 1604 that is threaded 1606, and fits through a small washer 1608 and into a first tong arm 1610. A wave spring 1612 and torsion spring 1614 within a compartment in tong arm 1610 one can be coupled with a complementary compartment in tong arm two 1616. Tong arm one 1610 can be oriented such that a rounded end near an elbow faces toward a similar shaped curvature of a second tong arm 1616. A base cap 1618 can have a threaded end 1620 that fits through a hole in one or both tong arms. Tong arm one and tong arm two can thus be biased in an open or closed position from each other. One or both tong arms 1610, 1616 can also have openings near their terminus 1622, 1624 respectively, such that they allow heat to pass through the openings. Additionally, one or more materials can be used to construct or manufacture tong arms. Tong components can be made of one or more materials, including combinations of stone handles, metal tips, wood, glass and others as appropriate.

FIGS. 30E-30F show shows an example embodiment of a cross sectional view 1600*e* and feature diagram 1600*f* of tongs 1601.

FIGS. 31A-31C show an example embodiment of a puck 1701 from a top view 1700*a*, side view 1700*b* and perspective view 1700*c*. As shown in the example embodiment, puck 1701 can include an internal, generally cylindrical space 1702 for electronic components that measures about 150 millimeters in diameter by about 15.25 millimeters in height that is defined by a wall 1703 and that can be sealed by a glass sheet 1704. Puck 1701 can be about 28.2 millimeters in height, about 195.82 millimeters across a top diameter and about 150.79 millimeters across an internal bottom diameter.

FIGS. 31D-31F show an example embodiment of a puck 1701 from a perspective view 1700*d*, side cross sectional view 1700*e* and perspective cross sectional view 1700*f*. As shown in the example embodiment, an LED strip area 1705 can be about 4 millimeters by 2 millimeters around an internal circumference within cylindrical space 1702. A reflective glass 1706 that is about 1 millimeter thick can be located parallel to and below glass sheet 1704, which can be transparent or opaque, in an area about 15.26 millimeters tall. Reflective glass 1706 can be about 150.35 millimeters in diameter in some embodiments. Walls 1703 can be silicone and can house a pressure sensor 1707 below reflective glass 1706 that can sense pressure on a side or bottom of puck 1701.

FIGS. 31G-31K show an example embodiment of a puck from a top view 1700*g*, side view 1700*h*, side cross sectional view 1700*i*, cross sectional detail 1700*j* and mockup 1700*k*. As shown in the example embodiment, a puck can be about 177.93 millimeters in diameter at its widest and about 19.96 millimeters tall when fully assembled. A ridge 1711 around part or all of an outer circumference of puck 1701 can allow it to be coupled in a fixed location within a manifold, gasket or other location for use.

FIGS. 31L-31N show an example embodiment of a puck rim 1708 from a top view 17001, cross sectional detail view 1700*m* and mockup 1700*n*. A ridge 1713 around part or all of an outer circumference of puck rim 1708 can allow it to be coupled in a fixed location within a manifold, gasket or other location for use or to be coupled with a puck body 1703.

FIGS. 310-31P show an example embodiment of a puck rim 1708 from a side view 1700*o* and from a side cross sectional view 1700*p*.

FIGS. 31Q-31S show an example embodiment of pressure sensor membranes 1700*q*, silicone rim 1700*r* and cross-sectional view 1700*s* of circuit board 1709 and battery 1710.

FIGS. 31T-31U show an example embodiment of an LED panel 1700*t* and LED strip 1700*u*. It should be understood that in various embodiments, different LED lighting setups can be used and can be controlled in different fashions. For example, multiple controllers, can be used to control multiple sets of LEDs independently of each other. LED arrangements can include flat surface arrangements facing upward, individual LEDs located in specific locations and various others. In some embodiments, LEDs or other display panels are operable to display images and holograms.

FIGS. 32A-32C show example embodiments of a user interface application color selection 1800*a*, application icon 1800*b* and interface 1800*c*. As shown in the example embodiment 1800*a*, users can select from one of a variety of colors and color schemes for their user interface experience. As shown in the example embodiment 1800*b*, users can be presented with different icons based on the operating system they are using. As shown in the example embodiment 1800*c*, users can select an appropriate icon to begin using their application.

FIGS. 32D-32F show example embodiments of a user interface application welcome screen 1800*d*, application introduction screen 1800*e* and login 1800*f*. As shown in the example embodiment 1800*d*, users can see a logo or other welcoming message upon loading the application. As shown in the example embodiment 1800*e*, users can see an introduction background and message after a welcome screen. As shown in the example embodiment 1800*f*, users can enter a username and password or sign up for an account at a login screen, which can then be authenticated via a local or remotely stored database, for instance on a server via a computer network.

FIGS. 32G-32I show example embodiments of a user interface login entry 1800*g*, device searching 1800*h* and pairing introduction 1800*i*. As shown in the example embodiment 1800*g*, a user can enter credentials such as a username and password via a user interface such as a touchscreen. As shown in the example embodiment 1800*h*, a user can select a search for local devices option to search for devices with which to couple their control device. As shown in the example embodiment 1800*i*, a user can select a device connectivity for their control device in order to search for devices.

FIGS. 32J-32L show example embodiments of a user interface pairing selection 1800*j*, pairing confirmation 1800*k* and mood selection 1800*l*. As shown in the example embodiment 1800*j*, users can select a device from a list of locally located devices for pairing with the control device. As shown in the example embodiment 1800*k*, the control device can display a paired device after pairing with the control device. As shown in the example embodiment 1800*l*, users can select a mood from a listing of one or more moods in order to control the paired device lighting output.

FIGS. 32M-32O show example embodiments of a user interface mood brightness selection 1800*m*, mood sensitivity 1800*n* and mood theme 1800*o*. As shown in the example embodiment 1800*m*, users can selectively choose a brightness level for lighting of a paired device via a scroll wheel or other selection. As shown in the example embodiment 1800*n*, users can selectively choose a sensitivity level for changing lighting of a paired device via a scroll wheel or other selection. As shown in the example embodiment 1800*o*, users can select a theme, here "Aurora."

FIGS. 32P-32R show example embodiments of a user interface mood pairing 1800*p*, mood 1800*q* and mood 1800*r*. As shown in the example embodiment 1800*p*, users can view a paired device and theme selection for the paired device. As shown in the example embodiment 1800*q*, users can change a paired device theme, here "Aurora." As shown in the example embodiment 1800*r*, users can preview a different theme for the paired device, here "Frost."

FIGS. 32S-32U show example embodiments of a user interface mood description 1800*s*, mood description 1800*t* and interface 1800*u*. As shown in the example embodiment 1800*s*, users can view multiple pairable devices via a user interface screen, including pairing status. As shown in the example embodiment 1800*t*, users can view multiple pairable devices via a user interface screen, including pairing status that has been selectively changed or updated. As shown in the example embodiment 1800*u*, users can view different application options including community, devices, store, story and account or others.

FIGS. 32V-32X show example embodiments of a user description 1800*v*, description 1800*w* and settings selection 1800*x*. As shown in the example embodiment 1800*v*, users can view and scroll through articles. As shown in the example embodiment 1800*w*, users can read and scroll through a story. As shown in the example embodiment 1800*x*, users can select and modify settings for applications, paired devices and accounts.

FIG. 32Y shows an example embodiment of a user interface product description 1800*y*. As shown in the example embodiment 1800*y*, users can view device specific information.

FIG. 33A is an example embodiment of a basic network setup. As shown in FIG. 33A, a server system 1800*aa* with multiple servers 1802 and 1804 which can include applications distributed on one or more physical servers, each having one or more processors, memory banks, operating systems, input/output interfaces, and network interfaces, all known in the art, and a plurality of end user devices 1806, 1808 coupled to a network 1810 such as a public network (e.g. the Internet and/or a cellular-based wireless network, or other network), private network or both. User devices include for example mobile devices 1806 (e.g. smartphones, tablets, or others) desktop or laptop devices 1808, wearable devices (e.g. watches, bracelets, glasses, etc.), other devices with computing capability and network interfaces and so on. The server system 1800*aa* includes for example servers operable to interface with websites, webpages, web applications, social media platforms, advertising platforms, and others.

FIG. 33B is an example embodiment of a network connected server system 1802. As shown in FIG. 33B, a server system 1802 according to an embodiment of the invention including at least one user device interface 1830 implemented with technology known in the art for communication with user devices. The server system can also include at least one web application server system interface 1840 for communication with web applications, websites, webpages, websites, social media platforms, and others. The server system 1802 can further include an application program interface (API) 1820 that is coupled to a database 1812 and can communicate with interfaces such as the user device interface 1830 and web application server system interface 1840, or others. The API 1820 can instruct the database 1812 to store (and retrieve from the database) information such as link or URL information, user account information, associated account information, messaging information, themes information, device information or others as appropriate. The database 1812 can be implemented with technology known in the art such as relational databases and/or object-oriented databases or others.

FIG. 33C is an example embodiment of a user device. As shown in FIG. 33C, a diagram of a user mobile device 1806 according to an embodiment of the invention that includes a network connected puck control application 1814 that is installed in, pushed to, or downloaded to the user mobile device 1806. In many embodiments, user mobile devices 1806 are touch screen devices such as smart phones or tablets. User mobile devices 1806 are implemented with memory, processors, communications links, transmitter/receivers, power supplies such as batteries, interfaces such as screens displaying GUI's, buttons, touchpads, software stored in memory and executed by processors, audio input and output components, video input and output components, and others. Software can include computer readable instructions stored on computer readable media such as computer memory.

Those in the art will understand that the user interface screens 1800*a*-1800*y* in FIGS. 32A-32I can be visually displayed by user interfaces of the user mobile device 1806 and navigated by analyzing user inputs and executing appropriate instructions stored in non-transitory memory. Puck control application 1814 can include various additional functionality, including allowing users to synchronize music, sounds, video, or holographic images with lighting and projections provided by a lighting puck. This can be accomplished by transmitting instructions to a puck device that is paired with the user mobile device using wireless or wired technological pairing as known in the art or later developed. This information can be received by the puck device via a transmitter/receiver over a protocol as known or later developed, such as Bluetooth, Wi-Fi or others.

FIGS. 34A-34C show example embodiments of lighting functionality. As shown in the example embodiments, numerous lighting schemes are contemplated that can be used with regard to one or more lighting pucks, for example in FIGS. 35A-35G, controllable by an application as described with respect to FIGS. 32A-32Y and 33A-33C or both.

A first lighting scheme called Aurora can include a slowly transitioning light color base that changes or transitions about once every 7 seconds. This can allow for randomly appearing details that may activate three adjacent or nearly adjacent LED lights for each detail. Details can occur at the same time, for instance three details may occur at once. Fade in and fade out effects can be used and may take a period of time to occur, for example three seconds. Detail colors can be selected at random. Changes in air pressure as sensed by a pressure sensor can increase detail frequency. For example, fade in and fade out may occur more quickly, in one second intervals. Details may be limited to three at a time or another number as appropriate. A base spectrum may be all available colors and a detail spectrum may be all available colors in Aurora embodiments.

A second lighting scheme called Fathom can include a slowly transitioning light color base that changes or transitions about once every 7 seconds. This can allow for randomly appearing details that may activate three adjacent or nearly adjacent LED lights for each detail. Details can occur at the same time, for instance three details may occur at once. Fade in and fade out effects can be used and may take a period of time to occur, for example three seconds. Detail colors can be selected at random from a fixed color scheme. Changes in air pressure as sensed by a pressure sensor can increase detail frequency. For example, fade in and fade out may occur more quickly, in one second intervals. Details may be limited to three at a time or another number as appropriate. A base spectrum may be dark blues, teals, purples and blues and a detail spectrum may include whites or light blues in Fathom embodiments. Dark blues can be HSB 205, 75, 40; RGB 25, 70, 100. Teals can be HSB 180, 100, 75; RGB 0, 190, 190. Purples can be HSB 240, 65, 75; RGB 65, 65, 190. Blues can be HSB 240, 100, 75; RGB 0, 0, 190. Whites can be HSB 0, 0, 100; RGB 255, 255, 255. Light blues can be HSB 180, 100, 100; RGB 0, 255, 255.

A third lighting scheme called Rise can include a slowly transitioning light color base that changes or transitions about once every 7 seconds. This can allow for randomly appearing details that may activate three adjacent or nearly adjacent LED lights for each detail. Details can appear randomly in the arrays that may activate three adjacent or nearly adjacent LED lights for each detail. Details can occur at the same time, for instance three details may occur at once. Fade in and fade out effects can be used and may take a period of time to occur, for example three seconds. Detail colors can be selected at random. Changes in air pressure as sensed by a pressure sensor can make base colors change to blue with a number (e.g. three) of randomly selected LED's appearing yellow at different times. Fade in and fade out may occur more quickly, in one second intervals. Details may be limited to three at a time or another number as appropriate and may occur every one second. A base spectrum may be golds, red oranges, purples and blues and a detail spectrum may include yellows in Rise embodiments. Golds can be HSB 35, 100, 75; RGB 190, 110, 0. Red Orange can be HSB 20, 85, 70; RGB 180, 75, 25. Purples can be HSB 255, 60, 40; RGB 55, 40, 100. Blues can be HSB 230, 70, 75; RGB 55, 80, 180. Yellows can be HSB 60, 100, 100; RGB 255, 255, 0. Air pressure changes can cause blue bases with yellow details, where blue bases can be HSB 0, 100, 100; RGB 255, 255, 255 and yellows be HSB 60, 100, 100; RGB 255, 255, 0.

A fourth lighting scheme called Ember can include a slowly transitioning light color base that changes, rotates or transitions about once revolution every 30 seconds. This can include red, black, orange, black, yellow, black, red rotating. Brighter details can appear randomly in the arrays that may activate three adjacent or nearly adjacent LED lights for each detail. Details can occur at the same time, for instance three details may occur at once. Fade in and fade out effects can be used and may take a period of time to occur, for example half of a second. Detail colors can be selected at random from a fixed selection of colors. Changes in air pressure as sensed by a pressure sensor can make base colors change to blue with a number (e.g. three) of randomly selected LED's appearing different colors at different times. Fade in and fade out may occur every three seconds. Details may be limited to three at a time or another number as appropriate and may occur every three seconds. A base spectrum may be reds, oranges, blacks and yellows and a detail spectrum may include bright oranges, bright yellow oranges and bright yellows in Ember embodiments. Oranges can be HSB 20, 85, 75; RGB 190, 80, 30. Reds can be HSB 10, 90, 50; RGB 130, 30, 15. Blacks can be HSB 0, 0, 0; RGB 0, 0, 0. Yellows can be HSB 45, 80, 90; RGB 230, 185, 50. Bright Yellows can be HSB 180, 100, 100; RGB 0, 255, 255. Bright Oranges can be HSB 0, 0, 100; RGB 255, 255, 255. Bright Yellow Oranges can be HSB 180, 100, 100; RGB 0, 255, 255.

A fifth lighting scheme called Clarity can include a slowly transitioning light color base that changes or transitions about once every 7 seconds from blue to golden yellow. Changes in air pressure as sensed by a pressure sensor can change a color to white, where increased air pressure change causes brightness to increase. A base spectrum may be blues and yellows and a detail spectrum may include whites in Clarity embodiments. Blues can be HSB 196, 100, 93; RGB 0, 175, 240. Yellows can be HSB 45, 85, 100; RGB 255, 200, 40. Whites can be HSB 0, 100, 100; RGB 255, 255, 255.

A sixth lighting scheme called Serenity can include a slowly transitioning red color base that changes or transitions about once every 7 seconds to different shades. Changes in air pressure as sensed by a pressure sensor can cause colors to blend together and rotate radially around the ring of about once every three seconds or alternatively change the color to purple, where increased air pressure change causes brightness to increase. A base spectrum may be maroons, reds and purples and a detail spectrum may include whites in Serenity embodiments. Maroons can be HSB 345, 90, 45; RGB 115, 10, 35. Reds can be HSB 355, 90, 75; RGB 190, 20, 35. Purples can be HSB 300, 100, 40; RGB 100, 0, 100. Whites can be HSB 0, 100, 100; RGB 255, 255, 255.

Various other lighting schemes are contemplated and many different effects can be used including flashes, fades and others.

Figure 35A:
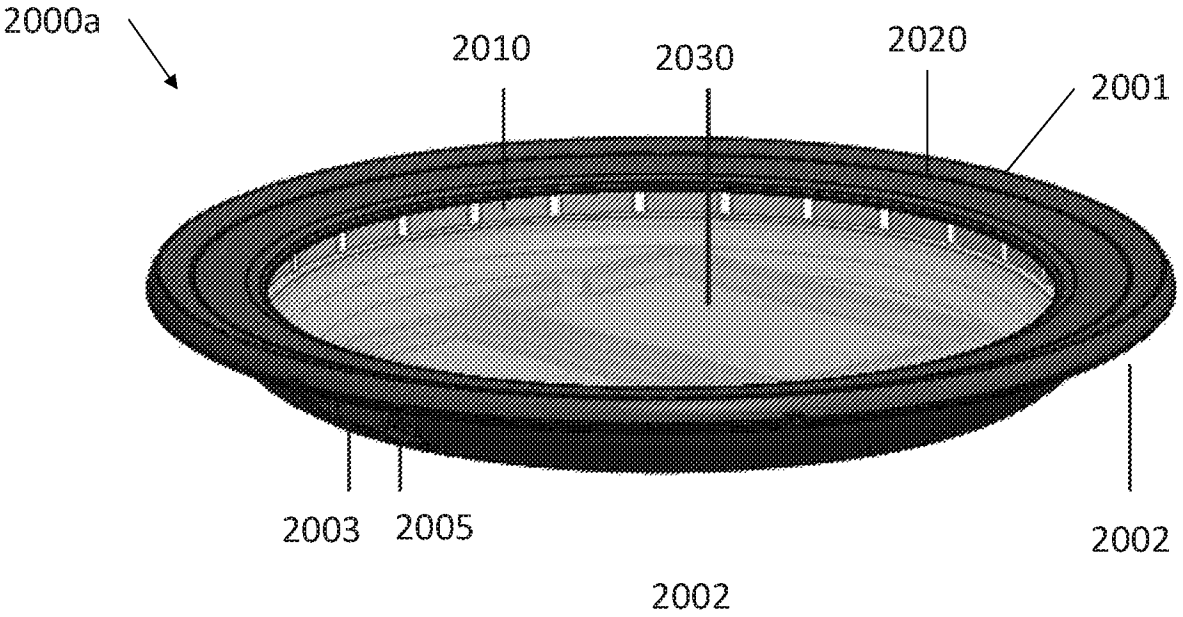

FIG. 35A shows an example embodiment of an LED Puck 2001 full assembly diagram 2000*a* from a perspective view.

Figure 35C:
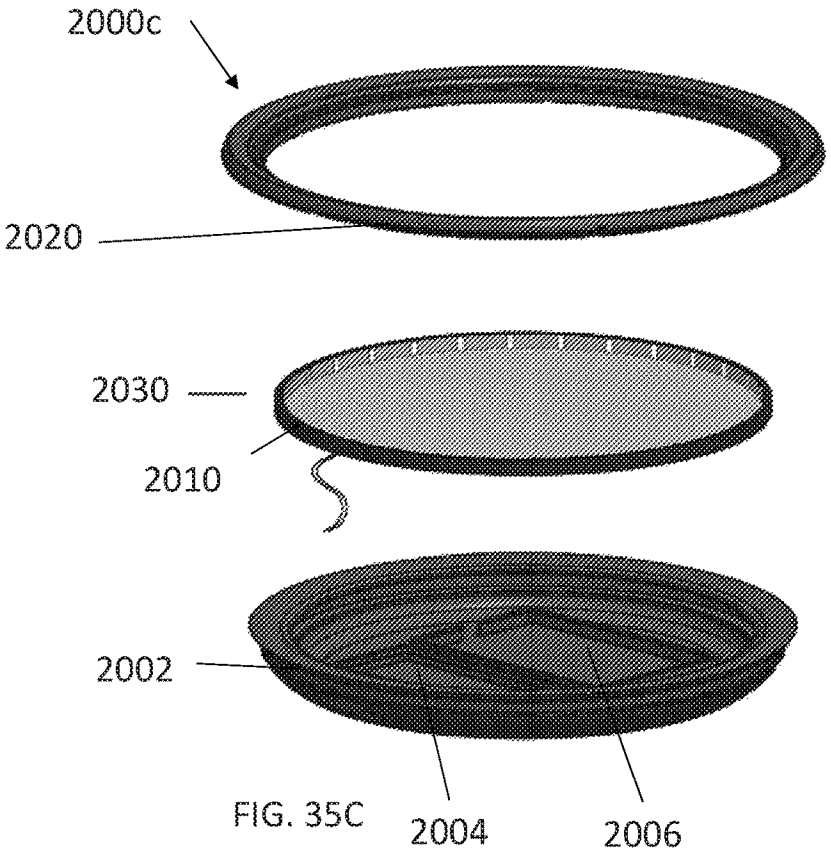
Figure 35B:
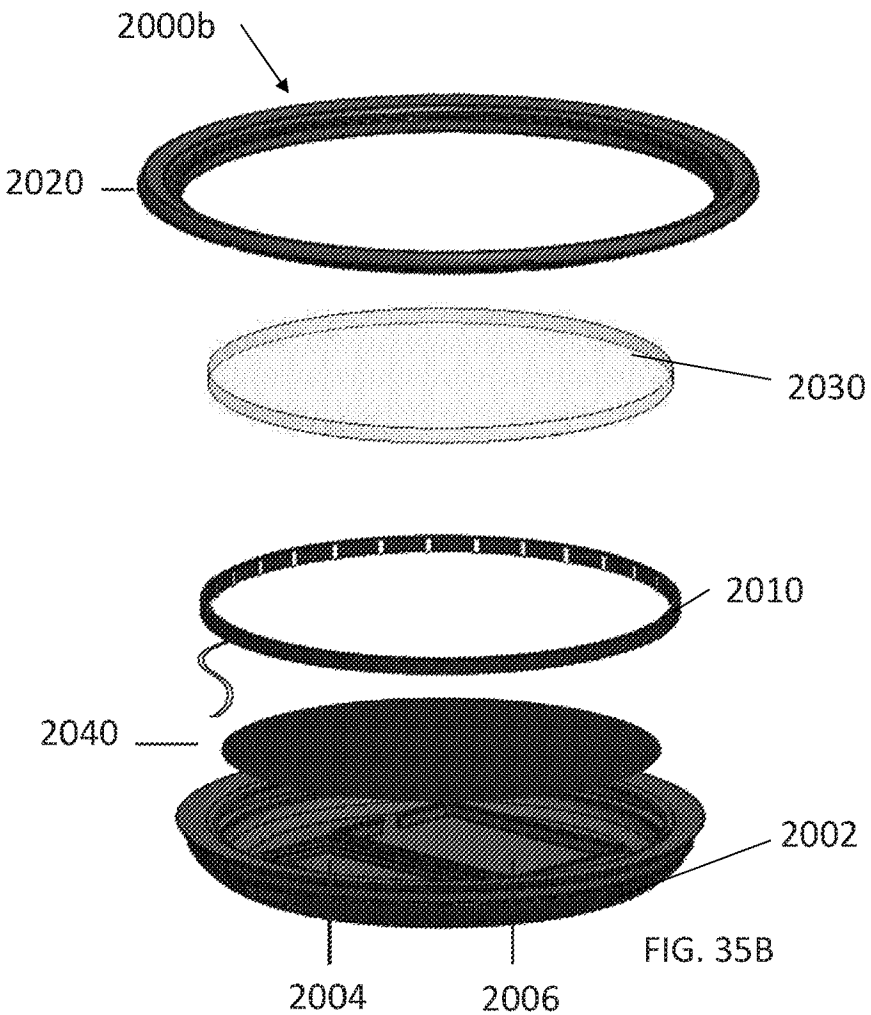
Figures 35D, 35E, 35F, 35G:
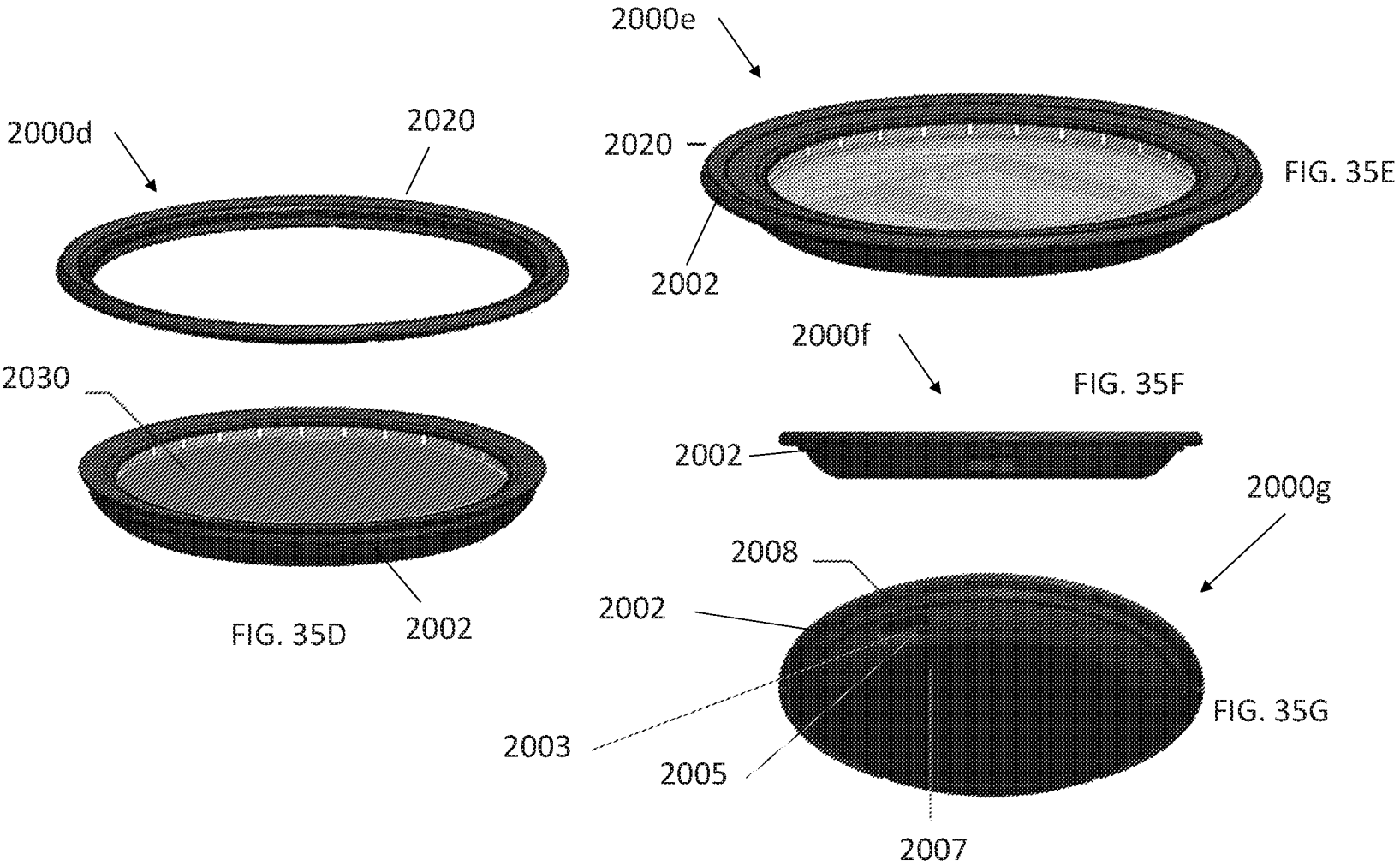

FIG. 35B shows an example embodiment of an LED Puck 2001 assembly exploded diagram 2000*b* and partial assembly diagram 2000*c* from a perspective view. As shown in the example embodiment, a tear away bumper 2020 can be used to hold or otherwise couple a glass cover 2030 in place within or above a puck body 2002. Glass layer 2030 can be glass that is etched or not etched. Similarly, it could also be any transparent or transparent material operable to serve the purpose of allowing lighting through. An opaque or reflective material layer 2010 can be located below glass cover 2030 and can seal an inner chamber area within puck body 2002. This layer 2010 can help to deflect or reflect light upward that is emitted by LED's or back reflected downward through a glass chamber or water within the chamber in use. Puck body 2002 is generally disk shaped and includes a hollow internal chamber for housing electronics include a PCB location area 2004 and battery placement area 2006. These areas may or may not have internal walls or other structures to rigidly define and hold components.

Etched glass layer 2030 can have a thickness that is generally about as wide as an LED strip 2010. LED strip 2010 has a length that is generally about equal to a circumference of glass layer 2030. As such, LED strip 2010 can be wrapped around and coupled with the edge of glass layer 2030, for instance using an adhesive, as shown in diagram 2000*c*. Power and operation control for one or more LED's housed in or on LED strip 2010 can be provided by wiring that is coupled with one or both of a battery housed in battery placement area 2006 and a PCB held in PCB location area 2004.

FIG. 35C shows an example embodiment of an LED Puck 2001 partial assembly exploded diagram 2000*d* and full assembly diagram from a perspective view 2000*e* and full assembly diagram from a side view 2000*f* and bottom perspective view 2000*g*. Glass layer 2030 and LED strip 2010 can be placed in a channel within puck body 2002, above layer 2040, which is located above internal electronics. Tear away bumper 2020 can then be coupled with a rim of puck body 2002, for example an upper, exterior or interior surface of body 2002 using adhesives, latches, gaskets or other operable mechanisms or components suitable for the purpose of affixing bumper 2020 with body 2002. As shown in the example embodiment, one or more airflow channels 2008 can allow air pressure to be sensed or transferred from a manifold exterior to a base area below the LED puck body 2002. These channels can be placed at regular or irregular intervals around the puck body 2002.

As shown in the example embodiment, a hole in the bottom of puck body 2002 can allow a pressure sensor within body 2002 to be in fluid communication with the air outside body 2002. As such, an appropriate pressure sensor that monitors ambient air pressure for changes can detect air pressure changes. This pressure sensor can be mounted to the bottom of a PCB housed within body 2002. Further, the PCB can be rated at a lower IPX rating such that it is not required to be waterproof. Monitoring the pressure of humid air including smoke provides that in the example embodiment, only the pressure sensor is exposed, while the remainder of the PCB is housed safely above the pressure sensor within body 2002 while being protected from the humidity and smoke. Also, shown in the example embodiment are a power button 2003 and a battery charging port 2005, in this embodiment a microUSB port. In some embodiments, different sensors are used including motion sensors, noise sensors, lighting sensors and others. Some embodiments of pucks include speakers for playing audio sounds. In some embodiments pucks include additional non-transitory memory coupled with PCB's and associated controllers.

FIGS. 36A-36C show an example embodiment of an upward purge valve assembly overview first step 2100*a*, second step 2100*b* and third step 2100*c*. As shown in the example embodiment a head 2102, upward purge valve 2104 and downstem 2106 with one or more purge airways 2105 may be coupled together. First upward purge valve 2104 can be coupled with downstem 2106 to form upward purge subassembly 2108. In this step, upper purge airways 2105 are covered by upward purge valve 2104. Next, subassembly 2108 is coupled with head 2102 to form full upward purge assembly 2110. Full upward purge assembly 2110 has a housing with airways 2105 that lead upward and outward with respect to downstem 2106.

FIG. 36D shows an airflow diagram 2100*d* through a full upward purge assembly 2110. As shown in the example embodiment, on an inhale or draw by a user, air is pulled down through a centralized hole and pathway through bowl 2102 and downstem 2106 into water 2112 held in a chamber 2114 defined by a wall 2116. Upon exhale or purging, air is pushed into the chamber through a hose (not shown) where it can then enter one or more airways 2105 where it pushes up the upward purge valve 2104 which is otherwise sealed by gravity or inward air pressure during inhalation. It should be understood that wall 2116 and upward purge assembly 2110 form a substantially airtight seal such that air does not readily escape on its own.

FIGS. 37A-37B show an example embodiment of a heat management device domed lid 4101, base plate 4601, and key arm 4301 and key cap 4302 from a perspective view in two orientations. Further description of embodiments of domed lid 4101 is given with respect to at least FIGS. 18G-18I, 26A-26C, 29A-29P, 38A-38B, 41A-41H, and 42A-42E. Further description of embodiments of base plate 4601 is given with respect to at least FIGS. 18G-18I, 26A-26C, 28A-28Z, 46A-46K, 47A-47G, 48A-48G, 49A-49G, 50A-50F, 50A-50G, 51A-51G, 52A-52G, 53A-53G, and 54A-54G. Further description embodiments of key arm 4301 is given with respect to at least FIGS. 40A-40B and 43A-43E. Further description embodiments of key cap 4401 is given with respect to at least FIGS. 40A-40B and 44A-44E.

As shown in the example embodiments of FIGS. 37A-37B, domed lid 4101 (also referred to herein as a ventilated cover) can be movably coupled with base plate 4601 by placing it on or over base plate 4601. In a coupled orientation, an interior wall of domed lid 4101 rests on or against one or more upper edges of base plate 4601 structures. Domed lid 4101 is shaped such that its lower section is located circumferentially around at least a portion of one or more outward facing surfaces of one or more walls of base plate 4601. In such an orientation, domed lid 4101 can be rotated about a central vertical axis to change orientations with respect to base plate 4601, thereby changing or modifying airflow through vents of one or both its own vents and those of base plate 4601. Domed lid 4101 can be removed from base plate 4601 in order to add, change, or remove heating elements from a surface of base plate 4601.

Also shown in the example embodiments, are coupled key arm 4301 and key cap 4401. These structures can first be coupled to each other by inserting key cap 4401 into an opening of key arm 4301 at its proximal end and pushing a portion of key arm 4301 into a channel in the side of key cap 4401, which is described in further detail with respect to FIGS. 40A-40B, 43A-43E, and 44A-44E. Once key arm 4301 and key cap 4401 have been coupled together, users can hold the coupled portion at the proximal end and removably couple a distal end of key arm 4301 with one or more components or structures of domed lid 4101. This can allow users to rotate or otherwise modify the orientation of domed lid 4101 with respect to base plate 4601, or remove it altogether.

In a first orientation 3700*a* that is shown in FIG. 37A, a distal end of key arm 4301 has been inserted in a side vent 4103 of domed lid 4101 located above a circumferential rim 4105 of domed lid 4101. This can be achieved in various embodiments with an insertion angle of a distal end of key arm 4301 that is somewhat downward, toward a horizontal plane. At least a portion of the distal end of key arm 4301 is sized such that it fits within side vent 4103 with relative ease when inserted.

In a second orientation 3700*b* that is shown in FIG. 37B, key arm 4301 has been inserted into side vent 4103 and rotated downward about a horizontal axis near its distal end and toward a horizontal plane. As such, it is nearly level with a horizontal plane that coincides with a plane of rim 4105. Further rotation is prevented by a distal surface of a protrusion 4303 on a bottom side of key arm 4301. Thus, the distal surface of protrusion 4303 engages an outward facing surface of rim 4105. In this orientation, a user is able to move domed lid 4101 with relative ease by keeping these surfaces engaged and can lift, rotate, or otherwise modify the orientation of domed lid 4101. Those in the art will understand that key arm 4301 can be angled upward slightly, as in FIG. 37A to slide into vent 4103 and once in place, can be locked into position by rotating downward to make full contact with rim 4105. This can secure the assembly for movement, including twisting, as shown in FIG. 38A-38B and lifting domed lid 4101.

FIGS. 38A-38B show an example embodiment of a heat management device domed lid 4101 and base plate 4601 from a perspective view showing movement and changes in orientation with relation to each other. When using or operating a water pipe to smoke organic material, such as tobacco, that are equipped with base plate 4601 and domed lid 4101, a user may wish to change airflow characteristics around a heating element in order to affect the temperature and amount of airflow about the heating element.

As shown in FIG. 38A, in an open position 3800*a*, one or more side vents 4103 of domed lid 4101 can be partially or wholly aligned with one or more side openings 4603 in vertical side walls of base plate 4601. As such, a maximum degree of airflow can be permitted when side openings 4603 and side vents 4101 are fully aligned. This maximum airflow can maximum allow for maximum variability of temperature in an interior chamber formed by base plate 4601 and domed lid 4101, about a heating element that is located on an upper surface of base plate 4601. Temperature can be changed easily in this orientation by drawing air through the aligned vents 4101 and openings 4603. In some instances, a user may wish to change the temperature and amount of airflow within the chamber, in order to change the smoking experience. This can be accomplished by changing the orientation of domed lid 4101 with respect to base plate 4601.

As shown in FIG. 38B, if a user wishes to change the orientation of domed lid 4101 with respect to base plate 4601, they can rotate domed lid 4101 about a central vertical axis. Since base plate 4601 remains in a fixed orientation when domed lid 4101 is rotated, the user can achieve a partially or fully closed orientation by performing this rotation. In a fully closed orientation 3800*b*, one or more side vents 4103 of lid 4101 can be aligned in front of one or more walls 4605 of base plate 4601. As such, some or all airflow through side vents 4103 is prevented. Thus, closed orientation 3800*b* creates a situation where most or all airflow into the interior chamber formed by domed lid 4101 and 4601 occurs through one or more upper vents 4171, 4173.

FIG. 39 shows an example embodiment of a top of a glass bowl 4501 and a heat management device base plate 4601 from a perspective view. As shown in the example embodiment, an upward facing surface 4505 can be slightly recessed below an upward facing surface 4503 of glass bowl 4501. This can provide support for one or more downward facing surfaces at an exterior circumferential edge of base plate 4601. The difference in elevation between surfaces 4503 and 4505 helps to ensure that base plate 4601 will not inadvertently slide off of glass bowl 4501 when coupled or in use.

When a user wishes to smoke a water pipe with a glass bowl 4501, it can first be coupled with the water pipe. Second, organic matter to be smoked can be added in area 4507. These two steps can be switched in some embodiments. Next the user can place base plate 4601 in position as described above. A heating element can be activated and placed in the interior area 4609 of base plate 4601. A domed lid (not shown) can be added if desired and then the user can draw air through the water pipe. This will cause air to be pulled through openings 4607 into an area above area 4507 which is holding the heated tobacco, and then through a central or other opening 4509 and into the water pipe. Further description is given with respect to FIGS. 18G-18I.

FIGS. 40A-40B show an example embodiment of a coupled key arm 4302 and key cap 4402 from a perspective view 4400*a* and side view 4400*b*, respectively. Further description of key arm 4302 is provided with respect to FIGS. 43A-43E. Further description of key cap 4402 is given with respect to FIGS. 44A-44E. Further description of coupled key arm 4302 and key cap 4402 is given with respect to FIGS. 37A-37B.

FIGS. 41A-41H show a variety of example embodiments of heat management device domed lids 4100*a*-4100*h* with different sizes, shapes, and quantities of vent openings.

Figures 41A, 41B:
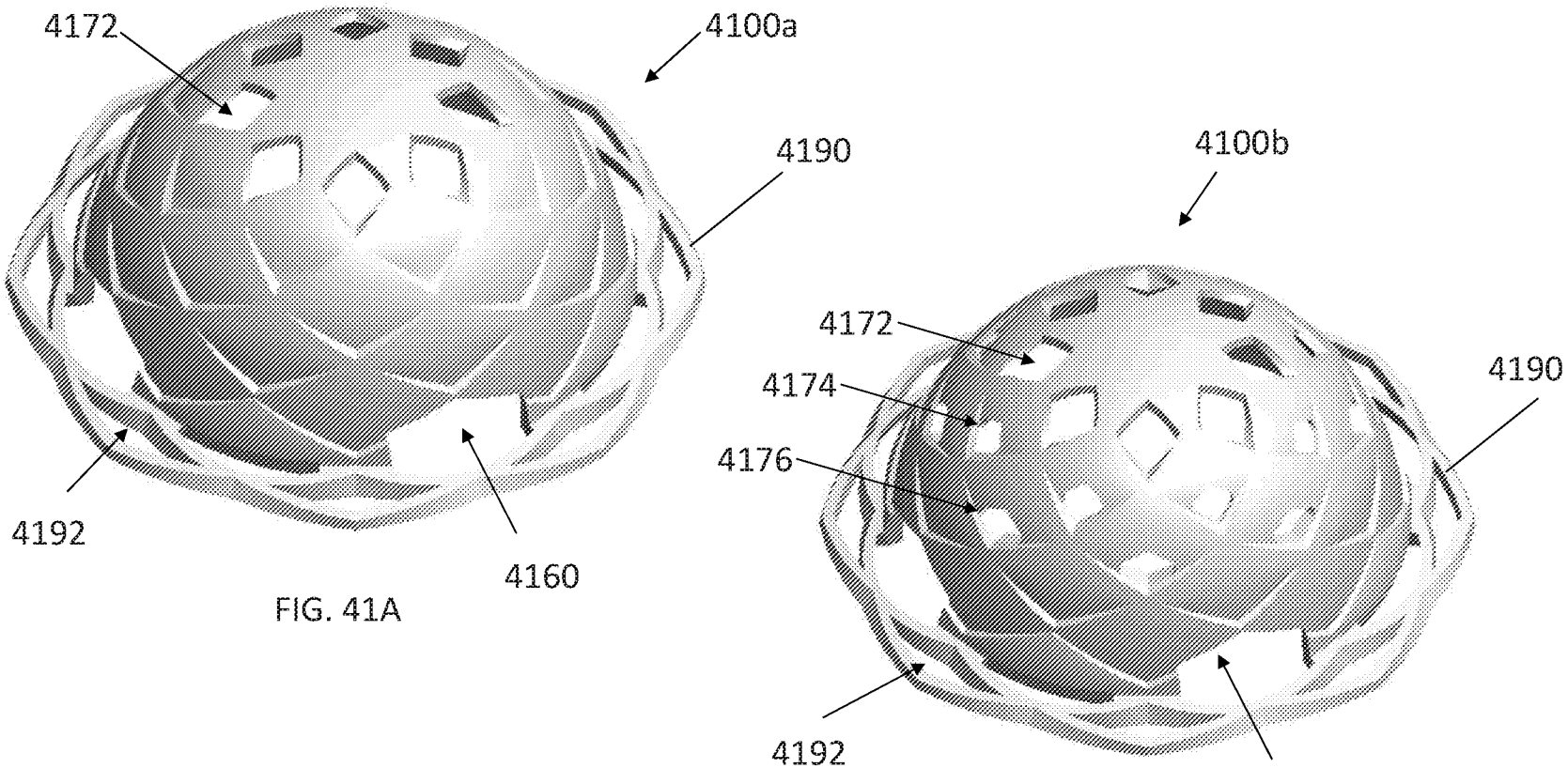
Figures 41C, 41D:
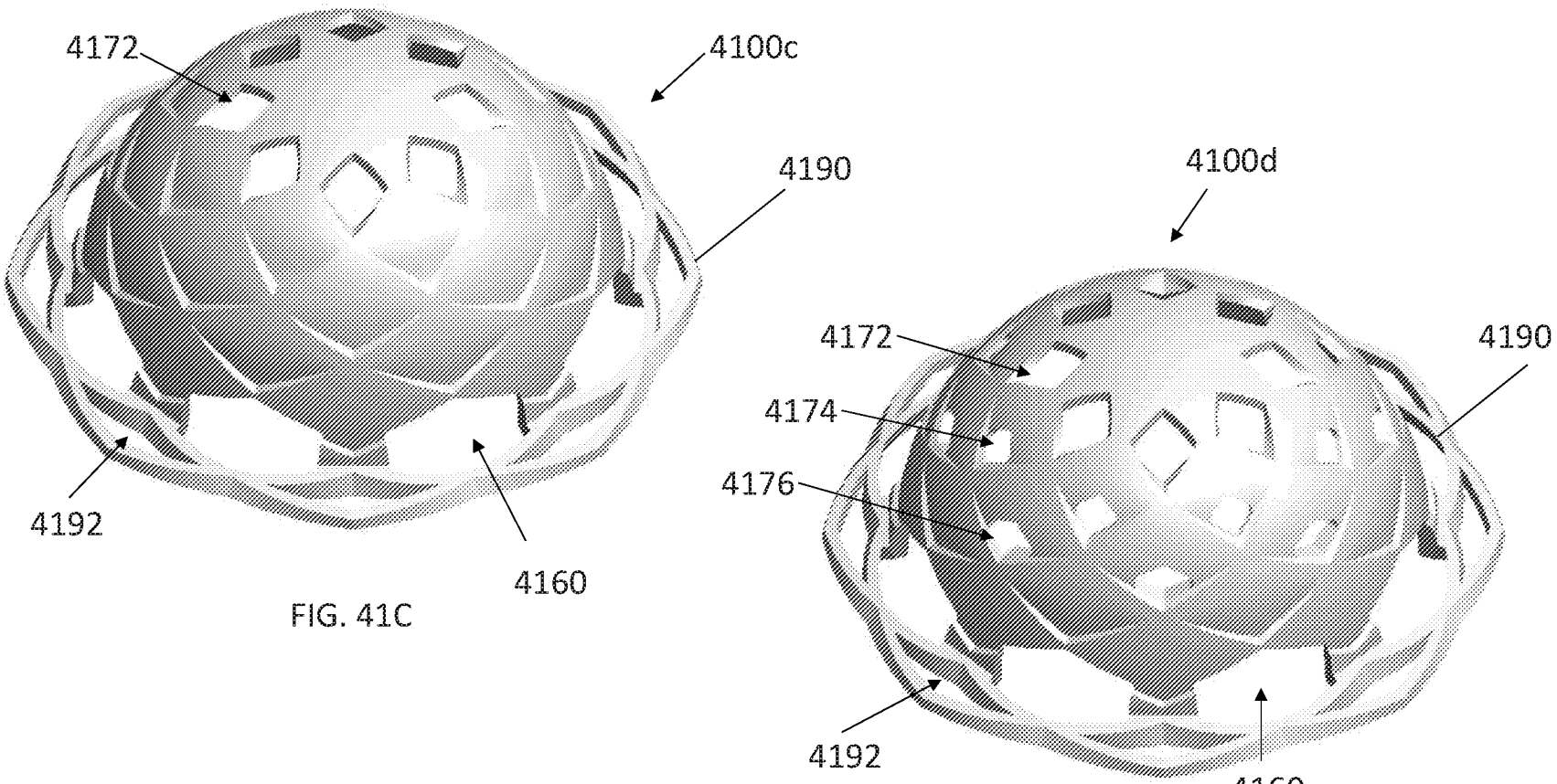
Figure 41F:
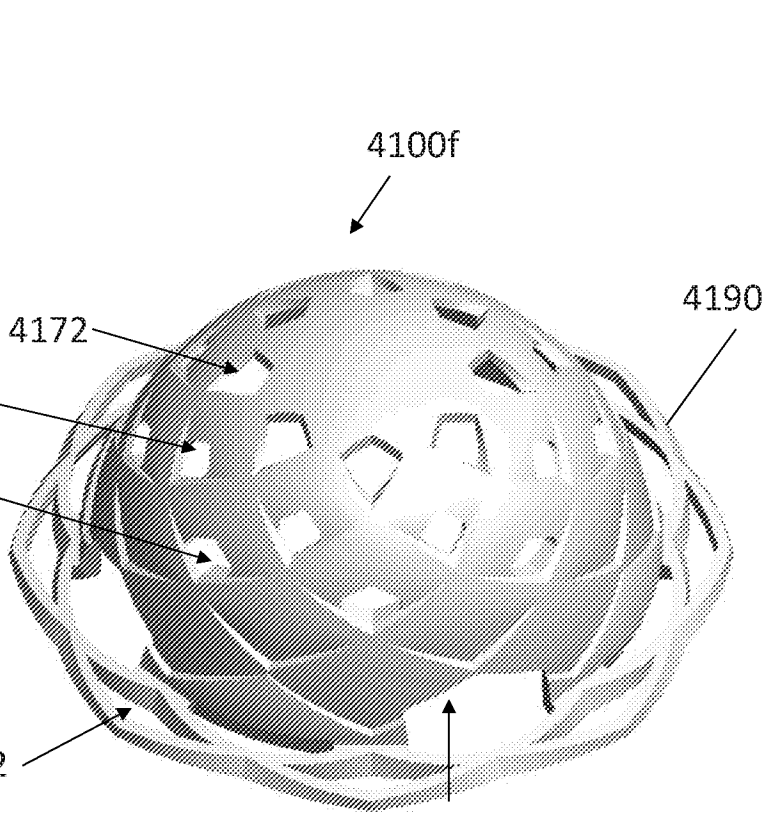

As shown in FIGS. 41A, 41C, 41E, and 41G, in some embodiments one or more upper openings or holes 4172 can be provided near the upper end of domed lid 4100. These can be arranged in a regular or irregular pattern that is generally in a single row. They can allow airflow into domed lids 4100*a*-4100*h* and also provide an egress for exhaust airflow. In FIGS. 41A and 41C holes 4172 are fairly large, while in FIGS. 41E and 41G, they are fairly small. Larger holes allow for greater airflow, while smaller holes allow for less airflow.

As shown in FIGS. 41B, 41D, 41F, and 41H, in some embodiments, additional rows of openings or holes can be provided that are below holes 4172. In these embodiments, two additional rows of holes are included, holes 4174, and 4176.

As shown in the various example embodiments of FIGS. 41A-41G, side ventilation holes 4160 can be located in the sides of domed lids 4100*a*-4100*g*. In these embodiments they are regularly spaced, however irregular spacing can also be applied in various other embodiments. In FIGS. 41C-41D and 41G-41H, side holes 4160 are numerous in quantity and allow for a high degree of airflow into the interior of domed lid 4100. In these embodiments, there are eight holes each, although other numbers are contemplated. Alternatively, in FIGS. 41A-41B and 41E-41F, side holes 4160 are fewer in quantity and allow for less airflow, comparatively. In these embodiments, there are four side holes 4160 each, although other numbers are contemplated.

Figure 41E:
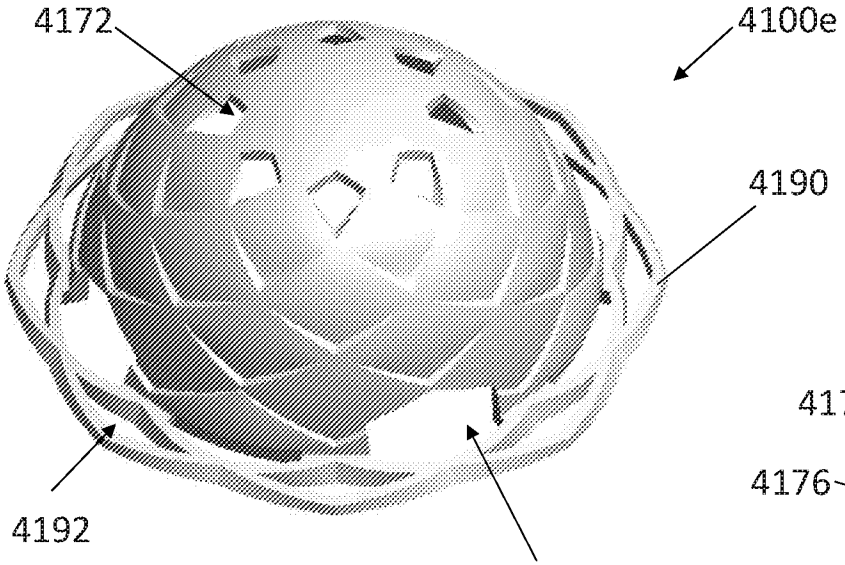
Figures 41G, 41H:
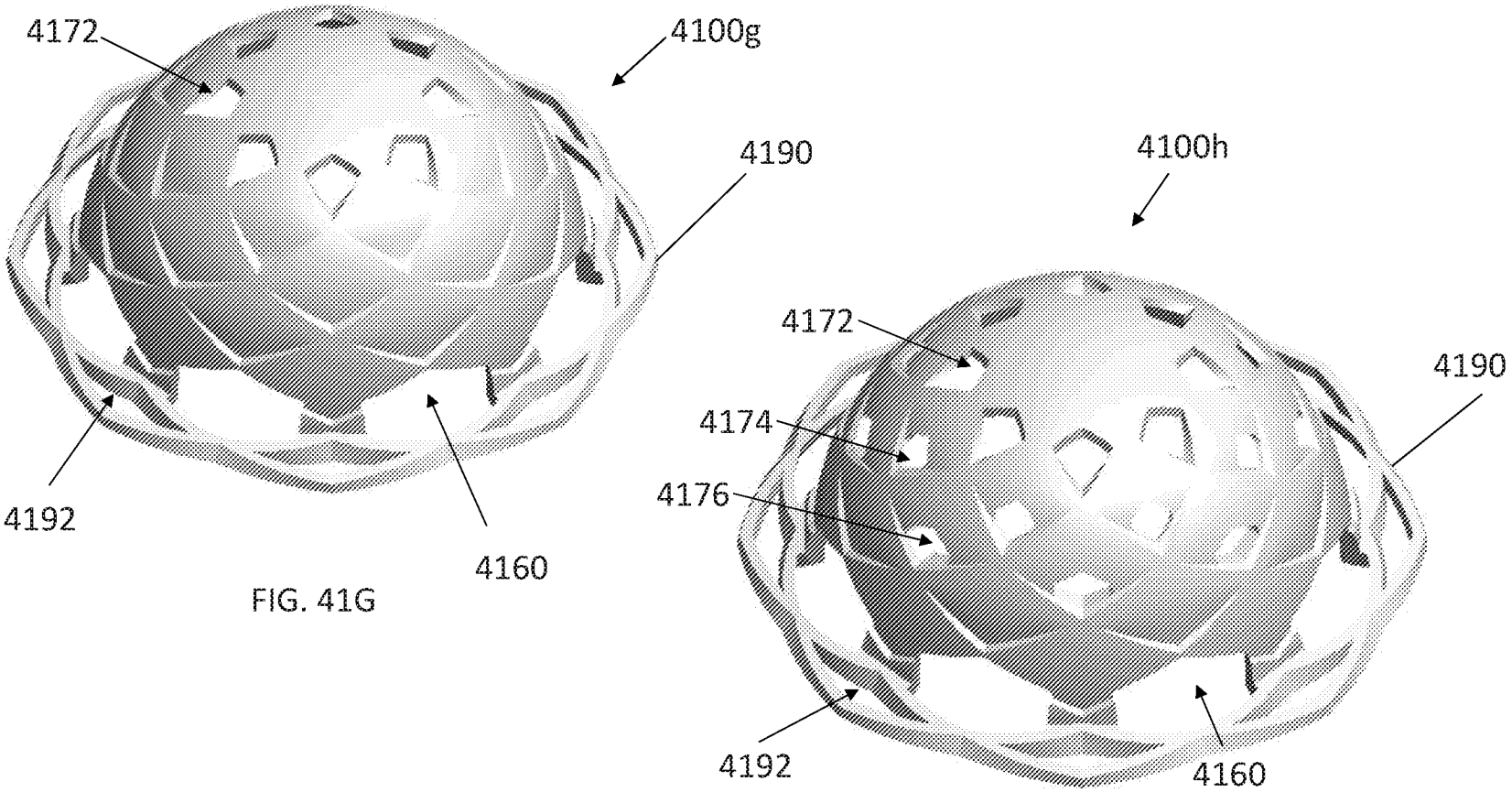

As shown in the example embodiments, allowance of airflow can vary greatly, depending on the features provided in an individual embodiment. Domed lid 4100*e* of FIG. 41E provides the lowest amount of airflow with small upper holes 4172 and a small quantity of side vents 4160, while domed lid 4100*d* of FIG. 41D provides a much greater amount, due to the large upper holes 4172, additional rows of holes 4174, 4176, and large quantity of side vents 4160.

In the example embodiments, a rim 4190 allows for adjustment of an orientation of cover 4100. Rim 4190 is shown with a series of vertical openings 4192 that allow for airflow and heat dissipation, such that they can minimize an amount of heat that may be retained by rim 4190 and help to provide a safe experience for users.

FIGS. 42A-42D show an example embodiment of a heat management device domed lid from a side cross-sectional view 4200*a*, perspective mockup view 4200*b*, top view 4200*c*, and side view 4200*d*, respectively. FIG. 42E shows an example embodiment of a heat management device domed lid from a perspective mockup view 4200*e*.

Similar numbering will be used for FIGS. 42A-42E with respect to the element numbering of FIGS. 41A-41H for simplification. As an example, Rim 4190 of FIGS. 41A-41H is analogous to rim 4290 of FIGS. 42A-42E.

As shown in side cross-sectional view 4200*a* of FIG. 42A, a lip 4297 can be provided circumferentially within an interior chamber of domed lid 4200 that is partially or substantially horizontal and is operable to removably interface with one or more surfaces near the top of a base platform.

As shown in top view 4200*c* of FIG. 42C, when rim 4290 has a series of outward directed points, tips of points on opposite sides of domed lid 4200 can be about 100.80 mm apart, such that the maximum diameter of the domed lid is such. Also shown, the sides of points that are one removed from opposite can measure about 92.55 mm.

As shown in side view 4200*d* of FIG. 42D, a bottom edge of rim 4290 is generally perpendicular from a vertical axis in the center of domed lid 4200.

As shown in FIG. 42E, surfaces such as the wall faces of upper holes 4272 and second row of holes 4274 and the upper surfaces of rim 4290 and any logo 4299 can be polished in various embodiments. In some embodiments, domed lid 4200 can be steel, injection molded steel, or others, as appropriate.

Figure 43C:
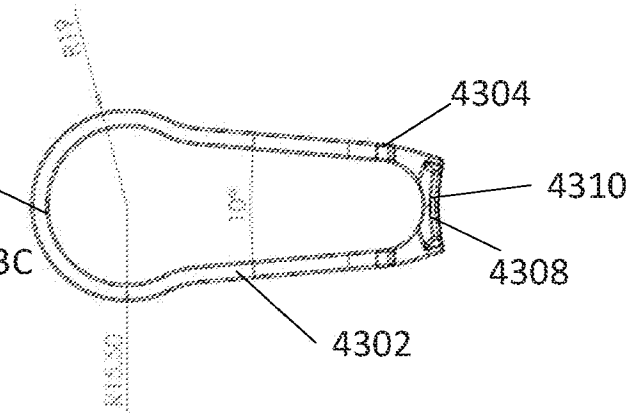
Figure 43D:
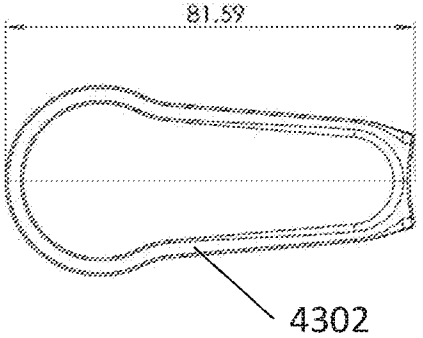
Figure 43E:
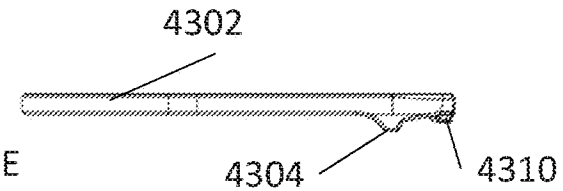
Figure 43A:
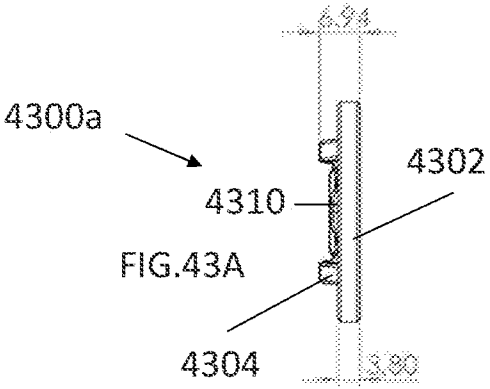
Figure 43B:
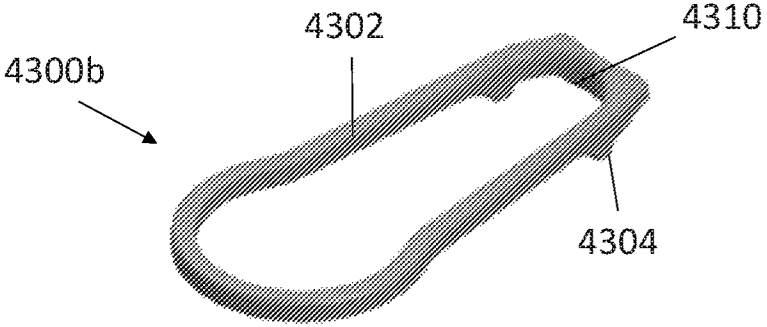
Figures 44A, 44B, 44C, 44D, 44E:
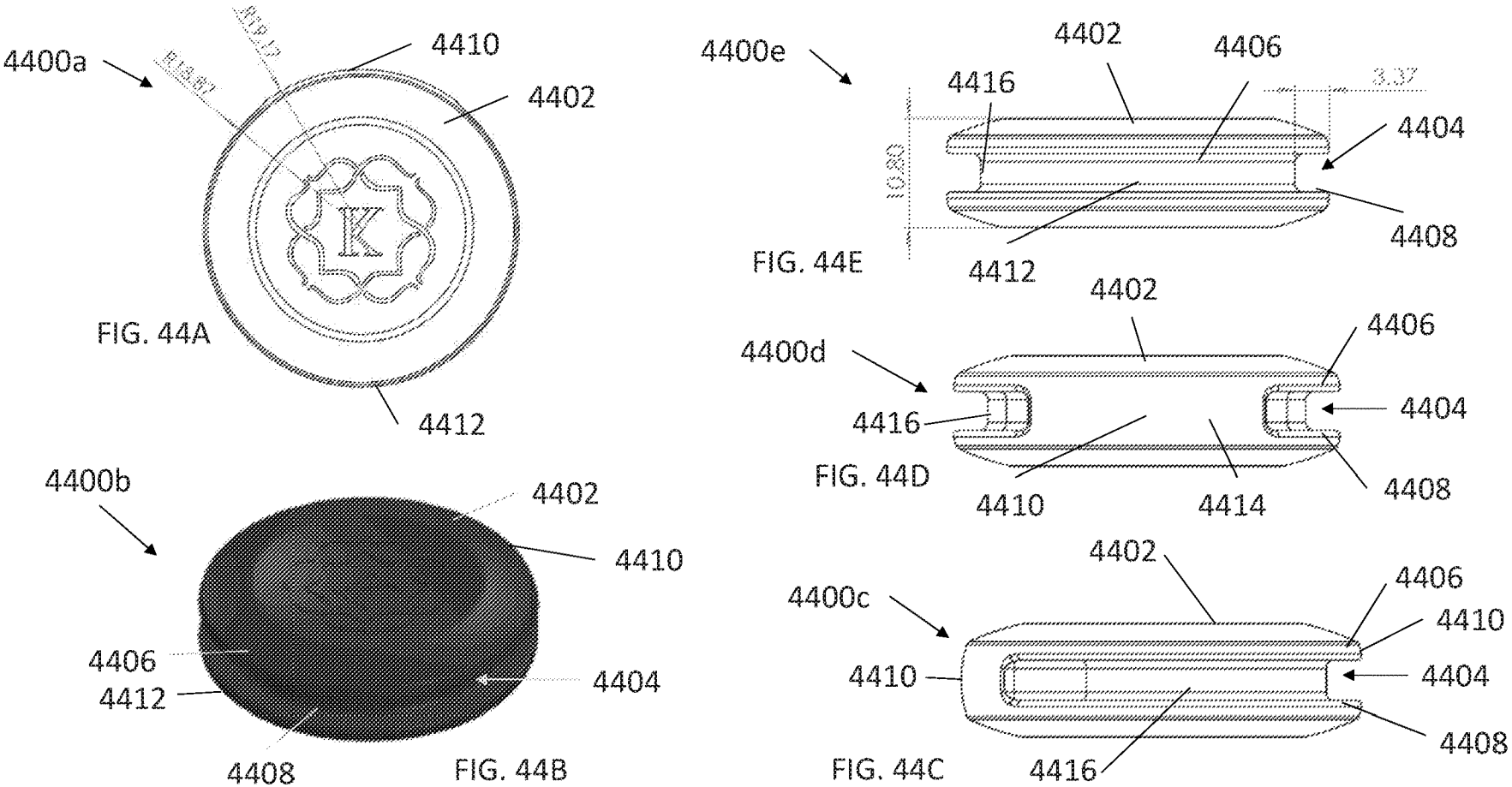
Figure 45A:
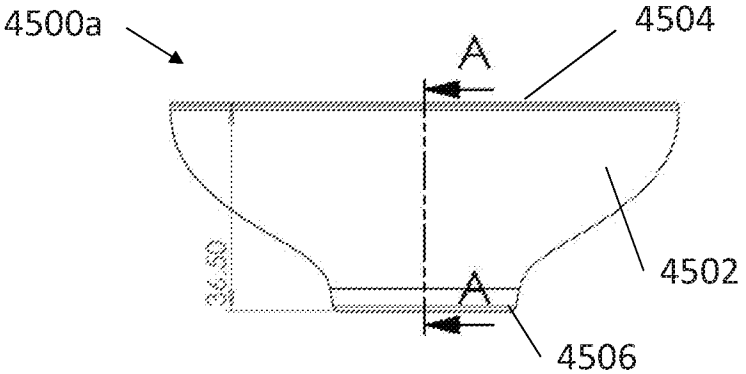
Figure 45B:
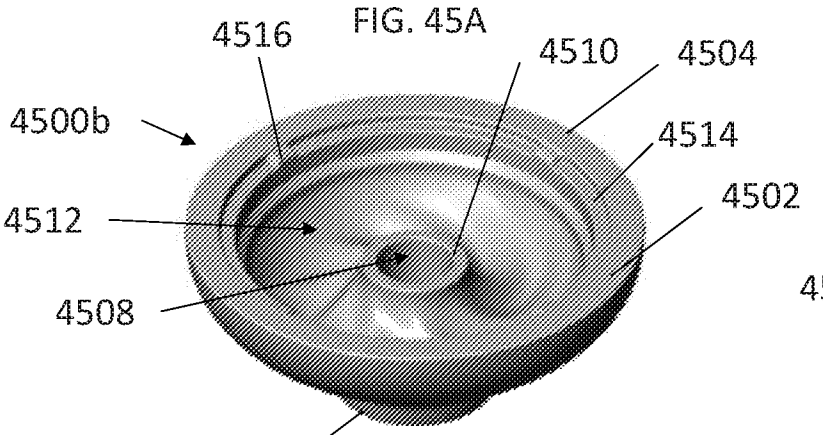
Figure 45C:
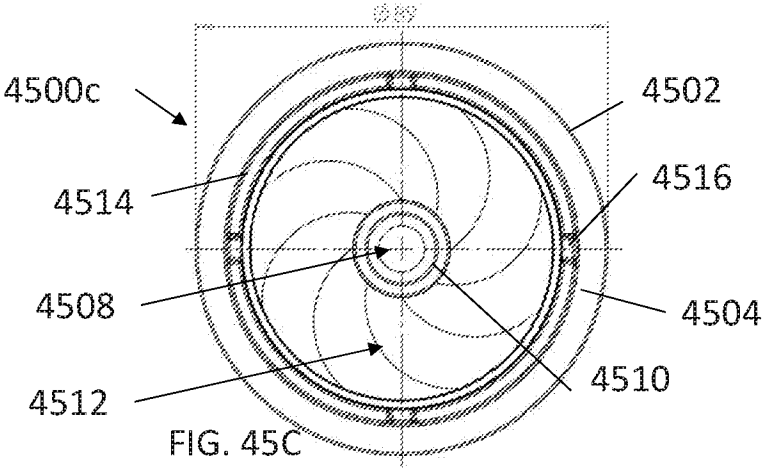
Figure 45D:
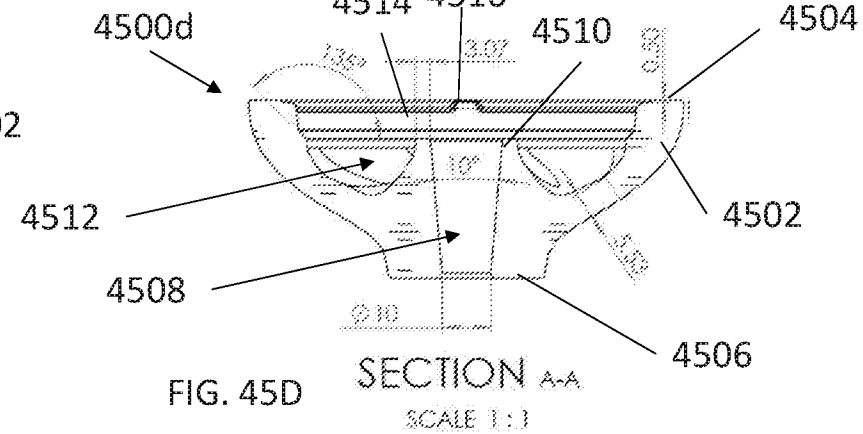

FIGS. 43A-43E show an example embodiment of a heat management device key arm from an end view 4300*a*, perspective mockup view 4300*b*, bottom view 4300*c*, top view 4300*d*, and side view 4300*e*, respectively. As shown in FIG. 43, a body 4302 of key arm 4300 can be about 3.80 mm thick and the thickness of body 4302 and protrusions 4304 can be about 6.94 mm. As shown in FIG. 43C, a proximal end of arm 4300 can be semi-circular, with a radius of about 15.50 mm, such that a maximum width of body 4302 is 31.00 mm. A distal end 4308 can have a small lip 4310 along part or all of a distal edge lower surface of body 4302. Semi-circle can converge into two sections that taper off to distal end 4308 at about ten degrees. As shown in FIG. 8D, a length of body 4302 can be about 81.59 mm. In general, key arm 4300 can be a unitary structure. In some embodiments, body 4302 can be metal, such as injection molded steel.

FIGS. 44A-44E show an example embodiment of a heat management device key cap 4400 from a top view 4400*a*, perspective mockup view 4400*b*, side view 4400*c*, back view 4400*d*, and front view 4400*e*, respectively. As shown in the example embodiments, a proximal end 4412 can be opposite a distal end 4410. In general, a body 4402 of key cap 4400 can be unitary and substantially cylindrical, with a maximum height or thickness of about 10.80 mm. A radius from a wall 4414 at distal end 4410 can be about 19.17 mm. A radius to an edge elsewhere around the circumference can be about 18.87 mm. A channel 4404 can extend circumferentially around a substantial majority of the circumference and be defined by an upper edge 4406, lower edge 4408, and interior wall 4416. Channel 4404 can be about 3.37 mm from an outer circumference edge to interior wall 4416. In some embodiments, body 4402 can be a molded silicone.

FIGS. 45A-45D show an example embodiment of a bowl from a side view 4500*a*, perspective mockup view 4500*b*, top view 4500*c*, and side cross-sectional view 4500*d*, respectively. As shown in the example embodiment, a maximum height of a body 4502 can be about 36.50 mm. Body 4502 can be generally cylindrical, and an outer profile can roundly curve inward from an upper edge 4504 before reaching an inflection point and then curving in the other direction before reaching a bottom edge 4506 with a substantially narrower diameter. Outer diameter of the upper edge 4504 can be about 89 mm.

Lower edge 4506 can have a centrally located hole 4508 that has a diameter of about 10 mm and an interior wall extending upward through body 4502 with opposite sides tapering downward toward a central axis at about 10 degrees. A rim 4510 around central hole 4508 can be defined by an upward facing surface that has a width of about 3.07 mm and extends down and outward before curving upward to upper edge 4504, with a body thickness of the upward flare of about 5.53 mm in some places. This area between an exterior circumferential edge of rim 4510 and interior circumferential edge of upper edge 4504 can define an interior 4512, where organic material to smoke can be housed.

Additionally, interior 4512 can have one or more surface features, such as a swirling pattern with ridges. Further, interior 4512 can house a circumferential ring 4514 that can support a base heating platform. Circumferential ring 4516 can have one or more upper protrusions that rise up slightly above an upper surface of ring 4516. These can couple with a heat management device base plate in order to prevent the plate from spinning. In some embodiments, body 4502 can be compression molded glass.

FIGS. 46A-46C show an example embodiment of a heat management device base plate from a top view 4600*a*, top mockup view 4600*b*, and top perspective mockup view 4600*d*, respectively.

FIGS. 46D-46G show an example embodiment of a heat management device base plate from a bottom view 4600*d*, bottom perspective mockup view 4600*e*, side view 4600*f*, and side cross-sectional view 4600*g*, respectively.

FIGS. 46H-46I show an example embodiment of a heat management device base plate from a side mockup view 4600*h* and bottom perspective view 4600*i*, respectively.

FIGS. 46J-46K show an example embodiment of a heat management device base plate from a top perspective mockup view 4600*j* and top mockup view 4600*k*, respectively. As described variously herein, base plate is also referred to as a platform or heating platform.

As shown in FIGS. 46A-46K, platform 4600 includes a body 4602 that has a recessed tray 4604 for supporting a heating source. In the example embodiment, a first set of upward protrusions 4606 and second set of protrusions 4608 can provide upper surfaces on which a heating source such as charcoal slightly above recessed tray 4604. These protrusions 4606 and 4608 can be triangular, diamond, or other shapes and can be arranged circumferentially about a central axis. Protrusions 4606 and 4608 can be spaced apart and slightly offset from each other to create channels 4610 between themselves and each other, in to promote airflow below the heating source.

The side surfaces of each vertical protrusion 4606 may create a substantially "V" shape with the point directed outward, toward a wall 4612 and a hole 4622. Accordingly, air may be channeled toward these holes in wall 1412. Additionally, the point of each "V" may correspond with a channel between adjacent protrusions 4608 above recessed tray 1522. It has been discovered that embodiments utilizing such an arrangement benefit from the created air channels which may promote circulation within wall 1412 and promote even heating of the coals or other heating elements during use.

Platform 4600 also includes an exterior wall 4612 shaped as a series of rounded clamshell arches 4614 rising above recessed tray 4604 and circumferentially surrounding it. As shown, eight arches can be included, although other numbers are also contemplated. Spaces between upper rounded edges of arches 4614 can allow air to flow between them. Arches 4614 are solid on the outside and each has a hump 4616 that is somewhat rounded and rectangular in nature. Hump 4616 does not extend the full height of arches 4614. An interior surface 4618 of clamshell arches 4612 is rounded in nature and defined by a hole 4622 that allows air to flow from above recessed tray within wall 1412 to a hollow interior area 4636 of body 4602. The interior surfaces 4618 can include an inward flare that promotes airflow within its circumference, creating a heating chamber that channeling air toward the heating elements.

Recessed tray 4604 may include a slightly raised perimeter area 4638 which has slightly flared inward walls from its upward facing surface. In the example embodiment, recessed tray 4604 has a star configuration with eight points. Other embodiments may incorporate other shapes without departing from the scope of the invention. It has been discovered, however that the eight-pointed star configuration provides benefits over other shapes, including benefits of even heating.

Ridges 4624 can extend below a bottom surface 4626 of body 4602. As shown, these can be in a spiral or other configuration to provide airflow and heat management in various embodiments. In the example embodiment, ridges 4624 are crescent shaped and emanate from a central area 4628 and toward a lower, interior circumferential wall 4630. Wall 4630 extends slightly below a lower edge 4632 of wall 4612. Ridges 4624 extend slightly below a lower edge of wall 4630, which can be about 2 mm in height. In the example embodiment, eight ridges 4624 are shown, although other quantities are also contemplated in various embodiments. One or more notches 4634 in the bottom of wall 4612 can allow for mating or otherwise coupling with complementary sized protrusions of a bowl (e.g. 4516 of FIG. 45B-45D).

Body 4602 can be 25.50 mm from the top of arches 4612 to the bottom of ridges 4624. It can have a radius of 37.75 mm from an outer edge of wall 4612 to its central axis. Platform 4600 may be comprised of aluminum, copper, steel, or any other material that is suitable for this purpose.

Holes 4622 may be arch shaped with flat bottoms, allowing airflow from the interior of a heating chamber above recessed tray 4604 into hollow interior 4636 and over a bowl. The combination of ridges 4624 and protrusions 4604 and 4608 promote airflow above and below tray 4604 for uniform heating of tobacco, or other organic material, below platform.

As discussed herein, a user can place or otherwise couple a platform 4600 on a rim of a bowl filled with tobacco, shisha or other organic matter already prepared as described above. Then a user can place coals or other combustible material on platform 4600 within wall 4612. Once the coals or other combustible material are in place, they can be heated by a heat source, for example a match or lighter, before a user can place or otherwise couple a ventilated cap on platform 4600.

FIGS. 47A-47C show an example embodiment of a heat management device base plate from a top view 4700*a*, top mockup view 4700*b*, and top perspective mockup view 4700*c*, respectively. Similar description of many of the features of FIGS. 46A-46C can be applicable to the features shown in FIGS. 47A-47C.

Figure 47E:
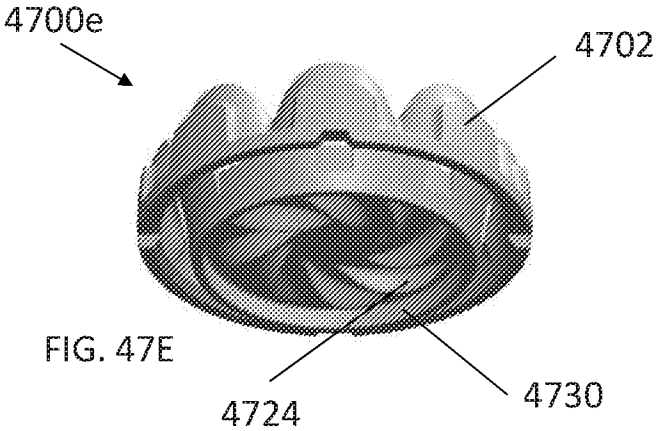
Figure 47F:
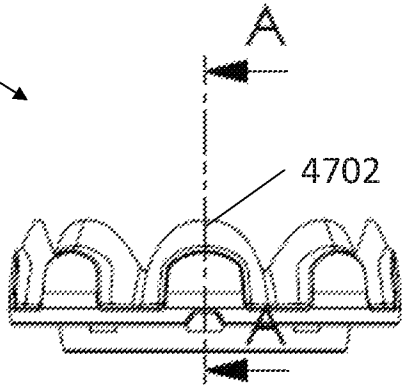
Figure 47G:
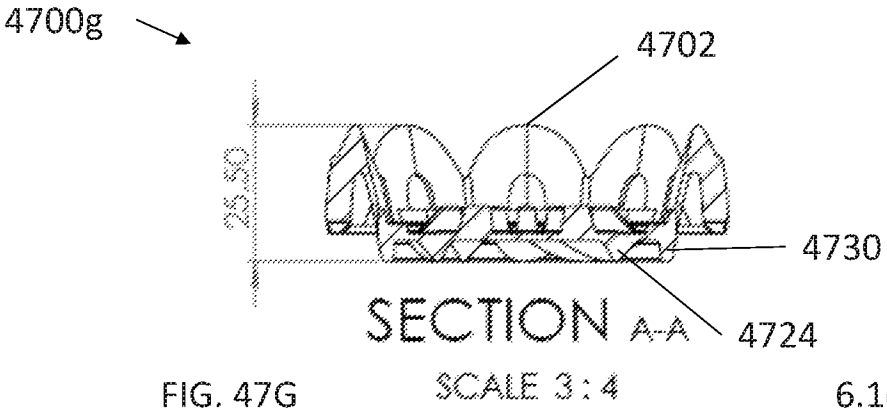

FIGS. 47D-47G show an example embodiment of a heat management device base plate from a bottom view 4700*d*, bottom perspective mockup view 4700*e*, side view 4700*f*, and side cross-sectional view 4700*g*, respectively. Similar description of many of the features of FIGS. 46D-46G can be applicable to the features shown in FIGS. 47D-47G. An important distinction between the embodiments of FIGS. 46A-46K and FIGS. 47A-47G is related to ridges 4724. As shown in FIGS. 47E and 47G, ridges 4724 in this example embodiment do not extend below a lower edge of lower wall 4730. In the example embodiment, ridges 4724 extend the same distance downward that wall 4730 does, which itself can be about 4 mm in height. Further, a total height from the bottom of ridges 4724 and lower wall 4730 to the top of arches 4712 is about 25.50 mm. In some embodiments, base plate 4700 can be diecast aluminum.

FIGS. 48A-48C show an example embodiment of a heat management device base plate from a top view 4800*a*, top mockup view 4800*b*, and top perspective mockup view

4800*c*, respectively. Similar description of many of the features of FIGS. 46A-46C can be applicable to the features shown in FIGS. 48A-48C.

FIGS. 48D-48G show an example embodiment of a heat management device base plate from a bottom view 4800*d*, bottom perspective mockup view 4800*e*, side view 4800*f*, and side cross-sectional view 4800*g*, respectively. Similar description of many of the features of FIGS. 46D-46G can be applicable to the features shown in FIGS. 48D-48G. An important distinction between the embodiments of FIGS. 46A-46K and FIGS. 48A-48G is related to ridges 4824. As shown in FIGS. 48D-48G, ridges 4824 in this example embodiment are fewer in quantity. As shown four ridges 4824 can provide different airflow and heating characteristics than higher quantities of ridges in other embodiments. Further, ridges 4824 extend below a lower edge of lower wall 4830.

FIGS. 49A-49C show an example embodiment of a heat management device base plate from a top view 4900*a*, top mockup view 4900*b*, and top perspective mockup view 4900*c*, respectively. Similar description of many of the features of FIGS. 46A-46C can be applicable to the features shown in FIGS. 49A-49C.

FIGS. 49D-49G show an example embodiment of a heat management device base plate from a bottom view 4900*d*, bottom perspective mockup view 4900*e*, side view 4900*f*, and side cross-sectional view 4900*g*, respectively. Similar description of many of the features of FIGS. 48D-48G can be applicable to the features shown in FIGS. 49D-49G. An important distinction between the embodiments of FIGS. 48A-48G and FIGS. 49A-49G is related to ridges 4924. As shown in FIGS. 49D-49G, ridges 4924 in this example embodiment do not extend below a lower edge of lower wall 4930. In the example embodiment, ridges 4924 extend the same distance downward that wall 4930 does. Further, a total height from the bottom of ridges 4924 and lower wall 4930 to the top of arches 4912 is about 25.50 mm.

FIGS. 50A-50B show an example embodiment of a heat management device base plate from a top view 500*a* and top perspective mockup view 500*b*, respectively. Similar description of many of the features of FIGS. 46A-46C can be applicable to the features shown in FIGS. 50A-50B.

Figure 50F:
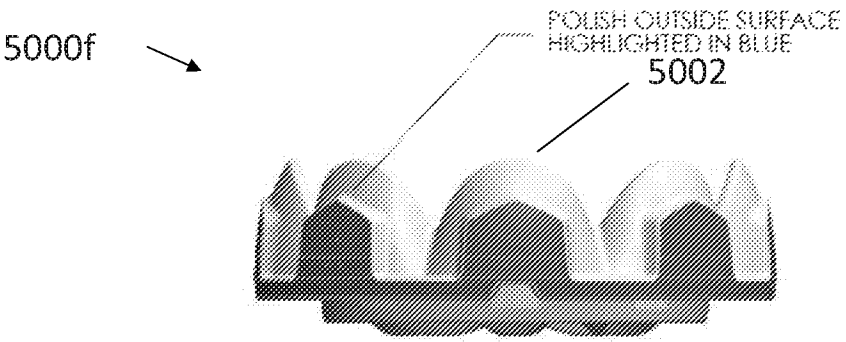
Figure 50C:
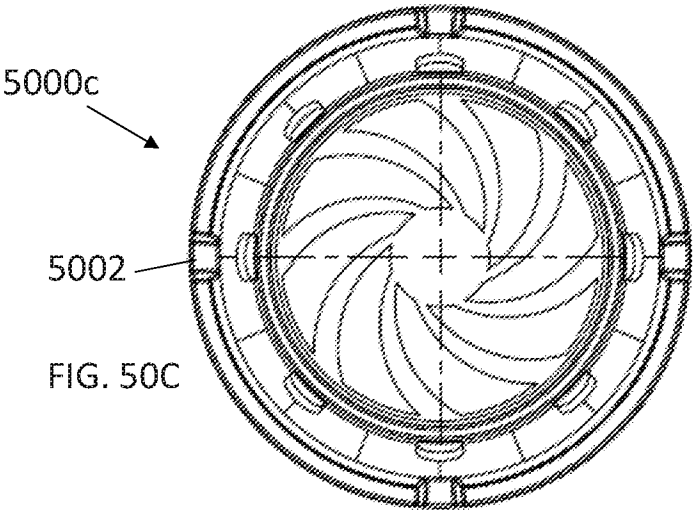
Figure 50E:
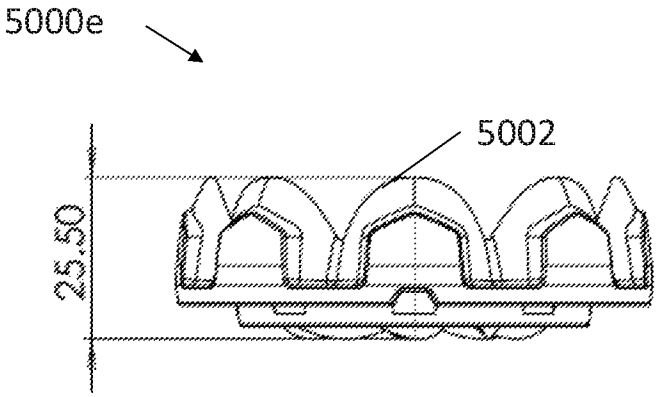

FIGS. 50C-50F show an example embodiment of a heat management device base plate from a bottom view 5000*c*, bottom perspective mockup view 5000*d*, side view 5000*e*, and side perspective mockup view 5000*f*, respectively. Similar description of many of the features of FIGS. 46D-46G can be applicable to the features shown in FIGS. 50C-50F. Further, as shown in FIG. 50F, in some embodiments a furthest exterior circumferential surface of body 5002 can be polished.

FIGS. 51A-51C show an example embodiment of a heat management device base plate from a top view 5100*a*, top mockup view 5100*b*, and top perspective mockup view 5100*c*, respectively. Similar description of many of the features of FIGS. 46A-46C can be applicable to the features shown in FIGS. 51A-51C. However, one major distinction is that in FIGS. 51A-51C recessed tray 5104 upper surface ridges 5106 can replace the first set of protrusions 4606 and second set of protrusions 4608 of FIGS. 46A-46C. As such, upper surface ridges 5106 can provide support for a heating source, such as charcoal, slightly above recessed tray 5104. In the example embodiment, a channel 5110 between each adjacent ridge 5106 leads directly toward an opening 5122 in wall 5112. Ridges 5106 are arranged in a regular spiral pattern emanating from a central axis of base plate 5100, although other orientations and arrangements are also contemplated. Further, eight ridges 5106 are shown in the example embodiment, although other quantities are also contemplated.

FIGS. 51D-51G show an example embodiment of a heat management device base plate from a bottom view 5100*d*, bottom perspective mockup view 5100*e*, side view 5100*f*, and side cross-sectional view 5100*g*, respectively. Similar description of many of the features of FIGS. 46D-48G can be applicable to the features shown in FIGS. 51D-51G.

FIGS. 52A-52C show an example embodiment of a heat management device base plate from a top view 5200*a*, top mockup view 5200*b*, and top perspective mockup view 5200*c*, respectively. Similar description of many of the features of FIGS. 51A-51C can be applicable to the features shown in FIGS. 52A-52C.

FIGS. 52D-52G show an example embodiment of a heat management device base plate from a bottom view 5200*d*, bottom perspective mockup view 5200*e*, side view 5200*f*, and side cross-sectional view 5200*g*, respectively. Similar description of many of the features of FIGS. 51D-51G can be applicable to the features shown in FIGS. 52D-52G. An important distinction between the embodiments of FIGS. 51A-51G and FIGS. 52A-52G is related to ridges 5224. As shown in FIGS. 52D-52G, ridges 5224 in this example embodiment do not extend below a lower edge of lower wall 5230. In the example embodiment, ridges 5224 extend the same distance downward that wall 5230 does. Further, a total height from the bottom of ridges 5224 and lower wall 5230 to the top of arches 5212 is about 25.50 mm.

FIGS. 53A-53C show an example embodiment of a heat management device base plate from a top view 5300*a*, top mockup view 5300*b*, and top perspective mockup view 5300*c*, respectively. Similar description of many of the features of FIGS. 51A-51C can be applicable to the features shown in FIGS. 53A-53C.

FIGS. 53D-53G show an example embodiment of a heat management device base plate from a bottom view 5300*d*, bottom perspective mockup view 5300*e*, side view 5300*f*, and side cross-sectional view 5300*g*, respectively. Similar description of many of the features of FIGS. 51D-51G can be applicable to the features shown in FIGS. 53D-53G. As shown in FIGS. 53D-53G, ridges 5324 in this example embodiment are fewer in quantity. As shown four ridges 5324 can provide different airflow and heating characteristics than higher quantities of ridges in other embodiments. Further, ridges 5324 extend below a lower edge of lower wall 5330, such that a total height from the bottom of ridges 5324 to the top of arches 5312 is about 25.50 mm.

FIGS. 54A-54C show an example embodiment of a heat management device base plate from a top view 5400*a*, top mockup view 5400*b*, and top perspective mockup view 5400*c*, respectively. Similar description of many of the features of FIGS. 53A-53C can be applicable to the features shown in FIGS. 54A-54C.

FIGS. 54D-54G show an example embodiment of a heat management device base plate from a bottom view 5400*d*, bottom perspective mockup view 5400*e*, side view 5400*f*, and side cross-sectional view 5400*g*, respectively. Similar description of many of the features of FIGS. 53D-53G can be applicable to the features shown in FIGS. 54D-54G. An important distinction between the embodiments of FIGS. 53A-53G and FIGS. 54A-54G is related to ridges 5424. As shown in FIGS. 54D-54G, ridges 5424 in this example embodiment do not extend below a lower edge of lower wall 5430. In the example embodiment, ridges 5424 extend the same distance downward that wall 5430 does. Further, a total height from the bottom of ridges 5424 and lower wall 5430 to the top of arches 5412 is about 25.50 mm.

FIG. 55 shows an example cross-sectional view of a water pipe system according to one embodiment. FIG. 56 shows an enlarged view a section of FIG. 55.

In FIGS. 55-56, a water pipe system 5500 may include a smoke supplying assembly 5580 and a plurality of vessels, including an inner vessel 5512 and an outer vessel 5514. The inner vessel 5512 may have configurations that are the same as or similar to configurations of the inner vessel 1312 discussed above in view of FIG. 26B. The outer vessel 5514 may have configurations that are the same as or similar to configurations of the outer vessel 1314 discussed above in view of FIG. 26B. In this illustrated embodiment, the inner vessel 5512 may be disposed in the outer vessel 5514. The inner vessel 5512 may define a liquid chamber 5518. The outer vessel 5514 and the inner vessel 5512 may define a smoke chamber 5520 between the outer vessel 5514 and the inner vessel 5512.

The smoke supplying assembly 5580 may include an aerator 5522, a down stem 5524, a shisha 5528, a bowl 5530, and a cap 5534. The aerator 5522, the down stem 5524, the shisha 5528, the bowl 30, and the cap 5534 may have configurations that are the same as or similar to the aerator 1322, the down stem 1324, the shisha 1328, the bowl 1330, and the cap 1334 of FIG. 26B, respectively. The smoke supplying assembly 5580 may be configured to supply smoke to the liquid chamber 5518. The liquid chamber 5518 may communicate with the smoke chamber 5520 such that smoke drawn from the smoke supplying assembly 5580 flows from the liquid chamber 5518 to the smoke chamber 5520. An example of smoke flow is shown by arrows in FIG. 55.

In the embodiment in FIGS. 55-56, the water pipe system 5500 may further include a gasket 5550. The gasket 5550 may be disposed between the outer vessel 5514 and the inner vessel 5512. The gasket 5550 may be in contact with the outer vessel 5514 and with the inner vessel 5512. The gasket 5550 may be disposed at an inner vessel hole 5512*a* of the inner vessel 5512. The gasket 5550 may be provided with a gasket hole 5550*a* that extends through the inner vessel hole 5512*a*. In one embodiment, in plan view, the gasket hole 5550*a* may overlap with both the inner vessel hole 5512*a* and an outer vessel hole 5514*a* that is formed by the outer vessel 5514. The gasket 5550 may plug the inner vessel hole 5512 and the outer vessel hole 5514. In the illustrated embodiment, as shown in FIG. 56, a first extension 5553 of the gasket 5550 may plug the inner vessel hole 5512*a*, and a second extension 5555 of the gasket 5550 may plug the outer vessel hole 5514*a*. The gasket 5550 may be made of a silicone rubber or some other flexible material, for example, to preferably plug the inner vessel hole 5512*a* and/or the outer vessel hole 5514*a*. The smoke supplying assembly 5580 may be inserted into the liquid chamber 5518 through the outer vessel hole 5514*a*, the gasket hole 5550*a*, and the inner vessel hole 5512*a*. Accordingly, the smoke supplying assembly 5580 plugs the gasket hole 5550*a*, and the gasket 5550 plugs the inner vessel hole 5512*a* and the outer vessel hole 5514*a*, thereby creating a fluid tight seal between the smoke supplying assembly and the liquid chamber 5518.

As shown in FIGS. 56-59, the gasket 5550 may be provided with at least one smoke passage 5551. In the illustrated example, the gasket 5550 is provided with a plurality of smoke passages 5551. In another example (not shown), the gasket 5550 may be provided with only one smoke passage. Via each smoke passage 5551 of the gasket 5550, the smoke chamber 5520 may communicate with the liquid chamber 5518. Each smoke passage 5551 may extend, for example, without limitation, along a direction in which the gasket hole 5550*a* extends such that it has an axis parallel to an axis of the gasket hole 5550*a*. In the illustrated example of FIG. 56, each smoke passage 5551 may extend vertically. However, smoke passages 5551 may extend horizontally, as shown in FIGS. 63-65, or along another direction. As shown in FIG. 58, the smoke passages 5551 may be arranged along a circumferential direction 5591 of the gasket hole 5550*a*.

In one example, as shown in FIGS. 56-59, the gasket 5550 may include a cylindrical portion 5558, the first extension 5553, and the second extension 5555. The cylindrical portion 5558 may be disposed in the inner vessel hole 5512*a* and form the gasket hole 5550*a*. The cylindrical portion 5558 may be in contact with an edge 5512*b* of the inner vessel hole 5512*a*. The cylindrical portion 5558 may include an inner wall 5558*e* and an outer wall 5558*f*. In one embodiment, the smoke passages 5551 may be formed in the cylindrical portion 5558 between the inner wall 5558*e* and the outer wall 5558*f*. The first extension 5553 may be a flange extending from the cylindrical portion 5558 radially outwardly from the gasket hole 5550*a*. The first extension 5553 may be in contact with the inner vessel 5512. The second extension 5555 may extend from the cylindrical portion 5558 radially outwardly of the gasket hole 5550*a*. The second extension 5555 may be in contact with the outer vessel 5514. In one embodiment of FIG. 57, the second extension 5555 may be disc-shaped. However, the shape of the second extension 5555 is not limited to the shape shown in FIG. 57, and the second extension 5555 may have other shapes. For example, as shown in FIG. 60, the second extension 5555*a* may include a plurality of extending parts 5556 that are spaced apart from each other in the circumferential direction 5591 of the gasket hole 5550*a*. In the example of FIG. 60, a gap 5557 between two adjacent extending parts 5556 of the extending parts 5556 may overlap with one of the smoke passages 5551 as viewed in the direction in which the gasket hole 5550*a* extends.

Returning to FIG. 56, the first extension 5553 and the second extension 5555 may be spaced apart from each other via a space 5559 between the first extension 5553 and the second extension 5555. The space 5559 may communicate with the smoke chamber 5520, and with the smoke passages 5551.

Optionally, as shown in FIG. 56, the water pipe system 5500 may further include at least one valve 5560. In the illustrated example, the water pipe system 5500 may include a plurality of valves 5560. In another example (not shown), the water pipe system 5500 may include only one valve. As shown in FIG. 56, each valve 5560 may be disposed in a corresponding one of the smoke passages 5551 of the gasket 5550. As shown in FIG. 58, the valves 5560 may include at least one first one-way valve 5561 that allows a gas to flow from the liquid chamber 5518 to the smoke chamber 5520 and that does not allow a gas to flow from the smoke chamber 5520 to the liquid chamber 5518.

Examples of one-way valves may include various kinds of valves, but in the illustrated example, umbrella valves may be used as the one-way valves. The umbrella valves may include an umbrella valve element, and a housing. The umbrella valve element may cover an opening of the housing when a pressure of one side is greater than a pressure of the other side, and may open the opening of the housing when the pressure of one side is not greater than the pressure of the other side.

As shown in FIG. 58, the valves 5560 may further include at least one second one-way valve 5562 that allows a gas to flow from the smoke chamber 5520 to the liquid chamber 5518 and that does not allow a gas to flow from the liquid chamber 5518 to the smoke chamber 5520. In this embodiment, the first one-way valve(s) 5561 may be a set of one-way valves providing a greater number of valves than the second one-way valve(s) 5562. In the present embodiment, the number of the first one-way valves 5561 is seven and the number of the second one-way valve 5562 is one, but various combinations of the numbers of the first one-way valves 5561 and the second one-way valve(s) 5562 may be adopted.

Returning to FIG. 55, the water pipe system 5500 may include at least one purge valve 5526 that allows a gas to flow from the smoke chamber 5520 to an outside of the water pipe system 5500. In the embodiment of FIG. 55, the purge valve 5526 may be disposed at a lower position of the system 5500. However, the purge valve may be disposed at any other position, such as a position of the valve 1326 as shown in FIG. 26A. In one embodiment, in order to support a purge method, described in more detail below, the second one-way valve 5562 may be smaller in minimum operating pressure differential than the one purge valve 5526.

In using the water pipe system 5500, a user can draw air through a hose attachment 5508. This causes smoke to be drawn from the smoke supplying assembly 5580 into the liquid chamber 5518. Once inside liquid chamber 5518, the flow of the smoke may be cleansed by liquid contained therein. The flow of the smoke may bubble within the liquid chamber 5518 and exits through the inner vessel hole 5512*a* of inner vessel 5512 into the smoke chamber 5520 between the inner vessel 5512 and the outer vessel 5514 by way of the smoke passages 5551. This allows the smoke to be cooled by both the large surface area of the interior of the outer vessel 5514 and the surface area of the inner vessel 5512, especially when liquid within liquid chamber 5518 is cool. The flow of the smoke then continues through gaps between a manifold 5506 and smoke chamber 5520, through the hose attachment 5508 and a hose and into the user's lungs for enjoyment.

Continuously, in a method 6100 as shown in FIG. 62, the user may draw the smoke in the smoke chamber 5520 to create a negative pressure in the smoke chamber 5520 relative to a pressure in the liquid chamber 5518 (see block 6102). The negative pressure may then create a pressure differential between the smoke chamber 5520 and the liquid chamber 5518 sufficient to actuate the one-way valves 5561 in the smoke passages. Then, the negative pressure in the smoke chamber 5520 may flow the smoke in the liquid chamber 5518 from the liquid chamber 5518 to the smoke chamber 5520, for example, without limitation, via the first one-way valves 5561 in the smoke passages 5551 of the gasket 5550 (see block 6104). Then, smoke may be further drawn from the smoke supplying assembly 5580 to the liquid chamber 5518 (see block 6106). As such, the user can use the water pipe system 5500.

Purging the smoke in the smoke chamber 5520 and the liquid chamber 5018 may be conducted as follows. FIG. 62 shows an example of a purging method in a block diagram. The user may blow a purge gas into the smoke chamber 5520 to create a positive pressure relative to a pressure in the liquid chamber 5518 (see block 6202). The positive pressure may flow the purge gas from the smoke chamber 5520 to the liquid chamber 5518 via the second one-way valve 5562 (see block 6204). This may improve efficiency of purging the liquid chamber 5518. In one embodiment, the second one-way valve 5562 may be smaller in minimum operating pressure differential than the purge valve 5526. Therefore, the purge gas may be transmitted from the smoke chamber 5520 to the liquid chamber, instead of being emitted from the smoke chamber 5520 to an outside of the water pipe system 5500 via the purge valve 5526. This may further improve efficiency of purging the liquid chamber 5518. Then, the purge gas in the liquid chamber 5518 may be transmitted from the liquid chamber 5518 to the smoke chamber 5520 via the first one-way valve 5561 (see block 6206). Then, the purge gas in the smoke chamber 5520 may be emitted from the smoke chamber 5520 to the outside of the water pipe system 5500 via the purge valve 5526 (see block 6208).

In the present embodiment, the gasket 5550 may reduce the chance of the liquid in the liquid chamber 5518 splashing out to the smoke chamber 5520. Further, the gasket 5550 may reduce the chance of the liquid chamber 5518 being devoid of smoke. The gasket 5550 may be used to fix the inner vessel 5512 to the outer vessel 5514 in embodiments in which the inner and outer vessels 5512 and 5514 are separable.

FIG. 63 shows an example cross-sectional view of a water pipe system according to one embodiment. FIGS. 64 and 65 show example perspective views of a gasket and valves in the water pipe system shown in FIG. 63, with FIG. 64 showing an exploded view.

In the water pipe system of FIG. 63, a gasket 5550*b* differs from the gasket 5550 of FIG. 56 in the followings. In the embodiment shown in FIGS. 61-63, the gasket 5550*b* may include a cylindrical portion 5558*b*. The cylindrical portion 5558*b* may form smoke passages 5551*b*. Each of the smoke passages 5551*b* may communicate with the gasket hole 5550*c*, and extending radially outwardly of the gasket hole 5550*c*.

The inner and outer vessels in FIGS. 55, 56, and 63 are illustrated as nested domes, but inner and outer vessels may similarly be nested cylinders separated by a gasket with valves, in view of portability of a water pipe system.

The gasket 5550 may be made of a flexible material, such as silicone, to ensure a seal between the gasket and the various components of the assembly. However, the gasket may be formed of a wide variety of materials, including materials that may be used to seal the components relative to each other.

The enablements described in detail above are considered novel over the prior art of record and are considered critical to the operation of at least one aspect of the invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus, if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense, it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that the named inventor believes that the claimed subject matter is what is intended to be patented.

What is claimed is:

1. A water pipe system comprising:

an inner vessel defining a liquid chamber;

a smoke supplying assembly configured to supply smoke to the liquid chamber;

an outer vessel in which the inner vessel is disposed, the outer vessel and the inner vessel defining a smoke chamber therebetween, the smoke chamber communicating with the liquid chamber such that smoke drawn from the smoke supplying assembly flows from the liquid chamber to the smoke chamber; and a gasket disposed between the outer vessel and the inner vessel, wherein the gasket is provided with at least one smoke passage, the smoke chamber communicating with the liquid chamber via the at least one smoke passage of the gasket, and the water pipe system further comprising at least one valve, each of the at least one valve being disposed in one of the at least one smoke passage of the gasket.

2. The water pipe system of claim 1, wherein the at least one valve includes at least one first one-way valve that allows a gas to flow from the liquid chamber to the smoke chamber and that does not allow a gas to flow from the smoke chamber to the liquid chamber.

3. The water pipe system of claim 2, wherein the at least one valve includes at least one second one-way valve that allows a gas to flow from the smoke chamber to the liquid chamber and that does not allow a gas to flow from the liquid chamber to the smoke chamber, and the water pipe system further comprises at least one purge valve that allows a gas to flow from the smoke chamber to an outside of the water pipe system.

4. The water pipe system of claim 3, wherein the at least one second one-way valve is smaller in minimum operating pressure differential than the at least one purge valve.

5. The water pipe system of claim 3, wherein the at least one first one-way valve is greater in number than the at least one second one-way valve.

6. The water pipe system of claim 1, wherein the inner vessel is provided with an inner vessel hole, and the gasket is disposed at the inner vessel hole.

7. The water pipe system of claim 6, wherein the gasket is provided with a gasket hole that extends through the inner vessel hole, the outer vessel is provided with an outer vessel hole, and the smoke supplying assembly is inserted into the liquid chamber through the outer vessel hole, the gasket hole, and the inner vessel hole.

8. The water pipe system of claim 7, wherein the gasket includes a cylindrical portion disposed in the inner vessel hole, the cylindrical portion forming the gasket hole, the cylindrical portion being in contact with an edge of the inner vessel hole.

9. The water pipe system of claim 8, wherein the gasket includes:

a first extension that extends from the cylindrical portion radially outwardly of the gasket hole, the first extension being in contact with the inner vessel; and a second extension that extends from the cylindrical portion radially outwardly of the gasket hole, the second extension being in contact with the outer vessel, the first extension and the second extension being spaced apart from each other via a space between the first extension and the second extension, the space communicating with the smoke chamber, wherein the at least one smoke passage is formed in the cylindrical portion, and communicates with the space between the first extension and the second extension.

10. The water pipe system of claim 8, wherein the at least one smoke passage is formed by the cylindrical portion, each of the at least one smoke passage communicating with the gasket hole, and extending radially outwardly of the gasket hole.

11. The water pipe system of claim 7, wherein the at least one smoke passage includes a plurality of smoke passages that are arranged along a circumferential direction of the gasket hole.

12. A method comprising:

preparing a water pipe system comprising:

an inner vessel defining a liquid chamber;

a smoke supplying assembly configured to supply smoke to the liquid chamber;

an outer vessel in which the inner vessel is disposed, the outer vessel and the inner vessel defining a smoke chamber therebetween, the smoke chamber communicating with the liquid chamber; and a gasket disposed between the outer vessel and the inner vessel, drawing the smoke in the smoke chamber to create a negative pressure in the smoke chamber relative to a pressure in the liquid chamber;

flowing, by the negative pressure in the smoke chamber, smoke in the liquid chamber from the liquid chamber to the smoke chamber; and drawing smoke from the smoke supplying assembly to the liquid chamber, wherein flowing the smoke in the liquid chamber includes flowing the smoke in the liquid chamber from the liquid chamber to the smoke chamber via at least one smoke passage of the gasket, and wherein flowing the smoke in the liquid chamber includes flowing the smoke in the liquid chamber from the liquid chamber to the smoke chamber via at least one first one-way valve, each of the at least one first one-way valve being disposed in one of the at least one smoke passage of the gasket, such that the at least one first one-way valve is not actuated unless a pressure differential in the smoke chamber relative to the liquid chamber is greater than a threshold.

13. The method of claim 12, further comprising:

blowing a purge gas into the smoke chamber to create a positive pressure relative to a pressure in the liquid chamber;

flowing, by the positive pressure, the purge gas from the smoke chamber to the liquid chamber via at least one second one-way valve, each of the at least one second one-way valve being disposed in one of the at least one smoke passage of the gasket;

transmitting the purge gas in the liquid chamber from the liquid chamber to the smoke chamber via the at least one first one-way valve; and emitting the purge gas in the smoke chamber from the smoke chamber to an outside of the water pipe system via at least one purge valve.

14. The method of claim 13, wherein the at least one second one-way valve is smaller in minimum operating pressure differential than the at least one purge valve.

15. A water pipe system comprising:

an inner vessel defining a liquid chamber;

a smoke supplying assembly configured to supply smoke to the liquid chamber;

an outer vessel in which the inner vessel is disposed, the outer vessel and the inner vessel defining a smoke chamber therebetween, the smoke chamber communicating with the liquid chamber such that smoke drawn from the smoke supplying assembly flows from the liquid chamber to the smoke chamber; and a gasket disposed between the outer vessel and the inner vessel, wherein the gasket is provided with at least one smoke passage, the smoke chamber communicating with the liquid chamber via the at least one smoke passage of the gasket, wherein the inner vessel is provided with an inner vessel hole, and the gasket is disposed at the inner vessel hole, wherein the gasket is provided with a gasket hole that extends through the inner vessel hole, the outer vessel is provided with an outer vessel hole, and the smoke supplying assembly is inserted into the liquid chamber through the outer vessel hole, the gasket hole, and the inner vessel hole, wherein the gasket includes a cylindrical portion disposed in the inner vessel hole, the cylindrical portion forming the gasket hole, the cylindrical portion being in contact with an edge of the inner vessel hole, and wherein the gasket includes:

a first extension that extends from the cylindrical portion radially outwardly of the gasket hole, the first extension being in contact with the inner vessel; and a second extension that extends from the cylindrical portion radially outwardly of the gasket hole, the second extension being in contact with the outer vessel, the first extension and the second extension being spaced apart from each other via a space between the first extension and the second extension, the space communicating with the smoke chamber, wherein the at least one smoke passage is formed in the cylindrical portion, and communicates with the space between the first extension and the second extension.

16. The water pipe system of claim 15, wherein the second extension includes a plurality of extending parts that are spaced apart from each other in a circumferential direction of the gasket hole, and a gap between two adjacent extending parts of the extending parts overlaps with one of the at least one smoke passage as viewed in a direction in which the gasket hole extends.

17. A water pipe system comprising:

an inner vessel defining a liquid chamber;

a smoke supplying assembly configured to supply smoke to the liquid chamber;

an outer vessel in which the inner vessel is disposed, the outer vessel and the inner vessel defining a smoke chamber therebetween, the smoke chamber communicating with the liquid chamber such that smoke drawn from the smoke supplying assembly flows from the liquid chamber to the smoke chamber; and a gasket disposed between the outer vessel and the inner vessel, wherein the gasket is provided with at least one smoke passage, the smoke chamber communicating with the liquid chamber via the at least one smoke passage of the gasket, wherein the inner vessel is provided with an inner vessel hole, and the gasket is disposed at the inner vessel hole, wherein the gasket is provided with a gasket hole that extends through the inner vessel hole, the outer vessel is provided with an outer vessel hole, and the smoke supplying assembly is inserted into the liquid chamber through the outer vessel hole, the gasket hole, and the inner vessel hole, wherein the gasket includes a cylindrical portion disposed in the inner vessel hole, the cylindrical portion forming the gasket hole, the cylindrical portion being in contact with an edge of the inner vessel hole, and wherein the at least one smoke passage is formed by the cylindrical portion, each of the at least one smoke passage communicating with the gasket hole, and extending radially outward of the gasket hole.

* * * * *